United States Patent [19]

Goodall

[11] 4,125,744

[45] Nov. 14, 1978

[54] COMMUNICATION SYSTEM

[75] Inventor: William M. Goodall, Oakhurst, N.J.

[73] Assignee: Bell Telephone Laboratories, Incorporated, Murray Hill, N.J.

[21] Appl. No.: 67,209

[22] Filed: Dec. 24, 1948

[51] Int. Cl.[2] ..... H04K 1/02

[52] U.S. Cl. ..... 179/1.5 R; 179/1.5 M; 178/22; 325/32; 325/38 B

[58] Field of Search ..... 179/1.5, 1.5 P, 1.5 C, 179/1.5 M, 1.5 M, 1.5 R; 332/13; 250/6, 6.6; 178/22; 325/32, 38 B

[56] References Cited

U.S. PATENT DOCUMENTS

| | | | |
|---|---|---|---|
| 2,406,024 | 8/1946 | McCann | 178/22 |
| 3,373,245 | 3/1968 | Newby et al. | 179/1.5 R |
| 3,944,745 | 3/1976 | Gannett | 179/1.5 R |
| 3,968,454 | 7/1976 | Busch | 179/1.5 R |
| 3,976,839 | 8/1976 | Miller | 179/1.5 R |
| 3,983,327 | 9/1976 | Gannett | 179/1.5 R |

*Primary Examiner*—Howard A. Birmiel
*Attorney, Agent, or Firm*—William F. Simpson

EXEMPLARY CLAIM

In a pulse code modulation system, a source of key signals comprising a source of random pulses, multisection delay device, means for applying said pulses to said multisection delay device, apparatus for combining the outputs of predetermined sections of said delay device and apparatus for enciphering pulse code modulation signals by combining said signals with said combined output from said sections of said multisection delay device.

38 Claims, 55 Drawing Figures

Figure 1:
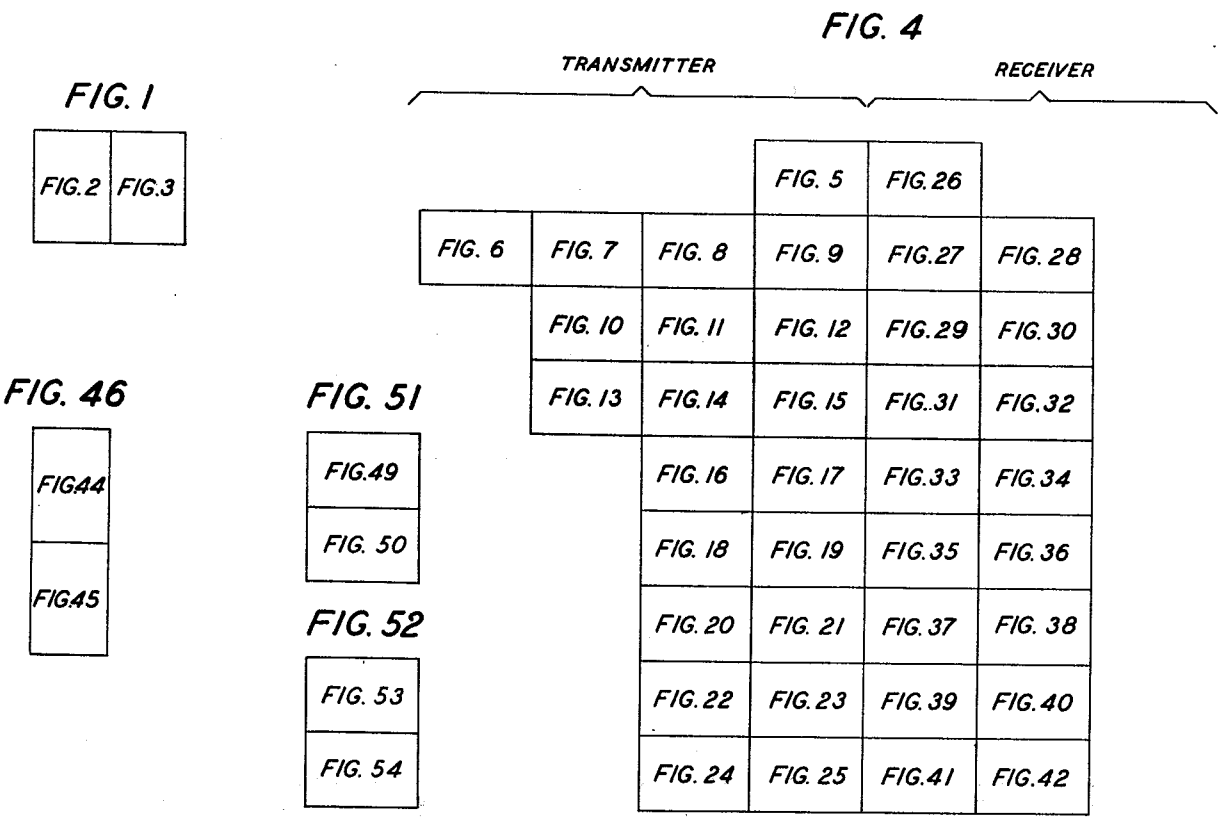

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson

INVENTOR
W. M. GOODALL
BY William F. Simpson.
ATTORNEY

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson.
ATTORNEY

INVENTOR
W. M. GOODALL
BY William F. Simpson,
ATTORNEY

INVENTOR
W.M. GOODALL
BY
William F. Simpson.

INVENTOR
W. M. GOODALL
BY
William F. Simpson.
ATTORNEY

INVENTOR
W. M. GOODALL
BY William F. Simpson.

INVENTOR
W. M. GOODALL
BY William F. Simpson.
ATTORNEY

INVENTOR
W. M. GOODALL
BY William F. Simpson
ATTORNEY

INVENTOR
W.M. GOODALL
BY William F. Simpson
ATTORNEY

INVENTOR
W.M. GOODALL
BY William F. Simpson.

INVENTOR
W.M. GOODALL
BY William F. Simpson.
ATTORNEY

INVENTOR
W.M. GOODALL
BY William F. Simpson.
ATTORNEY

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson
ATTORNEY

INVENTOR
W. M. GOODALL
BY William F. Simpson.

INVENTOR
W. M. GOODALL
BY William F. Simpson.
ATTORNEY

INVENTOR
W. M. GOODALL

BY
William F. Simpson.

ATTORNEY

INVENTOR
W.M. GOODALL
BY William F. Simpson.
ATTORNEY

INVENTOR
W. M. GOODALL
BY William F. Simpson.
ATTORNEY

INVENTOR
W.M. GOODALL
BY William F. Simpson,
ATTORNEY

INVENTOR
W. M. GOODALL
BY William F. Simpson.
ATTORNEY

INVENTOR
W. M. GOODALL
BY William F. Simpson.

INVENTOR
W. M. GOODALL
BY William F. Simpson.
ATTORNEY

INVENTOR
W.M. GOODALL
BY William F. Simpson
ATTORNEY

INVENTOR
W. M. GOODALL
BY William F. Simpson

INVENTOR
W.M. GOODALL
BY William F. Simpson.
ATTORNEY

INVENTOR
W. M. GOODALL
BY William F. Simpson.
ATTORNEY

INVENTOR
W. M. GOODALL
BY
William F. Simpson
ATTORNEY

INVENTOR
W. M. GOODALL
BY
William F. Simpson
ATTORNEY

INVENTOR
W. M. GOODALL
BY William F. Simpson.

INVENTOR
W.M. GOODALL
BY William F. Simpson
ATTORNEY

INVENTOR
W. M. GOODALL
BY William F. Simpson
ATTORNEY

INVENTOR
W. M. GOODALL
BY
William F. Simpson
ATTORNEY

INVENTOR
W. M. GOODALL
BY William F. Simpson
ATTORNEY

INVENTOR
W. M. GOODALL
BY William F. Simpson.
ATTORNEY

INVENTOR
W. M. GOODALL
BY William F. Simpson,
ATTORNEY

INVENTOR
W. M. GOODALL
BY William F. Simpson

INVENTOR
W. M. GOODALL
BY William F. Simpson

COMMUNICATION SYSTEM

This invention relates to a communication system and more particularly to a communication system in which complex wave forms are transmitted by code groups of pulses transmitted at rapidly recurring instants of time.

An object of this invention is to provide an improved and simplified means and methods for representing complex wave forms by means of code groups of different signaling conditions which improved means and methods are capable of operating at high speed.

Another object of this invention is to add random noise currents to the complex wave form before it is represented by the code groups of pulses in such a way that the noise effectively masks the nature of the complex wave form and the intelligence conveyed thereby after it is represented by the code groups of pulses but at the same time does not in any way interfere with or add to the actual complex wave form which may be recovered at receiving stations free and independent of the added noise.

Still another object of this invention is to provide an improved ciphering method and arrangement for enciphering coded groups of pulses in such a manner that they may not be understood unless they are transmitted through deciphering equipment which is complementary to or cancels the effects of the enciphering equipment at the transmitting station.

Another object of this invention is to provide deciphering equipment which is capable of deciphering enciphered code groups of pulses and recovering the original code groups of pulses.

Another object of this invention is to provide improved decoding equipment which is capable of operating at high speed for recovering the complex wave form represented by coded groups of difference signaling conditions of short duration occurring in rapid succession.

A feature of this invention relates to a cathode-ray tube which is capable of substantially continuously and instantaneously representing a complex wave form by a complete code group of different signaling conditions. The cathode-ray tube is of a type which is provided with a target and electrodes which at substantially all times have applied to them electrical conditions representing a complete code group, determined by the instantaneous amplitude of the complex wave form.

Another feature of this invention relates to a cathode-ray coding tube wherein the coding target is arranged to cause certain codes, i.e., the end codes, to be extended so that these codes will be formed when the applied signal exceeds the operating range of the tube.

Features of the coding tube disclosed but not claimed herein which are novel are claimed in my copending application Ser. No. 37,035 filed July 3, 1948.

Another feature of this invention relates to circuits and apparatus and methods of changing code groups of pulses of one code into code groups of pulses of a different code.

Another feature of this invention relates to circuits, apparatus and methods of changing from a second coded group of pulses back to the first code group of pulses.

Another feature of this invention relates to methods, circuits and apparatus for periodically checking and automatically setting the translating circuits.

Another feature of this invention relates to equipment for changing a code group of signaling conditions simultaneously present at an instant of time into a code group of signaling conditions occurring one after another in sequence by means of transmitting the signaling conditions through delayed networks, lines or devices having different delay intervals.

Another feature of this invention is to combine pulses of different signaling conditions received in sequence one after another into a single pulse by transmitting the various pulses received through delayed networks, lines or devices of different delay intervals so that pulses arrive at the output of the delay devices substantially simultaneously.

Another feature of this invention relates to switching equipment for readily connecting or disconnecting ciphered equipment both at transmitting and receiving ends of the system.

Another feature of this invention relates to key generating equipment for generating ciphered key signals for enciphering and deciphering pulse code groups of pulses of different signaling conditions.

A feature of this invention relates to employing noise currents to generate a series of random pulses of different signaling conditions for controlling the key generator.

Another feature of this invention relates to transmitting random pulses of different signaling conditions along a delayed network, line or device and employing the pulses after different delay intervals for controlling the generation of a series of ciphered keying pulses of different signaling conditions.

Another feature of this invention is to provide switching means having a large number of permutations of selectable orders and times for employing the random pulses from the noise generating equipment.

Another feature of this invention relates to a switching device capable of being arranged in a large number of different permutations which may be changed step by step in any random manner for further selecting the order and times of using the various noise control pulses.

Another feature of this invention is apparatus and equipment for employing a stepping switch controlled by a perforated punched or embossed tape for further increasing the number of permutations and random characteristic of the noise pulses.

Still another feature of this invention relates to control equipment for actuating the stepping switch and the tape controlled switch in any suitable manner.

Another feature of this invention relates to control equipment for suppressing the transmission of signaling conditions during the time the connections within the key generating equipment are being shifted thus preventing the transmission of either key signals or unciphered pulses.

Another feature of the invention is directed to equipment for starting the key equipment at both the transmitting and receiving stations in synchronism.

Briefly, in accordance with the invention described herein, a complex wave form is employed to control the generation of code signals. The magnitude or amplitude of a complex signaling wave, such as a speech wave, telegraph wave, frequency division multiplex signals, time division multiplex signals, or other complex signaling wave is represented by means of code groups of signals each signal of which may comprise any number of a plurality of different signaling conditions.

While the invention described herein is not limited to any particular code or groups it is usually convenient to employ a uniform code each code group of which has the same number of signals and each code group of which represents a predetermined amplitude of the complex signaling wave. That is, each code group is of a uniform number of different signals or a predetermined number of pulses in which each of the signals or pulses may comprise signaling conditions of any of a plurality of different signaling conditions.

In the specific embodiment set forth herein it is assumed that these code groups may comprise five or less signals or pulses and that each pulse or signal may comprise either one of the two signaling conditions may be transmitted during the time assigned to the various pulses or pulse positions.

In such a system any suitable code may be employed wherein the different code groups are assigned to represent the different amplitudes of the complex wave form. In the specific embodiment set forth herein the coding and decoding equipment is arranged to generate and respond to the binary code in which each of the signals or pulses represents or is analogous to a digital position of a binary number and one signaling condition represents one magnitude of a digit and the other signaling condition represents another magnitude of a digit.

In order to more readily describe and follow the various signals and signaling conditions employed in forming and transmitting code groups of signaling conditions, pulses of one character are frequently called marking pulses, on pulses, or current pulses while the pulses of the other signaling condition are frequently called spacing pulses, off pulses, or pulses of no current. Sometimes these two pulses are called positive pulses and negative pulses. The signals or signaling conditions as they are being transmitted through the various circuits and apparatus of the system may be represented by different signaling conditions. It is frequently most convenient to refer to each pulse as marking or spacing signals.

In accordance with the present invention the code groups of signals may be all generated substantially instantaneously under control of the complex wave or they may be generated at predetermined times in rapid succession so that the amplitude of the complex signaling wave can be represented by a group of signals or pulses occurring at a plurality of rapidly recurring instants of time. The rapidity of the recurrences of the code groups representing any complex signaling wave determines the highest frequency component of the signaling wave which may be transmitted over the system. In general, the frequency of this component is somewhat less than half the highest recurrence rate of transmitted pulse or signal groups representing the amplitude of the complex wave. Thus, for example, if it is desired to transmit a frequency range of up to 5,000 to 5,500 cycles then the coding equipment should generate complete code groups of pulses or signal conditions at a rate of at least 12,000 codes each second.

It is to be understood, of course, that any suitable frequency range may be employed.

Figure 2:
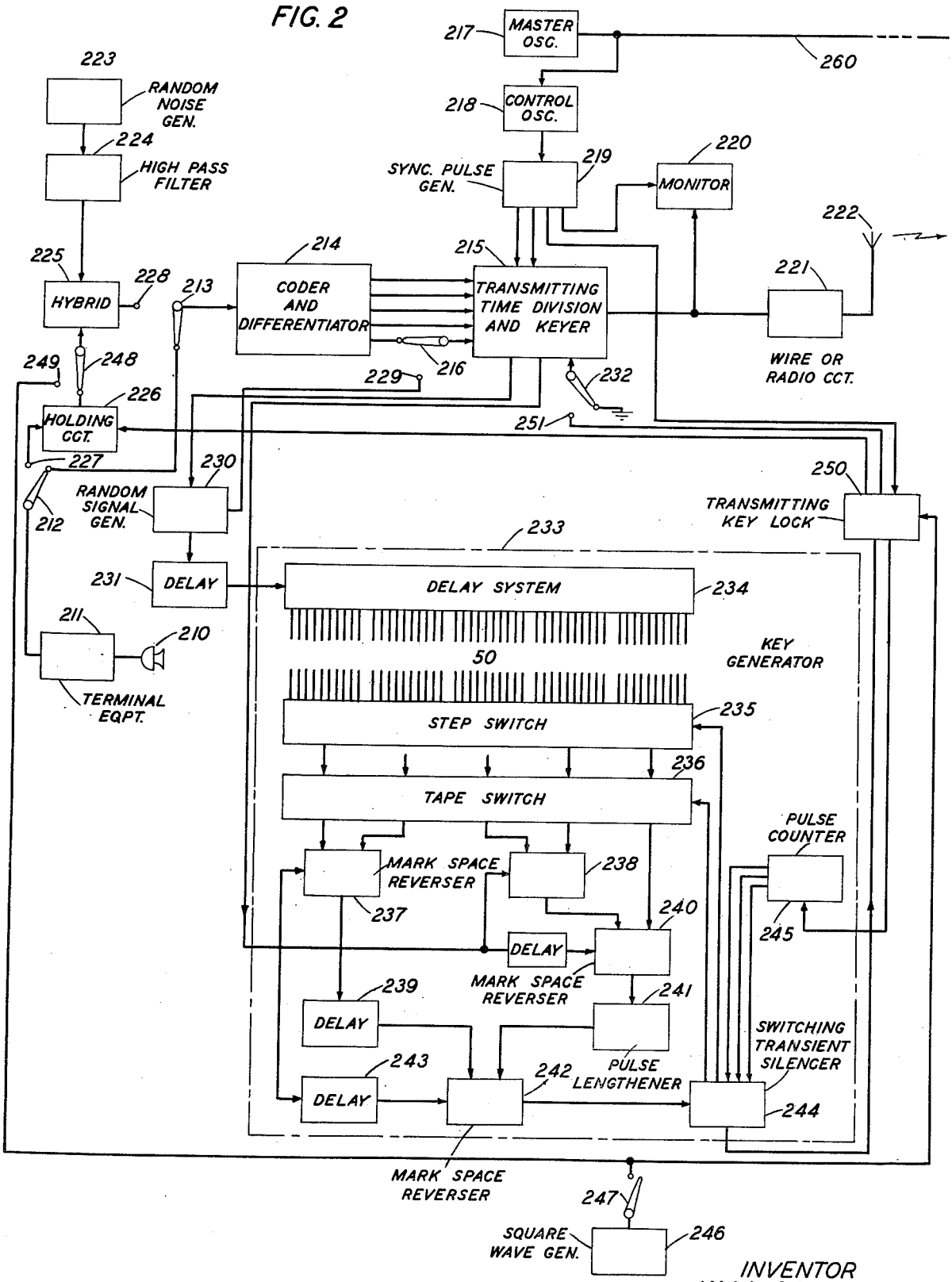
Figure 3:
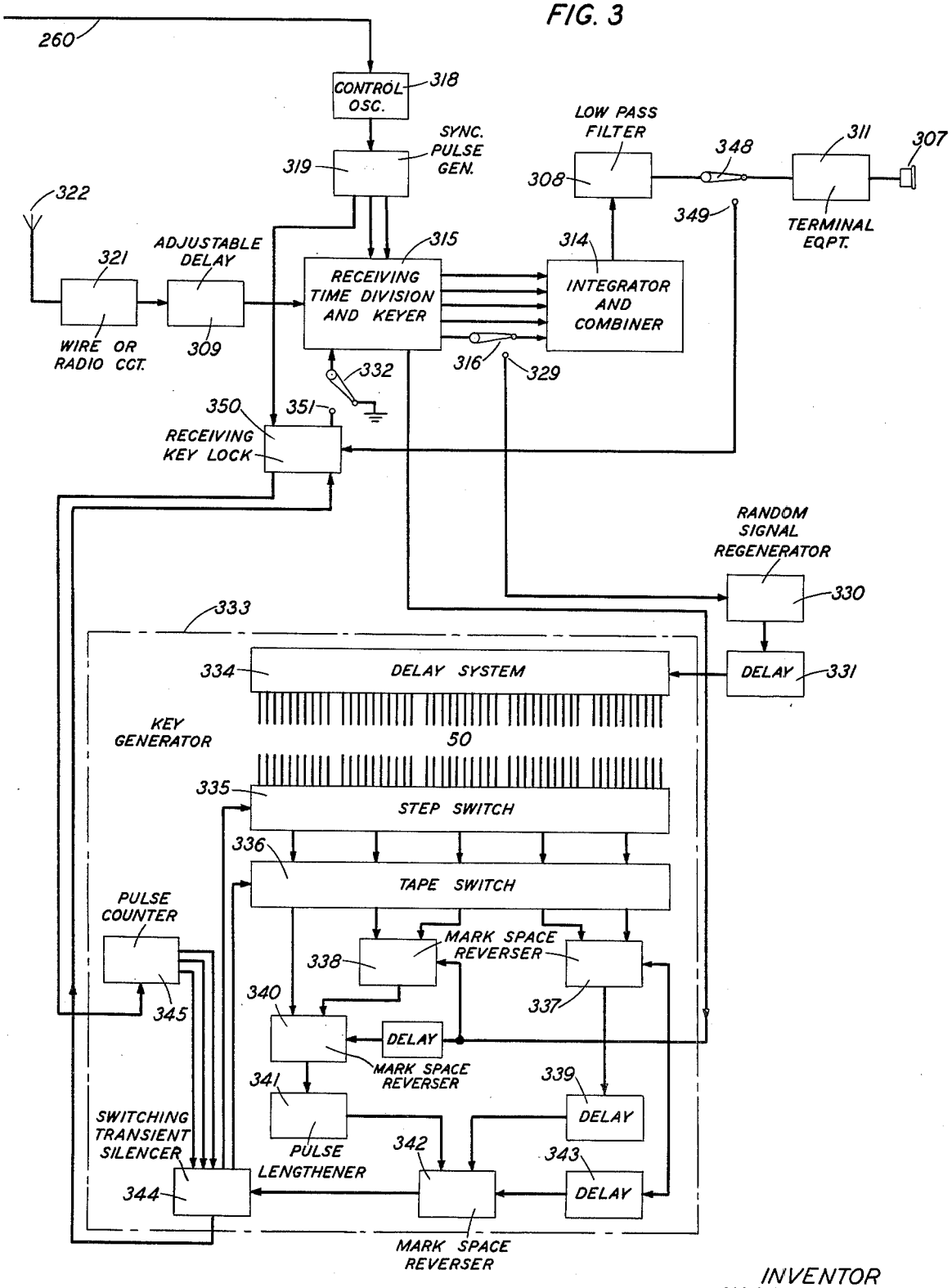
Figure 15:
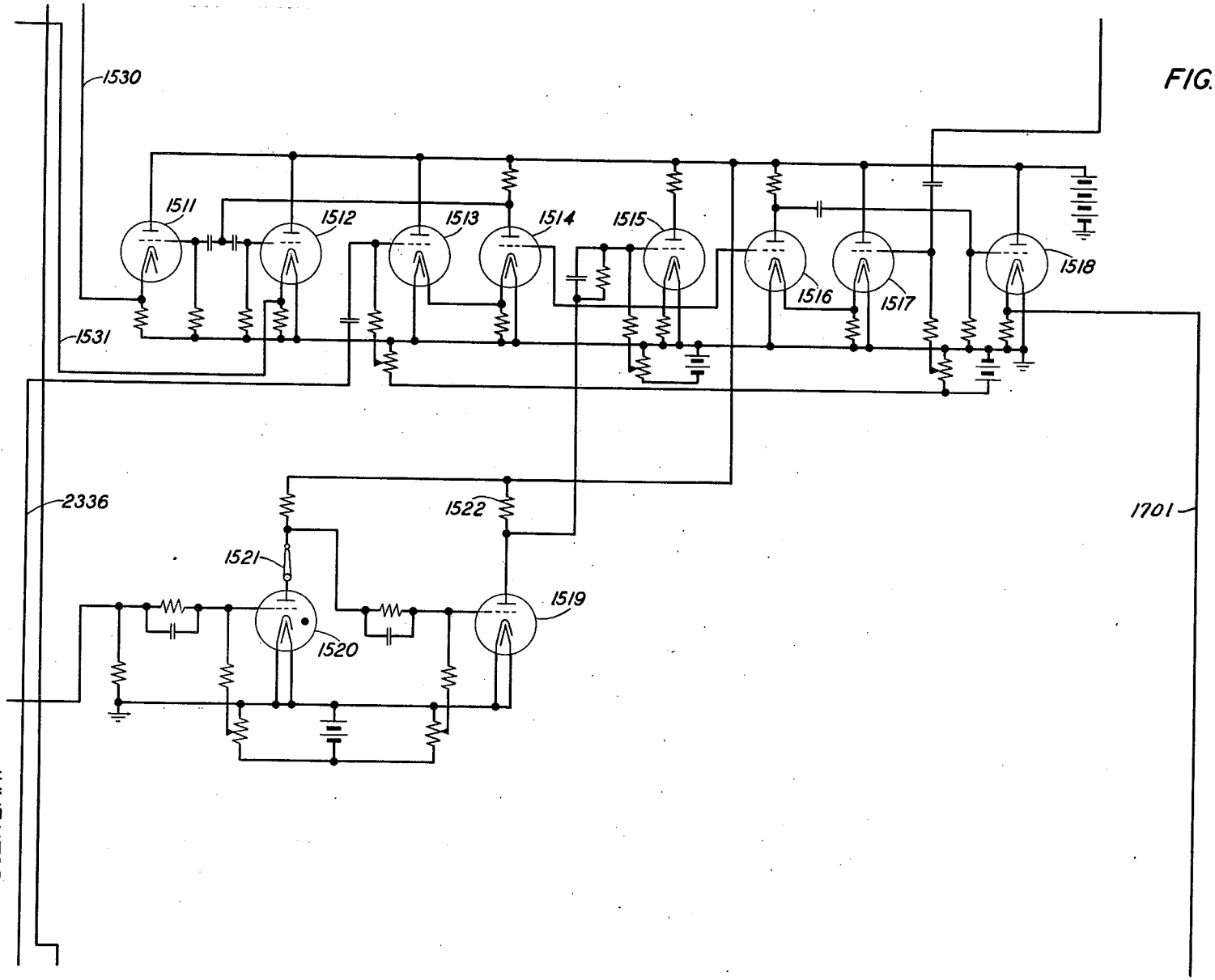
Figures 16, 16A:
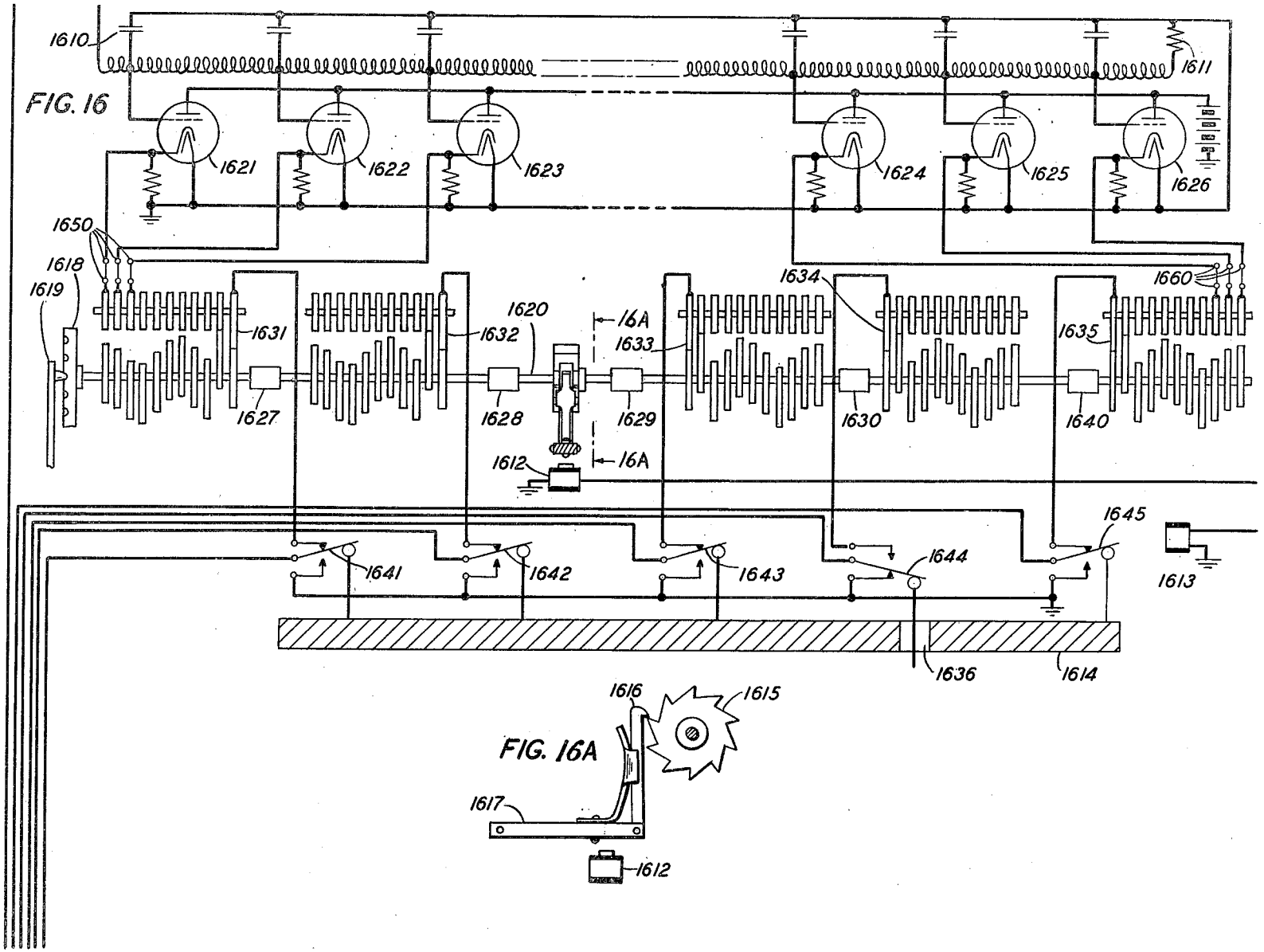
Figure 43:
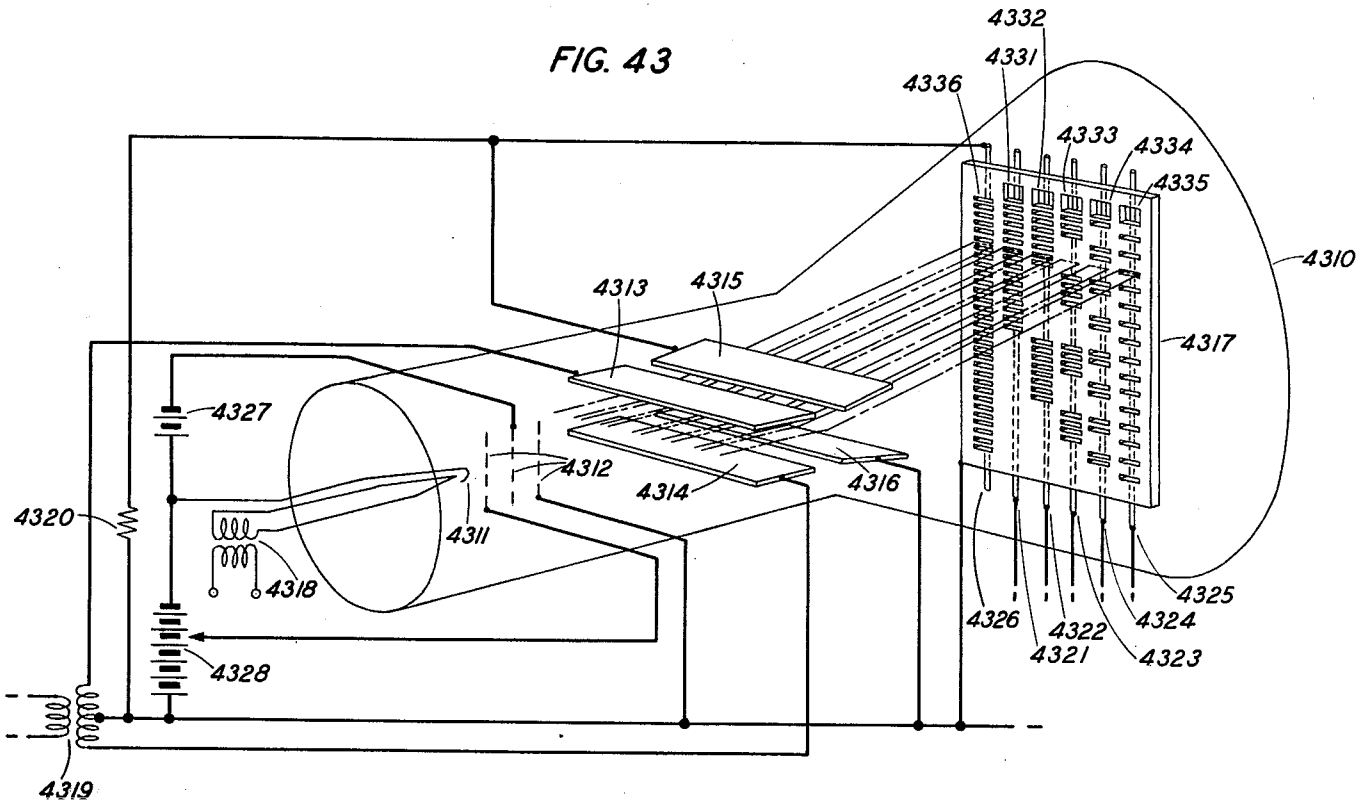

The foregoing objects and features of this invention, the novel features of which are specifically pointed out in the claims appended hereto, may be more readily understood from the following description when read with reference to the attached drawings in which:

FIG. 1 shows the manner in which FIGS. 2 and 3 are arranged adjacent one another;

FIGS. 2 and 3 show in outline form the various elements of an exemplary system embodying the present invention. FIG. 2 shows the various elements in the manner in which they cooperate one with another at the transmitting station or end of the system, while FIG. 3 shows the manner in which the various elements of the system cooperate with each other at the receiving or distant end of the system. As shown in FIGS. 2 and 3, as well as in other figures of the drawing, the equipment and apparatus required for the transmission of the signals or complex wave form in one direction only is shown in the drawing. It is to be understood, however, that this equipment will be duplicated for transmission in the opposite direction and that equipment such as shown in the drawing together with a duplicate thereof for transmission in the opposite direction may be readily combined in a well-understood manner to provide a two-way transmission path between the ends of the system;

FIG. 4 shows the manner in which FIGS. 5 through 42 are positioned adjacent one another;

FIGS. 5 through 42 when positioned as shown in FIG. 4 show in detail the various circuits and the method in which they cooperate to form an exemplary system embodying the present invention, and FIG. 16A is a partial section view taken along line 16A—16A of FIG. 16 showing in greater detail the stepping mechanism of the stepping switch described herein;

FIGS. 5 through 25 including 16A show in detail the equipment at the transmitting station while FIGS. 26 through 42 show in detail the circuits at the receiving station;

FIG. 43 shows a perspective of an exemplary cathode-ray tube embodying the present invention which is suitable for use as a coding device at the transmitting station;

FIGS. 44, 45, 47, 48, 49, 50, 53, and 54 show graphs of voltages and currents at various positions in the system illustrating the mode of operation of the various circuits and the manners in which they cooperate with each other; and FIGS. 46, 51, and 52 show the manner in which the graphs may be positioned adjacent one another.

GENERAL DESCRIPTION

FIGS. 2 and 3 when arranged as shown in FIG. 1 show in outline form the various component circuits in the manner in which they cooperate to form an exemplary system in accordance with the present invention. FIG. 2 shows the transmitting equipment including the coding apparatus, cipher key generating apparatus, the synchronizing equipment and the keying equipment for combining the output of the cipher key generating equipment and the output of the coding apparatus. FIG. 3 shows the corresponding equipment at the receiving terminal including the receiving synchronizing and controlling equipment, the receiving key generating equipment, the key equipment for again combining the output of the key generator with the received signals to recover the original code signals from the transmitted enciphered signals. The deciphered signals are then decoded and the original communication signals or wave forms recovered. In FIG. 2, 210 represents the source of signal which is usually a microphone for voice signals, but may include any other suitable source of signals including telegraph signals, picture signals, frequency division multiplex signals, facsimile signals, etc. The source of signals 210 is connected to the terminal equipment 211 by means of any suitable type of transmission circuits and paths including telephone open-wire lines, cable circuits, carrier current communication paths, radio paths, toll circuits, etc. The terminal equipment 211 may include various types of switching equipment for establishing communication paths from the source 210 to the terminal equipment in the exemplary system set forth herein. Each of these systems as well as the associated equipment operates in its usual and well-understood manner so that it is not necessary to repeat a description of the operation thereof herein.

The output of the terminal equipment 211 is transmitted through switches 212 and 213 which switches, when set in the position shown in the drawing cause the signaling currents or wave form which is usually a complex wave form to be transmitted from the transmitter 210 through the terminal equipment 211 and switches 212 and 213 to the code and differentiating circuit 214. The coding circuit 214 causes the amplitude of the complex wave form to be represented by a plurality of signal currents of either one or the other of two different signaling conditions. As shown in FIG. 2, five such signaling currents or pulses are employed to represent the amplitude of the output from the terminal equipment. Where desired, the code information may be in effect differentiated so that the pulses will represent not the amplitude of the complex wave, but rather changes in the amplitude of the complex wave. The signaling or current conditions are transmitted from the coder 214 to the transmitting time division system and keyer 215.

With switch 232 set in the position shown, the keyer will ause the applied pulses to be repeated through the transmitter time division system without alteration and in proper time sequence. The timing and synchronizing of the transmitting equipment 215 is controlled by a master oscillator 217 and control oscillator 218 through the synchronous pulse generator 219 and other control equipment as will be described hereinafter. The output pulse code signals are transmitted over the communication path extending to a distant station. The apparatus 221 is arranged to convert the coded signals into high frequency radio signals or other signals suitable for transmission over open-wire lines, coaxial cable circuits, wave guides, ultra-high frequency radio waves and the like. At the receiving station, the signals are received by the radio antenna 322 or over the other type of transmission path employed and transmitted through the receiving circuit 321 which responds to the incoming signals and causes a series of signaling currents of pulses similar to those received from the transmitter time division equipment 215 to be applied to the receiving time division equipment and keyer 315 through the adjustable delay network 309. The receiving time division and keying apparatus 315 is controlled by the control oscillator 318 and the synchronous pulse generator 319.

As shown in the drawings, a separate synchronizing channel 260 extends between the transmitting and receiving stations. It is to be understood, of course, that the synchronizing signals may be transmitted over the main communication path or the signals themselves may be employed for synchronizing purposes at the receiving station. Inasmuch as the various methods of transmitting the synchronizing signals from transmitting station to receiving station and controlling the receiving apparatus at the receiving station are well understood in the prior art, a detailed description of the operation of such equipment has not been included herein.

With the receiving time division circuits 315 operating and with switch 332 in the position shown, the signals output from the receiving equipment 315 are transmitted through and combining an integrator circiut 314 and then applied to the lowpass filter 308 which recovers the original wave form and transmits it through the switch 348 and the terminal equipment 311 to the receiving device 307. The receiving device 307 is arranged to respond to the same type of signals as transmitted by the transmitting device 210. If the system is arranged to transmit pulses representing the amplitude of the complex wave, then the receiving and integrating equipment 314 merely combines the coded pulses to obtain a pulse that has an amplitude represented by the coded pulses. If on the other hand, the coding and differentiating equipment 214 is arranged to transmit coded pulses representing a change in amplitude of the complex wave form from generator 210, then the integrating and combining circuit 314 is arranged to, in effect, integrate or change the received pulses into code groups of pulses again representing the amplitude of the complex wave or signal currents and then regenerate from these coded pulses a complex wave form similar to the wave form transmitted from the signal source 210.

The foregoing description of FIGS. 2 and 3 is for transmission in a single direction from the station shown in FIG. 2 and more specifically to the source of signals 210 to the receiving apparatus 307. If it is necessary or desirable to transmit in the reverse direction it is necessary to duplicate the equipment shown in FIGS. 2 and 3 for transmission in the reverse direction.

The lower portions of FIGS. 2 and 3 show in outline form the various component parts of the key generator employed at the transmitting and receiving stations. FIG. 2 shows the circuits and equipment to encipher the coded signals at the sending station and FIG. 3 shows the circuits and apparatus at the receiving station to decipher and recover the original signals from the enciphered signals transmitted between the two stations. The key generator equipments are shown within the rectangle 233 of FIG. 2 and rectangle 333 of FIG. 3. In general, the key generator comprises a delay line or delay system 234. Delay line 234 is arranged to transmit pulses from the delay device 231 down the line and through the delay apparatus such that a given pulse will arrive at each one of the branch points of connecting terminals at a given instant of time. As shown in the drawings fifty such taps are provided although any suitable number may be employed and different lengths of delay line or delay devices providing different delay times may be connected between each of the leads or connections shown in FIGS. 2 and 3. In addition, any additional number of connections to the delay line may be provided as may be desired. The greater the number of these connections the more diverse becomes the key generator and the harder it is to break the cipher system or signals, i.e., decipher by unauthorized persons signals enciphered under control of key signals from the key generator.

The output of each one of the taps or leads from the delay line is connected to a bank terminal of stepping switch 235. The interconnections between these lines and the terminals of the stepping switch have not been shown in detail in the drawings because these connections will usually be arranged to be readily changed and will be frequently changed when it is desired or necessary to change the enciphering code or system. The stepping switch is arranged to provide five output connections in the delay system at any given instant of time. These output connections are then employed to convey the pulses to a tape stepping switch 236 which tape switch will in effect interchange the connections between the five incoming leads and the five outgoing leads. The connections within the tape switch will be changed at frequent intervals and thus provide a greater degree of secrecy and make the code more complicated and more difficult to break.

The five output leads from the tape switch are combined by a series of devices called "mark space reversers" 237, 238, 240 and 242. These mark space reversers are circuit arrangements similar to keying arrangements included in the transmitting time division and keyer circuits 215. These circuits operate in response to signals of two different conditions applied to their input leads and cause a resulting signal to be applied to the output leads which signal may also comprise either one of two different signaling conditions. For example, if the input signaling conditions are of like kind, that is, either both spacing or both marking, one type of signaling condition, for example marking, is applied to the output leads. If, on the other hand, the input signals are of opposite character, that is, one spacing and the other marking, for example, then the output signal is of the opposite character, that is, spacing under the assumed conditions.

The signals from the first two leads from the tape switch are combined in the mark space reverser 237 and the signals from the next two leads from the tape switch are combined in the above manner by the mark space reverser 238. The output of the mark space reverser 238 is then combined with the signals from the fifth lead by mark space reverser 240. The output signals from the mark space reverser 237 are transmitted through a delay device 239 which in part compensates for the time required for the signals to be transmitted through the pulse lengthener 241. The signals from device 240 are transmitted through a pulse lengthener 241 and then combined with the delayed signals from delay device 239 by means of the mark space reverser 242. The signals from the mark space reverser 242 then comprise the key signals which are later combined with the coded signals to form the output enciphered signals. These key signals, however, are transmitted through two switching devices before being combined with the communication signals. The key signals from the mark space reverser 242 are transmitted through a switching transient silencer circuit 244 which interrupts the output of the key generator during the times the stepping switch 235 and the tape switch 236 are being advanced. In addition, the key signals are also transmitted through a transmitting key lock circuit 250 which is employed in the synchronizing of the keying equipment at both ends of the system.

The key generating equipment 333 at the receiving station is similar to the key generating equipment 233 at the transmitting station. This equipment comprises a delay system 334, stepping switch 335, tape switch 336, mark space reversers 337, 338, 340 ad 342. These devices work in substantially the same manner as those in the transmitting station shown in FIG. 2.

A random signal generator 230 is provided at the transmitting station for supplying pulses to the delay system 234 at the transmitting station. This random signal generator comprises a source of random noise currents preferably having no regularly recurring components. These noise currents are amplified so that pulses of either one or the other of two conditions are supplied from the random signal generator 230 to the delay device 231 and then to the delay system 234. Similar pulses are transmitted through switch 216 when the switch level 216 is operated to engage the terminal 229. Thereafter these pulses are transmitted through the time division multiplex and keyer equipment 215, the transmitting and amplifying equipment 221 over the radio channel from antenna 222 to antenna 322 and then through the terminating equipment 321 and adjustable delay device 309 and then through the receiving time division multiplex and keyer equipment 315 and through switch 316 to terminal 329, and then through switch 316 when it is operated to engage the terminal 329 and then to the random signal regenerator 330 which regenerates similar pulses to those generated by the random signal generator 230. The regenerated pulses are then transmitted through the delay device 331 to the delay system 334. As a result substantially identical pulses are transmitted down the two delay devices or systems 234 and 334. Furthermore, except for the delay of the transmission system from the transmitting station to the receiving station the pulses travel down these two systems in exact synchronism or coincidence when the two systems are properly synchronized.

So long as the same pulses are transmitted down the two delay systems and the connections between the delay systems and the stepping switches are the same at both ends of the system and the stepping switch and the tape switches at both ends of the system are in similar positions substantially the same key signals will be generated by both key generators 233 and 333. In order to insure that the same key signals are generated at each end it is necessary to start the various control and counting and other circuits at the two ends at proper times. In order to accomplish this, various switches and other circuits and apparatus have been provided. The switch 212 is operated to engage contacts 227, switch 213 operated to engage contacts 228, switch 216 operated to engage contact 229 and switch 232 operated to engage contact 251 all at the transmitting station. In addition the switch 332 is operated to engage contact 351, switch 316 operated to engage contact 329 and switch 348 operated to engage contact 349 at the receiving station. When the switches are operated as described above and before the system is fully set into operation, the coding equipment 216 as well as the transmitting equipment 215 is set into operation under control of the synchronizing oscillators 217, 218 and the synchronizing pulse generators 219. Likewise the receiving time division equipment 315 is set into operation and synchronized with the transmitting equipment 215 by means of signals received over the conductor or signaling path 260, control oscillator 318 and the synchronous pulse generator 319. At this time the pulses from the random signal generator will be applied to both the delay systems 234 and 334 in the manner described above. However, no key pulses are transmitted through the key lock circuits 250 and 350. Furthermore, the holding circuit 226 is blocked so that the communication signals from source 210 will not be transmitted over the system.

When the switches have all been set as described above and the transmitting and receiving multiplex apparatus 215 and 315 are properly synchronized, similar pulses are transmitted down the two delay systems 234 and 334. When it is finally desired to set the system into operation, switch 248 is operated to engage contact 249 and switch 247 closed. As a result a pulse or a substantially square wave form from the square wave generator 246 is transmitted through the hybrid coil 225, contact 228 and switch 213 to the coding apparatus 214. The square wave generator is then coded and transmitted over the communication system to the receiving station where it is decoded and reconstructed by the low-pass filter 308 and then applied to the receiving key lock circuit 350. The output of the square wave generator 246 is also applied to the transmitting key lock circuit 250.

These key lock circuits are provided with a plurality of counters which may be set to count any desired number of square waves from the square wave generator. It is essential, of course, that the counting equipment at the transmitting station and the receiving station be set to count the same number of pulses. When these devices have counted the proper number of pulses in accordance with their setting, they will cause the output of the key generator to be applied to the keying equipment in both the transmitting station and the receiving station so that the signals will be enciphered and later deciphered and the original signal is recovered.

In addition, the key lock circuits of each of the stations completes a transmission path through respective key locks from the synchronous pulse generating equipment to the pulse counters 245 and 345. These pulse counters are arranged to cause the stepping switches 235 and 335 to step after a predetermined number of pulses from the synchronous pulse generators 219 and 319, respectively. Similarly, tape switches 236 and 336 step after a predetermined number of pulses from the synchronous pulse generators 219 and 319 have been counted. These switches are initially set in the same position and the pulse counter at the two ends set to cause them to step after the same number of pulses. As a result these switches step at both ends of the system at substantially the same time and thus stay in step and cause the same key signals to be generated at each station. Furthermore, when the stepping switch and tape controlled switches 235 and 236 are actuated, the switching transient silencer is also actuated to prevent key signals from being transmitted from the keyer equipments. The absence of the key signals in turn causes the holding circuit 226 to be actuated so that the transmission path from the source of signals 210 to the coding equipment is interrupted, consequently no signals representing the complex wave form will be transmitted over the transmission circuit at these times.

After the key locks 250 and 350 are actuated at the beginning of communication between the two stations, the key signals of the transmitting station are combined with the coded signals by means of the circuit similar to the circuits of the mark space reversers FIGS. above. Sometimes circuits of this type are called reentrant circuits. When these two signals are combined they form an enciphered signal which is transmitted over the communication path and radio system to a distant receiving station. At the receiving station the enciphered signals are combined with a second set of identical key signals with the result that the original coded signals are recovered and then decoded and combined to reconstruct the complex wave form transmitted from source 210.

After the system has been set into operation as described above, switch 248 is actuated to the position shown so that signals from source 210 which are transmitted through the holding circuit 226 are applied to the coder 214 through the hybrid coil 225. In addition the random noise generator 223 is connected through the high-pass filter 224 and through the hybrid coil 225 to the transmission circuit extended through the coder and differentiator 214.

Noise currents from the random noise generator 223 pass through the high-pass filter 224. This filter is arranged to pass only the frequency components of the noise currents which have frequencies which are above the speech signaling current to be transmitted over the system. At the receiving station the high frequency noise currents are removed by low-pass filter 308 at the receiving station. However, these noise currents pass radio or other communication paths between the two stations and cause different code groups of pulses to be transmitted during pauses in transmission of the communication currents so that signals transmitted over the communication system at no time represent the communication signals or the signals generated by the cipher key generating equipment at the transmitting station. As a result pulses representing either the communication currents by themselves or the cipher key pulses by themselves, are not transmitted over the communication circuit or path. Consequently, a minimum of information useful to unauthorized persons desirous of deciphering the enciphered signals transmitted over the communication path, is transmitted over the system.

In addition to the main signaling path between the transmitting and receiving stations shown in FIGS. 2 and 3 a synchronizing path or channel 260 is shown extending between two stations in FIGS. 2 and 3. This control path or channel may be similar to the other transmission paths between the stations. Furthermore, if it is so desired the synchronizing signals or the control frequency may be transmitted over one or more of the other transmission paths extending between the two stations. Inasmuch as there are numerous types of synchronizing apparatus in the prior art which will operate over the same transmission paths as employed for the transmission of communication signals and since the operation of this type of equipment is well known and understood by persons skilled in the art, it is considered unnecessary to further expand the present disclosure to show details of a typical system of this type. It is understood, of course, that such equipment will cooperate with the various circuits of the present invention and may be provided when it is so desired Each of the stations is provided with certain control equipment which may be common to all of the circuits terminating at that station or it may be common to a plurality of the circuits terminating thereafter. Of course, this common equipment may be provided for each of the individual circuits if it is so desired as is well understood by persons skilled in the art. However, in the systems shown in FIGS. 2 and 3 the control circuits and equipment are shown at the top of these figures and may be common to all of the channels which terminate at each of the respective stations.

The common equipment at the station of FIG. 2 comprises a control oscillator 218 which may be of any suitable type, as for example, the types described in detail in any one or more of the following U.S. Pat. Nos. 1,476,721, Martin, Dec. 11, 1923; 1,660,389, Matte, Feb. 28, 1928; 1,684,455, Nyquist, Sept. 18, 1928 and 1,740,491, Affel, Dec. 24, 1929.

The output of the control oscillator is coupled to control a synchronous pulse generator 219. The output of this generator extends to the transmitting time division multiplex circuit 215, transmitting key lock circuit 250 and monitoring equipment 220. The synchronous pulse generator may include one or more delay devices. These delay devices as well as the other delay devices shown in the drawing may be any suitable type of delay network as, for example, one or more sections of one or more of the types disclosed in U.S. Pat. No. 1,770,422 granted July 18, 1930 to Nyquist.

Similar common equipment comprising a control oscillator 318 and synchronous pulse generator 319 are provided at the station shown in FIG. 3.

In addition to the control oscillators 218 and 318 at each of the control stations a master oscillator 217 is shown in FIG. 2. This master oscillator may be located at either of the stations of FIG. 2 or 3 and when so located at either of these stations, may replace the control oscillator 218 or 318 at either of these stations. However, the master oscillator is frequently located at some central point and provides a control frequency for the entire nationwide system or for some smaller division of a large system. Typical oscillators and standard frequency systems suitable for use as a master oscillator or source of control frequency are disclosed in U.S. Pat. Nos. 1,788,533, Marrison, Jan. 13, 1931; 1,931,873, Marrison, Oct. 24, 1933; 2,087,326, Marrison, July 20, 1937; 2,163,403, Meacham, June 20, 1939; and 2,275,452, Meacham, Mar. 10, 1942.

All of the patents referred to above are hereby made a part of the present application as if fully included herein.

Figure 6:
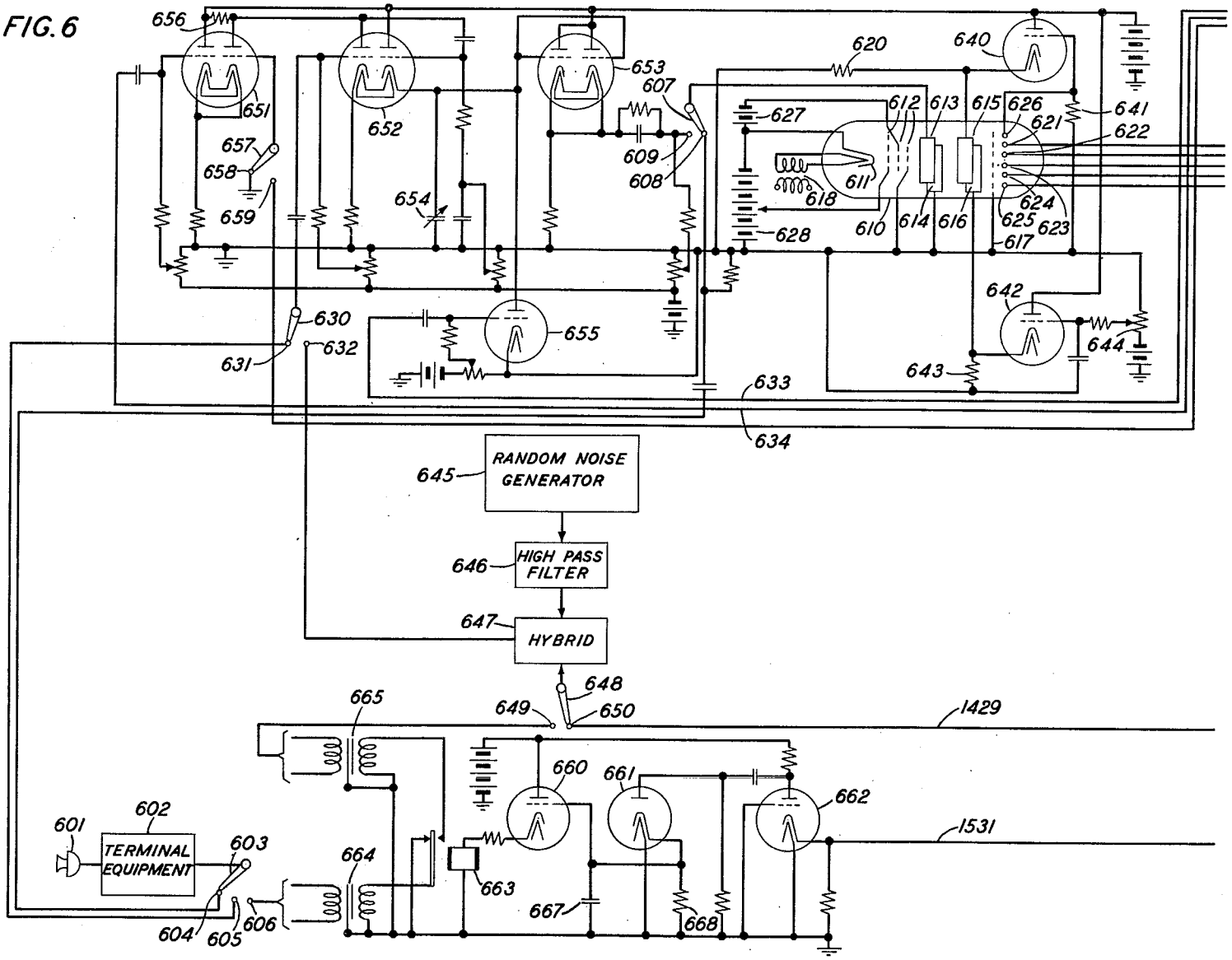
Figure 7:
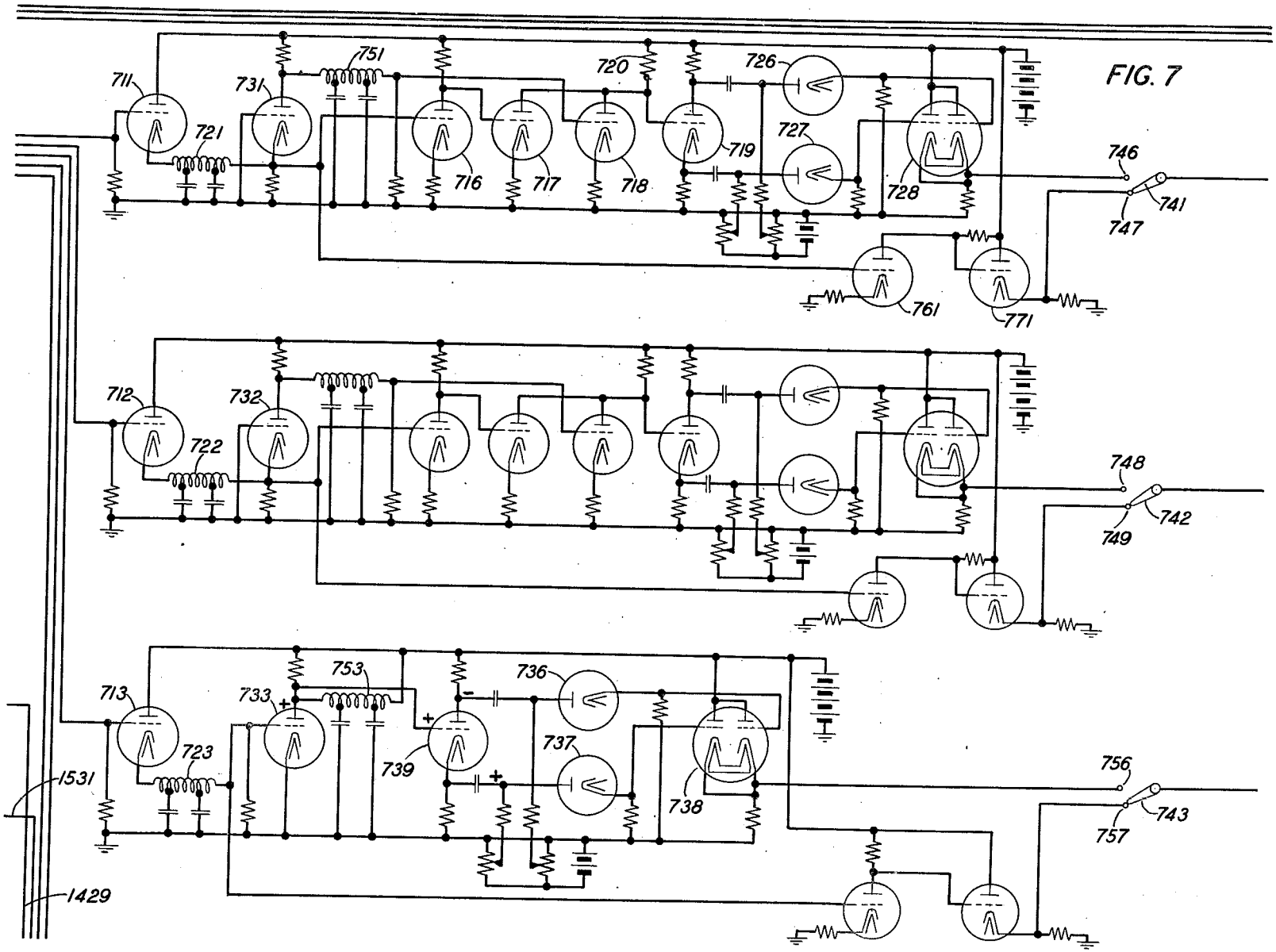

In the exemplary embodiment of the invention set forth herein a high speed coding tube is employed in coding apparatus 214. The tube is shown in FIGS. 6 and 43. Referring first to FIG. 43 the tube comprises an evacuated envelope 4310 in the form of a cathode-ray tube which may be of metal, glass, or other suitable material including combinations of metal, glass and other suitable material employed in the construction of evacuated electron tubes and devices. The tube is provided with a source of electrons from the cathode 4311 which is heated by a heater supplied by suitable power through transformer 4318 in the usual manner. In addition, beam forming elements 4312 are provided and then connected to suitable sources of accelerating and beam forming potentials from sources 4328 and 4327 which sources are illustrated as batteries in FIG. 43, but may comprise rectifiers, filters, or other suitable power sources.

In the usual electron beam tube the beam forming elements 4312 are arranged to form a small beam of electrons which is focussed to a small spot on a target or screen. These beam forming elements frequently comprise aperture plates and the like and are provided with suitable apertures to form a spot of small dimension.

In accordance with the present invention the beam forming electrodes 4312 of any suitable number and construction are arranged to form a wide sheet or plane of electrons of very small thickness which likewise is focussed upon the target 4317. The beam forming elements 4312 consequently will usually be provided with apertures in the form of slits instead of small holes as in the usual case. These beam forming electrodes will nevertheless function analogous to cylindrical lenses to focus the beam of electrons in a very narrow line across a target 4317. The beam forming members represent both electrostatic and electromagnetic focussing and beam forming elements including electrodes, coils and related elements and apparatus. Also, the beam forming and focussing may include a combination of both types of elements.

The target 4317 is provided with a plurality of series of apertures arranged in columns as shown in FIG. 43. These apertures are arranged to form the desired code which in the exemplary embodiment set forth herein is a five-element code arranged in accordance with a binary numbering system. It will be readily understood by persons skilled in the art that any number of code elements may be employed and they may be arranged in any desired manner to form the code employed for transmitting the signals as will be described hereinafter. In addition an auxiliary column of apertures 4336 is provided in the plate or target 4317 and employed to shift the beam so that it will not rest between the apertures forming in the code as will be described hereinafter. The source of signals to be coded and transmitted is supplied through the transformer 4319 to the deflecting plates 4313 and 4314. These deflecting plates in addition to having the signals to be transmitted applied to them are connected to the proper biasing potential so that they do not interfere with or aid in the focussing of the electrons in a narrow line upon the target 4317. Deflecting plates 4313 and 4314 deflect the beam vertically in accordance with the magnitude of the signals received through the transformer 4319. As a result the vertical position of the line of electrons across the target plate 4317 is controlled by the magnitude of the applied signals.

Certain portions of this electron beam pass through the apertures in plate 4317 and fall upon or are collected by the collecting elements 4321 through 4326, inclusive, positioned behind the various columns of apertures in the aperture target plate 4317. The electrons in falling upon these collecting elements or anodes change their potential as is well understood. It is thus apparent that the potentials of these elements 4321 through 4325, inclusive, at all times represent the magnitude of the incoming signals applied through the transformer 4319 to the deflecting plates 4313 and 4314. As shown in FIG. 43 the input to the deflecting means is balanced to ground while in FIG. 6 the input to the deflecting means is not balanced with respect to ground. Either arrangement may be employed. In other words the output from elements 4321 through 4325 of the tube at all times is a complete binary code representing the instantaneous amplitude of the applied signal or other complex wave form to be transmitted, which in the usual case is a speech wave form. When desired the beam may be deflected in a vertical direction under control of signals to be coded by magnetic deflecting coils and related apparatus or by a combination of both magnetic and electrostatic means in place of the means shown in the drawing.

In order to prevent the beam of electrons from remaining between any two rows of apertures representing two different amplitudes and thus either causing no potential on the output leads or causing potentials in accordance with two different codes to be applied to the output leads and in order to reduce the time required to shift the electron beam from one row of apertures to the next in an additional set of apertures provided in the target plate 4317 and an additional collecting element or electrode 4326 provided behind these apertures. The auxiliary apertures as illustrated in column 4336 are provided between the rows of coded apertures in columns 4331 through 4335, inclusive.

Thus, if the beam of electrons tends to fall between two of the rows of coded apertures in response to the applied signals, a portion of the electrons will pass through one of these auxiliary apertures and cause the collecting element or anode 4326 to become more negative due to the electrons received by it. This element is connected to one of an auxiliary set of deflecting plates 4315. As a result the deflecting plate 4315 will become more negative and tend to move the beam downward so that it will no longer rest between two rows of coding apertures. Instead, the beam or the major portion thereof will pass through apertures of the next lower row. If, however, the signal changes sufficiently then the beam will move up to the next row when the signal overcomes the depressing effect of the potential applied to the auxiliary deflecting elements 4315 and 4316. The auxiliary apertures, collecting element, and the auxiliary deflecting element of the tube described above are frequently called quantizing elements because they tend to cause the beam to occupy the discrete positions on the target plate 4317 and thus tend to represent the magnitude of the incoming signal by any one of a plurality of different discrete codes representing a particular discrete amplitude of the incoming signal. In other words the incoming signal is represented by the code output from the tube and is not a continuous function but one having any one of a plurality of separate and distinct amplitudes.

It is of course apparent that the feedback connection from the auxiliary element 4326 to the auxiliary deflecting plates 4315 to 4316 may include any suitable types of amplifier equipment to secure the desired amount of control of the electron beam to insure that the beam always passes through some one row of code apertures in the target plate 4317.

As shown in the drawing, the target plate 4317 extends some distance below the last row of apertures so that so-called blank code will be transmitted when the beam is directed to its lowermost position by the received signals. If the beam should be moved still lower than the normal range of the tube, the same code will still be transmitted because the beam will not pass through any apertures, will not impinge upon any of the collecting elements, but will be completely intercepted by the target plate 4317.

Likewise if the beam is directed by a signal having a greater amplitude than its normal operating range of the tube above the row associated with the uppermost apertures of the plate, the same code will still be transmitted because as shown in the drawing, the upper apertures of each of the columns 4331 through 4335 inclusive have been extended an appreciable distance above the normal position of the last row of code apertures in the plate. Consequently, if the signals should at any time have amplitudes which would temporarily exceed the range coding tube the codes representing the maximum or minimum amplitude would continue to be transmitted instead of some other code. In this manner the noise distortion introduced by overloading the coding tube is greatly reduced or eliminated.

When desired other or additional apertures in the target or aperture plate may be elongated or extended by a greater or lesser amount as may be desired. These additional or other elongated apertures may be positioned near the center of the plate to effect noise impression or they may be placed at other immediate positions for other special purposes including clipping, compression expansion, etc.

When desired the apertures may be made to come progressively larger or progressively smaller as the amplitude of the applied signaling wave is increased. In the first case the applied wave form is compressed so that a larger signal amplitude may be represented by a given number of codes. In the second case a complex wave form is expanded.

The apertures in the aperture or target plate are described herein as being arranged in rows of columns in which the apertures in any row represent a code group of signals.

It is evident that by rotating the tube or the aperture plate and electron gun structure through 90° the rows become columns and the columns rows so that the rows and columns may be interchanged.

In the exemplary embodiment set forth herein an aperture plate is provided in combination with collecting electrodes behind the apertures. It is evident that an equivalent group of properly shaped and proportioned collecting electrodes can be employed when desired.

It is also assumed herein that when the electrons of the electron beam pass through apertures in the aperture plate and fall upon the collecting electrodes behind these apertures they will cause a potential of the collecting electrodes to be reduced.

However, when desired, the collecting electrodes may be designed and arranged to operate as secondary emitters in which case they become more positive when the electron beam passes through an aperture and falls upon these collecting electrodes because each electron from the electron beam will cause a plurality of electrons to be dislodged from the collecting electrode thus leaving it more positive.

Thus, by providing a sheet of electrons which focus the line upon the target plate, a code representing any of the plurality of different discrete amplitudes of the applied signal is always complete and instantaneously available for transmission. It is unnecessary to move the beam across the apertures as in coding tubes in the prior art such as disclosed in the application of Llewellyn Ser. No. 656,485, filed Mar. 22, 1946.

The coding tube is also represented in FIG. 6 by tube 610 in a more schematic form so that the manner in which it is incorporated in transmitting and code modulation circuits may be more readily understood. Here the cathode is represented by 611 which is heated with power from transformer 618 or in any other suitable manner so that it will admit electrons. These electrons are formed and focussed into a sheet or plane of electrons which impinge upon the aperture target 617. This target is represented by the dotted line in FIG. 6, but actually has a form as shown by the target plate 4317 in FIG. 43. The collecting electrodes or anodes behind the target are represented at 621 through 626 in FIG. 6. Here the incoming signals are applied to the deflecting plates 613 and 614. Feedback path from the quantizing collecting element 626 is connected through vacuum tube 640 to the quantizing deflecting plate 615. The other quantizing deflecting plate 616 is connected to tube 642. The tubes 640 and 642 are shown as cathode follower tubes. Tube 640 is employed to respond to a small number of electrons falling upon the collecting element 626 which causes a small drop across the resistor 641. The tube 640 thereupon causes a much larger current to flow through the cathode resistor 620 and accurately control the potential of the deflecting plate 615. In other words, the cathode follower tube is employed as a current amplifier or impedance and changing device which has a high impedance input circuit and thus readily responds to a small number of electrons collected by the collecting element 626. Nevertheless it accurately controls the potential of deflecting plate 615 which may have appreciable capacity and thus a lower impedance.

It is to be understood of course that tube 640 represents an amplifier which may include more than a single stage cathode follower tube as shown in the drawing.

Tube 642 is similarly connected to the other correcting deflecting plate 616. Tube 642, however, has its grid connected to the voltage divider 644. The divider 644 may be adjusted for the purpose of centering or properly adjusting the position of the electron beam in tube 610. In addition tube 642 also tends to compensate for changes in battery potential of the various supply sources employed in the system. Thus, for example, if the anode batteries of the tubes 640 and 642 change, a corresponding change is applied to both quantizing plates 615 and 616 so that this change in battery potential is largely balanced out and does not cause improper operation of the coding tube and does not, in effect, add noise or other spurious currents to the coding apparatus which currents might otherwise appear as noise in the decoded signals.

Novel features of this coding tube disclosed but not claimed herein are claimed in my copending application Ser. No. 37,035 filed July 3, 1948.

Figure 44:
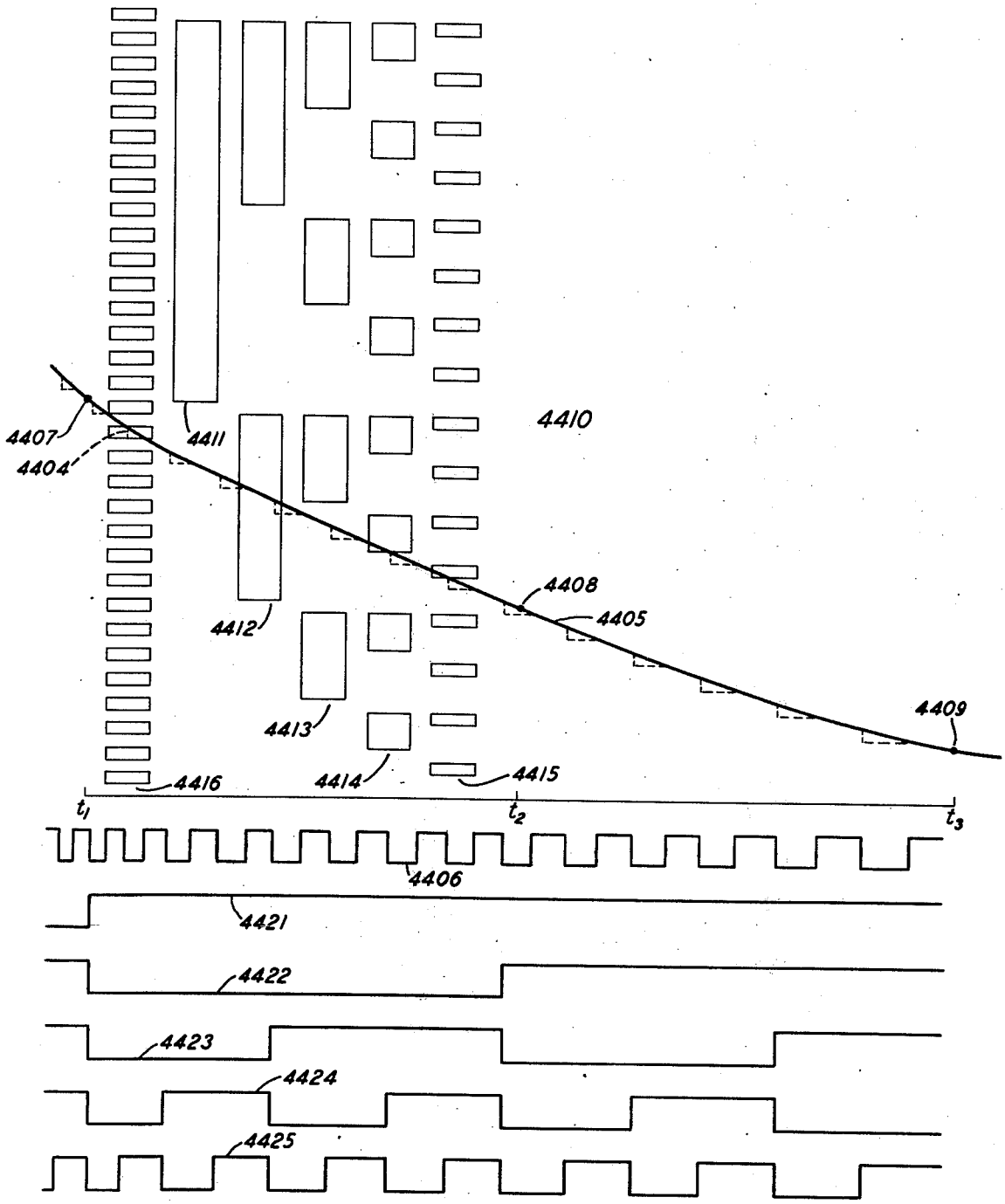

The above-described operation of the coding tube 610 is illustrated by the graphs in FIG. 44. 4410 shows a portion of the target similar to 4317 of the coding tube. This target is provided with a plurality of apertures arranged in six vertical columns 4415, 4414, 4413, 4412, 4411 and 4416. The vertical column 4411 comprises the apertures which control the digit in the first digital position or digit of highest denominational order of a corresponding binary number, likewise column 4412 comprises the apertures which control the second digit of the number and so on. The vertical column 4416 represents the apertures for providing auxiliary control of the electron beam within the tube.

It is assumed, for purposes of illustration, that the applied wave has a wave form such as illustrated by graph 4405 in FIG. 44. This graph has been superimposed upon the apertures of the target in such a way that it is assumed that at any time *t* along the X-axis the electron beam will be at a height on the target shown by the position of the graph 4405 at that time. Thus assuming that at time *t*1 the beam will be at position 4407, at a later time *t*2 the beam will be at a position 4408 and at a still later time *t*3 the beam will be at a position 4409. When the beam is in position 4407 it passes through only the one aperture in column 4411 thus indicating an amplitude of sixteen for the complex wave form at the time *t*1. The graph 4421 illustrates the potential on the collecting electrode 621 at this time and since the beam passes through an aperture in column 4331 and 4411 it impinges upon this electrode. The electrode will be at its more negative potential as illustrated for time *t*1 by graph 4421. The beam will not pass through any other apertures in front of any of the other coding electrodes 622 through 625. Consequently these electrodes will be at their more positive potential at time *t*1 as illustrated by graphs 4422, 4423, 4424 and 4425. At a slightly later interval of time the beam will be depressed due to the applied voltage illustrated by graph 4407 and will pass through an aperture in column 4416 which will cause current to flow and change the potential of the collector electrode 626 which will cause the beam to be immediately further deflected as illustrated by the dotted line 4404. Thus, the beam will then pass through apertures in columns 4412 through 4415, inclusive, and will not pass through an aperture in column 4411; as a result the potential of the collecting electrode 621 rises to a more positive value as illustrated by graph 4421 while the remaining coding electrodes 622 through 625, inclusive, will assume a more negative potential value due to the fact that electrons from the beam pass through apertures in front of these collecting electrodes and reduce their potentials. The voltages of these other electrodes at this time are represented by graphs 4422 through 4425. At each succeeding instant of time, the electron beam is deflected as indicated by graph 4405 and will pass through various ones of the apertures in the various columns. At time *t*2, for example, without the quantizing control apertures 4336 and 4416 the beam will be between the rows of apertures representing amplitudes of seven and eight. At this time *t* 2 the beam will pass through the aperture in column 4416 and thus cause the collecting electrode 624 to assume a more negative potential which in turn will depress the beam so that it will pass through the apertures representing an amplitude of seven. As a result the voltage of the electrodes 613, 614 and 615 will be negative and the voltages of all of the other collecting electrodes are at their more positive potential, as illustrated by graphs 4421 through 4425 at the time *t*2.

It is thus evident that at any time *t*, the potentials on the output electrodes represent in coded form the displacement of the electron beam and thus the magnitude of the complex wave form applied to the system described herein.

As will be described hereinafter the approximate times *t*1, *t*2 and *t*3 have been selected as the times at which pulses representing the amplitude of the complex wave form are to be transmitted over the multiplex system.

As shown in the drawings, a monitoring circuit 220 is provided at the transmitting station. This monitoring circuit enables the attendant to observe the operation of the coding circuits to determine if they are operating properly. The monitoring circuit may comprise receiving multiplex and pulse code demodulation and decoding equipment. This monitoring circuit may comprise substantially all of the apparatus at the receiving station as described hereinafter. The monitoring circuit operates in the manner well understood in the art or in accordance with the receiving equipment and circuits described herein. Consequently, there is no need to repeat the description of the operation of this equipment at this time.

A detailed description of an exemplary system embodying the present invention may be more readily understood with reference to FIGS. 6 to 62, inclusive, and arranged adjacent one another as shown in FIG. 4.

COMMON EQUIPMENT

In order to better understand the operation of the system the common equipment shown on the top of FIGS. 2 and 3 in diagrammatic form will be described first.

Figure 5:
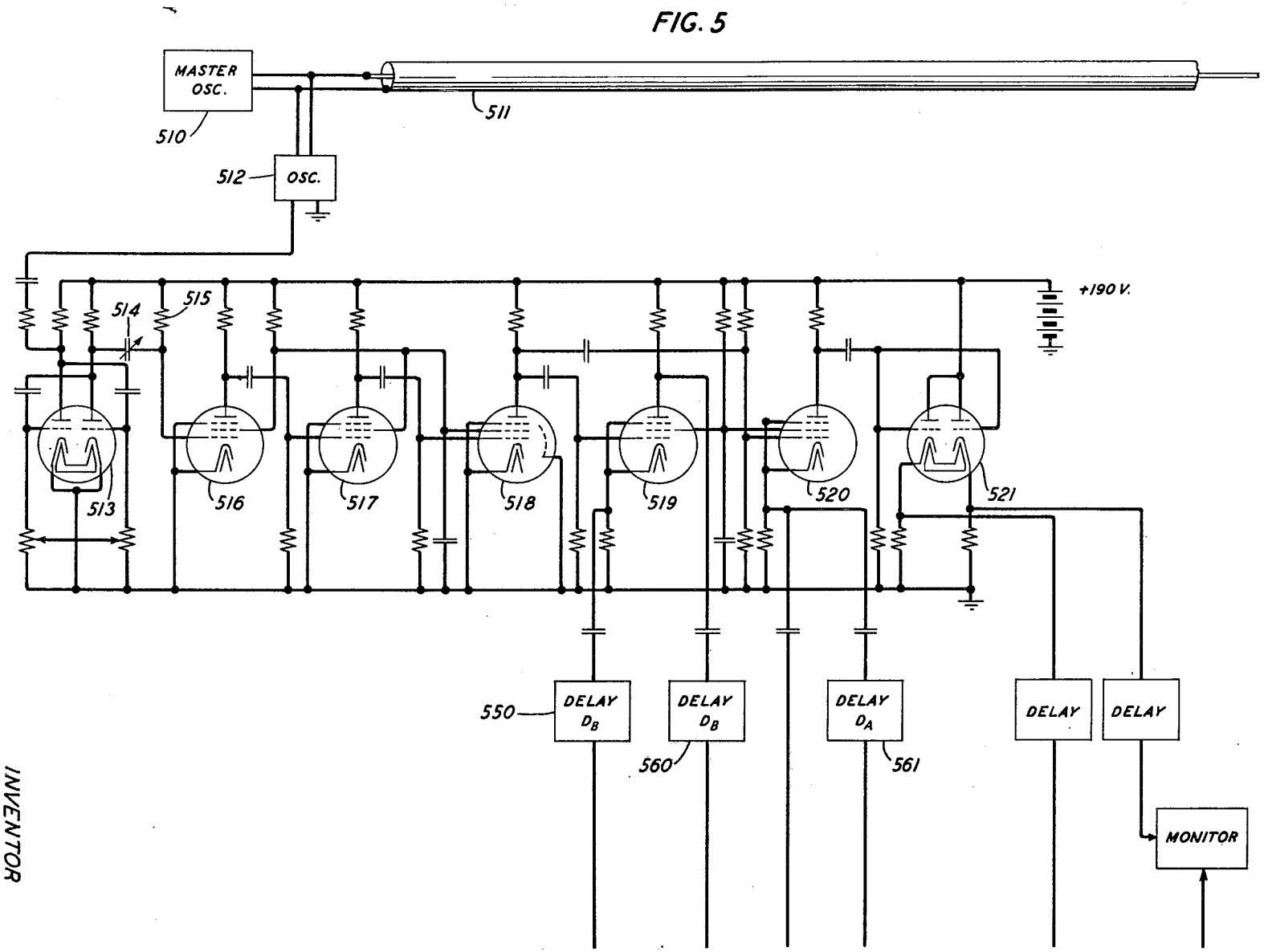

FIG. 5 illustrates a master oscillator 510 and the secondary oscillator 512. If the master oscillator 510 is located at the transmitting station the details of which are illustrated in FIG. 3, local oscillator 512 may be dispensed with. However, in case the master oscillator 510 is located at some other station or is a master frequency standard for a large number of stations, systems, or for the entire country, both oscillator 510 and the local oscillator 512 will usually be employed. Master oscillator 510 may be of any suitable type such as the type disclosed in the above-identified Meacham or Marrison patents. The local oscillator 512 will then incorporate control apparatus for maintaining its frequency in synchronism with the frequency from the master oscillator 510 similar to the equipment described in detail in the above-identified patents. Oscillator 512 is connected over a synchronizing line 511 which is shown in FIG. 5 as a coaxial line and extends to receiving station shown in FIGS. 26 through 42, inclusive. The coaxial line 511 terminates at the receiving station in a local oscillator 2612 which is similar to the oscillator 512. While the synchronizing line 511 is shown as a coaxial line, it is to be understood that any suitable type of transmission path may be employed which is capable of transmitting the synchronizing frequency employed.

SYNCHRONOUS PULSE GENERATOR

The local oscillator 512 or the master oscillator 510 is connected to a multivibrator circuit comprising tube 513. The multivibrator circuit 513 operates to generate square waves which usually have the same frequency as received from oscillator 512 or 510. However the frequency of operation of multivibrator 513 may be different from the frequency of the controlling oscillator. In addition the frequencies of operation of the oscillators 510, 512 and 2612 will usually be the same but may be different when desired. Multivibrator circuits are well known in the art. Typical multivibrator circuits for use in the present system are described in U.S. Pat. Nos. 1,744,935 granted to Van der Pol Jan. 28, 1930 and 2,022,969 granted to Meacham on Dec. 3, 1935, and in an article by Hull and Clapp published in the Proceedings of the Institute of Radio Engineers for February 1929, pages 252 to 271. See also section 4–9 "Multivibrator" on page 182 of Ultra-High-Frequency Techniques by Brainerd, Koehler, Reich and Woodruff. The output of the multivibrator 513 is coupled through a condenser 514 and a resistance 515 to amplifier tube 516.

Condenser 514 is made variable so that it, together with resistance 515 may be employed to control the length of the synchronizing pulses derived from multivibrator circuit 513. If the time constant of condenser 514 and resistance 515 is large, the output pulse will be relatively long, whereas if the time constant of condenser 514 and resistance 515 is small the output pulse will be short. In a typical example of the present system the values of condenser 514 and resistance 515 were selected to produce an output pulse of approximately two microseconds duration.

Figure 8:
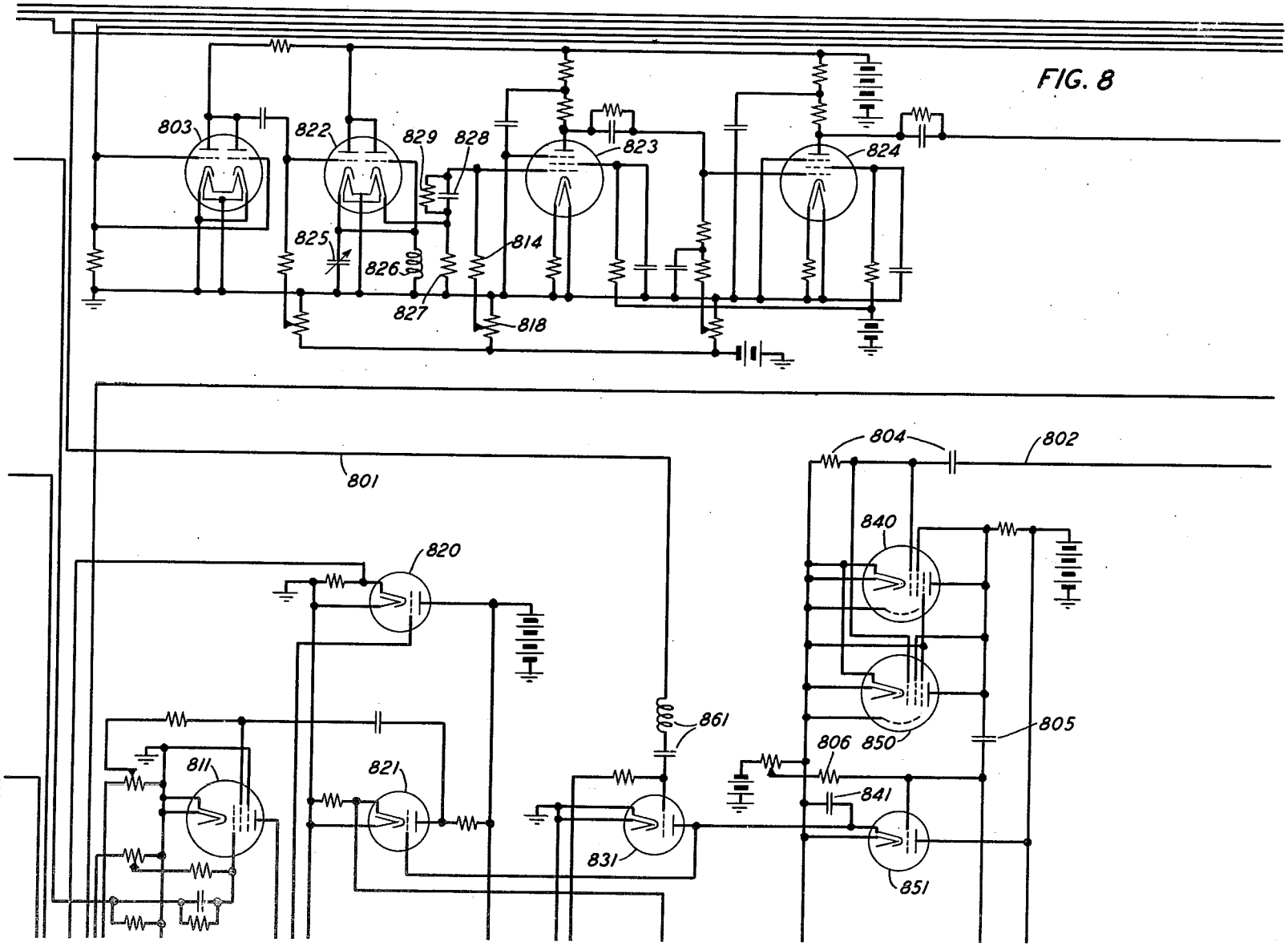
Figure 9:
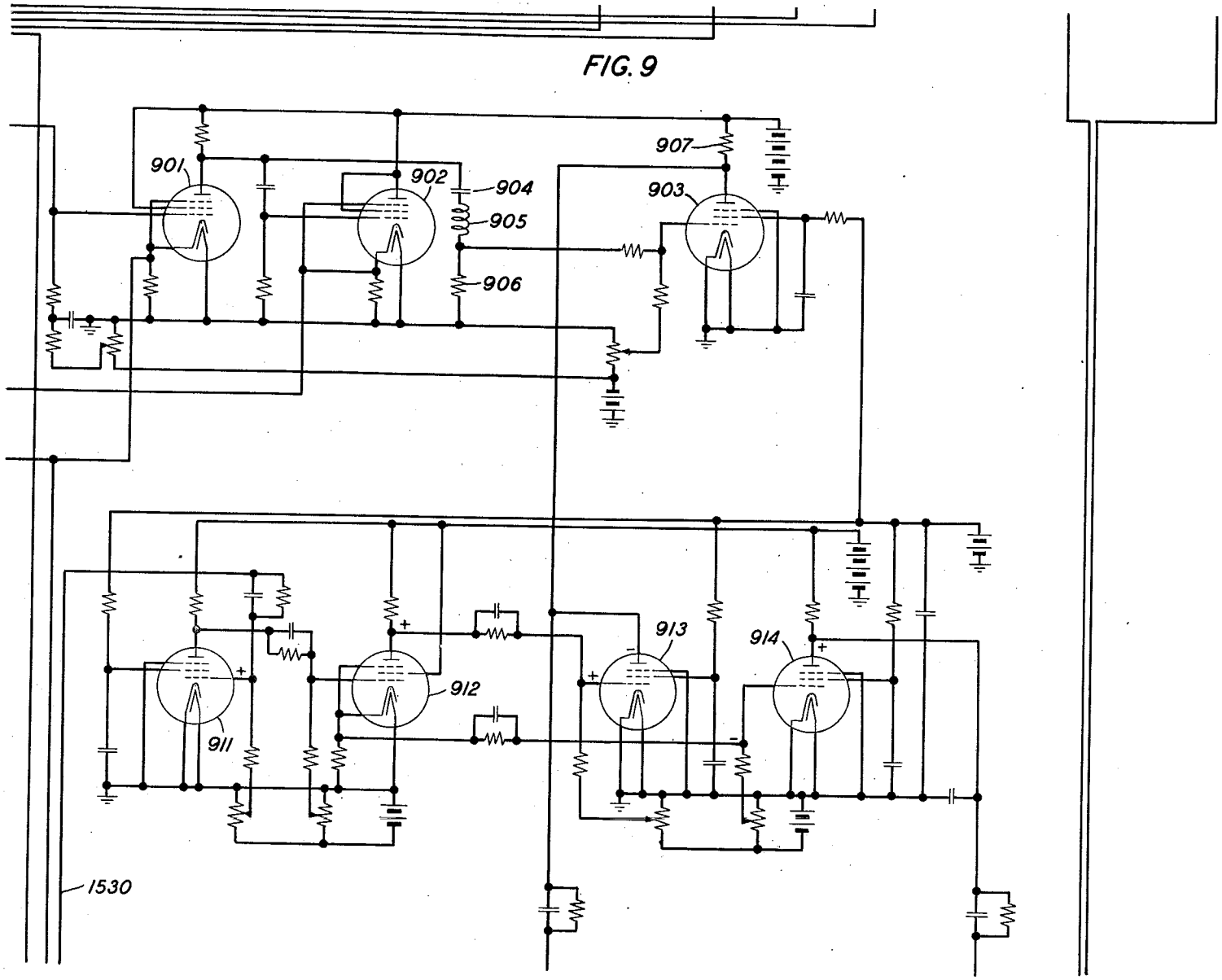
Figure 10:
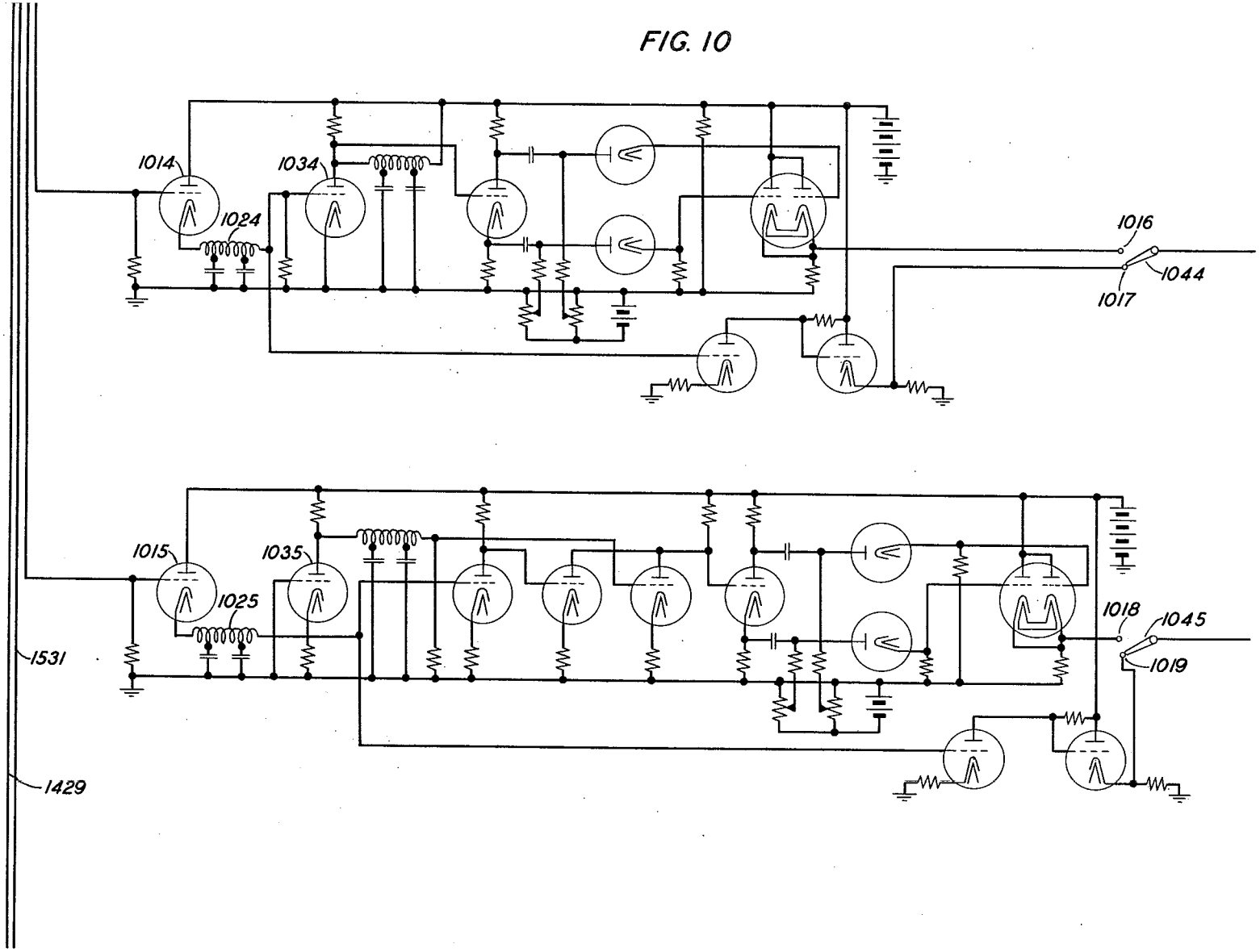

Condenser 514 and resistance 515 are coupled to the control grid of amplifier tube 516. The output of the amplifier tube 516 is in turn coupled to tubes 517, 518, 519, 520 and 521. Tubes 516, 517 and 518 are amplifier tubes which are overloaded by the magnitude of the pulse applied to them so that these tubes tend to limit the magnitude of the pulse repeated through them and at the same time tend to make it square in wave shape. Amplifiers of this type are sometimes called "limiters" and at other times "clipping" amplifiers because they limit, clip off or suppress the top portion of the waves applied to them. A single stage "limiter" is shown in FIGS. 8–6 on page 282 and described on page 283 of Ultra-High-Frequency Techniques by Brainerd, Koehler, Reich and Woodruff. First published July 1942 by D. Van Nostrand Company, Incorporated.

The output of tube 518 is coupled to tubes 519, 520, and tube 521 is coupled to tube 520 which tubes prevent improper interaction between the various utilization circuits and supply sufficient power for the output pulses of the circuit so that they may be employed to control the other circuits of the system. The output circuit of tube 519 is arranged to supply both positive and negative pulses. Negative pulses are obtained from the plate of tube 519, while positive pulses are obtained from its cathode as shown in FIG. 5.

In case a large number of circuits are supplied from pulse generator shown in FIG. 5, additional output stages may be connected in parallel with tube 519, i.e., may have their input circuits connected in parallel with the input circuit of tube 519 or may be driven from this tube as is well understood and frequently employed.

The negative pulses from the plate of tube 519 pass through a delay network 560 where they are delayed slightly in time with respect to the synchronous pulses. The purpose of this delay will be explained hereinafter. Delay network 560 will be of any suitable type employing reactive elements in a manner well understood in the art and pointed out above. The undelayed output of the pulse generator shown in FIG. 5 is diagrammatically indicated by the lines 4501 of FIG. 45 for the positive pulses. The negative output pules of course will occur at substantially the same time. Under the assumed condition the synchronous pulse generator circuit generates pulses at the rate of 10,000 per second so the pulses occur at intervals of 100 microseconds.

CODE ELEMENT TIMING CIRCUIT

The output from the anode of tube 519 is connected through the delay device 560 to code element timing circuit comprising tubes 803, 822, 823, 824, 901 and 902. The tube 803 is employed to drive the left-hand section of tube 822, which tube in turn is employed to shock-excite the resonant circuit comprising condenser 825 and inductance 826 connected in parallel in the cathode circuit of the left-hand section of tube 822. The bias conditions applied to the left-hand section of tube 822 are such that the tube is blocked or non-conducting at all times except when the positive pulse from tube 803 is applied to its grid. At these times the left-hand section of tube 822 forms a low impedance path for supplying current and energy to the oscillating circuit connected in its cathode circuit. At all other times the anode-cathode circuit of tube 822 is of such a high impedance that it does not materially affect the oscillations of the resonant circuit comprising elements 825 and 826. The application of a positive pulse to the grid of tube 822 thus sets the resonant circuit described above into oscillation. The wave form of such oscillations is shown by curve 4502 in FIG. 45.

As shown by curve 4502 one suitable type of adjustment for the resonant circuit is such that substantially five complete oscillations take place between the delayed positive synchronizing pulses 4503 applied to the grid of the left-hand section of tube 822.

In other words, one cycle or oscillation is generated between the synchronizing pulse for each code pulse of each group of code pulses. If six or some other number of pulses are required to represent the various amplitudes of each sample of the complex wave then the tuning of the resonant circuit comprising condenser 825 and inductance 826 would be varied to generate six or the required number of cycles or oscillations between synchronizing pulses.

As shown by curve 4502 slightly more than five complete oscillations of the resonant circuit take place but the synchronizing pulse causes the circuit to start oscillating from substantially the same point and with the same phase each time it is received. By supplying energy to the oscillating circuit when the current through the coil is small and by utilizing the low impedance of the cathode circuit, transients are small and quickly damped out. Transients do not, therefore, materially affect the frequency or amplitude of the oscillations and at the same time the oscillations are maintained in proper phase.

The cathode of the left-hand section of tube 822 is connected to the grid of the right-hand section of this tube. The output impedance of the right-hand section comprises a cathode resistor 827 which is of such a value that the right-hand section of tube 822 acts as a so-called "cathode follower" and thus presents an extremely high impedance to the resonant circuit comprising elements 825 and 826. Consequently, the operation of the right-hand section of tube 822 does not materially alter or interfere with the operation of the resonant circuit. Such properties and operation of "cathode followers" are well known to persons skilled in the art. (See "The Cathode Follower" by C. E. Lockhart, Parts I, II and III, published in Electronic Engineering, December 1942, February 1943 and June 1943, respectively.)

The cathode of right-hand section of tube 822 is coupled through a resistance and capacity network to the grid of tube 823. Capacity 828 and resistance 829 are employed in the coupling circuit in order to properly control the wave shape of the pulses transmitted to and repeated by the tube 803. Resistances 814 and 829 together with the position of potentiometer 818 control or determine the bias of the grid of tube 823. Condenser 828 is connected across resistance 829 to compensate for the effect of the input capacitance of tube 823, thus causing the potential of the grid of tube 823 to rise substantially as fast as the applied potential, i.e., the potential of the cathode of the right-hand section of tube 822. The optimum value of condenser 828 is the value of the input capacitance of tube 822 multiplied by the ratio of resistance 829 to resistance 827. It should be noted that the potentiometer 818 is connected between the negative source of bias potential or battery and ground.

The output of tube 823 is similarly connected to tube 824 and the output of this tube in turn, connected to tube 901. Tubes 823 and 824 are adjusted to operate as overload amplifiers so that they will limit the amplitude of the output pulse and at the same time cause these pulses to approach a square wave form. Tube 901 is a power tube for supplying sufficient output power to operate the other circuits as will be described hereinafter. In this case as in the case of the output the pulse generator, sufficient additional output tubes may be provided in parallel with or supplied by tube 824 to provide the necessary output currents and voltages as well as to isolate the various different circuits one from another, as may be required.

The amplifier tubes 822, 823 and 824 have their circuits and bias potentials so adjusted that a wave form approaching that illustrated by curve or broken line 4504 appears in the output from the tube 824. Both the positive and negative portions of this wave form as shown in the drawing are substantially of the same duration. Persons skilled in the art will at once realize that it is not necessary that both of these portions of the wave be of equal or substantially equal duration but may and usually will be of different duration to secure optimum operation. Furthermore, these waves are shown to be rectangular in form, as are other waves in the drawing. In practice, the waves are rounded to a greater or lesser extent. Inasmuch as typical actual wave forms approach the wave forms shown in the drawing and would not further aid in an appreciable manner the understanding of this invention the actual waves are represented by the forms shown in the drawing which are much easier to draw and adequately represent the operation of the system.

CONTINUOUS CODING

Assume for purposes of illustration that the various switches shown in the drawing are operated to the positions shown.

When the switches are so operated the exemplary system set forth herein is arranged to respond to and transmit complex wave forms such as voice frequency waves including speech, music and the like or any other suitable types of complex wave forms having frequency components having frequencies within the same frequency range. Such other wave forms may represent telegraph signals, picture currents and so forth. The complex wave is then translated into code groups of signals which signals are employed to generate pulses representing the instantaneous amplitude of the complex waves at each of a plurality of rapidly recurring instants of time. These pulses are then transmitted over a transmission system which may take a form of a radio path including the highest radio frequencies which when transmitted exhibit many properties of light beams. The transmission path may also include coaxial cables, wave guides, and other suitable transmission circuits, apparatus and media capable of transmitting the necessary and desired frequency range.

The signals as received at the receiving terminal are then decoded and a wave form similar to the original complex wave form will be constructed and transmitted to terminal equipment.

FIG. 6 shows a signal source 601 which corresponds to source 210 of FIG. 2. As shown in FIG. 6 source 601 is represented by a microphone. However, any suitable type of signal source may be employed including telegraph and picture apparatus.

The source 601 is connected to the terminal equipment 602 which terminal equipment may and usually will include one or more of the following types of equipment such as transmission paths, manual or automatic switching equipment, toll lines, carrier current circuits, radio circuits, amplifiers, gain regulators, coaxial lines, wave guides, repeaters, interconnecting equipment and the like.

This equipment operates in its usual manner as is well understood in the prior art so that details of its operation need not be repeated here. This equipment is employed to extend the transmission or communication path from source 601 to the exemplary transmission system described herein in detail embodying the present invention.

From the terminal equipment 602, the signals are transmitted through switch 603 to terminal 604 when switch 603 is operated to positions shown in the drawing. The signals are then transmitted through switch 607 from terminal 608 to the deflecting plate 613 of the coding tube 610. As a result the electron beam in this tube is caused to move in a vertical direction under control of received signals. Due to the action of the quantizing column apertures 626, quantizing deflecting plates 615 and 616 as well as the repeater represented by tube 640, the beam is moved in discrete steps so electrons of the beam fall upon the collecting elements 621 through 625, inclusive. The particular ones of these elements upon which the electrons fall is determined in part by the apertures or codes in the plate 617 and also by the magnitude of the received signals.

As a result, as pointed out hereinbefore, the elements 621 through 625, inclusive, have at substantially all times potentials applied to them which represent the amplitude of a complex wave form by means of a chosen code.

As shown in FIGS. 6 and 43, the coding tube is arranged to represent the instantaneous amplitudes of complex wave forms by means of a five-element binary code. It is to be understood, however, that any other type of binary code or other type of code may be employed. The greater the number of elements of the code employed the greater the number of discrete amplitudes of the incoming signal which may be represented by the code.

The aperture plate 617 of the tube may be formed as shown by the aperture plate 4317 in which the codes representing binary numbers are employed to represent a various successive amplitude of a complex signal wave. Any other suitable code may be employed such as the code disclosed in the patent application of Gray, Ser. No. 785,697 filed Nov. 13, 1947.

As shown in the exemplary embodiment set forth herein, the five output leads are connected to a synchronously operated multiplex distributing and transmission system. It is, of course, well understood that the output from each of these leads may be transmitted over a separate communication path extending to the receiving station and there employed to regenerate a complex wave form similar to that received from the terminal equipment 602. However, by means of time division multiplex systems the output of each one of these leads or terminals may be transmitted in sequence over a time division multiplex system at rapidly recurring instants of time. As is well understood, the recurrence rate should be somewhat greater than twice the highest frequency component of the signals received from the terminal equipment 602 which is necessary or desired to transmit to the distant terminal of the system.

Figure 11:
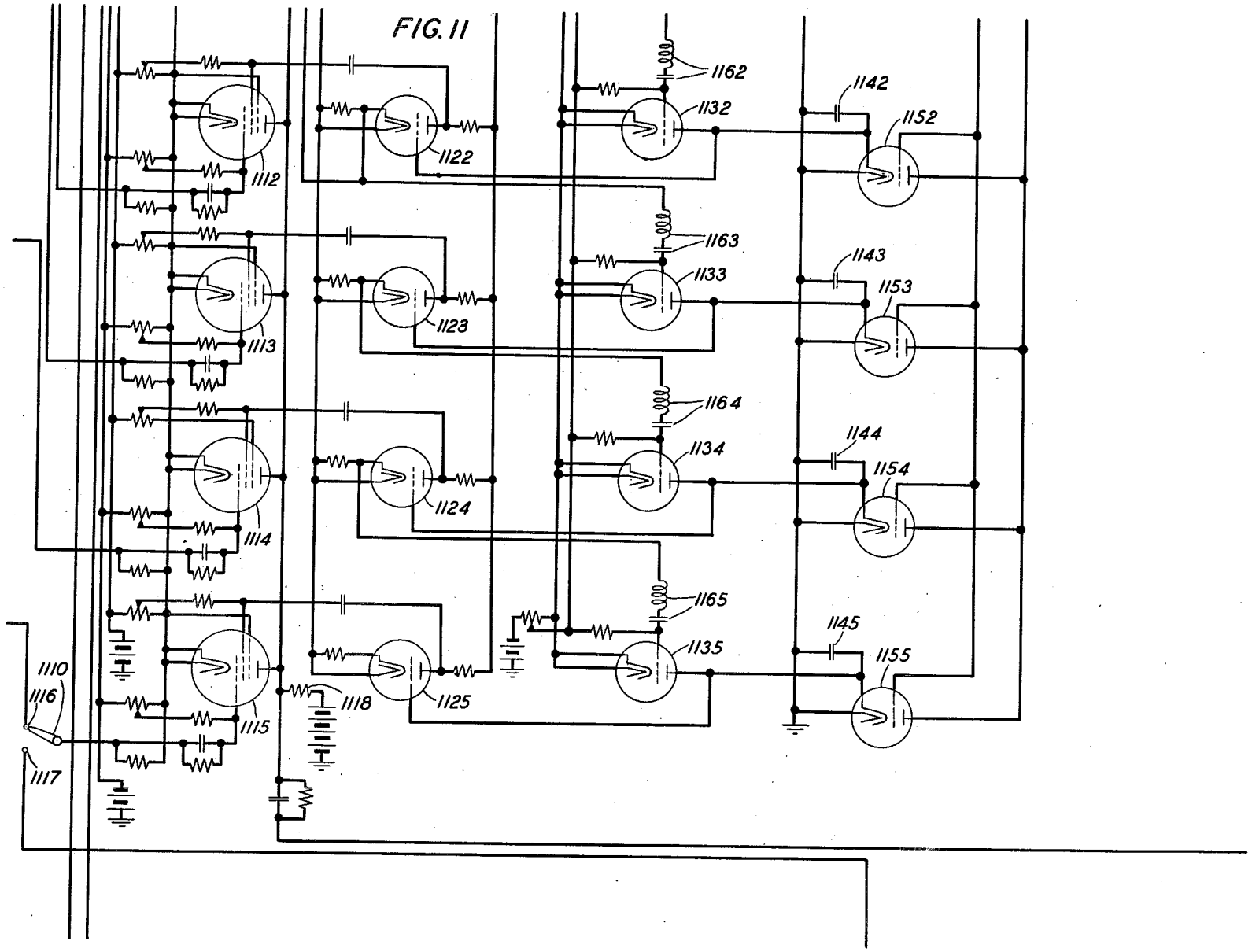
Figure 12:
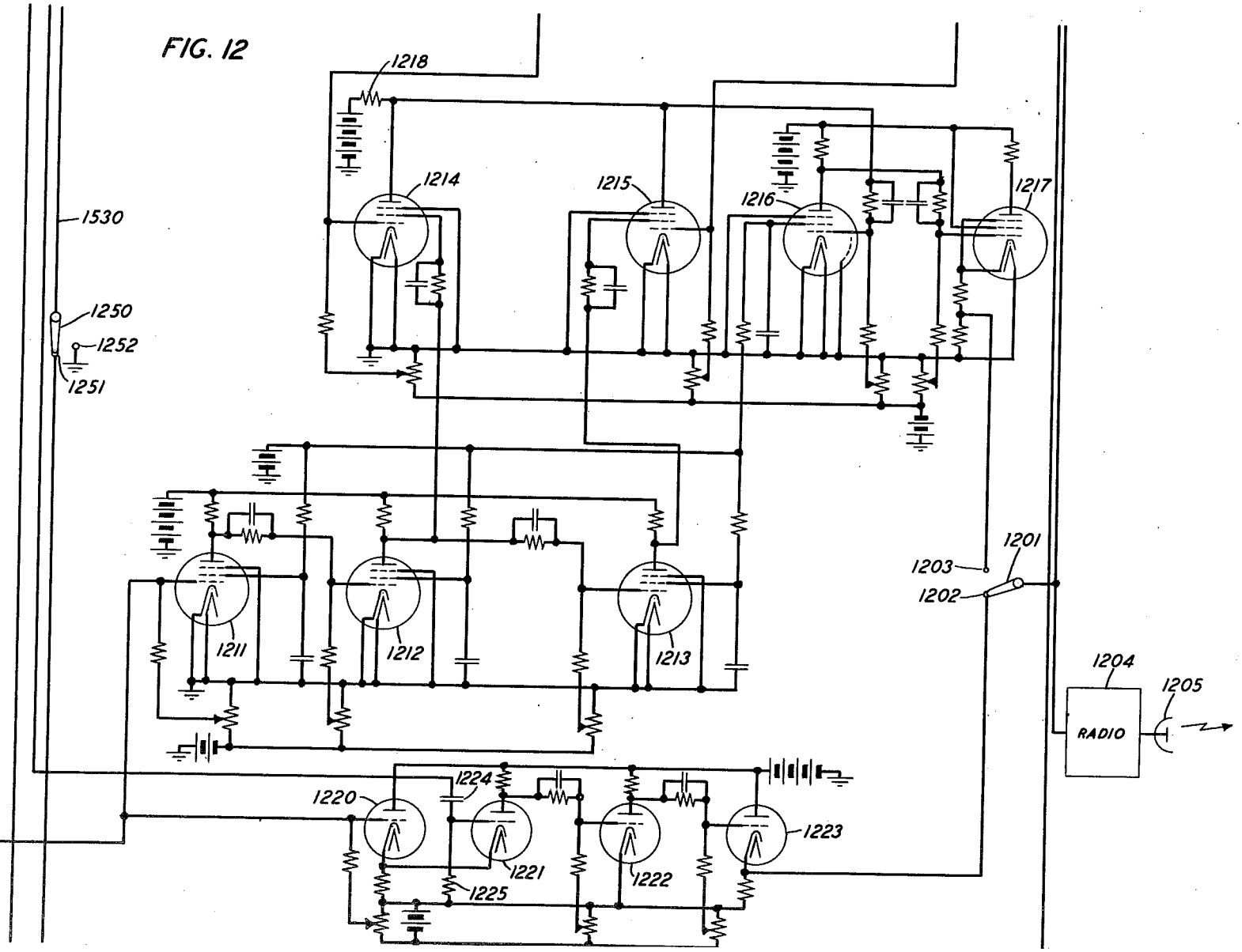

The transmitting multiplex equipment which successively transmits signals representing the output from each of the code element electrodes of tube 610 is shown in the lower half of FIG. 8 and in FIG. 11. Each row of tubes starting with tubes 811, 821, 831 and 851 of these figures is employed to transmit signals from one of the code element electrodes such as 621. The next row of tubes 1112, 1122, 1132 and 1152 is employed to transmit signals from another one of the electrodes such as 622 of tube 610, for example.

Figure 45:
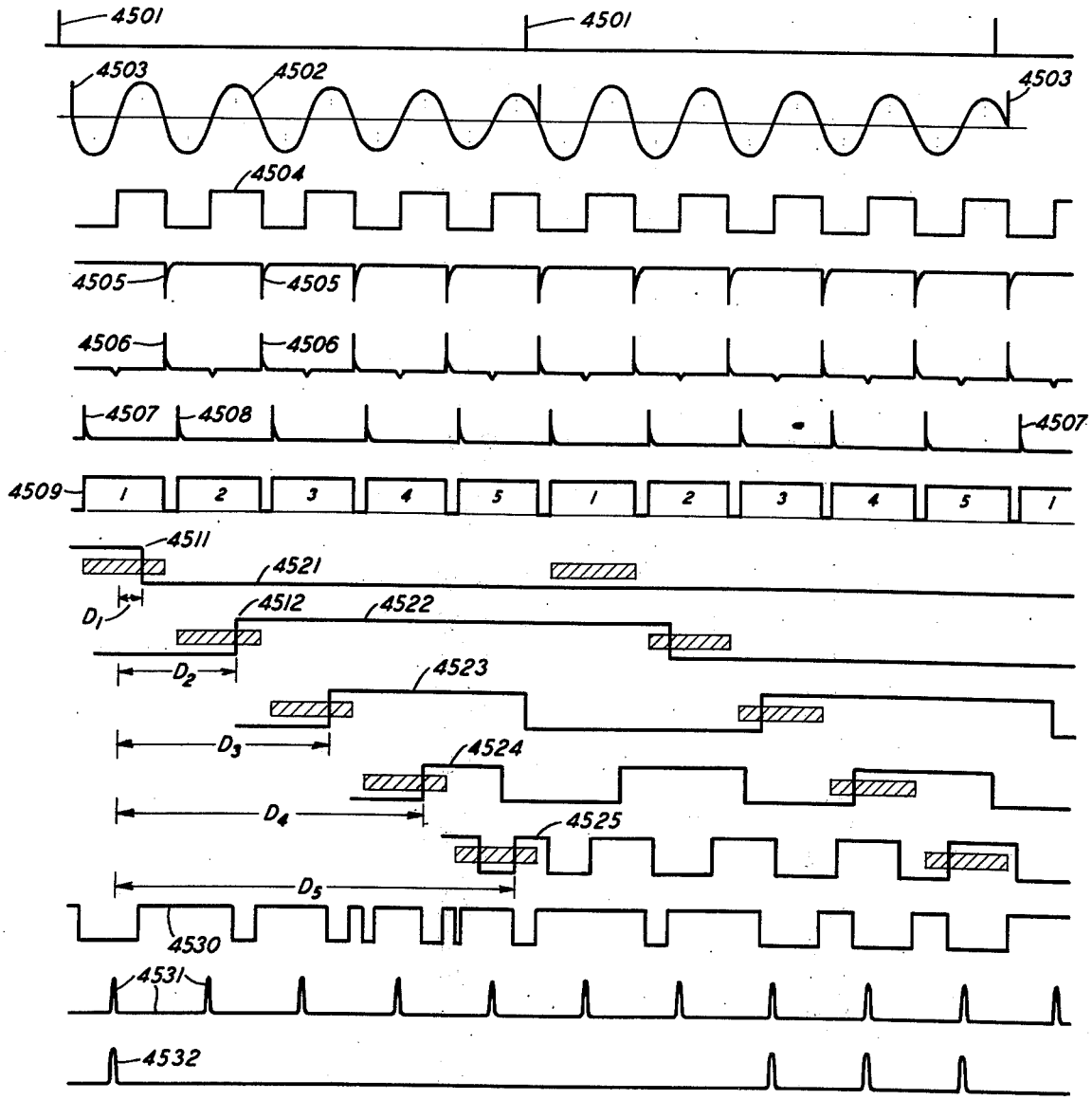

The distributor equipment shown in FIG. 8 and 11 is driven by pulses from the synchronous pulse generator shown in FIG. 5 and pulses from the code element time generator equipment shown in the upper portion of FIG. 8. A positive pulse is applied to lead 801 from the synchronous generator in FIG. 5 for each complete code combination. A negative pulse is obtained from lead 802 for each of the code elements of a complete code combination. Thus when the system arranged to transmit five-element binary permutation code signals five negative pulses are obtained from lead 802 from tube 901 for each pulse received from the synchronous pulse generating equipment over lead 801. These negative pulses are obtained by the condenser resistance combination 804 which has a low or short time constant so that the square wave is in effect differentiated and a negative pulse applied to the grids of tubes 840 and 850 each time the square wave 4504 changes from a positive value to a more negative value. The positive pulses obtained when the square wave changes in the other direction are largely suppressed by the bias conditions applied to tubes 840 and 850. The negative pulses are represented by lines 4505 and the corresponding positive pulses obtained from tubes 840 and 850 are represented by lines 4506. Furthermore, as shown in FIG. 45, the first negative pulse obtained from lead 802 is slightly in advance of the time a delayed positive pulse is applied to lead 801. The negative pulses applied to the grids of tubes 840 and 850 are repeated by these tubes 840 and 850, operating in parallel, as a positive pulse which pulse is applied to a control element of each of the tubes 851, 1152, 1153, 1154 and 1155. Tubes 851, 1152 through 1155, inclusive, operate as cathode follower tubes and cause the condensers individual to their cathode circuits 841, 1142, 1143, 1144, 1145 to become charged during the application of the positive pulse to control elements of the respective tubes. Each of these condensers becomes charged to substantially the same voltage which is a function of or substantially equivalent to the voltage or magnitude of the positive pulse applied to the control elements of tubes 851, 1152 through 1155, inclusive.

As pointed out above, the positive pulse is applied to lead 801 after the negative pulses obtained from lead 802 have terminated. The exact times at which these pulses are applied to these leads may be controlled by delay times of the delay devices 550 and 560. The pulses applied to lead 801 from the synchronous pulse generator shown in FIG. 5 are transmitted through delay device 550 and thus the delay introduced by this device controls the exact time of application of the pulses to lead 801. Pulses applied to the code element timing circuit shown in the upper portion of FIG. 8 are transmitted through the delay device 560; thus by adjusting the delay of this device the exact timing of the pulses obtained from lead 802 may be controlled.

The pulses as applied to lead 801 are delayed in time as well as in effect differentiated by the inductance and condenser circuit 861. As shown by lines 4507 these synchronizing pulses are delayed by this combination so that the grid of tube 831 will be positive after the short positive pulses 4506 applied to the grids of tubes 851, 1152 through 1155, inclusive, have terminated. The pulses applied to the control elements of the above tubes as its wave form may be controlled by the condenser resistance network 804 and by condenser 805 and the resistance 806. These networks have a short time constant. That is, the product of resistance and capacity of these networks is small so that they in effect differentiate or transmit only a very short pulse through them upon the application of a pulse or square wave to them from the previous circuit.

The application of a positive pulse to the control element of tube 831 after positive pulse applied to control element of tube 851 is terminated causes the upper terminal of condenser 841 to become discharged. The upper terminal of condenser 841 is connected to the control element of tube 821. Likewise, upper terminals of condensers 1142 through 1145, inclusive, are connected to the control elements of the respective tubes 1122 through 1125, inclusive. Thus after the application of a positive potential to the control element of tube 831 the control element of tube 821 has a relatively low voltage applied to it whereas the corresponding control elements of tubes 1122, 1123, 1124 and 1125 have a relatively high positive voltage applied to them from the corresponding condensers 1142, 1143, 1144 and 1145. The anode circuits of tubes 821 and 1122 through 1125, inclusive, are coupled to one of the control elements, frequently called the screen or screen grid, of tubes 811, 1112 through 1115, inclusive. These tubes are biased and are arranged so that they will pass substantially no anode current unless the screens of these tubes are at a relatively high positive potential. The coupling condensers between the anodes of the respective tubes 821 or 1122 through 1125 and the screens of tubes 811, 1112 through 1115, inclusive, as well as the screen resistors have a relatively long time constant; that is, the product of their capacity and resistance is relatively large compared to the duration of the signals. As a result the voltage or potential of the screen of tubes 811, 1112 through 1115, follows the potential of the anodes of the respective tubes 821, 1123 through 1125. When a positive voltage is applied to the control elements of tubes 1123 through 1125, inclusive, substantial current flows in the anode-cathode circuit of these tubes and produces a large voltage drop across the anode resistance with the result that relatively low voltage is applied to the screens of tubes 1112 through 1115, inclusive. Under these circumstances a bias voltage applied to the other elements of the tubes 1112 through 1115 is such that substantially no current will flow in their output circuits independently of the potential applied to other of the control grids such as the inner grid frequently called the control grid. However, inasmuch as a relatively low voltage is applied to the control element of tube 821 substantially no or much less current flows in the anode-cathode circuit of this tube with the result that this anode is a relatively high positive voltage. Consequently, voltage of the screen grid of tube 811 is at a sufficiently high positive voltage so that current may flow in the anode-cathode circuit of this tube depending upon the voltage of the inner or number one grid.

The application of the next pulse from the output circuits of tubes 840 and 850 to the control grids of tubes 851 and 1152 through 1155, inclusive, causes condenser 841 to be charged. In addition, condensers 1142 through 1145 are again charged to the full positive potential as controlled by the magnitude of pulses applied to the control grids of the corresponding tubes. In the case of condensers 1142 through 1145, however, the charge supplied to these condensers at this time compensates for loss due to leakage currents because the condensers are not otherwise discharged.

Upon the application of positive potential to the upper terminal of condenser 841, at this time, current again starts to flow through the anode-cathode circuit of tube 821 thus causing the voltage at the anode of this tube to fall to a relatively low value which in turn causes the screen of tube 811 to have its voltage reduced so that current can no longer flow in the anode-cathode circuit of tube 811, independently of the voltage of the control grid of this tube. That is, even though the control grid is positive, substantially no current flows in the output circuit of tube 811 at this time. The anode-cathode current of tube 821 flows through the cathode resistor of this tube as well as the anode resistor with the result that upon the initiation of a discharge through the tube 821 due to the charging of condenser 841, as described above, the voltage or potential of the cathode of tube 821 is increased.

The cathode of tube 821 is coupled through the coupling network 1162 comprising an inductance and condenser to a control element of tube 1132. This network is similar to the network 861 and causes a delayed pulse of short duration represented at 4508 of FIG. 45 to be applied to the control element of tube 1132. This delayed pulse 4508 does not terminate until after the positive pulse applied to the control elements of tubes 851 and 1152 through 1155, inclusive, is terminated. As a result the upper terminal of condenser 1142 will be discharged and increase upper current following through tube 1132. At this time tube 1122 will cause a voltage applied to the screen grid of tube 1112 to increase so that current may now flow in the anode-cathode circuit of tube 1113 under the control of the voltage applied to other control elements of tube 1112. At this time, however, the other condensers 841, 1143 through 1145, are substantially fully charged so that the screen grids of tubes 811 and 1113 through 1115, inclusive, are at a low voltage with the result that these tubes are unable to pass current in their anode-cathode circuits even though the control grid of these tubes becomes so positive as that of tube 1112 which tube will conduct current if its control grid has a positive signaling voltage applied to it at this time.

The circuits then stay in the above-described condition until another pulse is repeated by tubes 840 and 850 at which time the screen of tube 1112 again becomes more negative and the voltage applied to the screen of tube 1113 becomes sufficiently positive so that this tube will conduct anode-cathode current under control of another grid or control element thereof.

The times during which the tubes 811 and 1112 through 1115 are conditioned to conduct by having the voltage of their screen grids raised to the proper positive value is illustrated by graph 4509. The line 4511 shows the time tube 811 is conditioned to conduct, the line 4512 shows the time tube 1112 is conditioned to conduct, etc.

It is thus evident that the tubes 811, 1112, 1113, 1114 and 1115 are conditioned one after another in sequence to conduct current in their anode-cathode circuits under control of voltage applied to some other control element which is the control grid. It is also apparent that only one of these tubes may conduct current in any one given instant of time.

Each of the code element electrodes or collectors 621 through 625 of tube 610 controls the voltage applied to the control grid of the respective tubes 811, 1112 through 1115, inclusive. The path from each of the collector electrodes of tube 611 to the corresponding distributor gate tube includes repeating tubes and a delay network. For example, electrode 621 is connected to the control element of the repeating tube 711. Tube 711 is shown as a cathode-follower type of tube and is intended to represent generalized amplifier which may include voltage gain as well as the impedance transforming properties of the cathode-follower tubes actually shown. The cathode-follower tube 711 is connected to the delay line 721 and the output of the delay line is connected to the input circuit of the repeating and amplifying tube 761. The output of tube 761 is connected to the input circuit or element of the cathode-follower tube 771. The output of tube 771 is connected through switch 741 when it engages the terminal 747 as shown in the drawing to the control grid of tube 811 through suitable coupling network. The coupling network in this case includes a direct-current path and is arranged so that the voltage of the control grid of tube 811 has at all times substantially the same wave form as the wave form of the voltage at the output terminal of the delay line 721 and at the output of tube 771.

The collecting code element or electrode 622 of tube 610 is similarly connected through repeating tube 712, delay line 722, tubes 762 and 772, and switch 742 to a control grid of tube 1112. Likewise, each of the succeeding output elements of tube 610 is connected through similar repeating, delay, and switching apparatus to a control grid or element of the succeeding distributor tubes of FIG. 11.

The code elements or electrodes 611 through 615, as shown in the drawing, control the voltage or potential of the respective multiplex distributor gate tubes 811, 1112, 1113, 1114 and 1115. These connections have been so shown so that the operation of the system may be more readily understood. When desired the various code electrodes or elements of the coding tube 610 may be connected to control the various multiplex distributor gate tubes in any order or disorder that may be desired. Of course the connections at the receiving gate tubes would have to be changed in a corresponding manner.

As described above, the potentials applied to the code elements 621 through 625 of tube 610 change substantially simultaneously in response to the changes in amplitude of the applied signal wave. However, the distributor tubes 811 and 1112 through 1115 are energized successively as described above so that pulses representing the potential conditions on the code elements 621 to 625, inclusive, are sent in succession.

In order to prevent pulses which are transmitted from tubes 811 and 1112 through 1115, inclusive, from representing different code groups of pulses due to the fact that the potentials on the code elements 621 through 625 change during the time tubes 811, 1112 through 1115 are transmitting a series of pulse delay lines 721, 722, 723, 1024 and 1025 are connected between the respective code element electrodes 621 through 625 and tubes 811 and 1112 through 1115. The delay of the delay device 721 is provided to permit such initial delay as may be desired and compensate for other delays which may be encounterd in the system. The delay device 722 is arranged to provide a delay equal to the delay of delay device 721 plus the time interval between transmitted pulses, that is, the time interval between the energization of successive tubes 811, 1112, 1113, etc. The delay device 723 is provided with the delay equal to the delay of delay line 721 plus twice the interval between transmitted pulses. Simiarly, delay device 1024 is provided with a delay time equal to the delay of the delay line 721 plus three times the interval between pulses. Delay device 1025 is provided with a delay substantially equal to the delay of delay device 721 plus the time between the transmission of four successive pulses.

The delay devices 721, 722, 723, 1024 and 1025 may be of any suitable type such as transmission lines or sections, artificial lines or sections, electronic delay devices such as, for example, the type disclosed in U.S. Pat. No. 2,245,364 granted to Reisz et al on June 10, 1941, or they may be of the type employing supersonic waves such as disclosed in U.S. Pat. Nos. 1,775,775 granted to Nyquist Sept. 16, 1930 and 2,263,902 granted to Percival Nov. 25, 1941. The disclosures of all of the above-identified patents are hereby made a part of the present application as if fully set forth herein.

These delay lines may also be of the type described in an article entitled "Video Delay Lines" by Blewett and Rubel published in the Proceedings of the Institute of Radio Engineers for Dec. 1947, Vol. 35, No. 12, page 1580 through page 1584. The disclosure of the above-identified article is also hereby incorporated herein by reference to the same extent as if fully set forth.

Inasmuch as these delay devices are operated in the usual manner in cooperating with the other elements of the patented system and inasmuch as the operation of all such devices is understood in the prior art, their operation will not be described in further detail herein.

By providing these delay lines or devices with delay intervals such as described above, the series of pulses transmitted by the respective tubes 811 and 1112 through 1115 represent the potential conditions simultaneously applied to the code element electrodes 621 through 625, inclusive. Thus, except for the infrequent case wherein the potentials on code elements 621 through 625 change at substantially the exact time that these potentials will be applied in succession to the distributor tubes 811, 1112, 1113, etc., the delay networks change the pulses or voltage conditions simultaneously applied to the electrodes 621 through 625 into a series of voltage conditions occurring in sequence and applied to the control grids of other control elements of tubes 811 and 1112 through 1115, inclusive.

The outputs of anodes of the distributor tubes 811, 1112, 1113, 1114 and 1115 are all connected together and provided with a common anode resistor or impedance 1118.

When current flows in the output circuit of any one of the distributor tubes 811 and 1112 through 1115, inclusive, current also flows through the common output impedance 1118 and produces a voltage drop across this impedance. This voltage drop is applied as a negative pulse to the control element of tube 1220 and thus causes the cathode of this tube and the cathode of tube 1221 to become more negative. The control element of tube 1221 is coupled through the coupling network comprising condenser 1224 and resistor 1225 to the output of the code element timing circuit which is a wave form substantially as illustrated by graph 4504. The time constant of this coupling network is short so that the wave form illustrated by graph 4504 is in effect differentiated when applied to the grid of tube 1221. The bias applied to the control element of tube 1221 through resistor 1225 is such that the tube is normally non-conducting. When the output wave form in the code element timing circuit changes from its more positive value to its more negative value a negative pulse is applied to the control element of tube 1221. This negative pulse, however, merely tends to further cut the tube off and inasmuch as it is biased beyond cut-off, this negative pulse produces substantially no effect.

However, when the output from the code element beam circuits changes from its more negative value to its more positive value a positive pulse is applied through coupling condenser 1224 and allows tube 1221 to conduct under control of the potential applied to the control element of tube 1220. A pulse of short duration only is applied to the control element of tube 1221 due to the short time constant of condenser 1224 and the biasing resistor 1225. If the control element of tube 1220 is negative at this time due to a negative pulse received from one of the distributor tubes 811 or 1112 through 1115, current will flow in the output circuit of tube 1221 at this time. The negative pulse flows in the output circuit of this tube which pulse is amplified and repeated as a positive pulse by tube 1222. Tube 1223 acts as an output tube and causes a positive pulse to be applied through terminal 1202 and switch arm 1201 and radio transmitter 1204 and antenna 1205.

If, however, the voltage applied to the control element of tube 1220 is more positive at the time positive pulse is applied to the control element of tube 1221 in the manner described above, substantially no current flow in the output circuit of this tube. Consequently, the pulse of opposite character, that is, a spacing pulse, or a pulse of no current is transmitted to the radio transmitting equipment for transmission to the distant receiver.

The above-described operation of the transmission of the pulses to the radio system under the assumed conditions is illustrated by the graphs in FIGS. 44 and 45.

As described above, the potential of the coding element 621 at tube 610 is illustrated by graph 4421 and is negative at the time *t*1 because the beam passes through an aperture in front of the code element 621 allowing electrons to fall upon the electrode 621. This negative potential condition is repeated in tube 711 as a negative voltage which is transmitted down the delay line 721 and then repeated by tube 761 as a positive pulse. The tube 771 then repeats the positive pulse and applies it to the control element of tube 811 causing this tube to conduct current when it is rendered active. This in turn causes a negative potential in the output of the distributor which potential is then repeated as a positive pulse to the radio circuits by tubes 1220, 1221, 1222 and 1223 in the manner described above. Graph 4521 illustrates the potential applied to the control element of tube 811. This graph is similar to the graph 4421 except that it is inverted and delayed due to the delay introduced by the delay device 711. The shaded portion 4511 represents the time that the screen grid of tube 811 is rendered positive so that this tube will conduct and cause a negative voltage in the output circuit as illustrated by graph 4530. Graph 4531 represents the positive voltage applied to the control element of tube 1221 which in turn causes a positive pulse represented by graph 4532 to be applied to the radio transmitter. Graph 4522 represents the voltage applied to the control element of tube 1112 which is similar to graph 4422 except that it has been delayed by an amount of the delay in graph 4521 plus an amount equal to the time assigned to one pulse interval, that is, the time one step of the multiplex distributing equipment. Graph 4522 is likewise reversed in phase due to the operation of the repeating tube 752 similar to the operation of tube 761 described above. Likewise, the rectangle 4512 represents the time at which the screen of tube 1112 is rendered positive so that the tube is conditioned to conduct at this time. However, inasmuch as the control grid of tube 1112 is more negative no current flows in the output circuit of this tube and as a result, a negative pulse is not applied to the control element of tube 1220 so no positive pulse, i.e., no marking pulse, is transmitted to the radio transmitter at this time. Each of the succeeding graphs 4523, 4524 and 4525 is delayed by a greater delay interval so that the potential applied to the control grid of the respective distributor tubes 1113 through 1115 as well as that applied to tubes 811 and 1112 as described above at the time a positive pulse 4531 is applied to the control element of tube 1221 is controlled by or is a function of the potentials on the output electrodes 621 through 625 of the coding tube at the time *t*1. Thus, the pulses transmitted to the radio system as illustrated by graph 4532 represent the potential conditions of the electrodes 621 through 625 at the time *t*1 even though the various pulses are transmitted at progressively greater time intervals after time *t*1.

A second series of pulses corresponding to time *t*2 is also shown in the right-hand portion of the graphs of FIG. 45. The operation of the circuits is substantially as described above. It is noted that the potential conditions applied to the control elements of the gate tubes 811 and 1112 through 1115 may change time during the time tubes are rendered active by a positive voltage applied to their screens in the manner described above. However, so long as the voltage is not changed at the time pulses 4531 are applied to the control element of tube 1221 proper signals are transmitted as illustrated in the graphs.

By making the pulses 4531 applied to the control grid of tube 1221 of short duration the probability of the potentials applied to the control grids of tubes 811 and 1112 and 1115 changing at the time the pulses 4531 are applied to the control element of tube 1221 is greatly reduced.

SAMPLING THE APPLIED SIGNALING WAVE

If it is desired to prevent the potential conditions from the code element electrodes of tube 610 from changing at a time such that the codes representing the instantaneous amplitudes will be mutilated, that is, several potential conditions transmitted first in one code and then the successive pulses controlled by the potential conditions of a subsequent code, sampling circuits, storing circuits, clamping circuits and the like or combinations of these circuits may be employed, either connected between the electrodes 621 through 625 of tube 610 and tubes 711, 712, 713, 814 and 815 or similar circuits and elements may be connected ahead of the signal control and deflecting plates 615 and 614 of tube 610.

Such an arrangement is shown in FIG. 6 and comprises tubes 651, 652, 653 and 655 together with the storage condenser 654.

When it is desired to employ this sampling equipment, switch 603 is operated to the position where it engages contact 605 and switch 630 is operated to engage contact 631 as shown in the drawing. In addition switch 607 is operated to a position where it engages contact 609 instead of 608 and switch 657 engages contact 658. Under these circumstances the incoming complex signaling wave is sampled at recurring intervals of time and a charge placed upon condenser 654 which is a function of the magnitude of the incoming signal wave at the time the wave is sent.

With the switches set in the condition described above, the complex wave from the source 601 is transmitted through the terminal equipment 602, switch 603, contacts 605 and 631 to switch 630 and then to the control grid of the left-hand section of tube 652. The left-hand section of tube 652 and its anode connected in parallel with the anode of right-hand section of tube 651 to the common anode resistor 656.

The sampling circuit receives two pulses from the synchronous pulse generator shown in FIG. 5. It receives a positive pulse over lead 633 and a delayed positive pulse over lead 634. The delayed pulse over lead 634 is delayed more than the pulse received over lead 633 so that positive pulse arrives over lead 633 first. Upon the application of a positive pulse from lead 633 to the control element of tube 655 current flows in the anode-cathode circuit of tube 655 and discharges the upper terminal condenser 654.

Upon the termination of the positive pulse on conductor 633, and the application of a positive pulse on conductor 634, current flows in the anode-cathode circuit of the left-hand section of tube 651 and raises the voltage of the cathodes of both sections of tube 651 so the current flowing in the anode-cathode circuit of the right-hand section is interrupted. Normally, with switch 657 in the position shown the left-hand section of tube 651 is cut off but current flows in the right-hand section of this tube. With the right-hand section of tube 651 normally biased so that current flows through this section and thus through the anode resistor 656, the voltage of the anode of the right-hand section of tube 651 and the anode of the left-hand section of tube 652 is maintained at a relatively low value with respect to ground. However, upon the application of the delayed positive pulse to the control element the left-hand section of tube 651 from lead 634 current flowing through the right-hand section of this tube is interrupted. As a result the voltage of the plates of right-hand section of tube 651 of the left-hand section of tube 652 rises to a value controlled by the voltage of the grid of the left-hand section of tube 652 and thus to a value controlled by the instantaneous amplitude of the incoming complex wave form applied to the control grid of the left-hand section of tube 652.

The anode of the left-hand section of tube 652 is coupled through a coupling condenser to the control element of the right-hand section of tube 652. This coupling condenser together with the associated bias resistor of the control element of the right-hand section of tube 652 is provided with a long time constant so that the voltage applied to the control grid of the right-hand section of tube 652 is similar to wave form or shape of the instantaneous voltage of the anode of the left-hand section of tube 652.

As a result, the grid of the right-hand section of tube 652 upon the application of the delayed pulse to conductor 634 rises to a more positive voltage which is a function of the instantaneous amplitude of the received complex wave form at this time. The cathode of the right-hand section of tube 652 tends to follow the potential of the control element of the right-hand section of this tube with the result that the upper terminal of condenser 654 is charged to a positive potential at this time which potential is a function of the instantaneous amplitude of the complex wave received from source 601 through the terminal equipment 602. Upon the termination of this delayed pulse, the right-hand section of tube 651 again starts to conduct current and causes the voltage of the anodes of right-hand section of tube 651 and the left-hand section of tube 652 to again fall to a low value which in turn causes the grid of the right-hand section to fall to a low voltage below the voltage of the cathode of this tube with the result that current ceases to flow in the anode-cathode path of this section. Consequently, the charge on the upper terminal of condenser 654 is maintained at substantially the value of the instantaneous amplitude of the complex wave at the time the negative pulse applied to conductor 634 terminates.

Tube 653 operates as a cathode-follower tube and has its control element connected to the upper terminal of condenser 654. As is well understood in the prior art cathode-follower tubes have a very high input impedance so that the input circuit of this tube will not materially change the voltage of the upper terminal of condenser 654. However, the cathode of tube 653 is maintained at a voltage which is a function of and very nearly equal to the voltage of the upper terminal of condenser 654. Thus, the voltage applied to the deflecting plates 613 and 614 of the cathode-ray tube remains substantially constant between the sampling intervals and remains at a value which is a function of the instantaneous amplitude of the applied complex wave at the time this wave was last sampled. The remaining portion of the transmission circuit operates as described above and causes pulses representing this amplitude to be transmitted in the manner described above. It is to be understood, of course, that the sampling time and thus the time of occurrence of the positive pulse applied to lead 633 and the delayed pulse applied to lead 634 is chosen, by adjustment of the delay device 561 and delay devices 721, 722, 723, 824 and 825, at such a time that the potentials of the code element electrodes 621 through 625, inclusive, of tube 610 remain constant and do not change at the time these potentials control the transmitted pulses.

Figure 47:
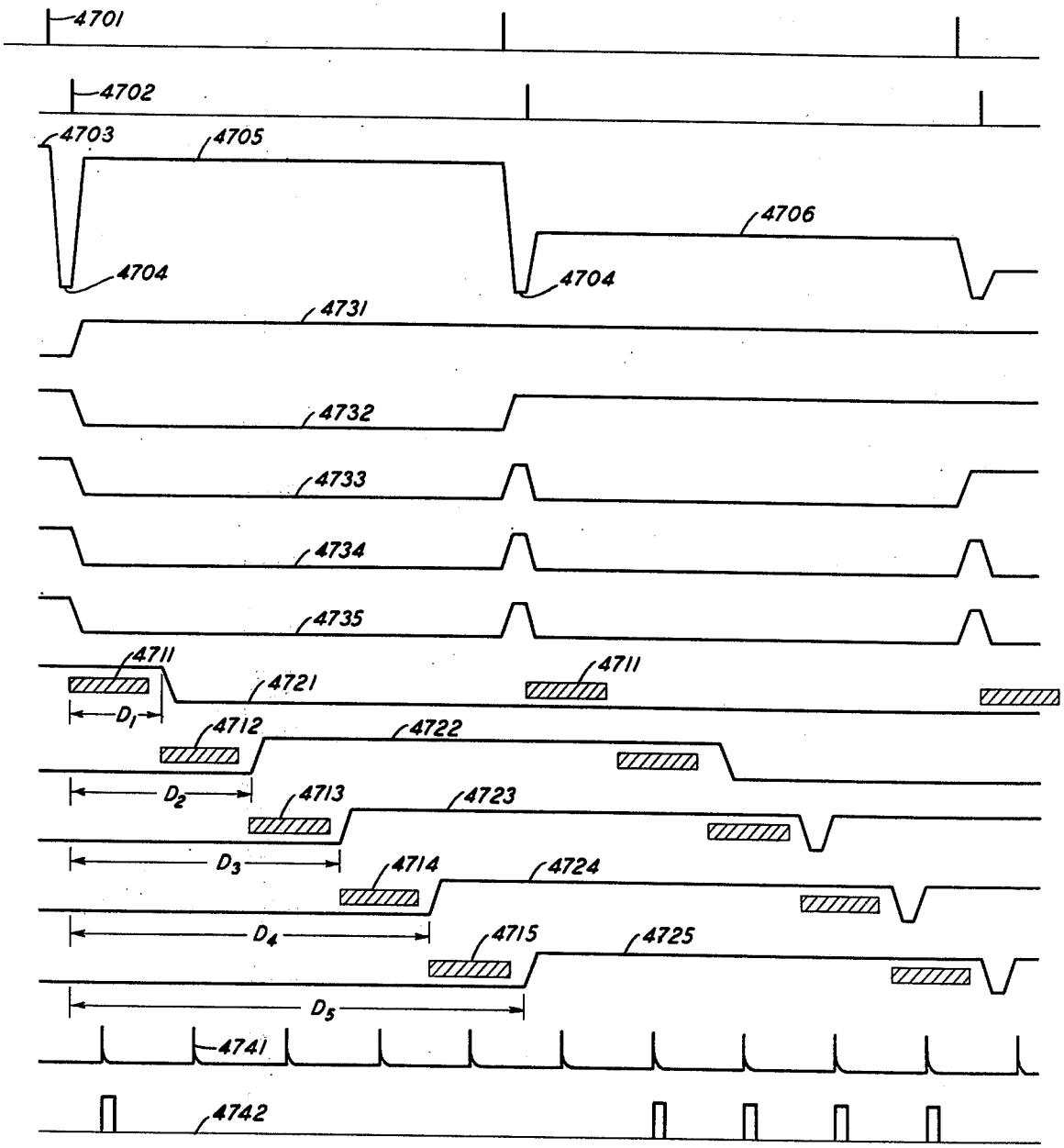

The above-described operation of the sampling circuits are further illustrated by the graphs of FIG. 47. The graph 4701 illustrates the undelayed positive synchronizing pulses from the cathode of tube 520. Graph 4702 illustrates the delay synchronizing pulses from the cathode of tube 520 after they have been transmitted through the delay device 561 and applied to the control element of the left-hand section of tube 651.

As described above when positive pulses are applied to the control element of tube 655 which are the undelayed pulses, they cause the storage condenser 654 to become discharged.

For purpose of illustration it has been assumed at the previous sampling time the storage condenser 654 was charged in response to a signal amplitude of 16 units. This charge is represented by the portion of the graph designated 4703. Upon the application of the undelayed pulse 4701 to the control element of tube 655, condenser 654 is discharged to a zero or reference value indicated by 4704 in FIG. 47.

Then upon the application of the delayed pulse such as represented by 4702, to the control grid of the left-hand section of tube 651, assuming of course that switch 657 is operated to the position shown in FIG. 6 where it engages contact 658, condenser 654 is charged under control of the amplitude of the applied signaling wave which, as shown in FIG. 44, has an amplitude of 15 units. This amplitude is represented by the portion of the graph designated 4705 in FIG. 47.

Upon the reception of the second undelayed synchronizing pulse condensers again then discharge to zero or reference value 4704 and upon the reception of the second delay synchronizing pulse 4702, condenser is recharged, this time to a value of 7 units because as shown in FIG. 44 the applied wave has the magnitude of 7 units of amplitude at the second sampling time $t2$.

The graphs 4731 to 4735 inclusive, show potential conditions of the output code electrodes or elements of the coding tube 610. Thus under the assumed conditions, the graph 4731 represented the potential conditions on the output electrode 621 of the coding tube. Likewise graph 4732 represents the potential of the code element 622, etc.

Under the assumed conditions prior to the reception of the first undelayed synchronizing pulse 4701, the previous sample had an amplitude of 16. In other words, the electron beam passed through an aperture in the column 4331 of the tube and caused the corresponding electrode 621 to become more negative as shown in graph 4731. For an amplitude of 16, the beam does not pass through any of the other code apertures so that all of the other code elements or electrodes of the tube 610 are at a more positive value as illustrated by the graphs 4731 to 4733 prior to the reception of the synchronizing pulse 4701. After the delay synchronizing pulse has been applied to the system the sample stored on condenser 654 has been assumed to represent 15 units of amplitude. This time electron beam does not pass through an aperture in column 4331. It does pass through apertures in the remaining columns 4332 through 4335. As a result, the potential of the electrode 621 becomes more positive while the potentials of the remaining coding electrodes 622 through 625 assume their more negative value. Thereafter these potentials are maintained at these values until the second undelayed synchronizing pulse is applied to the sampling equipment of FIG. 6.

After the second delay synchronizing pulse is applied, the condenser 654 is charged to a value representing 7 units of amplitude of the applied signal wave. Consequently, the beam will pass through apertures in columns 4723 through 4725 inclusive, but will not pass through apertures in columns 4321 and 4322. As a result, the electrodes 621 and 622 assume their more positive value while the remaining electrodes 623, 624 and 625 assume their more negative values until the third undelay synchronizing pulse is applied as illustrated in FIG. 47.

As described above, the potentials of the output code element electrodes of tube 610 are employed to control the potentials applied to the control grids of tubes 811 and 1112 through 1115 inclusive. However, the potentials applied to these control grids are reversed or opposite to the potentials of the control electrodes of tube 610 and in addition are delayed by the respective delay networks 721, 722, 723, 824 and 825. As a result, the potentials applied to the control grids of the distributor gate tubes 811 and 1112 through 1115 inclusive are illustrated by the graphs 4721 to 4725. In these graphs the various delays due to the respective delay lines enumerated above, are illustrated by the delay time D-1 through D-5 inclusive. A plurality of rectangles are drawn adjacent to graphs 4721 to 4725. These rectangles represent times during which the respective distributor gate tubes 811 and 1112 through 1115 are rendered active by having a sufficiently high positive voltage applied to their screen grids or other control elements. Thus the rectangles 4711 represent the times during which the gate tube 811 may conduct current under control of the control grid thereof. Rectangle 4712 shows the times during which tube 1112 may conduct current, etc.

The times during which the various respective graphs 4721 through 4725 inclusive are positive when the respective distributor gate tubes are rendered active, the corresponding gate tubes conduct current as described above. Consequently when the timing pulses 4741 are applied to the control element of tube 1221, positive pulses are transmitted to the radio equipment in the manner described above. These pulses are illustrated by graph 4742.

It is also evident that if the delay lines or the other delay devices 721, 722, 723, 824 and 825 are provided with longer delays, the significant time during which the ptoential on the code elements 621 to 625 is employed to control the transmitted pulses may be shifted as desired. As shown in FIG. 47, the portions near the end of each sampling period are employed so that the various circuits may have ample time to assume their proper steady state conditions.

It is also evident that the control electrodes of the coding tube 610 cannot change during the time during which these potentials are employed to control the transmitted signals. Also the potentials of the output code element electrodes of tube 610 at predetermined and specific instants of time, which instants of time are the same and simultaneous for all of the code element electrodes, control the transmission of pulses in sequence.

As shown in the drawing, the signals are transmitted from radio antenna 1205 to the receiving antenna 2901. This radio path may be of any suitable frequency including the ultra-short wave or high frequency radio path wherein the radio waves exhibit many of the properties of light. The radio path and the antenna structures may include suitable reflectors, lenses and other related types of transmission equipment.

While the radio path is shown in the drawing it is to be understood that any suitable type of transmission path or medium may be provided including coaxial lines, wave guides or other cable circuits capable of transmitting the desired frequency range. These paths may include any and all necessary or desirable repeater stations, amplifiers, transmission control equipment, and other auxiliary equipment useful in cooperating with the various types of transmission paths. The transmission path from the transmitting equipment 1204 to receiving equipment 2902 may be similar to the synchronizing path 501 or it may be of a different type as shown in the drawing or pointed out above, or these paths may include any combination of the various types of paths when it is so desired.

Inasmuch as the transmission equipment of both the signals and the synchronizing equipment operate in their usual and well-understood manner detailed descriptions of representative types need not be repeated in the present application. It is understood, of course, that this equipment operates in its normal and usual manner in cooperating with the other elements of the exemplary system embodying the present invention.

The radio waves from the transmitting antenna 1205 are received by the receiving antenna 2901 and then transmitted through the radio receiver 2902. The radio receiver 2902 generates pulses similar to those applied to the radio transmitter 1203 and applies these pulses to the adjustable delay device 2903. The delay device 2903 may be similar to any of the other delay devices described herein and is provided so that the time of transmission from the transmitting station to the receiving station may be adjusted so that the synchronizing equipment at the two stations may be common to a number of different paths between the two stations in question as well as common to paths between the receiving station and other stations when it is desired.

From the adjustable delay device 2903 the signals are applied to the control element of the amplifying tube 2904 which amplifies and shapes the received signals and repeats them in its output circuit to switch 2910. With the switches 2910 and 2923 set in the positions shown in the drawing wherein switch 2910 engages contact 2912 and switch 2923 engages contact 2925 the signals are transmitted from the output circuit of tube 2904 to the cathodes of the receiving distributor tubes 2811, 2812, 3013, 3014 and 3015 which cathodes are connected in parallel into the output circuit of tube 2904 through the switches 2913 and 2910 as described above.

Tubes 2811, 2812, 3013, 3014 and 3015 are part of a receiving time division multiplex distributor similar to the distributor described at the transmitting station. This distributor comprises five groups of tubes. The first group comprises tubes 2751, 2752, 2953, 2954 and 2955. This group of tubes is supplied by code element timing pulses from tubes 2740 and 2750. In the specific embodiment of this invention set forth herein five tubes are provided in each group so that five code element timing pulses are supplied to tubes 2740 and 2750 for each complete code combination of pulses. These pulses are supplied from the code element timing generator shown in the upper portion of FIG. 27 which operates in the manner similar to the arrangement shown in the upper portion of FIGS. 8 and 9. As in the case of the transmitting distributor tubes 2740 and 2750 received negative pulses from the cathode circuit of tube 2710 and repeat these pulses as positive pulses in their common output circuits which positive pulses are applied to the code element of tubes 2751, 2752, 2953, 2954 and 2955. The above series of tubes 2751 through 2955 are normally biased so that no current flows in their anode-cathode circuits. However, upon the application of a positive pulse to the control elements of all of these tubes in parallel a positive voltage is applied to the left-hand terminal of the respective condensers 2741, 2742, 2943, 2944 and 2945. The magnitude of this voltage is a function of the magnitude of a positive pulse applied to the control elements of the respective tubes 2751 through 2955, inclusive.

At the termination of the positive pulse the tubes 2751, 2752, 2953, 2954 and 2955 all become non-conducting so that they do not further affect the voltage or charge on the left-hand terminals of the respective condensers 2741, 2742, 2943, 2944 and 2945.

Figure 26:
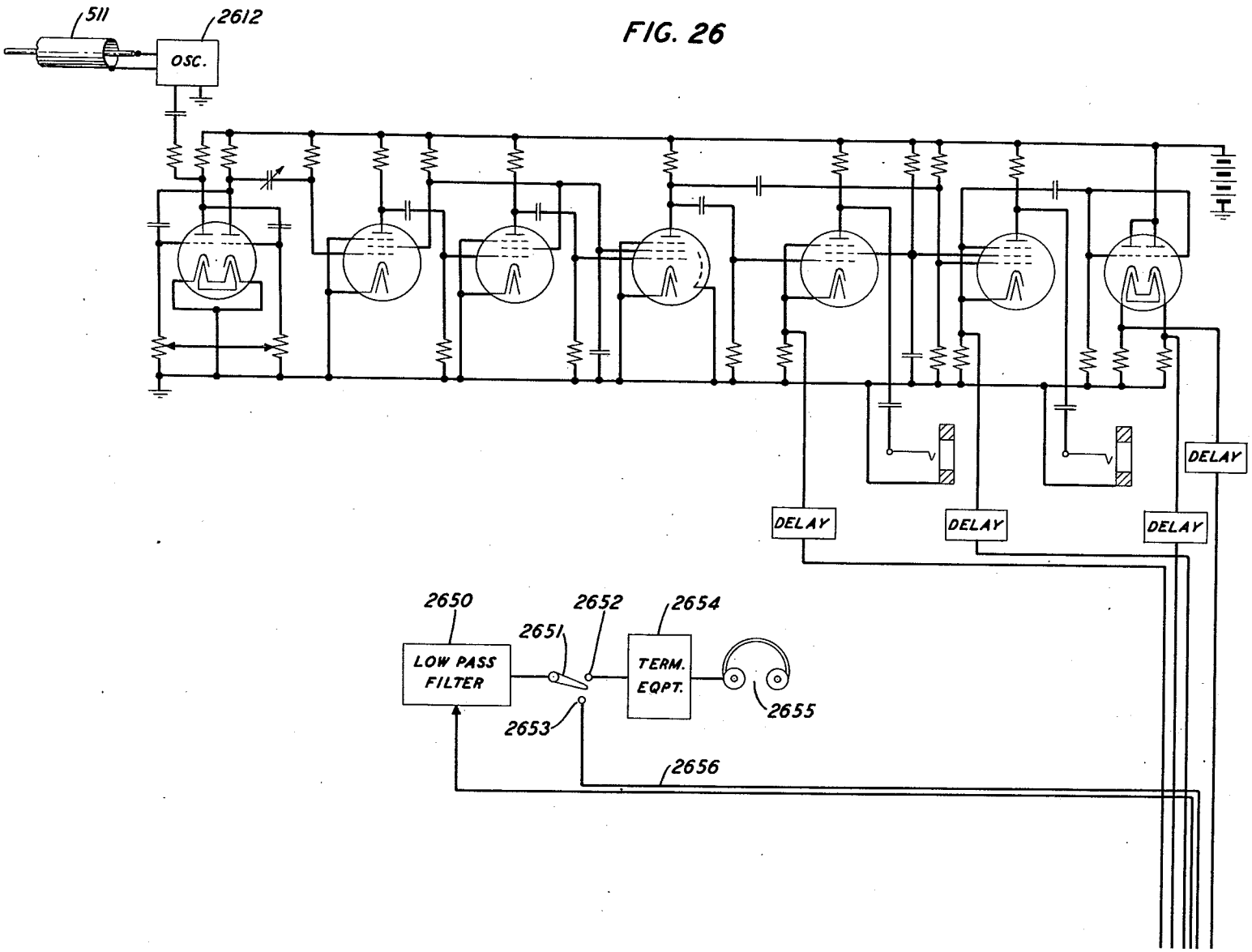
Figure 27:
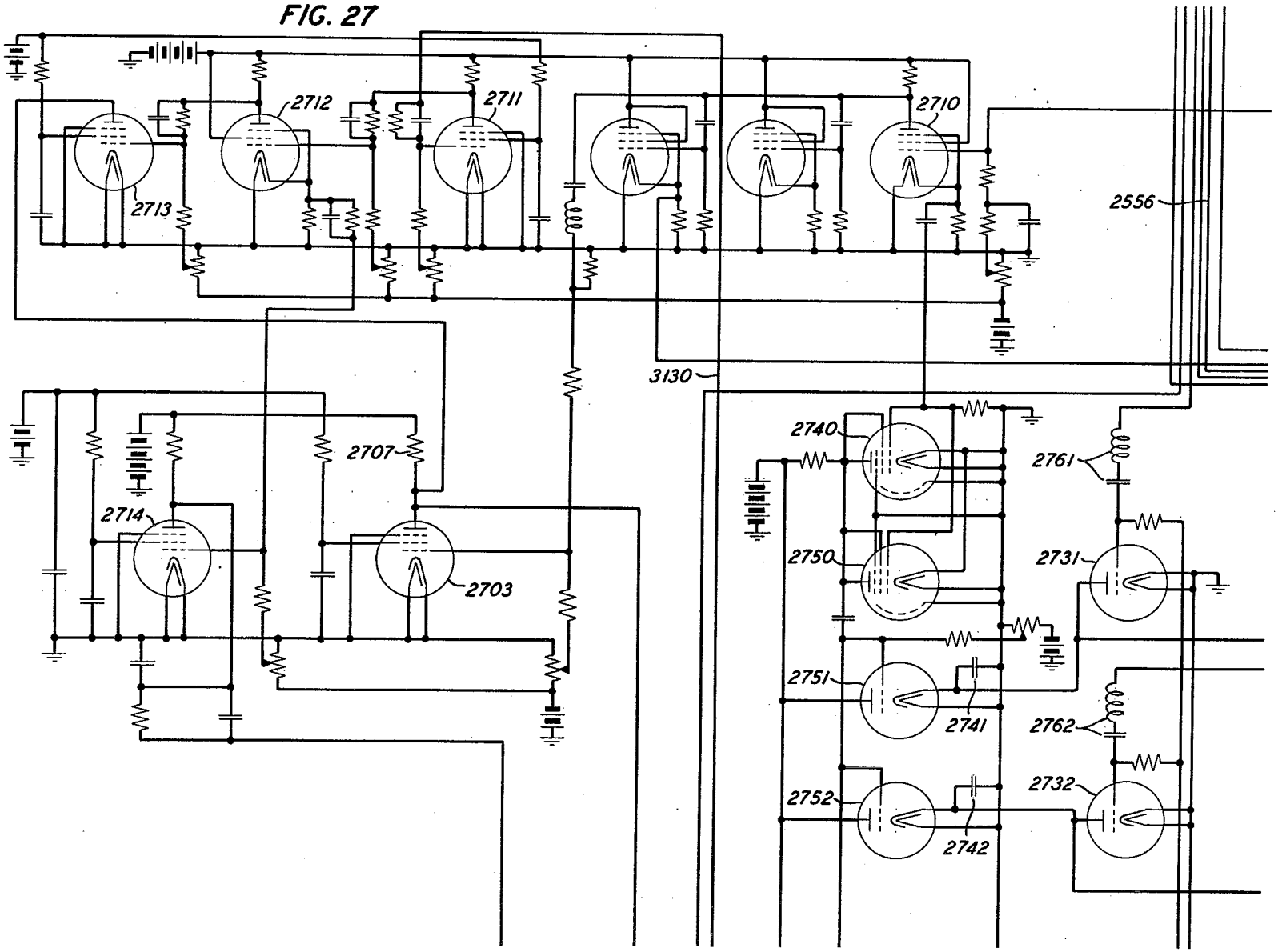

In addition to the pulse received from the common control and synchronizing circuits a positive pulse is received from the synchronizing circuit of FIG. 26 for each complete code group of signals. This pulse is applied to the control element of tube 2731 through the delay network comprising inductance and condenser 2761.

The simple delay network shown in the drawings usually will be satisfactory. However, if long delays are required this delay network may assume a more complicated and complex form. This delay network is provided so that the positive synchronizing pulse will be applied to the control element of tube 2731 at about the time the negative pulse, which is applied to the control elements of tubes 2751 through 2955, terminates. As a result the application of the positive potential to the control element of tube 2731 causes current to flow in its anode-cathode circuit which current discharges the left-hand terminal of condenser 2741 and thus reduces its voltage. The voltages of the left-hand terminals of the remaining condensers 2742, 2943, 2944 and 2945 remain at their previously charged relatively high value because no positive pulse is applied to the control elements of the respective tubes 2732 and 2933 through 2935.

The left-hand terminals of all of these condensers are connected to a control element of the respective tubes 2821, 2822, 3023, 3024 and 3025. Upon the charging of the above series of condensers to a positive voltage current flows through the anode-cathode circuits of the respective tubes 2821, 2822, 3023, 3024 and 3025. However, upon the discharge of condenser 2741 as described above the current flowing through tube 2821 is interrupted because voltage of the left-hand terminal condenser 2741 is reduced below the cut-off voltage of tube 2821.

The anode circuits of the respective tubes 2821, 2822, 3023, 3024 and 3025 are coupled to one of the control elements of tubes 2811, 2812, 3013, 3014 and 3015.

Tubes 2811, 2812, 3013, 3014 and 3015 have biasing potentials applied to their various electrodes and control elements such that these tubes normally do not pass current in their anode-cathode circuits. In order for current to flow in their anode-cathode circuits of these tubes it is necessary that additional voltages be applied as follows: (1) a more positive potential be applied to the first grid or control element, and (2) a more negative voltage to be applied to the cathode as shown in the drawing. If only one of these two additional voltages is applied to the elements in the manner described herein no current will flow in the output circuit of the respective tube. However, if such additional potentials are applied to both of these elements current will flow in the output circuit of these tubes.

When current is flowing in the anode-cathode circuits of the respective tubes 2821, 2822, 3023, 3024 and 3025 the potential of the anodes of these tubes and thus the potentials of the control grids of tubes 2811, 2812, 3013, 3014 and 3015 are reduced to a sufficiently low value so that no current can flow in the output circuits of any of these tubes. However, when the current flowing in the output circuit of any one of these tubes 2821, 2822, 3023, 3024 and 3025 is interrupted, the voltage of the anodes of these tubes and thus the voltage of the control grids of the respective tubes 2811, 2812, 3013, 3014 and 3015 rises so that if and when the voltage of the cathode of these tubes is made more negative current will flow in the output circuit of the respective tubes. Thus when the current flowing through tube 2821 is interrupted in the manner described above, the voltage applied to the control element of tube 2811 is such that current may or may not flow in the output circuit of tube 2811 depending upon whether or not a received marking signal is applied to the cathode of this tube from the amplifier tube 2904. If the cathode of tube 2811 is made more negative at this time in response to the received pulse of the proper character current will flow in the output circuit of tube 2811. If on the other hand the received pulse is of the opposite character no current will flow in the tube 2811.

The pulse of current flowing in the output circuit of tube 2811 when the received pulse is of the proper polarity is a negative pulse and is repeated by the cathode follower or repeating tube 2871 and applied to the delay device 2881.

Thereafter upon the application of the next negative code element timing pulse of tubes 2740 and 2750 a positive pulse is repeated to the control elements of tubes 2751, 2752, 2953, 2954 and 2955 which pulse causes the left-hand terminal of condenser 2741 to be charged again to a relatively high positive voltage and any charge which may have leaked off to condensers 2742, 2943, 2944 and 2945 to be replaced so that these condensers will again be charged to their full positive value.

The application of a positive voltage to the left-hand terminal on condenser 2741 applies a positive voltage to the control element of tube 2821 which in turn causes current to flow in the anode-cathode circuit of tube 2821. This voltage reduces the voltage of the control grid of tube 2811 so that the voltage applied to the control element of tube 2811 is below the value required to cause current to flow in the output circuit of this tube independently of the signal voltage applied to the cathode of this tube. Thereafter the 2811 is unable to pass current in its anode-cathode circuit until a next code combination is received in the manner described above. When current starts to flow in the anode-cathode circuit of tube 2821 the voltage of the cathode of tube 2821 becomes more positive. This more positive voltage is applied through a delay and shaping network 2762 such that at the termination of negative pulse applied to the control elements of tubes 2740 and 2750 a positive pulse of short duration is applied to the control element of tube 2732 which voltage causes current to flow in the anode-cathode circuit of tube 2732 and discharge the left-hand terminal of condenser 2742. As a result, current flowing through tube 2822 is interrupted and a proper potential applied to the control element of tube 2812 to permit current to flow in the output circuit of this tube under the control of the received signaling pulses. If a received signaling pulse at this time is of a proper polarity or character the pulse of current will flow in the output circuit of tube 2812. This pulse is repeated by tube 2872 and applied to the delay device 2882. Upon the termination of this pulse and due to the application of another pulse from the code element timing circuit to tubes 2740 and 2750 the distributor is advanced in the manner described above so that a pulse will be applied to the delay device 3083 if the proper polarity pulse is received at this time. In this manner the succeeding pulses are distributed through the receiving distributor to the delay devices 2384 and 2385. Thereafter another pulse will be applied to the control grid of tube 2731 in the manner described above and another series of pulses applied to the delay devices 2881, 2882, 3083, 3084 and 3085, and the above-described action repeated at a high rate of speed controlled by the synchronizing equipment.

The delay devices 2881, 2882, 3083, 3084 and 3085 are all designed with different delay times such that the sum of the delay times of these devices and the corresponding delay devices at the transmitting station is constant. In other words, the sum of the delay time of the delay devices 721 and 2881 is the same as the sum of the delay times of the delay device 722 and the delay device 2882. Likewise, the sum of the delay times of the delay devices 723 and 3083 is the same as the delay times of the sums of the other delay devices. As a result, the outputs of the delay devices change substantially simultaneously under the control of the change in potential applied to the coding elements 621 through 625 of the coding tube 610. In other words, the instantaneous amplitude of the transmitted signals is represented by the potentials simultaneously applied to the coding elements 621 through 625 of tube 610 has been transferred or transmitted to receiving station where corresponding potentials are substantially similarly simultaneously applied to the output terminals of the delay devices 2881, 2882, 3083, 3084 and 3085.

Assume first that the switches 2807, 2831, 2832, 3033, 3034, 3035, 2861, 2862, 3063, 3064 and 3065 are positioned in the position shown in the drawing. Under these circumstances the potential conditions from the output of the delay devices 2881, 2882, 3083, 3084 and 3085 are applied to the control elements of the respective tubes 2891, 2892, 3093, 3094 and 3095.

As shown in FIG. 43 the target 4317 in an exemplary tube embodied in the system set forth herein has apertures out in it in accordance with the binary code or binary number system. For the lowest magnitude of signal with the beam depressed toward the bottom edge of the aperture plate 4317 will find no apertures thus applying no potentials to the code element electrodes 4321 through 4325. As the beam is raised it will pass through an aperture in column 4335 thus applying a potential to the electrode 4325 thus indicating one unit of signal amplitude above the lowest level. As the beam is further raised it will pass through an aperture in column 4334 and through no other aperture. This indicates that the beam is at the second level above the lowest level at which time potential is applied to the code element electrode 4324. As the beam is still further raised it will pass through apertures in both columns 4335 and 4334 and apply corresponding potentials to the electrodes 4325 and 4324 thus indicating that the beam is at the third position above the lowest level. At the fourth position above the lowest position the beam will pass through an aperture of column 4333. In similar manner the target plate 4317 is provided with additional aperture through which the beam may pass in accordance with binary number system and causes potentials to appear on the code electrodes which are in accordance with represented corresponding binary numbers. In other words, the electrode 4325 represents the units digit or denomination of the binary number, the electrode 4324 represents the next succeeding digit and so on. As is well understood in binary number systems, these digits can have only one of two values, either zero or one. When these digits have zero, no potential other than the biasing potential is applied to the corresponding code element electrodes 4321 through 4325. However, when the value of the digit is one, a signal potential differing from the bias potential is applied to the corresponding electrodes 4321 through 4325. As is also understood in binary number systems, the digit of one in the units position represents a magnitude of one in the number digit of one, in the second position represents a magnitude two, digit one in the third position represents a magnitude four, digit one in the fourth position represents a magnitude of eight and a digit one in the fifth position represents a magnitude of sixteen. In this manner by combining various ones of these digits it is possible to represent all magnitudes including zero up to and including thirty-one. If additional digits are provided it is, of course, possible to represent a greater number of magnitudes.

At the receiving station, it is necessary to weigh each of the pulses representing these digits by the proper or corresponding values and combine or add them together.

Such an arrangement is disclosed at the receiving station. The output circuit of tubes 2891, 2892, 3039, 3094 and 3095 is arranged to properly weigh and combine the output of these tubes so that the combined output will be a function of the magnitude represented by the signaling pulses of each code combination and thus a function of the magnitude of the instantaneous amplitude of the applied signaling wave at the transmitting station at the time its amplitude is sampled and/or coded.

Tubes 2891, 2892, 3093, 3094 and 3095 are all biased so that they are normally conducting their maximum current. As a result, the voltage drops across anode resistors 3055, 3054, 3053, 2852 and 2851 are all a maximum value with the result that the anode of tube 2891 has a minimum voltage applied to it in the absence of any received marking pulses.

As pointed out above, the character of the signaling condition in the units digit is controlled by electrode 4325 of the tube shown in FIG. 43 or by the electrode 625 of tube 610 and when marking, for example, represents one unit of amplitude of the applied complex signaling wave. Thus, when this pulse is of marking character for example, it represents one unit in the magnitude of the applied signal wave. The pulses of this signaling condition are transmitted to the receiving stations and applied to the control element of tube 3095. As pointed out above, the marking pulses are applied to the control element of tube 3095 as pulses of negative voltage. Consequently, these pulses tend to reduce the current flowing through tube 3095. This variation of voltage applied to the control element of this tube is such that the reduction of current flowing through tube 3095 causes an increase voltage across the anode resistor 3055 which increase represents one unit of amplitude of the complex wave. If no other changes in current flowing through any of the other tubes 2891, 2892, 3093, 3094 are made, then the voltage of the anode of tube 2891 will rise by one unit of signal amplitude.

When a marking pulse corresponding to the second position of the binary number is received in response to the application of a signal wave of two units of amplitude applied to the coding equipment at the transmitting station or in which the amplitude applied to the coding equipment at the transmitting station is represented in part by the marking pulse in the second position, this pulse is distributed to the control element of tube 3094 in the manner similar to that described above and appears as a negative pulse as applied to the control element of this tube. The negative pulse causes current to decrease through tube 3094, which current also was previously flowing through the anode resistors 3054 and 3055. This decrease in current flowing through these resistors causes a voltage drop across the resistors to decrease with the result that a voltage of the anode of tube 2891 increases. The biasing and other potentials applied to tube 2894, together with the magnitude of the anode resistors 3054 and 3055, is such that the rise in voltage of the anode of tube 2891 under these circumstances, assuming no other marking pulses are applied to any of the other tubes, is equivalent to two units of signal amplitude.

If a marking pulse is received in both the units position and the next position, these two pulses represent a signal amplitude of three units of the signaling wave. When these pulses are applied to the control elements of tubes 3095 and 3094, they each produce a decrease in current through the respective tube in above-described amounts so that the rise in potential of the anode of tube 2891 will be the sum produced by the change in currents to the respective tubes or, in other words, the three units under the assumed conditions.

When a negative pulse is applied to the control element of tube 3093, it causes a decrease in the current flowing through the resistors 3053, 3054, and 3055 and produces a voltage rise across these resistors which when measured at the anode of tube 2891 is equivalent to four units of amplitude of the applied signal wave. Similarly, the decrease of current flowing in the output circuit of tube 2892 and through the resistors 2852, 3053, 3054 and 3055, causes a voltage rise across all of these resistors which is eight units of amplitude of the complex wave form. In addition, the decrease in current flowing through tube 2891 in response to a marking pulse which is a negative pulse as applied to the control element of tube 2891, causes an increase in voltage of the anode of tube 2891 which is sixteen units of amplitude of the complex wave form.

Furthermore, as pointed out above, due to the operation of the delay devices 2881, 2882, 3083, 3084 and 3085, the respective pulses of each code group are all applied substantially simultaneously to the control elements of tubes 2891, 2892, 3093, 3094 and 3095. Consequently, the voltage changes as described above due to the negative pulses applied to the control elements of the above-enumerated tubes are all applied substantially simultaneously, consequently, the output voltage, that is, the voltage of the anode of tube 2891 due to the change in current flowing through the resistors 2851, 2852, 3053, 3054, and 3055 are all added together since the change takes place substantially simultaneously through all of the tubes and all of the resistors are connected in series. In other words, the voltage at the anode of tube 2891 is caused by the sum of the voltage drops in the anode circuits of the other tubes. As a result, the voltage at the anode of tube 2891 when the signaling pulses are applied to the tubes 2891, 2892, 2893, 2894 and 2895 is a function of the amplitude of the complex wave form represented by the pulse code group applied to the control elements of the above-enumerated tubes.

The anode of tube 2891 is coupled to the grid of tube 2829 which tube, with switch 2807 engaging contact 2808, operates as a repeating tube and repeats the pulses from the output circuit of tube 2891 to the low-pass filter 2650 which low-pass filter removes the high frequency components of the applied pulses and, in effect, reconstructs the complex wave form of the signaling wave applied to the system at the transmitting station.

When switch 2651 is moved in contact with terminal 2652, the reconstructed output wave form is transmitted through the terminal equipment 2654 to a receiving device 2655.

Figure 48:
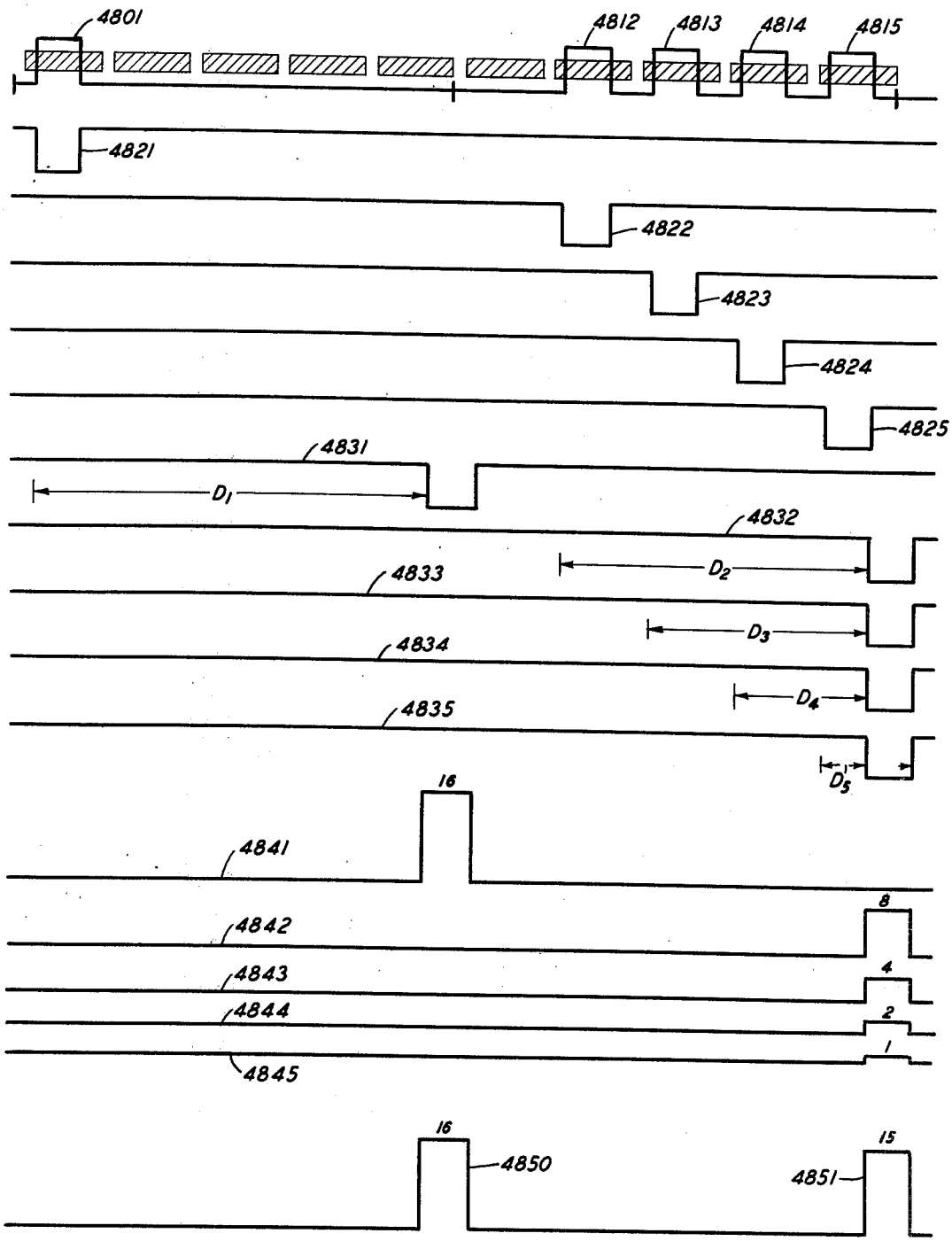

The operation of the receiving and decoding equipment is further illustrated by the graphs shown in FIG. 48. The first graph represents typical received pulses and shows two code groups of pulses similar to the pulses transmitted from the transmitting station as described above with reference to FIG. 47. In this case, the first code group comprises a marking pulse in the first or largest digit and a second code group comprises four marking pulses in the other four positions. Thus, pulse 4601 represents an amplitude of sixteen units in the first code group. Pulse 4812 represents eight units in the second code group, pulse 4813, the second code group, represents four units, pulse 4814 represents two units and pulse 4815, one unit of signal amplitude. Thus, this code combination represents an amplitude of the complex wave form, at the time this code group was determined, of fifteen units of signal amplitude.

The shaded rectangles, superimposed upon the above-described pulses, represent the time during which the various distributor tubes are conditioned to distribute the pulses to the various decoding tubes. As a result, the marking pulse in the first code group of pulses is distributed as a negative pulse 4821 to tube 2891. Likewise, pulse 4822 represents the negative pulse of the second code group distributed to tube 2892. It is similar to the other pulses 4812 to 4815 which distribute as negative pulses to the respective tubes 3093, 3094 and 3095. These pulses are represented in FIG. 48 at 4823, 4824 and 4825. As described above, these pulses from the distributor tubes are transmitted through the respective delay lines 2881, 2882, 3083, 3084 and 3085 and then applied to the control elements of the decoding tubes enumerated above. The delay time for the pulses transmitted through the delay device 2881 is illustrated by the delay time D1 in group of FIG. 48. The voltage applied to the control element of tubes 2891 is shown by group 4831. Other pulses of the second code combination are likewise delayed corresponding shorter intervals of time so that these pulses appear at the output terminals of the delay devices substantially simultaneously as shown in graphs 4332, 4333, 4334 and 4335.

The negative pulse applied to the control element of tube 2891 interrupts current flowing through the anode circuit of this tube and through all of the anode resistors 2851, 2852, 3053, 3054 and 3055. As a result, the voltage of the anode of tube 2891 rises to a value of sixteen units amplitude as shown by pulse 4841 in FIG. 48 which in turn causes a pulse of sixteen units of amplitude 4850 to be applied to the control element of tube 2819 and repeated thereby. In the above-described operation, it is assumed to be in response to the pulse of the first code group on the left as shown in FIG. 48 which comprises a marking pulse in the first or left-hand position.

In response to the second code group of pulses assumed above, a negative pulse illustrated by graph 4832 is applied to the control element of tube 2892. A similar pulse shown by graph 4833 is applied to the control element of tube 3093, likewise, pulses as shown in graphs 4834 and 4835 are applied to the control elements of the respective tubes 3094 and 3095. The pulse applied to the control element of tube 2892 causes a rise in potential of eight units due to a decrease in current through tube 2892. This rise potential is illustrated by graph 4842. The rise in potential in response to the respective tubes 3093, 3094 and 3095 is illustrated in graphs 4843, 4844 and 4845. It should be noted that due to the action of the delay device described above pulses are applied substantially simultaneously to the control elements of all of the decoding tubes with the result that the change in potential conditions due to each pulse is properly added to the change in potential conditions produced by all of the other pulses of the given code group. Pulse 4850 represents the pulse of sixteen units amplitude generated under control of the first code group of pulses while pulse 4851 represents an amplitude of fifteen units which are generated under control of the pulses of the second code group as described above. These pulses are then transmitted through the low-pass filter in the manner described above and the complex signal wave reconstructed in response to the application of these pulses to the low-pass filter equipment.

The terminal equipment 2654 may be similar to the terminal equipment 602 described hereinbefore. It may include any of the various types of transmission and switching equipment described with reference to terminal equipment 602 independently of whether or not the terminal equipment 602 includes the same type of such equipment as the terminal equipment 2654.

The receiving device 2655 is shown as a telephone receiver which will respond to the voice currents from microphone or signal source 601. This receiver 2655 is merely representative of a receiving device of the type suitable for response to the signals generated by the signal source 601. If the signal source 601 produces other types of signaling currents then a receiving device 2655 will be arranged to respond to these other types of signaling currents. For example, if the signal source 601 comprises telegraph transmitting apparatus then the receiving device 2655 will comprise telegraph receiving apparatus of the type which will respond to the signals transmitted by the source 601. Likewise, if source 601 comprises a source of picture currents then receiver 2655 will include apparatus responsive to such picture currents.

The decoding equipment comprising tubes 2891, 2892, 3093, 3094 and 3095 decodes the pulses of the code combinations and produces a potential drop across the combined anode resistors 2851, 2852, 3053, 3054 and 3055 having a magnitude which is a function of the particular code group received. In order to provide a high degree of accuracy of the operation of such a decoding arrangement, it is desirable that the tubes 2891, 2892, 3093, 3094 and 3095 operate as constant current sources or devices. In other words, the current transmitted or passed by these tubes should be a function of the received signal pulses but not a function of the anode voltages applied to the respective tubes. In other words, the current through the tubes should be substantially independent of the voltage applied to the anode of the respective tubes from the combined anode network described above. Under these circumstances, the voltage drop produced by current in each tube and thus by the repetition of the respective pulses produces a voltage drop in the output circuit of these tubes which is independent of any of the other tubes and thus independent of any of the other pulses of a given code combination.

Furthermore, it is assumed that the consecutive pulses and also the consecutive electrodes 621 through 625 represent consecutive digits of a binary number. It will be apparent that such an arrangement is not essential so long as the signaling potential applied to each one of the code electrodes 621 through 625, inclusive, always represent the same fraction of the instantaneous amplitude of the complex wave at the time the code is determined. Under these circumstances, the pulses may be set in any order desired by interchanging the various delay devices 721, 722, 723, 824 and 825 provided, of course, the corresponding receiving delay devices 2881, 2882, 3082, 3084 and 3085 are correspondingly changed so that the sum of the delay intervals by each pair of the delay devices, that is, one transmitting and corresponding receiving delay devices are all substantially the same. The same results may be obtained by connecting the various delay devices in different paths between the code element electrodes of tube 610 and the distributor tubes 811 and 1112 through 1115 provided that the corresponding changes in connections are made between the delay devices between the receiving distributor tubes 2811, 2812, 3013, 3014, and 3015 and the decoding tubes 2891, 2892, 3093, and 3095.

CODING TO REPRESENT CHANGES IN AMPLITUDE

The foregoing description of the operation of the system with the various switches set in the position described, the system operates to transmit code groups of pulses at rapidly recurring instants of time each code group of which represents the magnitude of the instantaneous amplitude of the complex wave form to be transmitted at each of a plurality of rapidly recurring instants of time. These code groups are decoded at the receiving station and a complex wave reconstructed.

By changing switches 741, 742, 743, 1044 and 1045 at the transmitting station the circuits will operate to transmit code groups of pulses in which each code group of pulses no longer represents the magnitude of the complex wave form at each of the instants of time at which the code is determined, instead each code group will now represent the magnitude of the change in amplitude of the complex wave form between each of the instants of time the codes are determined.

Assume, for example, that switch 741 has been positioned to engage contact 746, switch 742 positioned to engage contact 748, switch 743 positioned to engage contact 756, switch 1044 positioned to engage contact 1016 and switch 1045 positioned to engage contact 1018.

With the switch 741 engaging contact 746 instead of contact 747 the output of the delay device 721 no longer is applied through the repeating tubes 761 and 771 to the control grid of tube 811. Instead it is applied to the cathode circuit of tube 731 and to the grid or control elements of tube 716. Thus when the beam of electrons fall on the code element electrode 621 of tube 610 electrons make this element more negative and cause the grid of tube 711 to become more negative. As a result, the cathode of tube 711 also becomes more negative. This negative potential is then transmitted to the delay line 721 and after the delay interval of the delay device 721 its output terminal also becomes more negative. This more negative potential is applied to the cathode of tube 731 and the control grid of tube 716. Tube 731 causes its anode to also become more negative in response to the negative potential applied to its cathode. The application of this negative potential to the control element of tube 716 causes the anode of tube 716 to become more positive. The control element of tube 717 is connected to the anode of tube 716 and as a result more current flows in tube 717 causing a greater potential drop across the anode resistor 720 which is common to tubes 717 and 718. The greater potential drop across the common anode resistor 720 reduces the voltage of these anodes and also the voltage of control element of tube 719 connected thereto. Consequently, less current flows through tube 719 causing its anode to rise to a more positive voltage. The anode of tube 719 is coupled to the anode of diode 726. The application of a positive voltage through the coupling condenser causes this diode to conduct current and apply a positive pulse to the control element of the right-hand section of tube 728. Consequently, a positive pulse is repeated in the cathode circuit of this tube to the control element of tube 811. This pulse is of sufficient duration so that a pulse will be transmitted by tube 811 when it is rendered active by a distributor arrangement shown in FIGS. 8 and 11 in the manner described above.

When the anode of tube 731 becomes negative in response to the negative potential applied to this cathode this negative voltage or potential condition is transmitted down the delay line 751. The delay line 751 is provided with a delay interval substantially equal to the repetition interval of the code combinations. In other words, the delay interval is equivalent to the time of a complete code group of pulses, i.e., 100 micro-seconds under the conditions assumed above. When the applied signal is sampled as described above, the charge on condenser 654 remains substantially fixed the time of a complete code group or multiples thereof. As a result the potential on the output code electrodes likewise remains the same for a like interval of time as described above and shown in FIG. 47. Assuming that the electron beam continues to impinge upon the code element electrode 621 for an interval of time greater than the time of a complete code group or multiplex cycle. Then at the end of the delay interval of the delay line or device 751 a negative potential is applied to the control element of tube 718. This delayed negative pulse is repeated by tube 718 so it substantially cancels the potential condition repeated by tube 717 in the common anode resistor 720. As a result, the positive potential applied to the anode of diode 726 by repeating tubes 719 is removed and a corresponding positive potential from the cathode of tube 728 likewise removed. A diode 727 is biased at this time so that no current will flow in its output circuit due to the change in current flowing through the tube 719 when the potential of this grid is restored to its original value. Consequently, the next code group transmitted from the distributor equipment will not include a pulse current through tube 811 when this tube is activated during the succeeding cycles of operation of the multiplex equipment shown in FIGS. 8 and 11.

As a result, a pulse is transmitted from tube 811 in response to the electron beam in tube 610 falling upon the electrode 721 the first time the associated distributor tube 811 is activated thereafter. So long as this electron beam continues to fall upon this electrode no further pulses are transmitted through tube 811 during the subsequent cycles of operation of the distributor equipment.

At a later time when the electron beam in tube 610 is shifted so that it no longer falls on the electrode 621 the potential of this electrode will rise and as a result, additional current will flow through tube 711 causing a more positive voltage to appear on the cathode of this tube. This more positive voltage is transmitted down the delay line or device 721 and after the delay interval of this device a more positive voltage will appear on its output terminals. This more positive voltage is applied to the control element of tube 716 which repeats a negative voltage in its output circuit and this interrupts or reduces the current flowing through tube 717 and the common anode resistor 720. The reduced current through anode resistor 720 causes the voltage of the anodes of tubes 717 and 718 to become more positive with the result that tube 719 conducts more current. The cathode of tube 719 will become more positive at this time and apply a positive voltage to the anode of diode 727 thus causing diode 727 to conduct current and apply a positive voltage to the control element of the left-hand section of tube 728. Tube 728 repeats this more positive voltage on its cathode circuit and consequently applies a positive voltage to the control element of tube 811. The next time tube 811 is activated by distributing equipment of FIGS. 8 and 11 causing a pulse of current to flow in the output circuit which pulse will be transmitted to the receiving station in the manner described hereinbefore.

The positive voltage applied to the cathode of tube 731 at this time causes a more positive voltage to be repeated to the anode of this tube which positive voltage condition is transmitted down the delay line 751. The delay line 751 is terminated so that substantially no reflection takes place at the terminals thereof. When this voltage arrives at the output terminals of the delay line after the delay interval of this line, this voltage will cause more current to flow through tube 718 and thus through the common anode resistor 720 compensating for the decrease in current due to the negative potential applied to the control element of tube 717. As a result, the potential of the anodes of tubes 717 and 718 and the control grid of tube 719 become less positive. Tube 719 thereupon conducts less current. However, tube 719 in conducting less current interrupts the current flowing through diode 727 but due to the bias potential applied to the diode 726, current does not flow through diode 726 at this time. As a result, the positive potential is removed from the control element of tube 811 which tube will not thereafter cause a pulse of current to be transmitted when it is activated during the succeeding cycles of a multiplex distributor equipment.

It is thus apparent that by operating switch 741 to the position where it engages contact 746 a code pulse is transmitted to the distant station every time the electron beam first falls upon the electrode 621 or first ceases to fall upon this electrode. In other words, a pulse is transmitted only when the potential or voltage upon the code element electrode 621 changes.

The electrodes 622 and 625 are connected to similar circuits for causing pulses to be transmitted only when the voltage condition of these electrodes changes.

The change in potential on the electron beam in shifting from one row of apertures in the aperture plate 716 will generally be of extremely short duration so that a circuit may be arranged not to respond to such potential conditions of such short duration.

The code element electrodes 623 and 624 are connected to similar types of circuits which operate in a somewhat different manner. These circuits operate to produce the same results but require somewhat less equipment. The circuits are however more critical in adjustment. Assume, for example, that the electron beam falls on electrode 623 and applies a negative signaling condition to the grid of tube 713. The negative signaling condition is repeated to the cathode of tube 713 and then transmitted down the delay line 723. After the delay interval of the delay line or device 723, a negative signaling condition is applied to the control element of tube 733 which repeats a positive signaling condition in the anode circuit of tube 733. The control element of the tube 739 is connected to the anode of tube 733 and as a result this tube conducts more current causing a positive signaling condition to be applied to the cathode of tube 739 and a negative signaling condition to the anode of this tube. As a result, the diode 737 conducts current and applies a positive voltage to the lefthand section of tube 738 which tube repeats this voltage and applies it to the control grid of tube 1113; switch 743 of course being operated or positioned to engage contact 756. Consequently, the next time tube 1113 is activated by the distributor equipment of FIGS. 8 and 11 in the manner described above, a pulse is transmitted to the receiving station.

The positive signaling voltage repeated in the anode circuit of tube 733 in response to the electron beam falling on element 623 is transmitted down the delay line 753. The delay line 753 is short-circuited at the end not connected to the anode of tube 733. As a result, the voltage condition is reversed and transmitted back to the anode circuit of tube 733 and when it arrives back at the anode of tube 733 it cancels the original positive voltage applied to this anode and as a result the circuit conditions in tube 739 are restored to their initial conditions at which time neither diode 736 nor 737 conduct current. Consequently, a positive signaling voltage is removed from the control element of tube 1113. By adjusting the delay time of the delay device 753 to be substantially one half the time interval of a complete multiplex cycle, the reflected pulse will arrive back at the anode of tube 733 substantially one multiplex cycle later so that the positive voltage is applied to the control element of tube 1113 for only one multiplex interval, consequently, only one positive pulse is transmitted over the multiplex system at this time. Thereafter as long as the electron beam falls upon the code electrode 623 of tube 610 the circuits remain in the position described during which time no further pulses are transmitted by tube 1113.

When the electrons falling on the electrode 623 are interrupted due to the beam being moved to a position where no aperture appears in front of this electrode the negative signaling condition is removed from electrode 623 and as a result, more current flows through tube 713 causing a positive signaling voltage to be transmitted down the delay line 723. This positive signaling voltage is applied to the control element of tube 733 and repeated in the output circuit of this tube as a negative signaling voltage. The negative signaling voltage is then applied to the tube 739 which causes the current flowing through this tube to be interrupted or reduced with the result that the anode of this tube becomes more positive applying a more positive voltage to the anode of diode 736. The diode 736 thereupon conducts current and applies a positive voltage to the control element of the right-hand section of tube 738. A positive voltage is repeated in the cathode circuit of this tube and applied to the control element of tube 1113. Consequently, when tube 1113 is again conditioned during the subsequent multiplex cycle it will conduct current and cause a pulse to be transmitted to the distant station.

The negative voltage condition applied to the anode of tube 733 is also transmitted down the delay line 753 and reflected at the distant end back to tube 733. As is pointed out above, this delay interval is substantially a multiplex interval and at the end of this delay interval which is twice the delay interval of the delay line 753, a reversed polarity pulse is received back at the anode of tube 733 canceling the original signaling condition and restoring the circuits to their initial condition wherein no positive potential is applied to the control grid of tube 1113, consequently, no further pulses are transmitted through this tube during a succeeding multiplex interval until electrons again fall upon the electrode 623 of the coding tube 610.

It is thus apparent that pulses are transmitted only when the potential conditions of the respective electrodes 621 through 625 change. It is further apparent that the amount of change in the amplitude of the complex wave between coding intervals determines which ones of the potential conditions change, thus, the pulses transmitted represent changes in amplitude of the signal wave rather than the absolute amplitude of the wave at each of the times the codes are determined.

When the switches at the transmitting stations 741, 742, 743, 1044, and 1045 are positioned to make contact with the respective contacts 746, 748, 756, 1016, and 1018 the pulses transmitted are a function of the change in the amplitude of the complex wave between the sampling intervals, that is, between the times the codes are determined as described above. Under these conditions switches 2807, 2831, 2832, 3033, 3034 and 3035 at the receiving station are positioned so that they engage respective contacts 2809, 2841, 2842, 3043, 3044 and 3045. Likewise, switches 2861, 3862, 3063, 3064 and 3065 are positioned so that they engage the respective contacts 2836, 2838, 3016, 3018 and 3020.

With switch 2831 engaging contact 2841 the output of the delay device 2881 is applied to the cathodes of tubes 2816 and 2817 through a coupling condenser. Coupling condenser together with the common cathode resistor are such that the pulse applied to these cathodes is of substantially the same wave shape and duration as the pulse from the output of the delay device or line 2881.

Tubes 2816 and 2817 are connected in a double stability circuit of the type sometimes called on Eccles-Jordon circuit. Such circuits are stable in either one of two conditions, that is, with tube 2816 conducting and tube 2816 non-conducting or vice versa, with tube 2817 conducting and tube 2816 non-conducting.

In order to properly condition the tubes such as 2816 and 2817, rectifiers or diodes 2886, 2887, 3088, 3089 and 3090 have been provided. These rectifiers are connected to the output of tube 4125 so that when the grid of tube 4125 is driven positive by the operation of key 4126 the control grids of tubes 2816, 2818, 3012, 3022, and 3032 are driven positive with the result that any of these tubes which are not conducting current start to conduct current and interrupt current flowing through the opposite tube. The application of a positive voltage to the control grid of any of the tubes above-enumerated which are conducting current at this time produces no effect with the result that upon the release of the key 4126 all of the tubes 2816, 2818, 3012, 3022 and 3032 of the flip-flop circuits associated with each of the pulse positions remain conducting. Further, the voltage of the cathode of tube 4125 is sufficiently low at this time so that no current passes through rectifiers or diodes 2886, 2887, 3088, 3089 and 3090 with the result that these diodes effectively isolate the various flip-flop circuits so that they do not interfere one with another.

With all of the tubes corresponding to tube 2816 conducting the tubes corresponding to 2817 are non-conducting with the result that their plate voltages are at their highest values. Under these circumstances, and with the switches 2861, 2862, 3063, 3064 and 3085 are moved so that they engage the respective contacts 2836, 2838, 3016, 3018 and 3020 and connect the control elements of the respective tubes 2891, 2892, 3093, 3094 and 3095 to the plates of the respective tubes 2817 and corresponding tubes of the other channels. Inasmuch as the anodes of these tubes are at their more positive value the control elements or grid of the decoding tubes 2891, 2892, 3093, 3094 and 3095 are also at their more positive values with the result that these tubes are all conducting current so that the anode of tube 2891 is at its lowest value. The setting of these tubes corresponds to the application of the lowest magnitude of amplitude of the applied signaling wave wherein the electron beam of tube 610 does not fall upon any of the output code elements 621 to 625. The above set of conditions are shown graphically at the left-hand end of FIG. 49 graphs 4911 through 4915, inclusive, of FIG. 49 which show the potentials of the output code elements 621 through 625, inclusive, at their more positive values. The left-hand portions of the graphs 5021 to 5025 of FIG. 50 similarly show the output of the tubes corresponding to tube 2817 at their more positive values in response to the above-described signaling condition.

Figure 49:
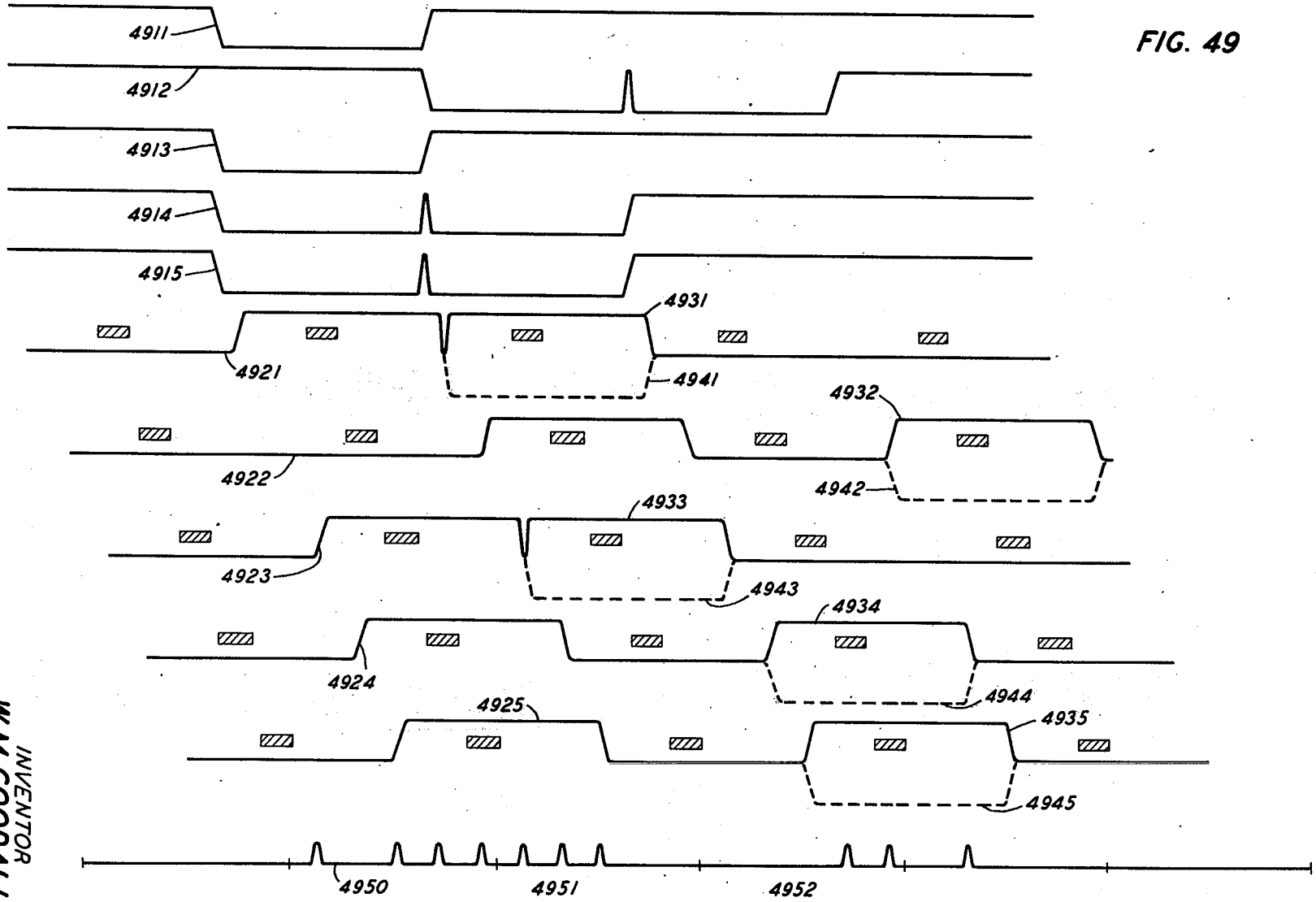

In the graph shown in FIG. 49, it is assumed that at a slightly greater later time, the electron beam moves from its lowermost position so that it will pass through four apertures and fall upon the collecting electrodes 621, 623, 624 and 625, but not upon the collecting electrode 622 with the result that these electrodes become more negative at this time. Consequently, a negative step voltage is transmitted down the respective delay lines 721, 723, 1024 and 1025 which, in turn, cause positive pulses to be transmitted through the diodes 726 and 737 and the corresponding diodes of FIG. 10 to the control elements of the distributor gate tubes 811 and 1112 through 1115, inclusive. This operation is illustrated by the graphs 4921, 4922, 4923, 4924 and 4925 which graphs show the voltages applied to the respective tubes 811, 1112, 1113, 1114 and 1115. As is shown by these graphs, positive pulse or potential is applied to the control grids of the respective gate tubes 811 and 1113 through 1115, inclusive. The potential applied to the control grid of tube 1112 is not sufficiently positive so that this tube does not conduct current when it becomes activated as described above. The shaded rectangles superimposed upon the graphs in FIG. 49 represents the times during which the various gate distributor tubes are rendered active by a positive voltage applied to their screen grids in the exemplary embodiment set forth therein in the manner described above. When the control grid is positive at the time the tubes are rendered active, the pulses are transmitted over the radio system as described above. These positive pulses are represented by the graph 4950 which represents the code group transmitted in response to the change in position of the electron beam from its lowermost position to a position representing twenty-three units of amplitude wherein pulses are transmitted in the first, third and fourth positions.

Figure 28:
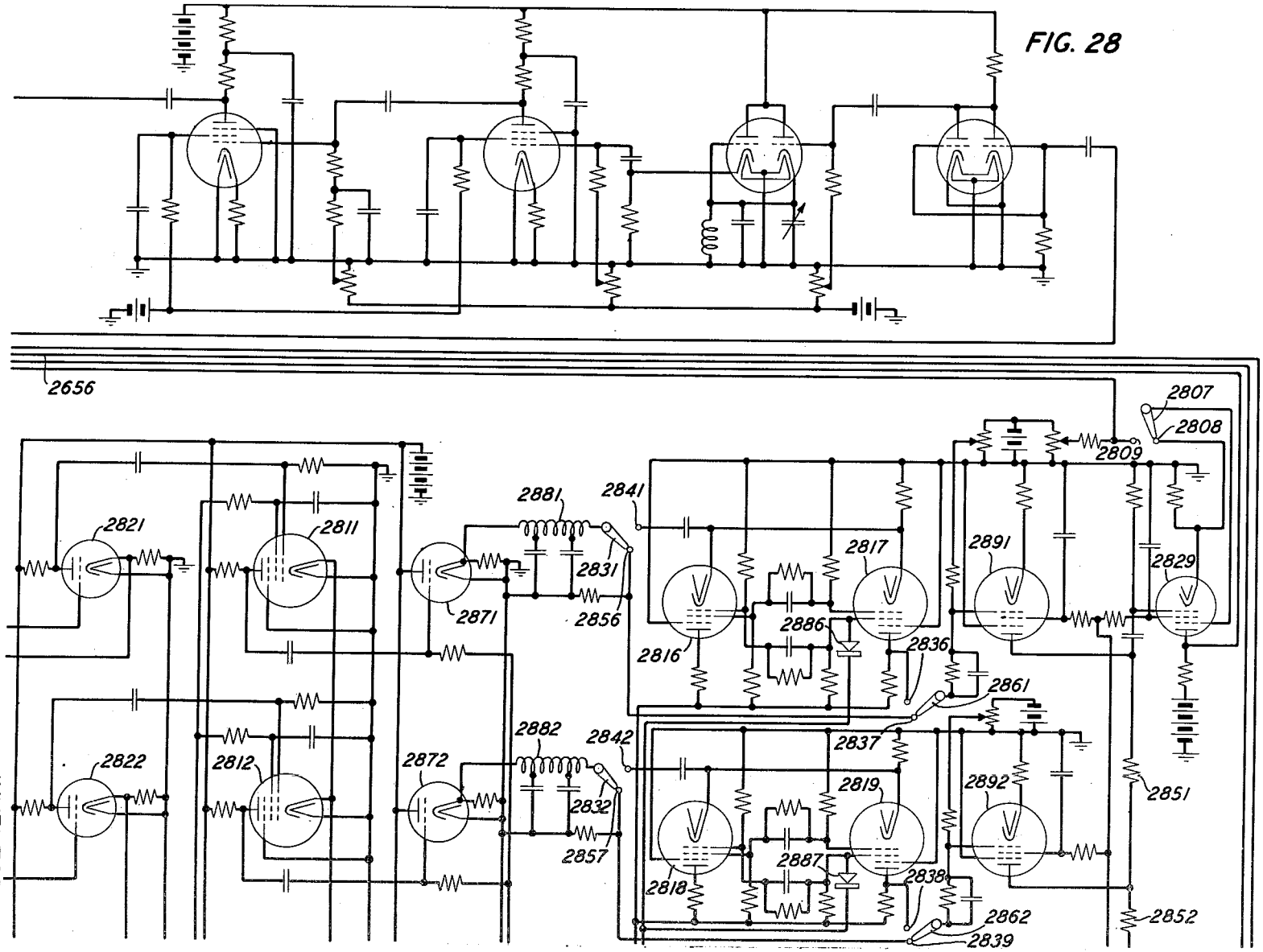
Figure 29:
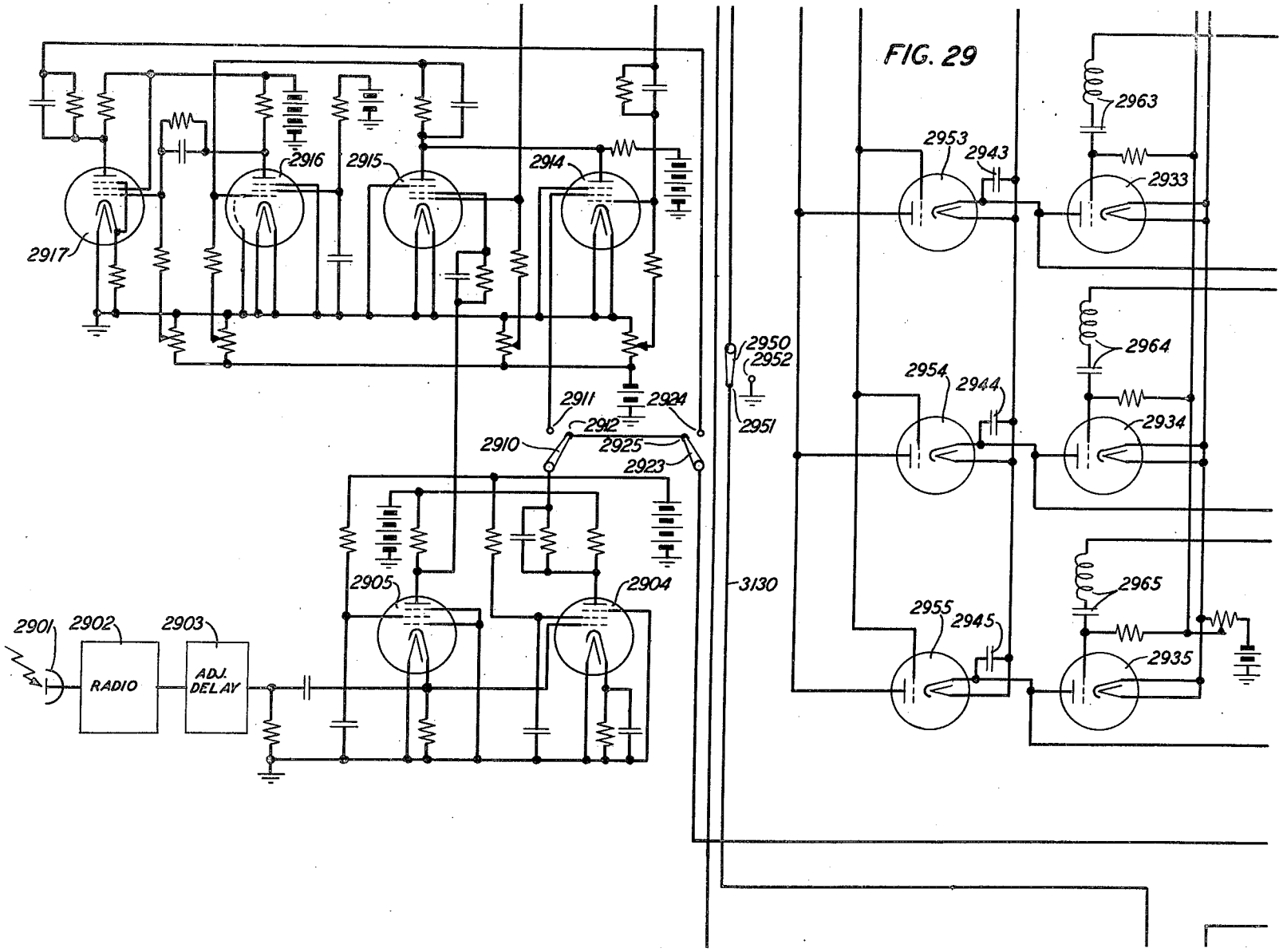
Figure 30:
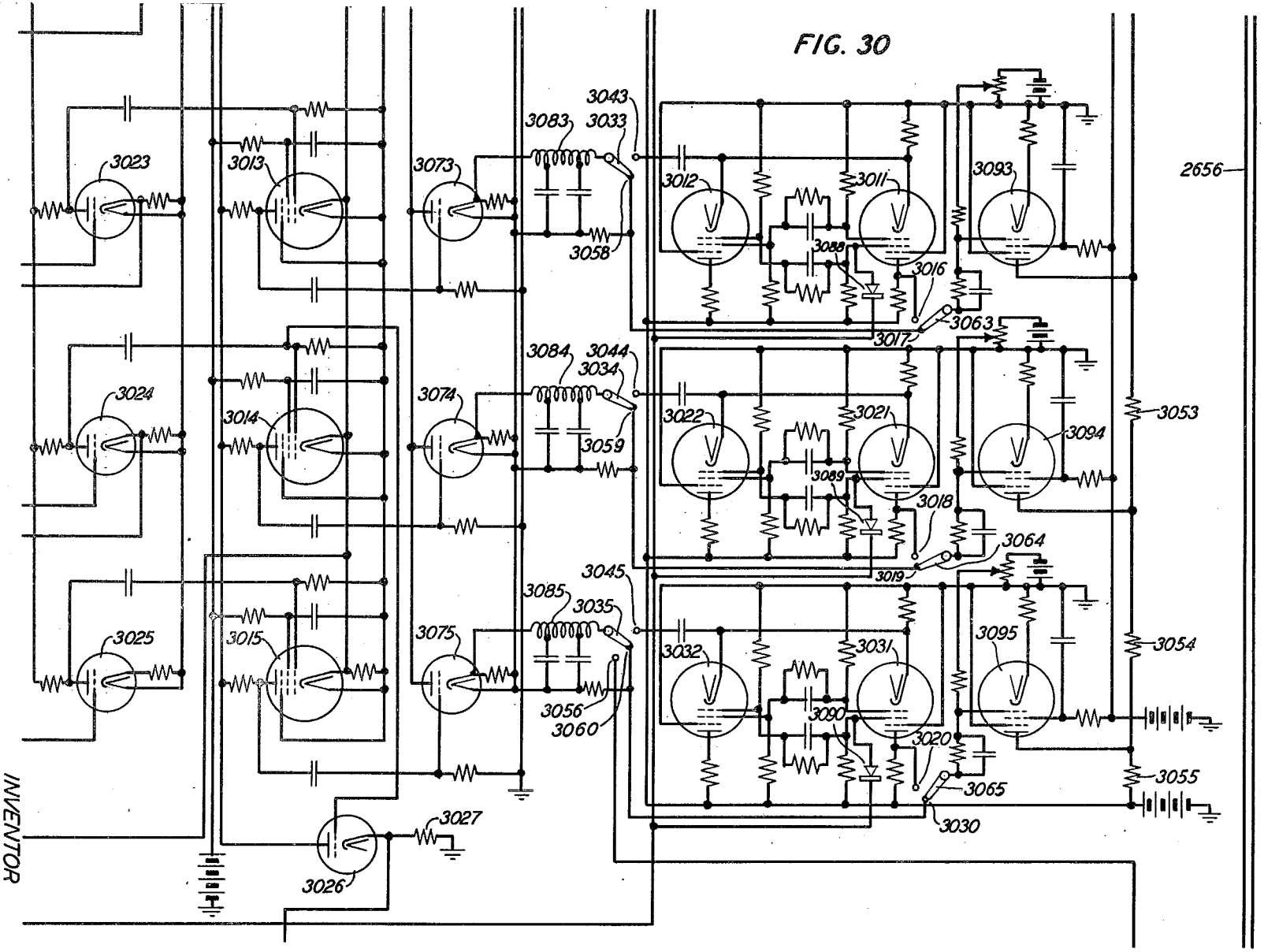

Graph 5010 represents the signals as received in the receiving station. These signals are transmitted through the multiplex system and distributor and the various delay lines or other delay devices 2881, 2882, 3083, 3084 and 3085. The pulses appear at the ends of these delay lines or devices substantially simultaneously as illustrated by the graphs 5011 through 5015, inclusive. As shown in the graphs in FIG. 50 these pulses are negative pulses and are applied to the cathodes on both tubes of the respective flip-flop circuits as shown in FIGS. 28 and 30. As a result, both tubes in the flip-flop circuits become conducting for the duration of the pulse. At the termination of the pulses, tube 2816 is rendered non-conducting and the corresponding tubes of FIG. 30 are likewise rendered non-conducting. Tube 2817, however, and the corresponding tubes of FIG. 30 remain conducting at this time. These conditions are represented by the graphs 5021 through 5025 of FIG. 50.

Figure 50:
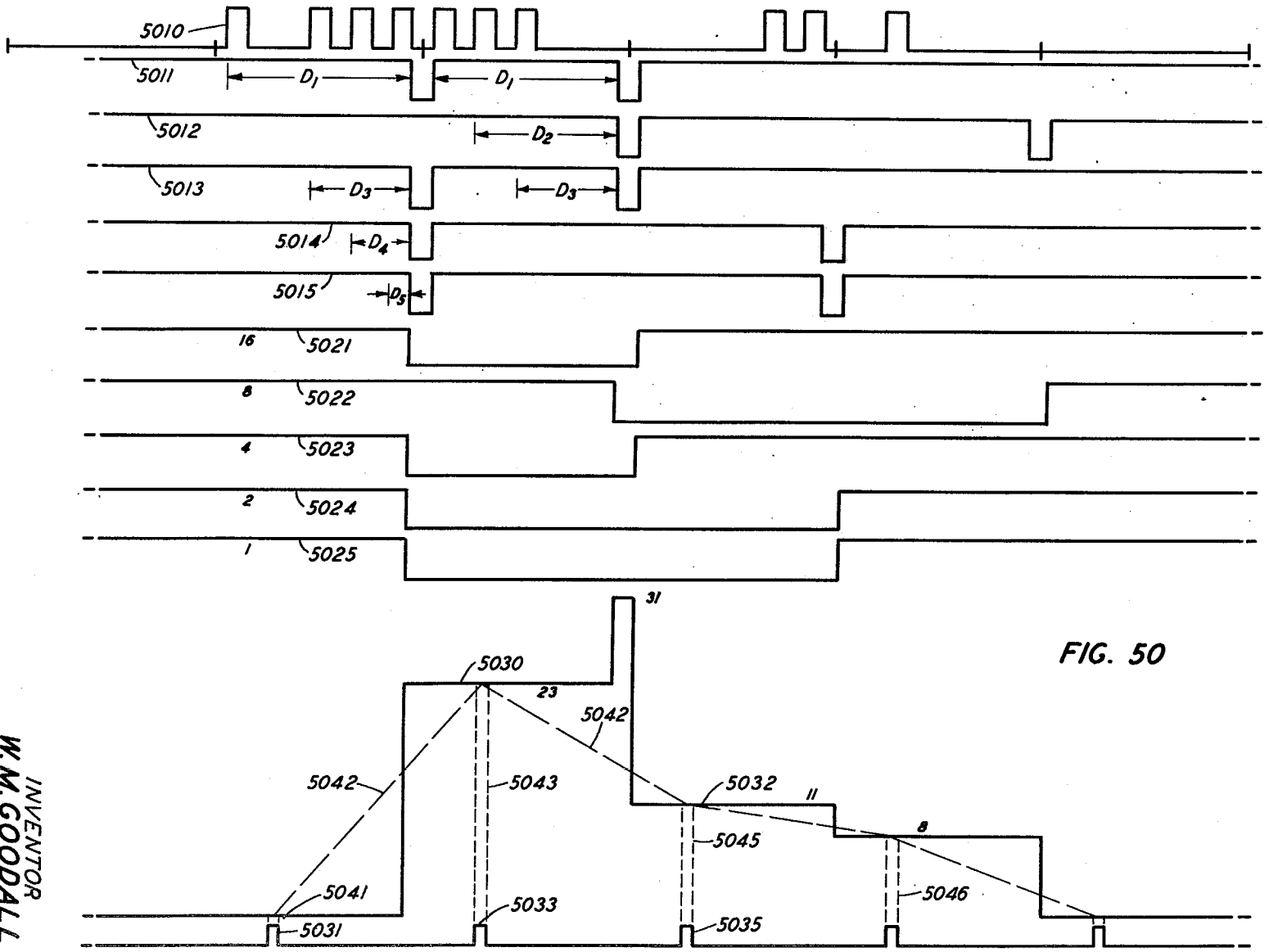

As a result, the voltage of the control elements of tubes 2891, 3093, 3094 and 3095 is reduced so that the current flowing through these tubes is reduced or interrupted, consequently, the voltage of the anode of tube 2891 rises to a value representing twenty-three units of amplitude in the manner described above. With switch 2807 operated to engage contact 2809 a delayed pulse from the synchronous pulse generator shown in FIG. 26 is applied to one of the control elements of tube 2829 causing an output pulse to flow in the output circuit of this tube. This delayed pulse is shown in FIG. 50 at 5033. The magnitude of this pulse will be controlled by the magnitude of the voltage applied to the control grid of the tube at the time of the pulse and thus be a magnitude corresponding to twenty-three units of signal amplitude. Such a pulse is illustrated by the dotted pulse 5043 of FIG. 50.

As shown in FIG. 50, it is further assumed that the next time the incoming wave is sampled in the manner described above the applied signal wave will have an amplitude of eleven units. Consequently, the electron beam falls upon the output electrodes 622, 624 and 625, but does not fall upon the electrodes 621 and 623. These signaling conditions are illustrated during the third frame or complete code group interval of tim by the upper five graphs 4911 through 4915 of FIG. 49. As a result, the negative pulse or a pulse of opposite polarity to that described above is transmitted through tube 719 which pulse is illustrated by the dotted graph 4941. However, due to the connection of diode 727 to the cathode of tube 719, a positive pulse illustrated by pulse 4931 is applied to the diode 727. As a result during the time tube 811 is rendered active, a positive pulse is transmitted over the radio system. Pulses are also transmitted over the radio receiver during second and third pulse intervals, but not during the fourth and fifth pulse intervals because no change in potential occurred in the output electrodes 624 and 625 of tube 610. The second set of pulses 4951 illustrates the code group of pulses transmitted in response to the electron beam moving from the twenty-third position to the eleventh position. The graphs of FIG. 50 show the corresponding pulses at the receiver. Thus, graphs 5011, 5012 and 5013 show negative pulses applied substantially simultaneously to the cathodes of both of the tubes of the first three pairs of flip-flop tubes. These pulses cause potentials applied to the control elements of the decoding tubes 2891, 2892, 3093, 3094 and 3095 to change as illustrated in graphs 5021 through 5025, inclusive. It should be noted that a pulse was transmitted in the first position in both code groups 4950 and 4951. This pulse causes the voltage applied to the control element of tube 2891 to first become more negative and upon the second transmission of this pulse the voltage applied to the control element of this tube again becomes more positive. This is a wave form substantially the same as applied to the code electrode 621 of tube 610. Substantially the same conditions exist with respect to the voltage applied to the control element of tube 3093 and the voltage of the output electrode 623. Inasmuch as the voltage applied to the electrodes 624 and 625 do not change between the times the first and second samples represented in the top of FIG. 49 were taken, no pulse is transmitted during these pulse intervals, consequently, no change takes place between the two tubes of each of the last flip-flop circuits of FIG. 30. This arrangement is clearly illustrated by graphs 5024 and 5025. Likewise, the output at this time is illustrated by the portion of the graph 5032 so that when pulse 5033 is applied to a control element of tube 2829, a pulse representing eleven units of amplitude is transmitted to the low-pass filter equipment.

It is further assumed in FIG. 49 at the next sampling period that the amplitude of the complex wave is eight units with the result that the electron beam falls upon only the output electrode 622. These conditions are shown during the third interval of the graphs of FIG. 49 and the pulse code group 4952 represents pulses transmitted in response to the change in signal amplitude from eleven units to eight units inasmuch as this change represents a change in the potential conditions of the last two code elements 624 and 625 pulses are transmitted only during the fourth and fifth pulse intervals of this code. These pulses are transmitted to the receiving station as illustrated by graphs 4952 and 5010. These pulses cause the potential conditions of the last two flip-flop circuits to reverse as shown in graphs 5024 and 5025 with the result that a pulse of eight units is transmitted through output tube 2819 when the third pulse shown in FIG. 50 is applied to the control element of this tube.

It is thus apparent that each time the potential applied to one of the output code electrodes of tube 610 changes, a pulse of one character is transmitted over the radio system which character is assumed to be marking and so illustrated and described herein. This pulse as received at the receiving station changes the conducting conditions of the corresponding flip-flop circuits with the result that the potentials output from these flip-flop circuits are substantially identical with the voltage or potentials on the code electrodes of the coding tube 610 at the transmitting station. These potentials are then decoded and combined in the manner described above. The combined potentials then employed to control the amplitude of the pulses repeated by tube 2829 as shown by the dotted pulses 5041, 5043, 5045, 5046 etc. These pulses of varying amplitude together with the subsequent pulses from tube 2819, one for each code group is transmitted through the low-pass filter where their high frequency components are removed and a signaling wave such as shown by the dash line 5042 similar to the wave applied at the transmitted station is reconstructed.

Novel features of the foregoing transmission system set forth hereinbefore, but not claimed herein, are claimed in my copending application Ser. No. 67,211, filed on Dec. 29, 1948 the same data herewith.

KEY GENERATOR AND CIPHERING CIRCUITS

When desired, key generating equipment may also be provided at both the transmitting and receiving stations. This equipment is employed to generate the cipher key signals which are combined with the code groups of signalling pulses at the transmitting station for ciphering the signals. Key signal generating equipment is provided at the receiving station for generating cipher key signals identical with the cipher key signals generated at the transmitting station. The cipher signals are again combined with the receiving pulses in the same manner as at the transmitting station. As a result the original code signals are recovered.

Details of an exemplary key generator designed to cooperate with the other elements of the exemplary system described in detail herein are shown in FIGS. 13 to 25, inclusive, for the transmitting station, and in FIGS. 31 through 42, inclusive, at the receiving station. The above-enumerated figures also show various control circuits and apparatus which are employed to control the key signals generated by the key circuit.

The key generating equipment is controlled by a random signal generator which generates signals under control of noise currents which signals are then employed to actuate the key generator circuits as will be described hereinafter.

Figure 13:
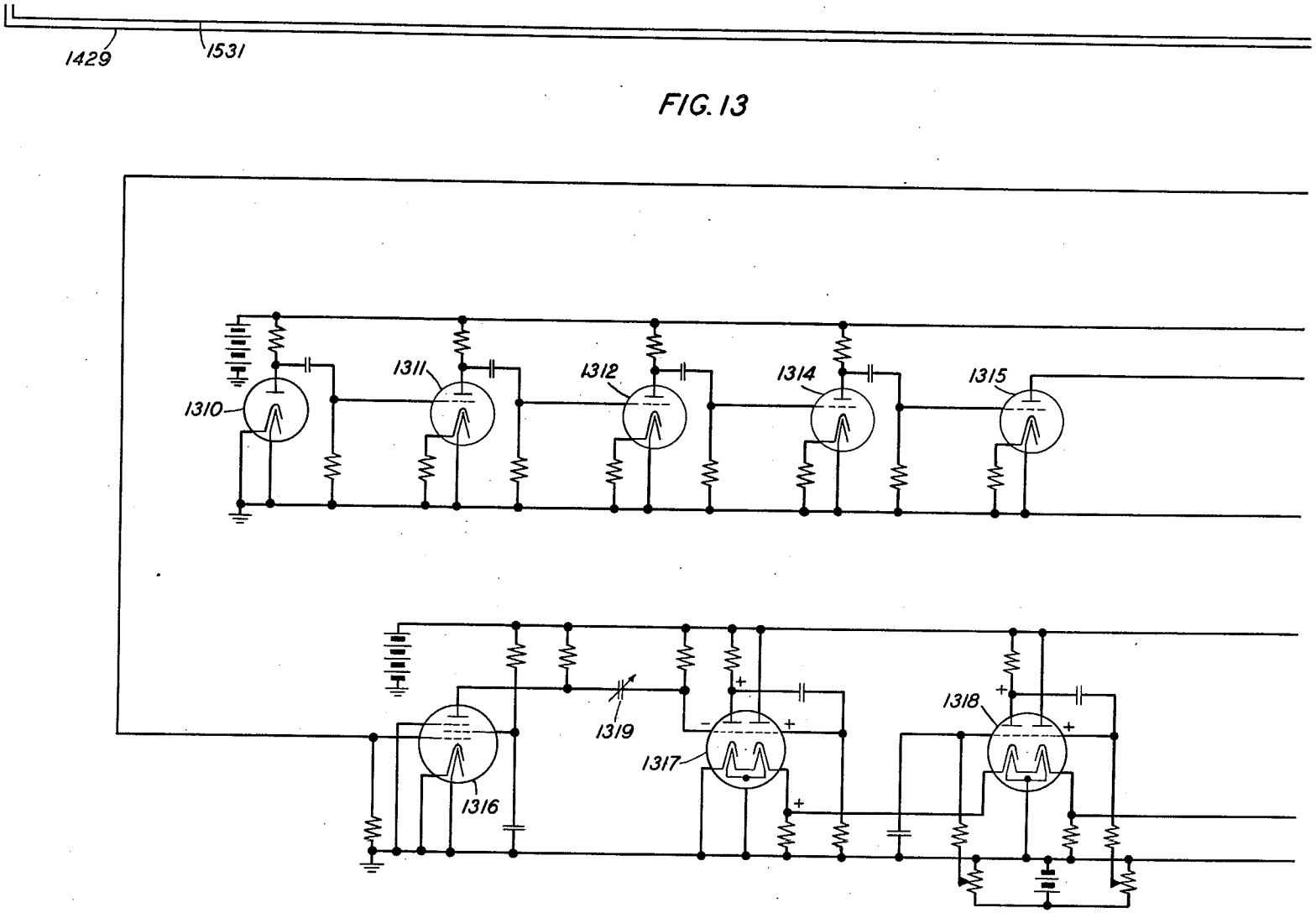

As shown in FIG. 13, a diode 1310 is employed to generate the noise currents. As shown in FIG. 13, this diode is a high vacuum diode. However, this noise source may include a gas tube or any other suitable source of noise currents. It is desirable, however, that the source of noise currents 1310 should exhibit little or no resonance phenomenon. Likewise the noise source should generate noise currents of a relatively wide frequency range in which the currents throughout the frequency range are of substantially the same average amplitude or energy level.

The output of the noise source 1310 is amplified and shaped by a series of amplifying vacuum tube circuits including tubes 1311, 1312, 1314 and 1315. These circuits may be arranged to provide some limiting and clipping of the noise currents when desired.

The output of tube 1315 is connected in parallel with the anode circuit of 1410, which tube together with tubes 1411 and 1410 serve to obtain samples of the output noise voltage. Sometimes sampling circuits of this type are called clamping circuits. The sampling circuits are controlled by pulses received from the transmitting distributor described above. Tube 820 of the transmitting distributor shown in FIGS. 8 and 11, has its input circuit connected across the cathode resistor of tube 1122. Thus when the second row of tubes is rendered active so that tube 1112 may conduct current under control of signaling pulses from the various code groups, tube 1122 will be cut off as described above, with the result that little or no current will flow through its cathode resistor so that the grid of tube 820 will be at a relatively low voltage, and thus cause the output of tube 820 to be at a relatively low value. When at the end of the second interval of the multiplex distributor tube 1122 again starts to conduct current, the voltage of its cathode will rise and cause a correspondingly higher positive output voltage from tube 820.

The output of tube 820 is coupled to the input or control circuits of tube 1316. Tubes 1316, 1317 and 1318 operate as pulse forming and amplifying tubes. Tube 1316 amplifies the long pulse received from the distributor which has a duration of substantially a pulse interval. The output circuit of tube 1316 is coupled through condenser 1319 to the input circuit or control grid, the left-hand section of tube 1317. The magnitude of condenser 1319 together with the magnitude of the anode resistor of tube 1316 and grid resistor of the left-hand section of tube 1317, are chosen so that the product of these resistors, and capacity of the condenser is small. As a result, condenser 1317 tends to operate as a differentiating circuit and transmits a short pulse in response to the application of voltage changes generated in the output circuit of tube 1316. It is also to be noted that the bias resistor of tube 1317 is connected to positive battery, thus tending to provide a positive bias for tube 1317 and cause anode-cathode current to be at a saturated value normally.

When the output voltage of tube 820 falls to a low value as described above, the output of tube 1316 will become more positive and cause a short positive pulse to be applied to the control grid of tube 1317 and inasmuch as the output current of this tube is substantially saturated at this time, little if any change in the output current will result. However, at the end of the second interval of the transmitting distributor, the output of 820 again rises and thus the output voltage of tube 1316 falls to a relatively low value at which time negative ulse of short duration is transmitted through condenser 1319 to the control grid of tube 1317. The application of this negative pulse to the grid of tube 1317 causes a positive pulse to be repeated in the output circuit of this tube. The right-hand section of tube 1317 and both sections of tube 1318 cause a positive pulse to be repeated in the output circuit of tube 1318 in response to the positive pulse generated in the output circuit of tube 1317 at this time. The right-hand section of tube 1317 together with both sections of tube 1318 tend to shape and limit the output pulse so that a pulse of substantial rectangular wave form and of the desired duration is formed; for example, a rectangularly shaped pulse having duration of one or more microseconds is generated in the output circuit of tube 1318.

The positive output pulse from tube 1318 is applied to the control grid of tube 1412, which pulse causes current to flow through tube 1412 and discharge the upper terminal of condenser 1419 if it has been previously charged. The output circuit of tube 1318 is also connected through the coupling network comprising condenser 1420 and resistor 1421 which elements have low value so that their product and thus their time constant are small. As a result this coupling network applies a positive voltage of short duration at the beginning of the pulse from tube 1318 and a similar negative pulse at the termination of the pulse from tube 1318. As described, with reference to condenser 1319 and the left-hand section of tube 1317, the positive pulse at the beginning of the pulse from tube 1318 is not repeated through tube 1415. The negative pulse at the trailing edge of the pulse from tube 1318 is again repeated and again shaped and limited by the right-hand section of tube 1415 and both sections of tube 1416. As a result, the negative pulse from the output circuit of the right-hand section of tube 1416 is applied to a control element of tube 1417. Tube 1417 operates as a cathode-follower tube with a delay line connected in its cathode or output circuit. The delay line 1418 may be of any suitable type and delays the pulse from tube 1417 so that sufficient time is provided to allow tube 1412 to discharge condenser 149 and then return to its non-conducting condition before the delayed pulse from tube 1417 is applied to a control element of tube 1410.

The delayed negative pulse from tube 1417 is applied to a control element of tube 1410. Tube 1410 is normally conducting current so that the voltage of its output or anode is at a relatively low value independently of the magnitude of the noise voltage output from tube 1315. However, upon the application of the negative pulse from the delay line 1418, the control element of tube 1410, and due to the anode resistor 1430 common to tubes 1315 and 1410, the voltage of the anode of tube 1410 will rise to a value determined by a magnitude of the noise voltage applied to the control element of tube 1315 at this time.

The control element of the cathode-follower tube 1411 is coupled to the anodes of tubes 1315 and 1410 by a coupled circuit having a long time constant so that the voltage of the grid of tube 1411 accurately follows voltage of tubes 1315 and 1410. As a result when the voltage of the anodes of tubes 1315 and 1410 rise to a value determined by the mangitude of the noise voltage at this time, a correspondingly positive voltage is applied to an upper terminal of condenser 1419 due to the operation of tube 1411. At the termination of the negative pulse applied to the control element of tube 1410 the voltage of the anode of this tube again falls to a relatively low value and as a result tube 1411 remains cut off so that it no longer produces any effect upon the voltage or charge upon the upper terminal of condenser 1419. The voltage or charge upon the upper terminal of condenser 1419 then remains substantially constant until discharged and then recharged during the next multiplex cycle in the manner described above.

The upper terminal of condenser 1419 is connected to a conrol element of tube 1421 which tube operates as a cathode-follower tube and thus has a high input impedance with the result that the operation of this tube does no materially affect the voltage or charge upon the upper terminal of condenser 1419. Output of tube 1421 which follows the voltage of the upper terminal of condenser 1419 is amplified and limited by both sections of tubes 1422, and 1423.

Tubes 1422 and 1423 may be also employed to shape and control the duration of the output pulse. Inasmuch as the potential on the upper terminal condenser 1419 remains constant for substantially a complete code interval, the output of tube 1423 may remain in either one of the two values for any desired interval of time. Usually this time interval will be some multiple of the pulse interval from one pulse interval to the complete code interval or longer. For the purpose of illustration, it is assumed that this interval is for a multiple of a complete code interval including a single code interval. It is to be understood of course, that this interval may however, be of any desired longer or shorter duration. The output from tube 1423 is applied to a control element of the two cathode-follower tubes 1413 and 1414.

The output of tube 1413 is connected through delay device 1405 to the input of a delay line 1610. The delay device 1405 may be any suitable delay device or line including an initial section of delay line 1610 and is provided so that the signals may be applied to the delay line 1610 at times corresponding to times similar signals are applied to a similar delay line at the receiving station as will be described hereinafter. The output signals from tube 1413 are then transmitted down the delay line 1610 to the terminating resistance 1611. Terminating resistor 1611 should substantially match the impedance of the delay line 1610 so that it, together with any final section of this delay line which may form part of the termination, prevents any substantial reflection of the signals transmitted down the line. In other words, the termination of the delay line should absorb all the signals transmitted down the line.

The output of tube 1414 is connected to terminal 1117 of switch 1110. When it is desired to use the cipher equipment switch 1110 will be positioned so that it engages terminal 1117. With switch 1110 so positioned signals transmitted during the fifth pulse interval are not controlled by the magnitude of the applied complex signal wave but rather by the output of random signal generator. In other words, the same signals are transmitted during the fifth pulse interval of the code group as are applied to the delay line 1610 through the delay device 1405.

It is to be understood of course that when desired additional pulses may be provided for transmitting pulses from the random signal generator instead of employing one of the signaling pulses.

By employing the pulses heretofore described as representing the small increment of amplitude of the complex wave for transmitting signals, the intelligibility of the signals is affected the least. It is of course possible to employ any of the pulses when so desired.

Figure 32:
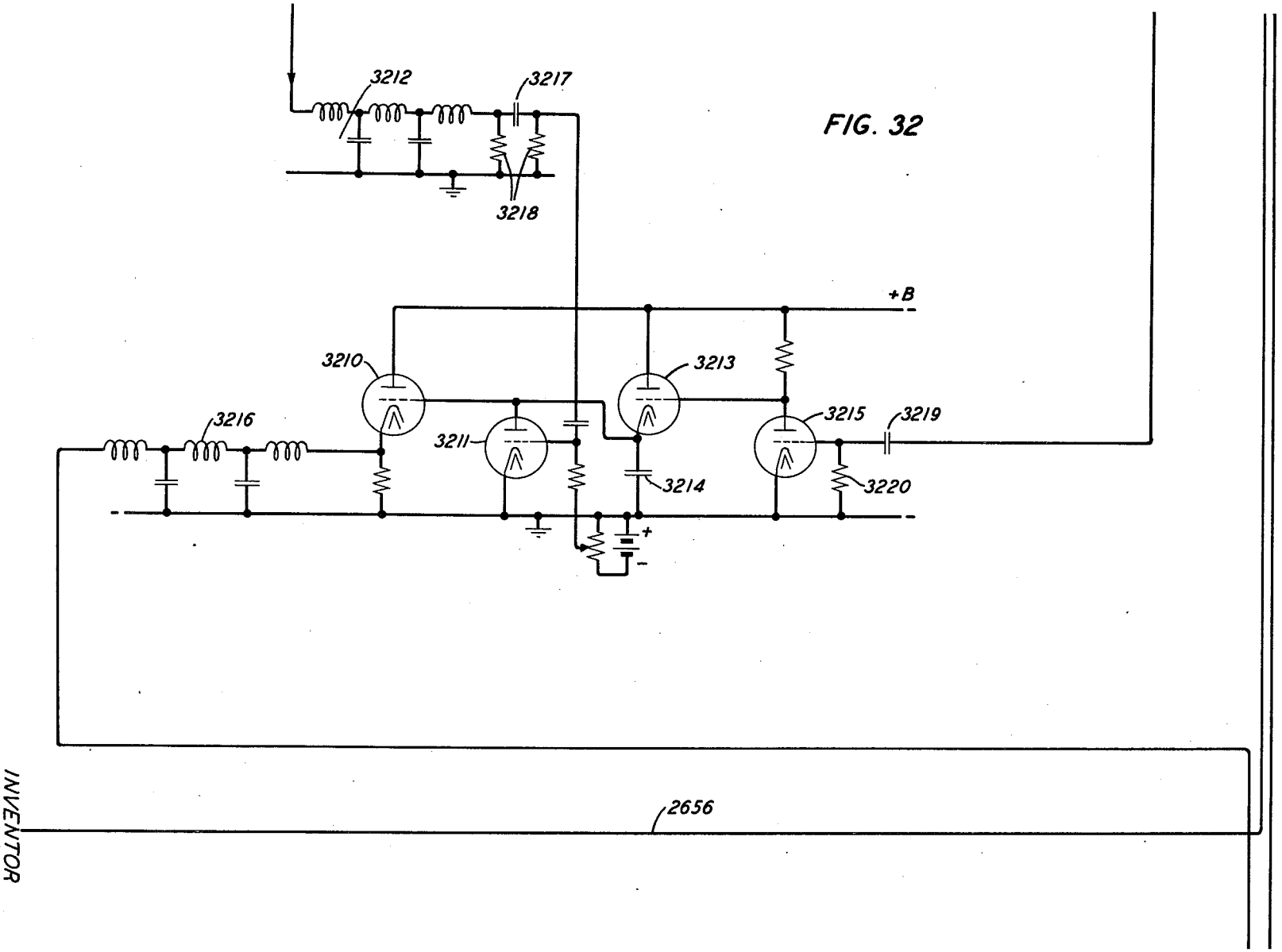
Figure 33:
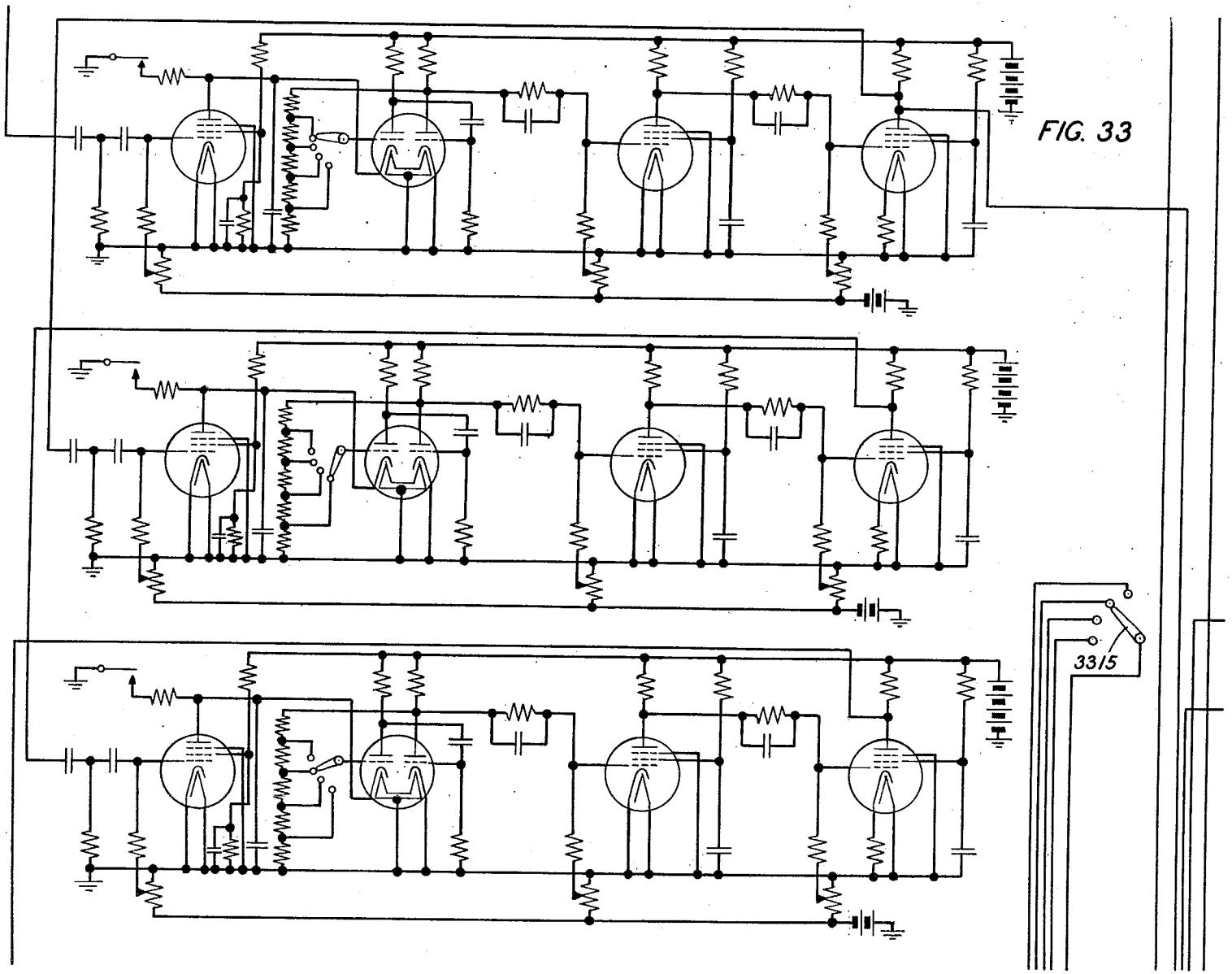

At the receiving station switch 3035 is positioned to engage the switch contact 3056 which causes the corresponding pulses from the delay line 3085 to be transmitted through the regenerating and repeating circuit shown in FIG. 32.

Figure 14:
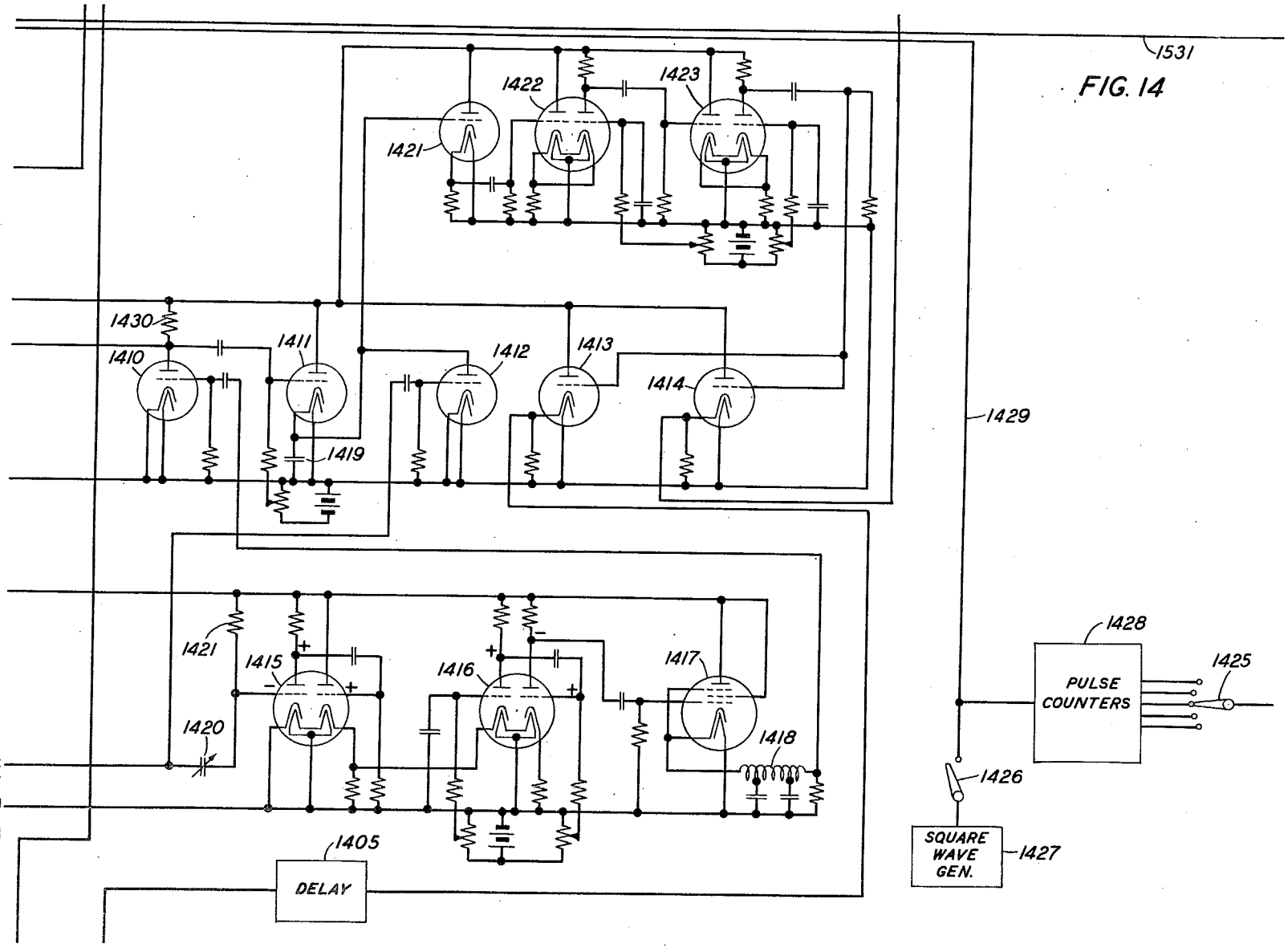

FIG. 32 operates to lengthen and regenerate pulses from the delay line 3085 so that they are similar in wave form and shape to the pulses from the random signal generator shown in FIGS. 13 and 14 and applied to the delay line 1610 at the transmitting station.

Tube 3211 receives a pulse of short duration through the delay line 3212 and the pulse forming and shaping network comprising condenser 3217 and resistors 3218 from tube 3026. Tube 3026 is a cathode-follower tube and receives a positive pulse during the fourth pulse interval of each frame or multiplex cycle. In other words, the control grid of tube 3026 becomes positive and remains more positive during the fourth code element interval of each complete code group because it is connected in parallel with the control grid of tube 3014, which likewise becomes positive at this time. Tube 3026 repeats the positive pulse across its cathode resistor 3027 and applies a corresponding pulse to the delay line 3212. This positive pulse is transmitted down the delay line 3212 and through the pulse forming network comprising resistors 3217 and 3218. The network comprises condenser 3217 and resistor 3218 is designed to have the product of the magnitudes of the capacity and resistance elements of this network a small value so that the network in effect tends to differentiate the pulse from the delay line or other suitable delay device 3212, applying positive pulse of short duration to the control element of tube 3211 at the beginning of the pulse received from line 3212, and a corresponding negative pulse of short duration at the end of the positive pulse received from line 3212.

The delay time of the delay line 3212 or other suitable delay device of the type described hereinafter provides a delay interval which is only slightly less than time between the start of the fourth pulse interval of the multiplex cycle and the time at which pulse in the fifth code element interval is normally received, plus the delay time of the delay network 3085. The positive pulse applied to the control element of tube 3211 at this time causes current to flow in the anode-cathode circuit of this tube and discharge condenser 3214. This discharge occurs slightly before the time in which the pulse from the delay line 3085 may be expected. When this pulse is of a marking character, as described above, it will apply a negative pulse to the control element of tube 3215. The pulse from the delay line 3085 will have a duration similar to other received pulses. This pulse is transmitted through the coupling condenser 3219, which together with the grid resistor 3220, have a small tie constant and thus serve to differentiate the pulse from the delay network 3085 and apply pulses of short duration to the control element of tube 3215.

The negative pulse of short duration applied to the control grid of tube 3215 at the beginning of the pulse received from the delay line 3085, is repeated as a positive pulse in the output circuit of tube 3215 and then applied to the control element of tube 3213. Tube 3213 operates as a cathode-follower tube and causes the upper terminal of condenser 3214 to be charged to a positive voltage in response to the application of a positive pulse to the control grid of tube 3213. This positive voltage is applied to the upper terminal of condenser 3214 a short interval of time after this terminal has been discharged. At the end of the pulse received from the delay line 3085, a positive pulse of short duration is applied to the control grid of tube 3215. This pulse will only be partially repeated by tube 3215 as a negative pulse of small or negligible amplitude as applied to the control grid of tube 3215. The biases applied to tube 3215 are such that the negative pulses in its output circuit have only small or negligible amplitudes. This negative pulse produces no effect upon the voltage of the upper terminal of condenser 3214 because tube 3213 is cut off at this time. Similarly, the negative pulse at the end of the fourth code element time interval produces no effect upon tube 3211 or condenser 3214, because tube 3211 is cut off at this time.

As a result, condenser 3214 upon being charged in response to the marking pulse, remains charged for substantially the entire frame or multiplex code interval until discharged by tube 3211 in the manner described above. If the subsequent pulse received from the delay line 3085 is of a spacing character the condenser 3214 will not be recharged so it will remain discharged for the following multiplex code interval.

The control element of tube 3210 is connected to the upper terminal of condenser 3214. Tube 3210 operates as a cathode-follower tube and repeats the voltage of the upper terminal of condenser 3214 in its cathode circuit which voltage is then applied to the delay line or other delay device 3216. This voltage is next transmitted down the delay line 3410 and absorbed by the terminating resistor 3411 and such other terminating network elements and apparatus as may be necessary. It is desirable that the pulses applied to the delay line 3410 be of substantially identical wave form as the pulses applied to the delay line 1610 so that they will be transmitted down the two lines with the same speed. It is also desirable to have the pulses transmitted down these lines in substantially the same time or phase relationship with respect to the signals and intervals assigned to them. In order to accomplish the necessary timing of the applications of the signals to the delay devices at the two ends of the system, the auxiliary delay devices 1405 and 3216 are provided. As pointed out hereinbefore these devices may comprise part of the first section of the respective delay lines 1610 and 3410, provided of course the sections may be made adjustable so that the proper time and phase relationship may be maintained at both ends of the system.

Figure 53:
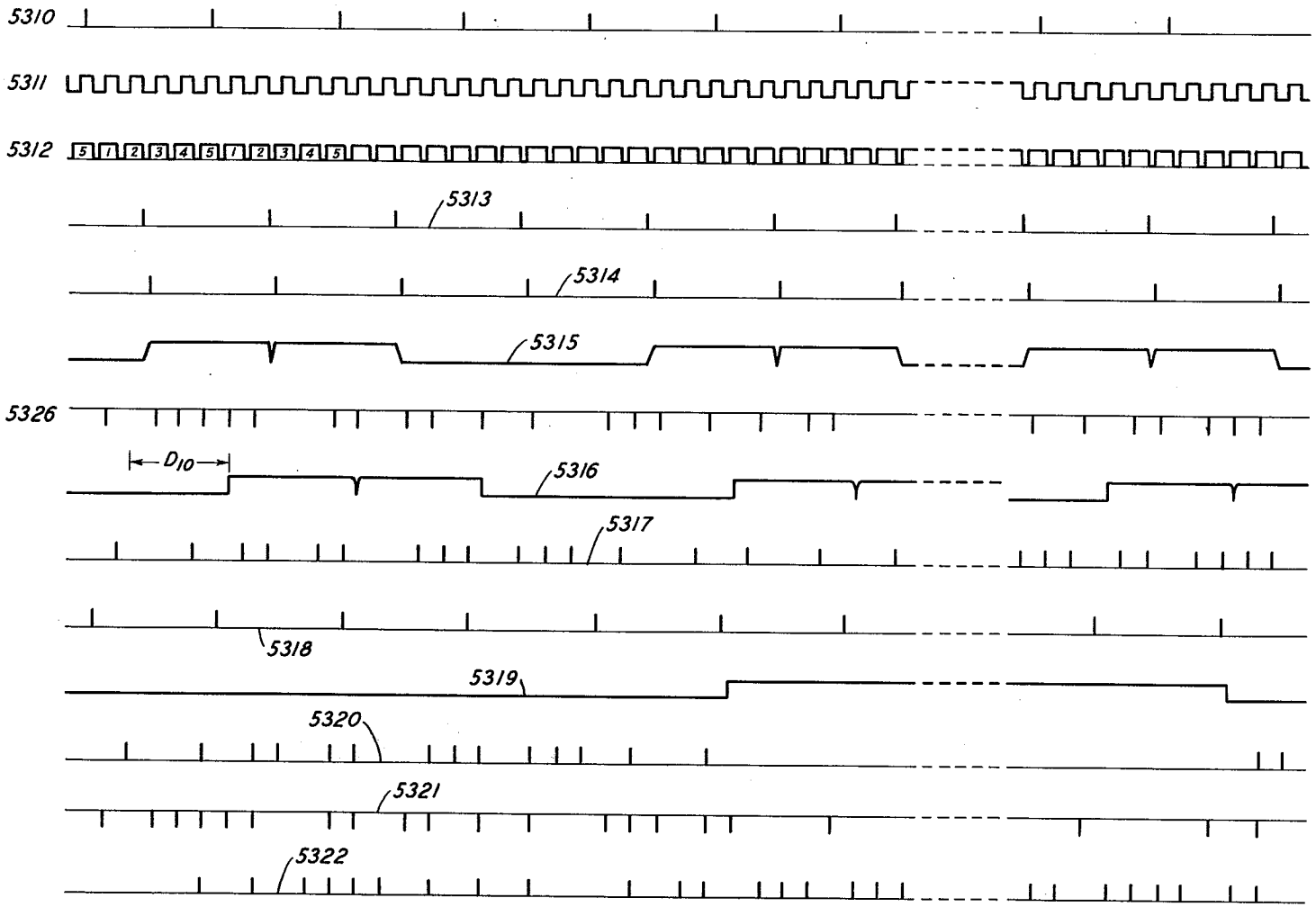
Figure 54:
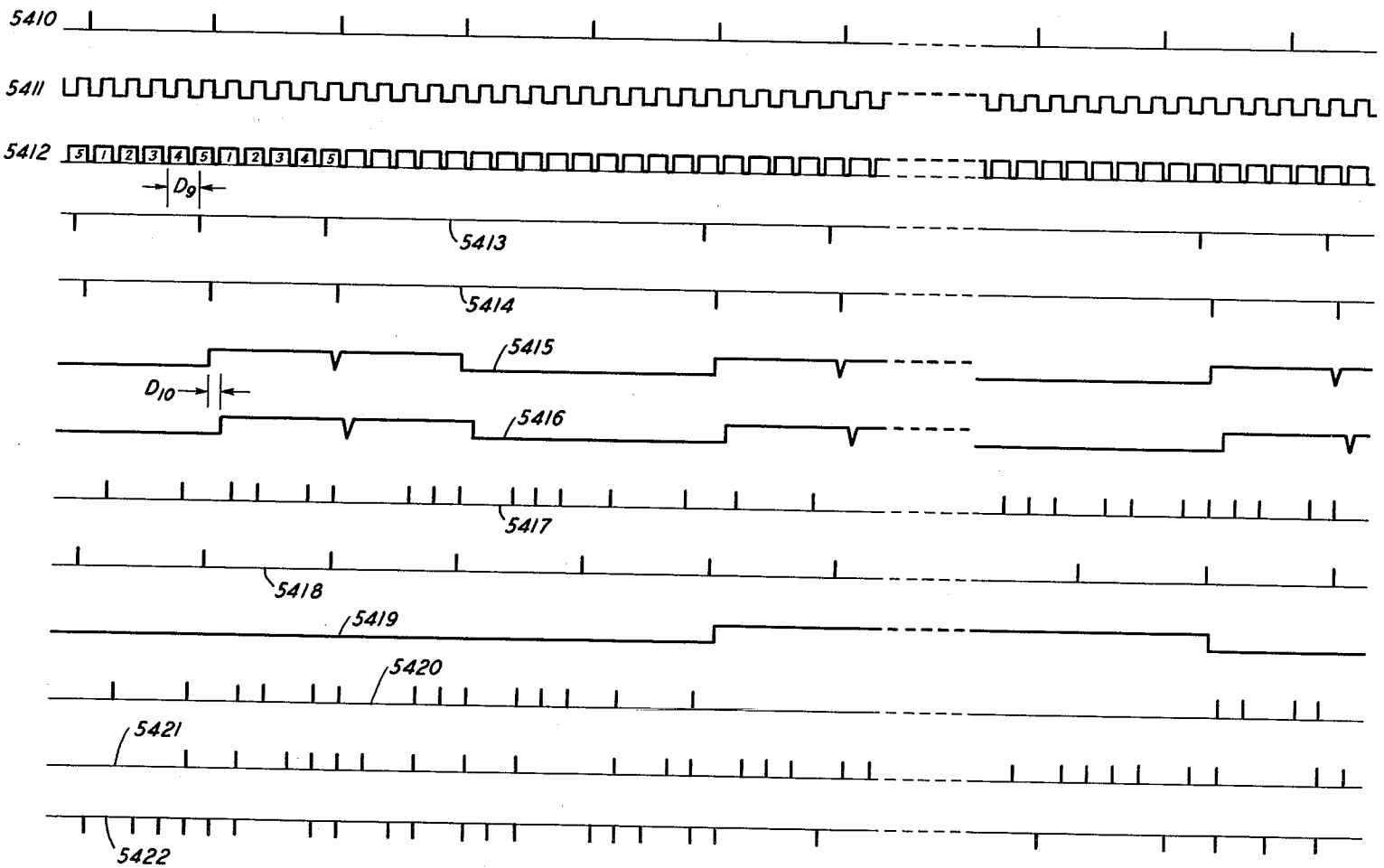

The timing of these various currents and pulses is illustrated in FIGS. 53 and 54. FIG. 53 shows the various pulses at the transmitting station, while FIG. 54 shows similar or corresponding pulses at the receiving station. The first graph in both figures, namely, 5310 and 5410, show the synchronizing pulses applied to the code element time generators at the respective ends of the system. Graphs 5311 and 5411 illustrate the output of the code element timing circuits at the respective ends of the system. The rectangles 5312 and 5412 represent the times at which the various channels or code element intervals are assigned for transmission over the multiplex system.

Graph 5313 represents the differentiated pulses occurring at the end of the second code element interval from tube 520 which pulses are employed to discharge condenser 1419 as described above. The graph 5314 illustrates the same pulses further delayed by the circuits and tubes in the lower part of FIG. 14, as well as by the delay line 1418. As described above, the pulses shown in graph 5314 are employed to permit the upper terminal of condenser 1419 to be recharged under control of the noise current from the random signal generator shown in the upper part of FIG. 13. The graph 5315 ilustrates the wave form of the voltage on the upper terminal of condenser 5419 after it has passed through the amplifying limiting and otherwise pulse forming and shaping tubes 1421, 1422 and 1423. This graph consequently shows the wave form of the pulses as applied to delay line 1610 through the delay network 1405. As described above, the potential on the upper terminal of condenser 1419 after being amplified, limited, clipped and otherwise formed, is also applied to the gate tube 1115 and thus controls the fifth pulse of each code group tramsitted over the multiplex system. Graph 5326 represents typical code groups of pulses transmitted over the system in which the fifth pulse is marking when the voltage of the upper terminal of condenser 1419 is in excess of a predetermined value and in which the fifth pulse is spacing when the upper terminal of condenser 1419 does not exceed such predetermined value. In other words, when the graph 5315 is more positive, the marking pulse appears in the fifth code element interval and when the graph 1513 is not positive, the marking pulse does not appear in the transmitted pulses; instead a spacing pulse appears at this time.

This pulse is transmitted to the receiving station and distributed by the gas tube to the delay line 3085. These pulses as distributed to the delay line are represented by graph 5413 and as they appear the output of the delay line 3085 by graph 5414. The circuits and tubes of FIG. 32, lengthen these pulses and regenerate them to have a wave form similar to that shown in FIG. 5415, which is the wave form of the pulses applied through the delay line 3216 to the key generator delay line 3410. The delay interval between the pulses of graphs 5413 and 5414 represent the delay time of the delay line 3085. The delay indicated by D-9 is the delay interval of the delay line 3212 or other suitable delay device 3212. As described above, as indicated in the drawing, this delay interval is such that the upper terminal of condenser 3214 is discharged slightly before the fifth pulse from the delay line 3085 causes this condenser to be recharged.

It is apparent that the wave shape of the pulses 5315 and 5415 are quite similar. These pulses are then transmitted through the two auxiliary delay devices and applied to the delay lines of the key generators at the two ends of the system. In order to properly utilize these signals, it is desirable that they have the same time or phase relationship with the multiplex code intervals at the two ends of the system. However, in order to properly generate the pulses at one end and transmit information relative to them to the other end, and regenerate them at the other end, requires that they be generated and regenerated during different poritons of the multiplex code interval or during different multiplex code intervals. Consequently, it is necessary to delay the pulses at the transmitting station for greater interval of time prior to the application of these pulses to the delay line 1610.

Furthermore, it is undesirable that these pulses should change in character at the time the pulses are received from the code element timing generator and applied to the mark-space reverser and key generators. In order to properly control the relative timing, the delay device 3216 is provided. This delay device has a delay interval illustrated by D-10 of FIG. 54. It is assumed that the key pulses output from the key generator will require a small portion of a code element interval to be generated and transmitted through key generator which delay interval comprises the time required to transmit the pulses through the various tubes and the delay devices and pulse lengthening circuit described hereinafter. The delay interval D-10 shown in FIG. 53 represents the corresponding delay interval of the delay device 1405 at the tramsmitted station. It will be observed that the graphs 5316 and 5416 are similar to the corresponding graphs 5315 and 5415, and similar to each other, and in addition occupy substantially the same position in the varius multiplex cycles in both FIGS. 53 and 54. Thus the pulses represented by the graphs 5316 and 5416 are in similar wave form and time and phase adjustment for the application to the delay lines 1610 and 3410.

Delay device or line 1610 is provided with a plurality of taps. Delay line 3410 provided with a similar plurality of taps. The taps along the line provide progressively greater delays. The first section of the line together with delay devices or lines 1405 and 3216 provide a sufficient initial delay interval to insure that the pulses will have sufficient time at the receiving end of the system to be received and properly applied to the delay line before they can be employed at either end of the line to encipher or decipher the message signals. It is essential that the pulses be applied to the delay lines at substantially the same times but not employed encipher or decipher signals until the character of the pulses to be applied to the line at the receiving end has been properly determined. In the exemplary embodiment described in detail herein each of the succeeding taps is connected to the delay line a code element interval later. That is, the time delay between each of the succeeding taps on the delay lines is equivalent to a single code element pulse or a single pulse interval.

Any suitable number of such taps may be provided with the limits of the delay line and the line may be extended to provide as long an overall delay as may be desired.

In the exemplary embodiment set forth herein, it is assumed that a satisfactory and sufficiently long line will provide fifty such taps, plus the initial delay interval, and then a final terminating network including attenuation means and much additional length of line as may be necessary or desirable. A vacuum tube such as tubes 1621, 1622, 1623, 1624, 1625, 1626, etc., is associated with each of the taps and has its input circuit or control grid connected to the line at the proper place. The tubes are connected as cathode-follower tubes so that they present the highest impedance to the line and thus do not dissipate the pulses traveling down the line or add appreciable attenuation to the transmission characteristics of the lines. While tubes 1621, 1622, 1623, 1624, 1625, 1626, etc., are shown as cathode-follower types of tubes they represent one or more tubes for coupling, repeating, amplifying, clipping, limiting, and otherwise shaping and regenerating the pulses transmitted through them. Furthermore, when necessary or desirable, such tubes may be connected in the delay line to compensate for the attenuation and distortion introduced by the delay lines.

Figure 34:
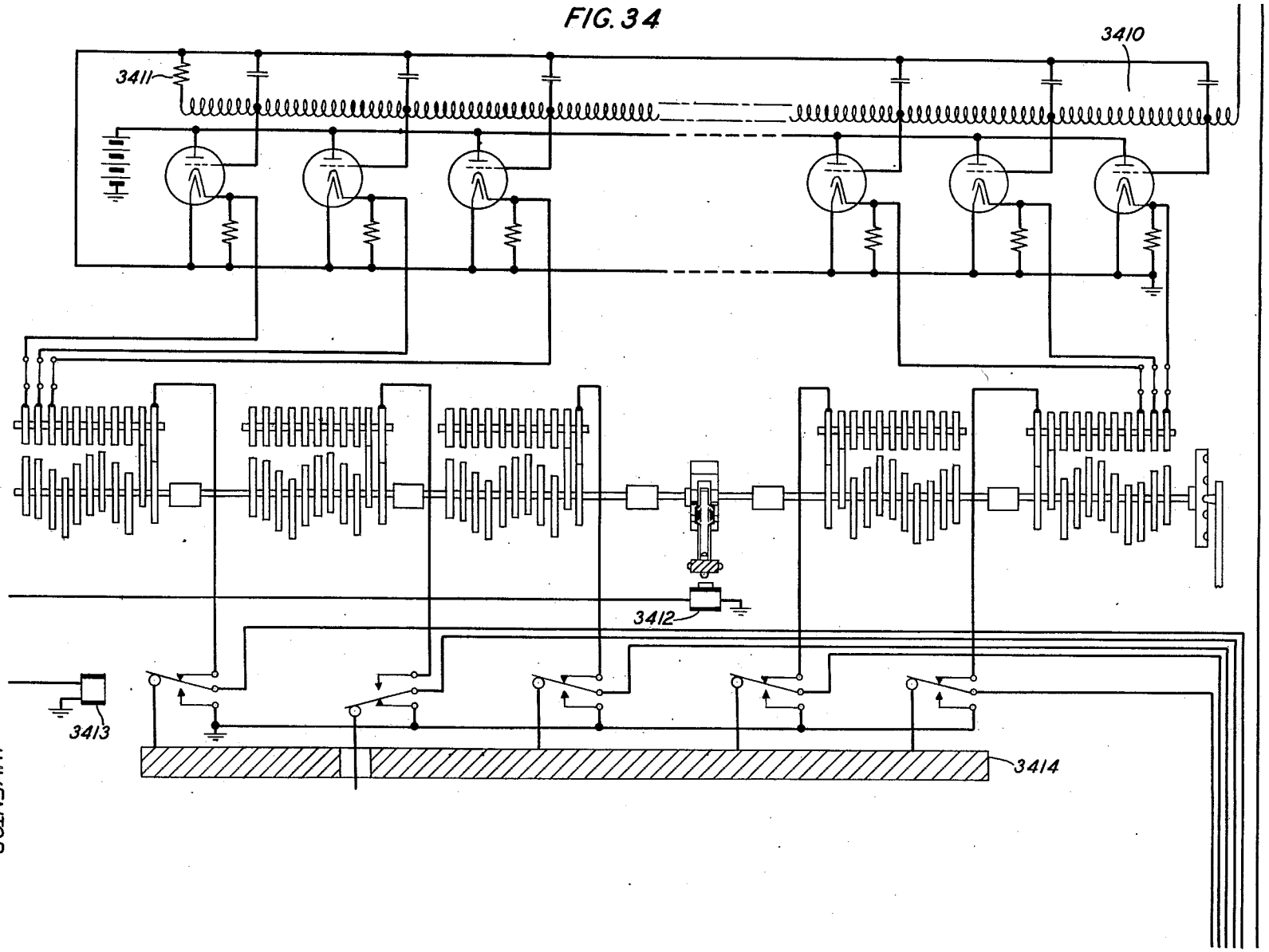
Figure 35:
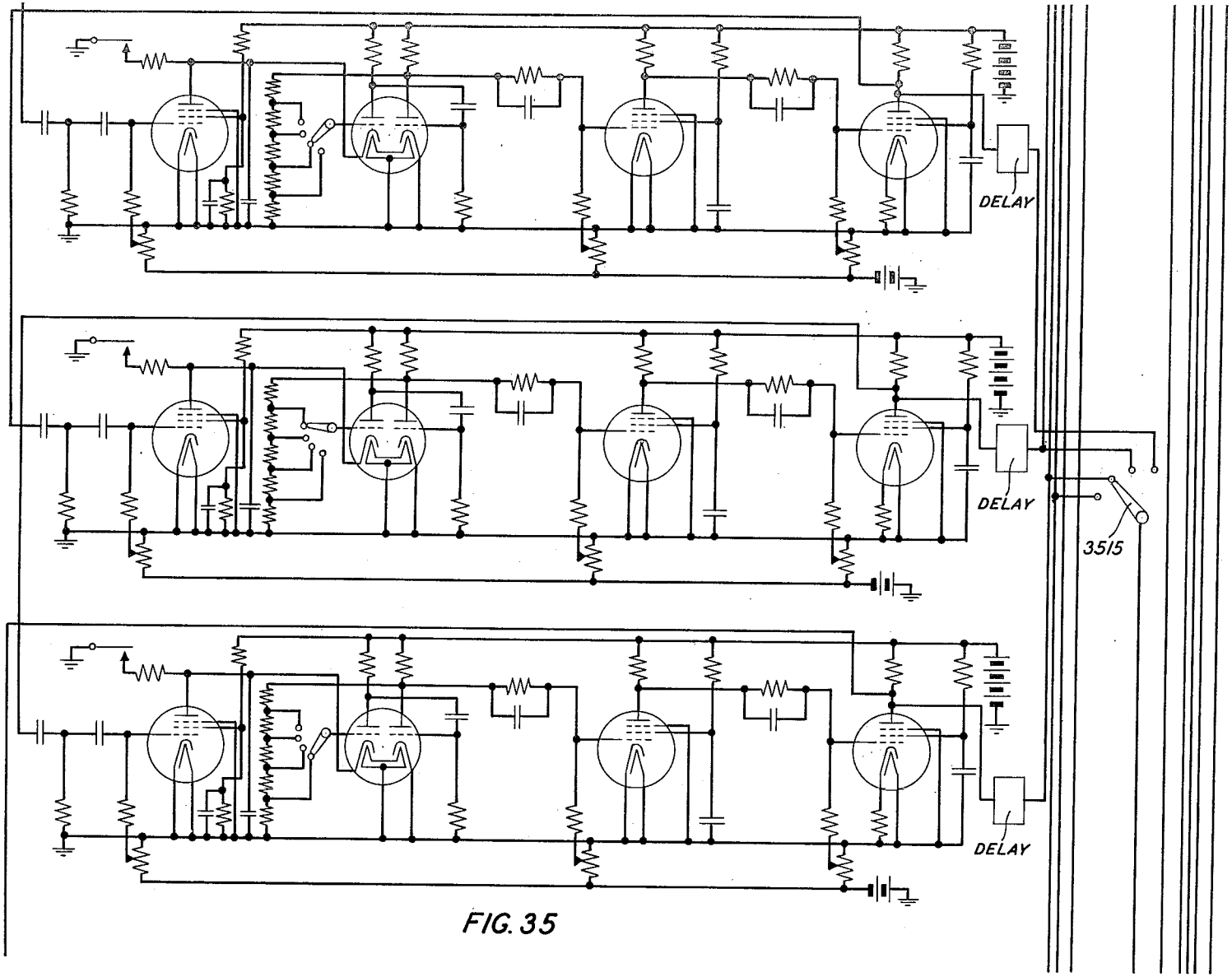

Each of the vacuum tubes has its output or cathode circuit connected to one of a plurality of contacts of a stepping switch. The switches are shown diagrammatically in FIGS. 16 and 34 and represent any suitable type of multi-position switches capable of connecting various circuit paths through the switch in the various positions of the switch. The switch shown in the drawing is similar to the switch shown in FIG. 4 of U.S. Pat. No. 1,829,783 granted to Chestnut et al, November 3, 1931. Such a switch comprises plurality of cams each having one or more lobes or raised portions for closing the contact associated therewith in any one or more positions of the switch. In the arrangement shown in FIGS. 16 and 34, the switch is driven by an electro magnet 1612 in cooperation with the ratchet wheel 1615 and pawl 1616. The magnet 1612 is normally released. By energization of this magnet its armature 1617 is attracted, moving pawl 1616 downward as seen in FIG. 16A and FIGS. 16 and 34, and thus advancing the switches one step. The switch advances during the operation of the magnet and upon the complete operation of the magnet, the switch has been advanced to its next position. Thereafter, the magnet is released so that its armature 1617 and pawl 1616 are restored to their initial positions. The switches then remain in the position set until the magnet 1612 is again energized. As shown in FIG. 16, five independent switches are connected together by electrically insulated couplings 1627, 1628, 1629, 1630, 1640. These couplings couple the shafts of the various switches together so that they are driven by the same ratchet 1615. These switches are advanced one step at a time under control of the stepping magnet 1612. A cam or contact mechanism is provided for each switch such as 1631, 1632, 1633, 1634 and 1635. Thus the outputs of the respective tubes or amplifiers 1621 through 1626 and other similar tubes or amplifiers not shown are connected through the switch to the output terminals one or more times during each complete rotation of the switch. In general, each switch is provided with contacts or switch mechanisms capable of connection to ten different vacuum tubes which tubes in turn are connected to ten different taps on the delay line. Furthermore, the cams and contacts controlled thereby on each of the switches are usually arranged to connect the output lead from the switch to only one of input leads from the vacuum tubes, at a time.

The stepping switch may have the cams arranged so that they may be adjusted and set in different positions on the different switches or they may be replaced by other cams when it is desired to increase the degree of secrecy. It is of course necessary that the switches at both the transmitting station and receiving station have identical sets of cams positioned in identical positions at all times during which the output of the generators at both ends of the system are employed to cipher and decipher the transmitted signals.

A centering device comprising the notched member 1618 and detent 1619 is provided to properly position the switch and hold it in each of the proper positions so that the switch will be properly held in any one of its positions during the time the magnet 1612 is released.

It is to be understood that the connections to the various tubes connected to the delay lines to the various contacts of the switches may be wired in permanently or they may be arranged so that these connections can readily be changed from time to time in order to secure greater degree of secrecy of the enciphered message signals. Such arrangemenets are well understood as for example those shown in the above-identified patent to Chestnut et al the disclosure of which is hereby made a part of the present disclosure to the same extent as if fully set forth herein. Suitable interconnecting terminals are shown at 1650 and 1660.

The five output leads from the five switches extend to contacts of tape controlled mechanism. A suitable type of tape control mechanism is similar to tape control transmitter employed in telegraph systems such as for example, tape controlled contact mechanism or transmitter disclosed in U.S. Pat. No. 1,298,440, granted to Benjamin, March 25, 1919, the disclosure of which patent is hereby made part of the present application as if repeated and set forth in full herein.

Briefly, such a mechanism comprises a plurality of contacts associated with tape feeling or sensing mechanism. The tape, illustrated by tape 1614 shown in cross section in FIG. 16, is employed to control the position of the contacts. The contacts are provided with pin members which determine which positions in the tape have punches or perforations therein. Such positions allow the associated contacts to be moved to their operated positions and those fingers which find no punches in the tape are restrained from further movement so that the contacts remain in the original or initial position. As shown in FIG. 16, the tape control contacts 1641, 1642, 1643, 1645 are in their normal positions and are maintained in this position because there are no perforations in the tape 1614 adjacent the feeler pins controlling these contacts. However, contact 1644 is shown operated to its opposite position due to a punch or perforation or other similar type of mark or hole in the tape 1614. The contacts will thus remain in the position shown in the drawing as long as the controlling magnet 1613 remains released. Upon energization of the magnet 1613, the contacts are all restored to their normal position, the sensing pins withdrawn from the tape and the tape advanced. Upon the release of the magnet, the sensing pins are again released whereupon the contacts associated with pins finding holes or other emboss marks or punches in the tape are actuated to their operated position. The other contacts remain in their normal position. As shown in the drawing, the normal contacts of each one of these contact groups is connected to one of the stepping switches. The armature contact member of each group is connected to a group of reentrant or marked space reversing circuits. The operated or front contact of the tape control contacts 1641 through 1645 inclusive, are shown all connected to ground. If it is so desired, these contacts may be connected to other stepping switches similar to those controlled by the ratchet mechanism 1615 or the tape contacts may be employed to alter the connections between the switches and the leads extended to the marked space reversing circuits shown in FIGS. 18 and 20. Here again the various connections may be arranged so that they may be readily changed in accordance with any desired information or schedule.

The tape 1614, of course, will be supplied with any desired or suitable perforations therein and may be arranged to be used over and over again or in cases where greater secrecy is required, this tape may be used only once. It is to be understood of course, that an identical tape 3414 is provided at the receiving station and it is set with the same perforations under the feeler pins as at the transmitting stations.

Figure 18:
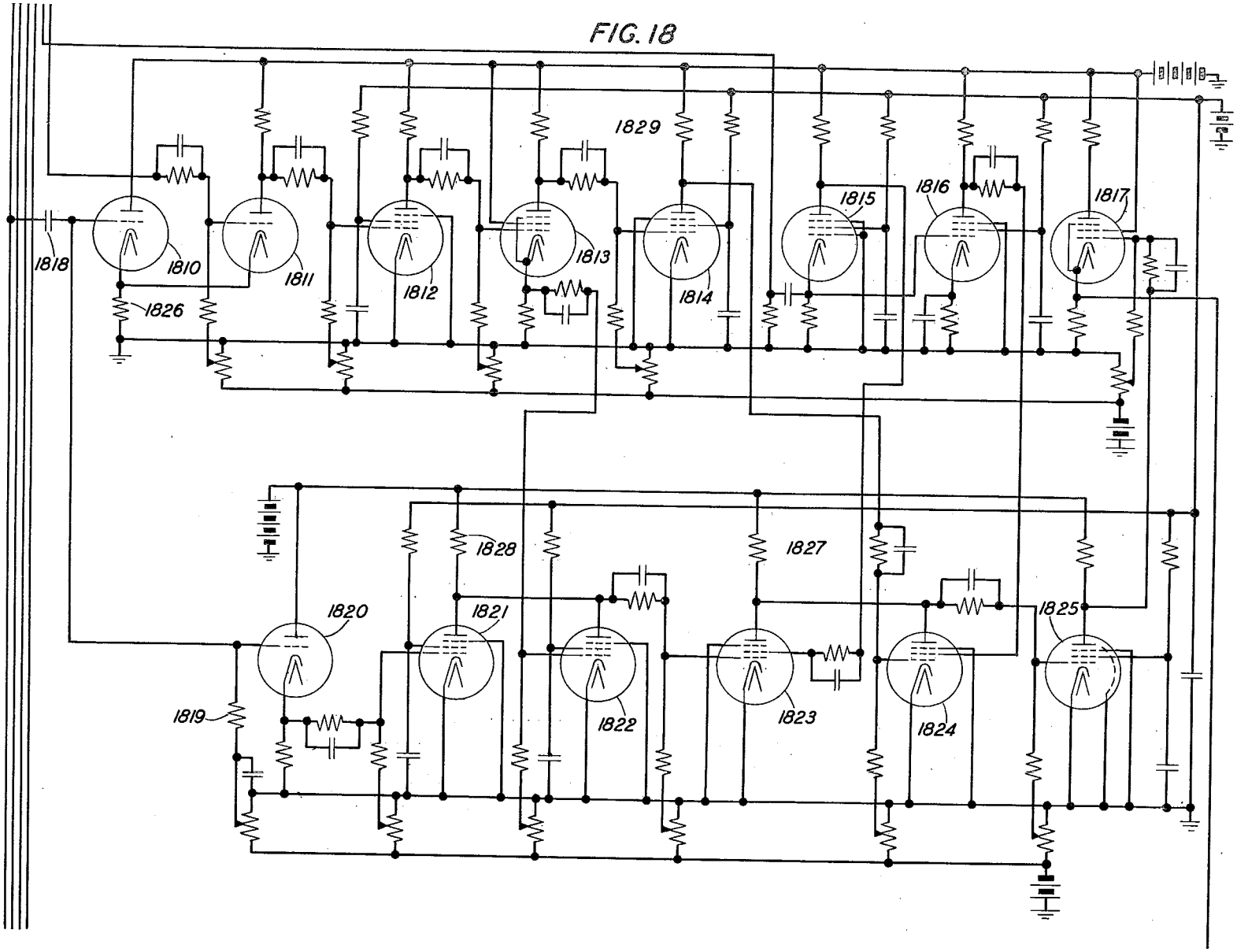

The output from the tape control contacts 1642 and 1641 are combined in the circuit shown in FIG. 18, such that if the output from these two contacts are of like character or polarity no output pulse results. On the other hand if these two outputs are unlike in character or polarity, negative output pulses are transmitted from the output of circuit shown in FIG. 18. In other words, the output is of a positive character or nature if the two outputs from the tape controlled contacts 1642 and 1641 are alike and negative in character, or less positive, if the two outputs are unlike. The combining circuit shown in FIG. 18 is sometimes called a mark space reversing circuit and other times a reentrance circuit in the exemplary embodiment of the invention shown here in these combining circuits are arranged to accurately time the output pulses as well as control their length and shape.

As pointed out above, the pulses applied to the delay line 1610 are frequently of a code cycle in length. For example, where the repetition rate is 10,000 cycles, these pulses will be approximately 1/10,000 of a second long; that is, about 100 microseconds. The time assigned to each of the code element pulses under assumed conditions will be 20 microseconds. Thus each of the code element timing pulses received from the code element timing circuit shown in the upper parts of FIG. 8 and 9 will, under these assumed conditions, have a repetition rate of approximately 20 microseconds. The negative pulses from the code element timing circuit are connected to the control grids of tubes 1810 and 1820 through the coupling condenser 1818. This condenser, together with the grid resistor 1819, have a low time constant. In other words, the product of their capacity and resistance is small, with the result that only a very short pulse is applied to the control elements of these two in response to each of the currents received from the code element timing circuit, which pulses under the assumed conditions, will be approximately 20 microseconds apart.

The output from the tape controlled contacts 1642 are applied to the cathode of tube 1815 and the control grid of tube 1816. As a result the output of the tubes 1815 and 1816 will be of opposite character or polarity. Thus the application of a positive pulse to the cathode of tube 1815 and to the grid of tube 1816, from one of the cathode circuits of tubes 1621 to 1626 inclusive through the various contacts including the tape control contact 1642, will cause a positive pulse to be repeated in the output circuit of tube 1815 and a negative pulse to be repeated in the output circuit of tube 1816. The output of tube 1815 is connected to the one of the grids or control elements of tube 1823. The output or anode circuit of tube 1816 connected to one of the control elements of tube 1824. As shown in the drawing, the output of tubes 1815 and 1816 is connected to the screen grids of the respective grids 1823 and 1824. However it is to be understood these output circuits may be connected to any desired one of the control elements of the tubes 1823 and 1824. The coupling circuits between the various tubes are designed so that the potentials or output pulses applied to the control elements of tubes 1823 and 1824 will be substantially constant for the duration of the pulses received from the delay line 1610 through the various circuits described above. In other words, these pulses will have a length of approximately 100 microseconds or multiples thereof, depending upon the pulses transmitted down the delay line 1610. Of course if the output of the tap controlled contacts is not positive, then the polarity of the potential applied to the screens of tube 1823 and 1924 will be reversed. In other words, if the output from the contact 1642 is positive, a positive voltage is applied to the screen of tube 1823 and a negative voltage is applied to the screen of tube 1824. On the other hand if the output from contacts 1642 is not positive then the potential of the screen of tube 1823 will be negative and the potential of the screen of tube 1824 will be positive.

The output from tape controlled contacts 1641 is applied to the control element of tube 1811. The cathode of tube 1811 is connected in parallel with the cathode of tube 1810 and the common cathode resistor 1826. The bias voltage applied to the control element of tube 1811 and the potential applied to its cathode due to current flowing through the tube 1810 and the common cathode resistor 1826 is such that current does not normally flow in the output circuit of tube 1811 even though a positive voltage is applied to its grid from the contacts 1641. On the other hand, tube 1810 is normally conducting current in its anode-cathode circuit due to the bias voltages applied to its various elements. Consequently when the output from the code element timing circuit becomes more positive the control grids of tubes 1810 and 1820 also become more positive. However, since these tubes are already conducting substantially their saturation current in their anode-cathode circuits, the further increase in the control grid potential at this time does not produce further appreciable voltage change of their cathodes. However when the output voltage frm the code element timing circuits changes in a negative direction, that is, from a more positive voltage to a less positive voltage or to a negative voltage, a negative pulse of short duration is transmitted to the coupling condenser 1818, to the control element of tubes 1810 and 1820. This pulse interrupts the current flowing through the cathode resistors of these tubes and thus applies a negative pulse to the cathode of tube 1811 and tube 1821. The application of the voltage or pulse negative to the cathode of tube 1811, together with the application of a more positive potential to its control element causes a negative pulse to be repeated in the output circuit of tube 1811 at this time.

It should be noted that the duration of the pulse applied to the control grid of tube 1811 will be of approximately 100 microseconds duration or some multiple thereof, under the assumed conditions, but that the pulse repeated in its output circuits would be of much shorter duration, for example of the order of several microseconds or less. Pulses similar to the above described negative pulse will be repeated in the output circuit of tube 1811 approximately every 20 microseconds so long as the positive pulse is applied to the control element of tube 1811. The output pulse from tube 1811 is repeated by tube 1812 as a positive pulse and applied to the control element of tube 1813. Tube 1813 operates as a phase inverter tube. In other words, tube 1813 has two output circuits and two output resistors, one in the anode circuit and the other in the cathode circuit. The output from the cathode circuit is positive in response to a positive pulse applied to the control element of tube 1813. The output of the anode circuit is negative in response to a positive pulse applied to the control element of tube 1813. The output positive pulse from the cathode of tube 1823 is applied to the control element of tube 1822. The application of the positive pulse to the control element of tube 1822 maintains current flowing through the common anode resistor 1828 so that the potential of the anode of tube 1822 and thus the potential of the control grid of tube 1823 connected to it remain negative or at a low positive voltage, even though a positive pulse is repeated through tube 1821 at this time.

The negative pulse from the anode of tube 1813 is repeated by tube 1814 as a positive pulse and applied to the control element of tube 1824.

If the outputs of both tape control contacts 1642 and 1641 are positive at this time, a negative pulse is applied to the control grid of tube 1823 and a positive pulse to a screen grid of this tube. Likewise a positive pulse is applied to the control grid of tube 1824 and a negative pulse to its screen grid. Tubes 1823 and 1824 are biased so that no current will flow in either of their output circuits unless a more positive pulse is applied to both their control grids and their screens. Consequently, with a positive potential simultaneous output from contacts 1642 and 1641 no current flows through either tube 1823 or 1824.

If, however, the voltage output from contacts 1641 is positive or marking but the voltage from contacts 1642 is not positive, then the voltage of the screen grid of tube 1823 will be negative so no current flows in the output circuits of this tube. However, the potential applied to the screen grid of tube 1824 at this time will be positive so that positive signaling potentials are applied to both the control grid and screen grid of tube 1824 and as a result current will flow through tube 1824 and the common anode resistor 1827, with the result that a negative pulse will be applied to the control element of tube 1825. This pulse is repeated as a positive pulse in the output circuit of tube 1825 and further repeated as a positive pulse in the output circuit of tube 1817. Tubes 1825 and 1817 operate as amplifying and repeating tubes and they also may serve to clip, limit or otherwise shape the output pulses.

If the output of the tape controlled contacts 1641 is not positive, then no pulse will be repeated in the output circuit of tube 1811 upon the application of negative pulse to its cathode from tube 1810 as described above. As a result, a positive voltage or pulse is not applied to the control grid of tube 1824 at this time. Neither is a positive pulse applied to the control grid of tube 1822. Under these circumstances, the application of a negative pulse to the control grid of tube 1821, from the cathode of tube 1820 as described above, in response to the output from element timing circuit, interrupts the current flowing through tube 1821 and allows its anode to become more positive. Inasmuch as substantially no current is flowing through tube 1822 at this time because this control grid is not positive as described above, a positive pulse having a short duration is applied to the control grid of tube 1823. The above-described positive pulse will thus be applied to the control grid of 1823 at intervals of approximately 20 microseconds so long as the output from the tape control contacts 1641 is not positive.

If the output from the tape control contacts 1642 is positive at this time, i.e. when the output of contacts 1641 is negative, a positive potential is also applied to the screen grid of tube 1823 with the result that a pulse of current flows in the output circuit of this tube and applies a negative pulse to the control element of tube 1825. Tubes 1825 and 1817 will again repeat this pulse as a positive pulse in the output circuits of tube 1817.

If on the other hand the output of contacts 1642 is also not positive at this time, then a negative potential or signaling pulse is applied to the screen in tube 1823. Under these circumstances, with a negative voltage applied to the screen of tube 1823 and positive applied to its control grid, no current flows through the output circuit tube 1823.

It should be noted that during the time the output from tape control contacts 1641 is not positive, a negative potential due to the anode current of tube 1814 flowing in the anode resistor 1829 as a result of the bias voltages applied to the various electrodes of tube 1814, aplies a negative potential to the control grid of tube 1824. Consequently, 1824 cannot pass any current in its output circuit at this time.

It is thus apparent that when the output from the tape control contacts 1642 and 1641 are of like character or polarity no current flows through either tube 1823 or 1824. On the other hand if the output of these contacts is of unlike character or polarity, a pulse of current flows on the output circuit in either one or the other of these tubes 1823 or 1824 and causes an output pulse to be transmitted to the delay device 2013.

Figure 20:
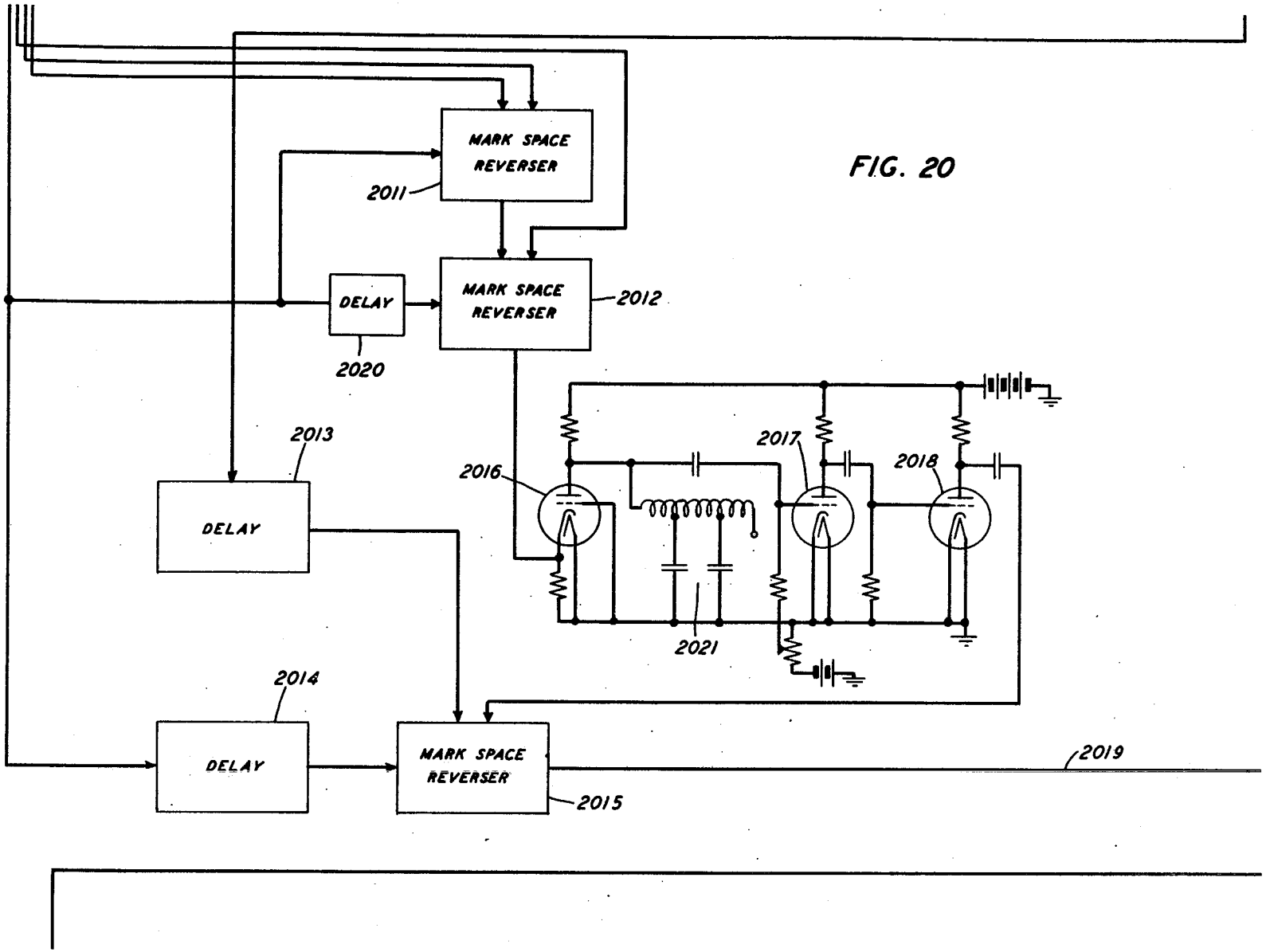

The output from the tape control contacts 1643 and 1644 is combined by the mark space reversing circuit 2011 in a manner similar to the manner in which the output contacts 1641 and 1642 are combined by the circuits of FIG. 18. In other words, the mark space reverse circuit 2011 shown in FIG. 20 represents another circuit similar to the one shown in detail in FIG. 18.

The output of the tape control contacts 1645 and the output of the mark space reverser circuit 2011 are employed to control another similar circuit 2012. The timing signals applied to control the mark space reverser circuit 2012 are delayed by the delay device or line 2020. This delay device is provided to compensate for the time required to transmit the signals through the various tubes and circuits of the mark space reverser circuit 2011. The output of the circuit shown in FIG. 18 is transmitted through the delay device 2013 and the output from circuit 2012 is transmitted through a pulse lengthening device comprising tubes 2016, 2017, 2018.

The pulse lengthening circuit comprises tubes 2016, 2017, and 2018. Tube 2016 operates as a grounded grid amplifier tube and repeats positive pulses from the mark space reverser 2012 as positive pulses in its output circuit. These pulses are of short duration and timed by means of the pulses from the code element timing circuit which are delayed by the delay device 2020. Delay device 2020 is provided so that the circuits of the mark space reverser 2012 will have sufficient time to respond to the pulses from the mark space reverser 2011 which pulses are delayed and thus a little later than the accurately timed pulses from the code element timing generator, due to the time required to transmit these pulses through the pulse forming and shaping circuits of the previous mark space reverser 2011.

The pulses repeated in the output circuit of tube 2016 are applied to the control element of tube 2017 and also to a delay line 2021. The pulses are transmitted down the delay line 2021 which is open circuited and thus reflects back a pulse of the same character. Thus if the delay line 2021 has a delay interval substantially equal to or sightly less than one-half of the length of the pulse, the reflecting pulse from the line will be transmitted back to the control element of tube 2017 at about the time or just before the initially applied pulse is terminated. Thereafter the reflected pulse continues to be applied to the control element of tube 2017 for substantially the second duration pulse. Thus the pulse is substantially doubled in length as applied to the control element of tube 2017.

Tubes 2017 and 2018 represent suitable tubes and circuits for pulse lengthening, shaping, clipping and otherwise forming and controlling of wave form of the pulses which pulses are applied to the mark space reverser 2015. Thereafter the output from the delay device 2013, the pulse lengthening device is again combined in a final mark space reverser 2015 which likewise is similar to the circuit of FIG. 18. In this case however additional delay device 2014 is required so that the pulses from the code element timing circuit will be properly timed with respect to the pulses applied to the mark space reverser circuit 2015 due to the delay of these pulses being transmitted through the various mark space reverser circuits in the manner described above. The output from the key generator is then applied to the conductor 2019 which is later used to control the enciphering of the coded signal as will be described hereinafter. Graph 5317 illustrates a few representative pulses from the key pulse generator circuits. As shown in the graph these output pulses are delayed about a third or half of the time assigned to a code element. The conductor 2019 however causes the pulses to be transmitted through certain additional switching circuits to properly control th key generator and to increase the security of the enciphering signals.

Figure 36:
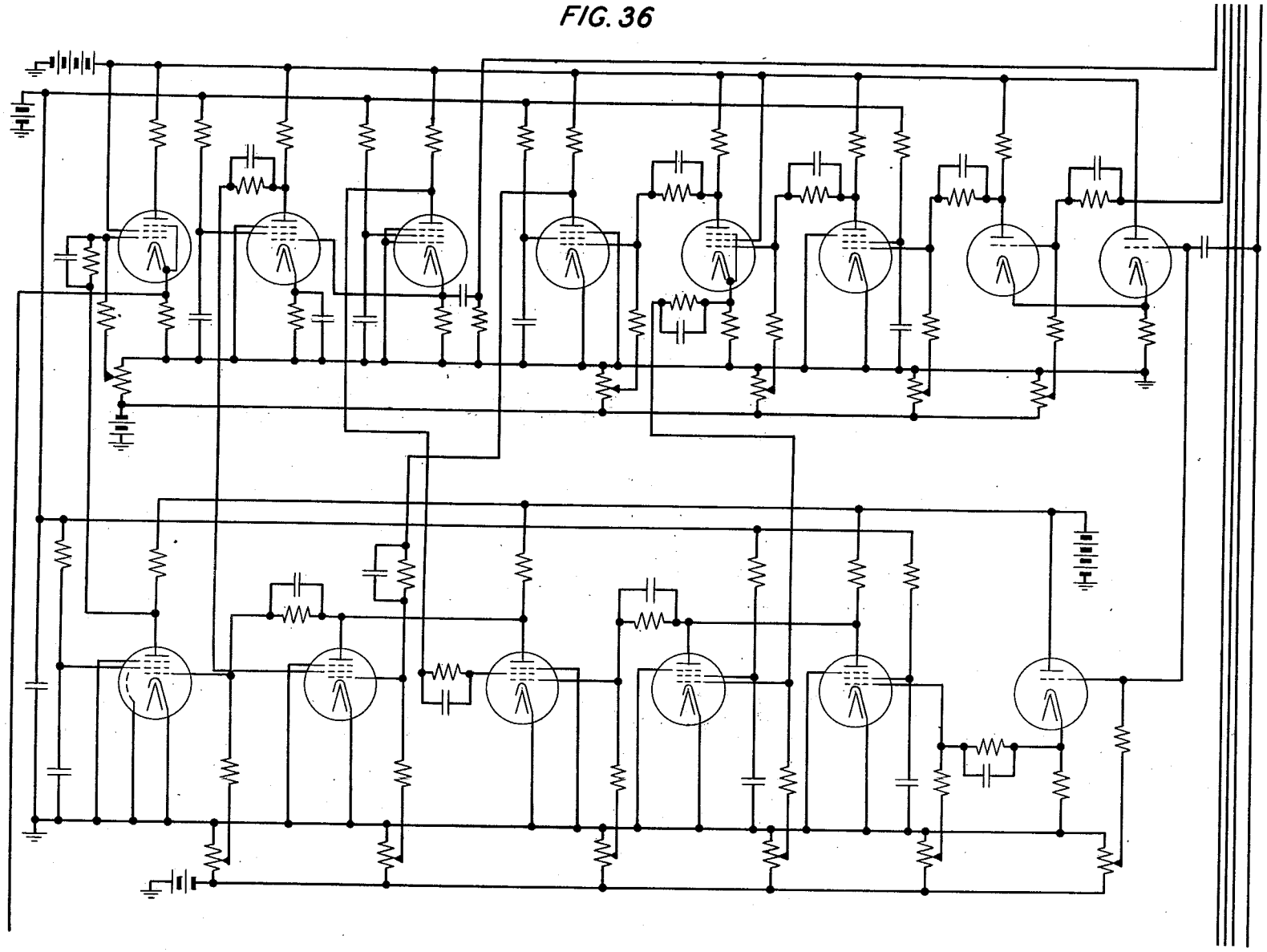
Figure 37:
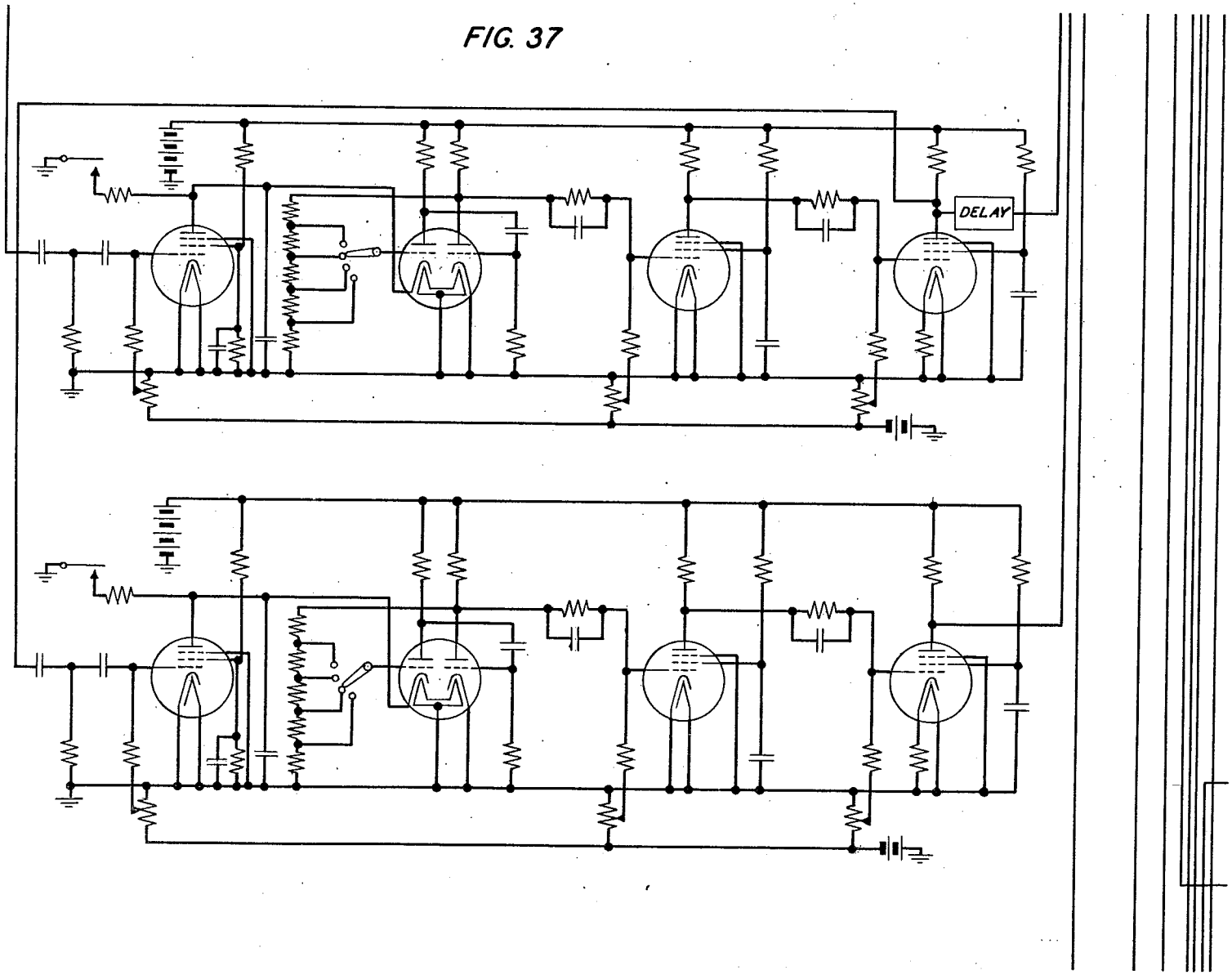
Figure 38:
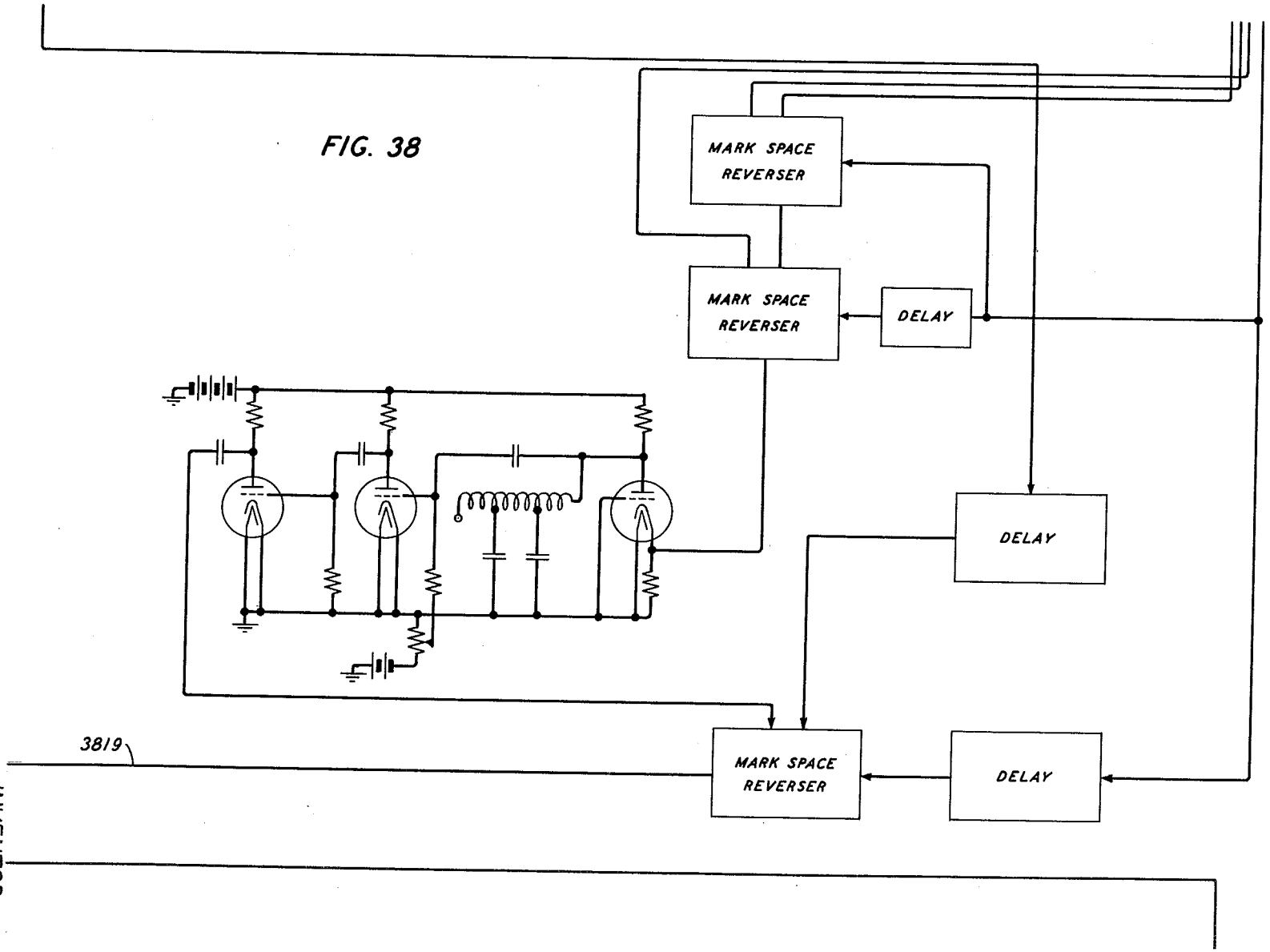
Figure 39:
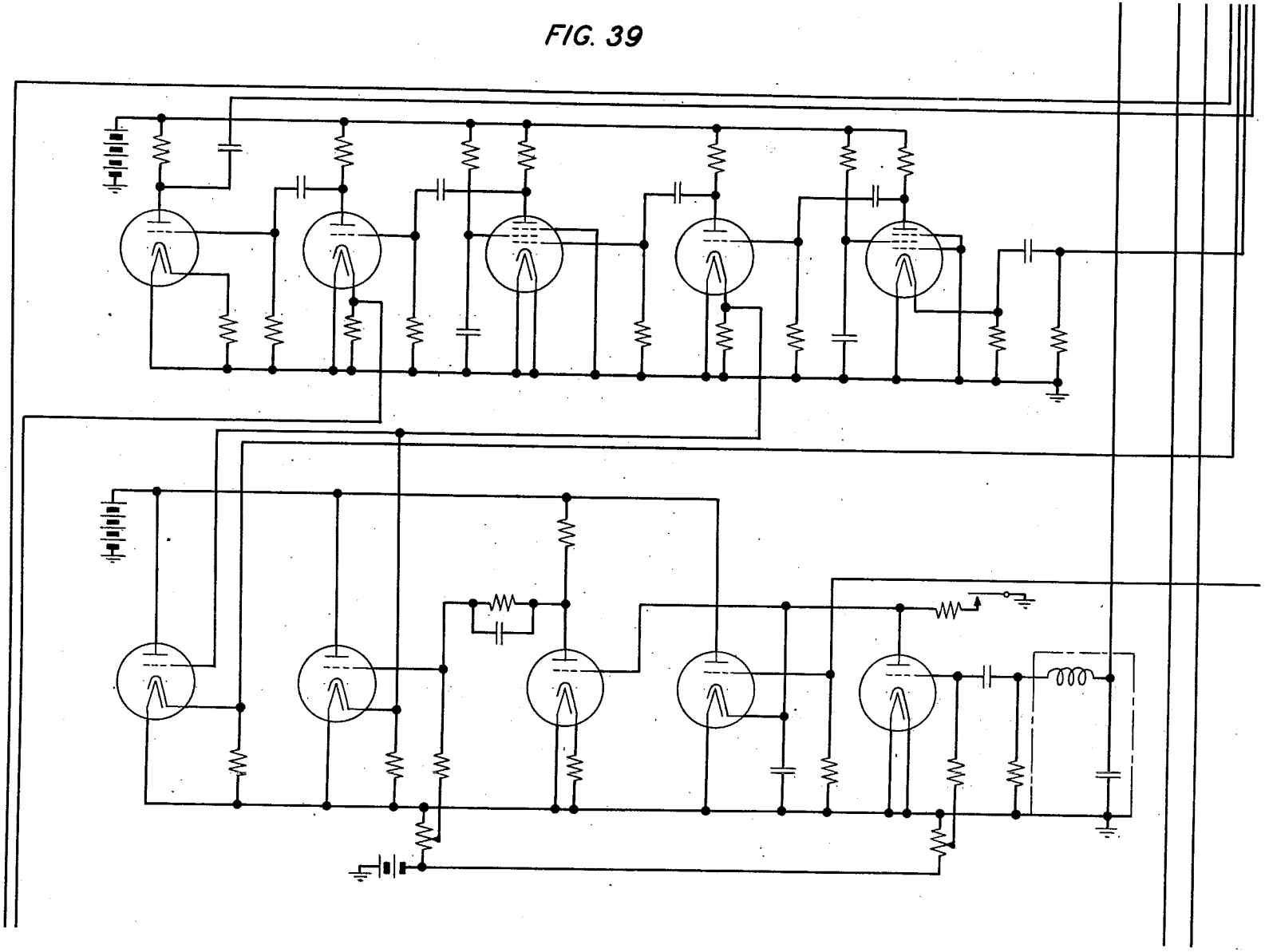
Figure 40:
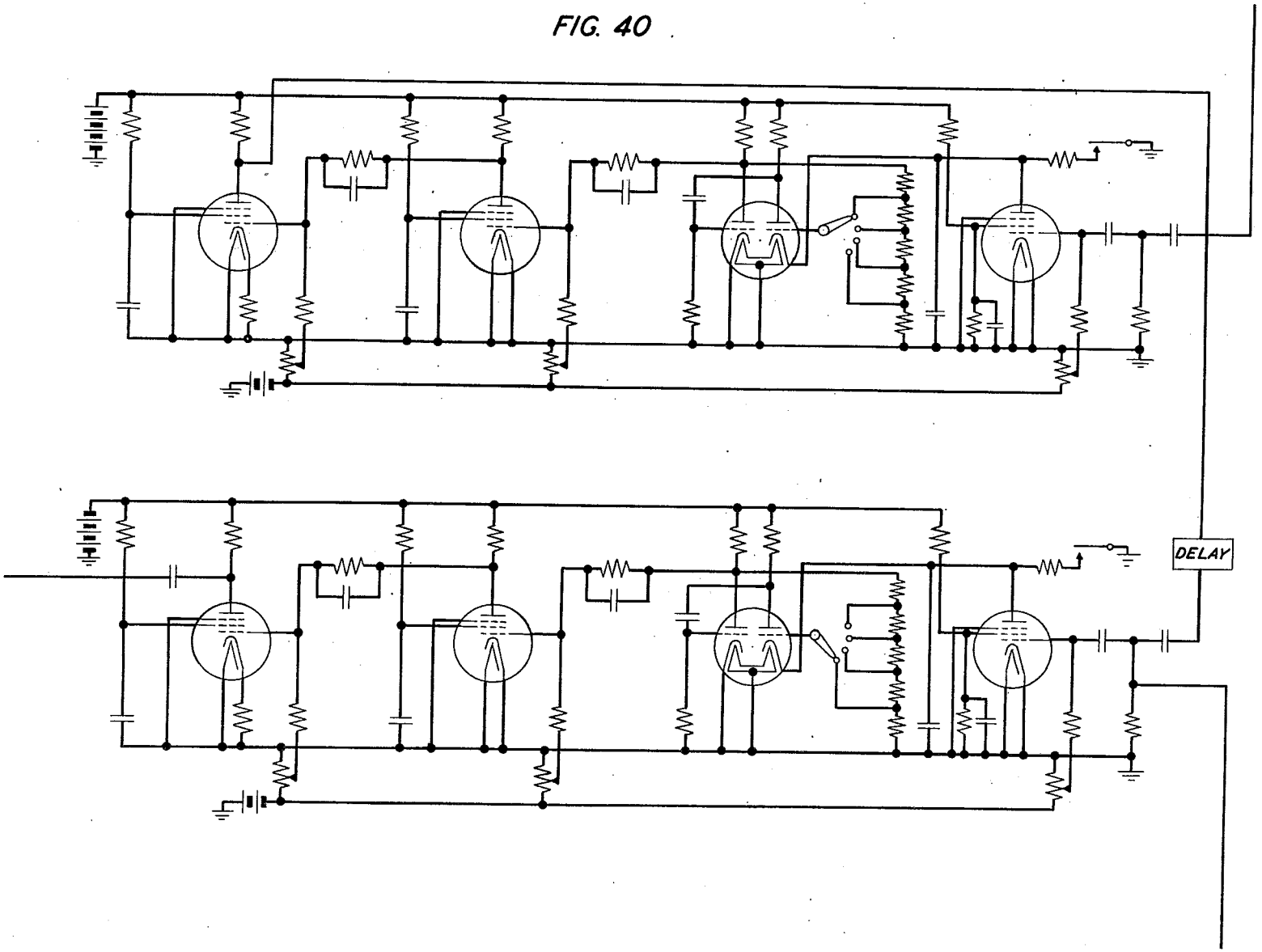

Similar mark space reverser circuits are shown in FIGS. 36 and 38 at the receiving station, which circuits operate similar to the manner in which the above-described circuits operate at the transmitting circuit and cause key signals to be applied to the conductor 3819 which signals are identical with those applied to the conductor 2019 at the transmitting station. The key signals applied to the conductor 3819 are delayed due to the transmission time of signals transmitted from the transmitting station to the receiving station; oherwise the signals applied to conductor 3819 are in exact synchronism with the key signals applied to the conductor 2019. As shown by graph 5417 the key pulses generated at the receiver are identical with those generated at the transmitter and are synchronized or phased in the multiplex frame or code interval at the same relative time as at the transmitting station.

In order to increase the security of the ciphering system it is desirable to interchange the various connections from time to time. Of course, the more often these connections are changed the greater the security and the less likelihood that the cipher employed may be broken by unauthorized persons. In order that the various connections may be interchanged readily and at frequent intervals it is necessary to operate the stepping switch and the tape controlled contacts and advance tape at frequent intervals. It is also neceessary to substantially simultaneously advance the stepping switch and tape at the receiving station. In order to control the actuation of these devices a plurality of pulse counting circuits are provided at both the transmitting and receiving stations. At the transmitting stations FIG. 17, 19, 21, 22 and 24 show pulse counting circuits. Similar circuits are shown in FIGS. 33, 35, 37, 40 and 42 at the receiving station. At the transmitting station the pulse counting circuits are actuated by means of positive pulses received over lead 1701 in FIG. 15 which pulses come from the snchronous pulse generator shown in FIG. 5. This pulse is transmitted through FIG. 15 in a manner which will be described hereinafter.

Figure 17:
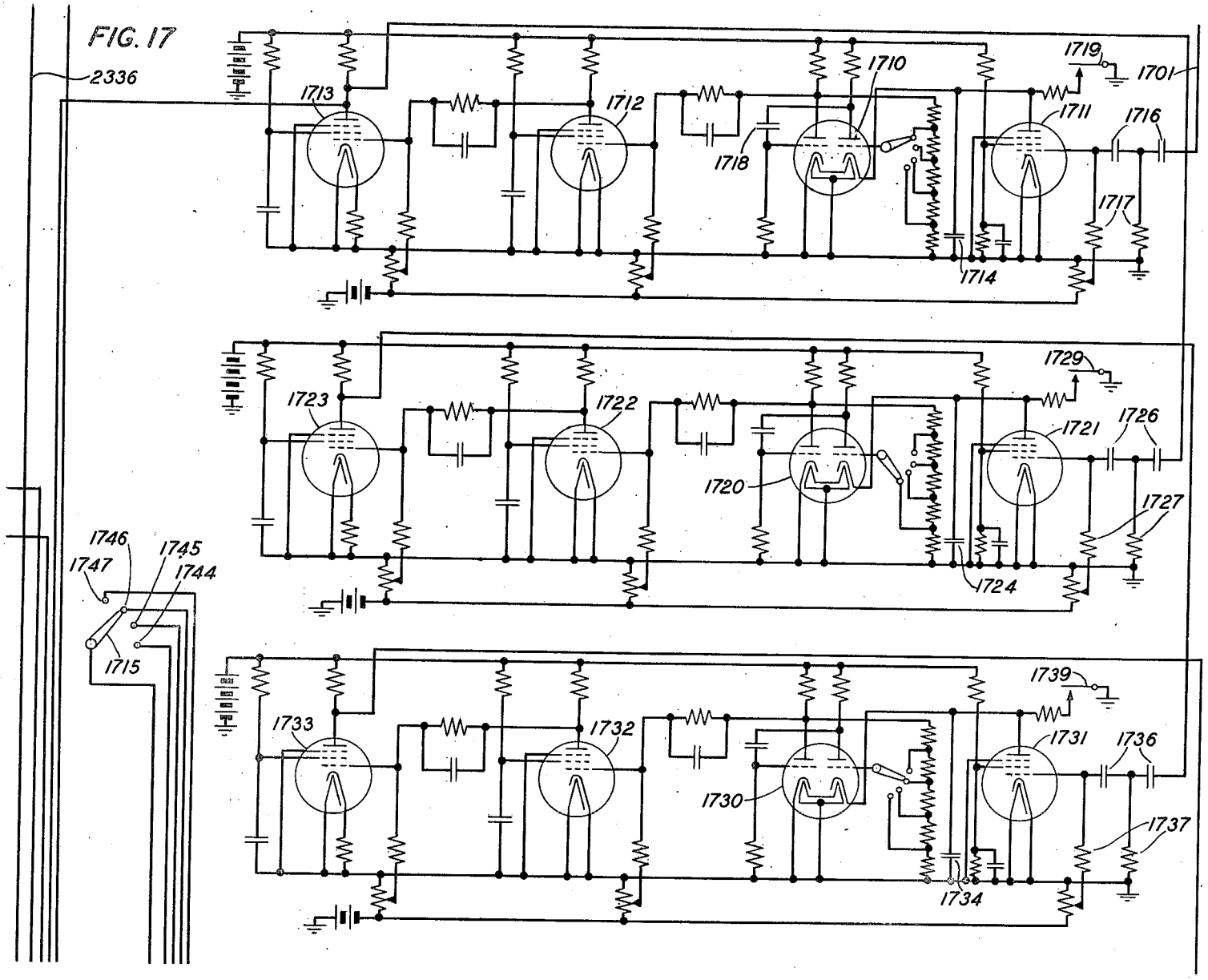
Figure 19:
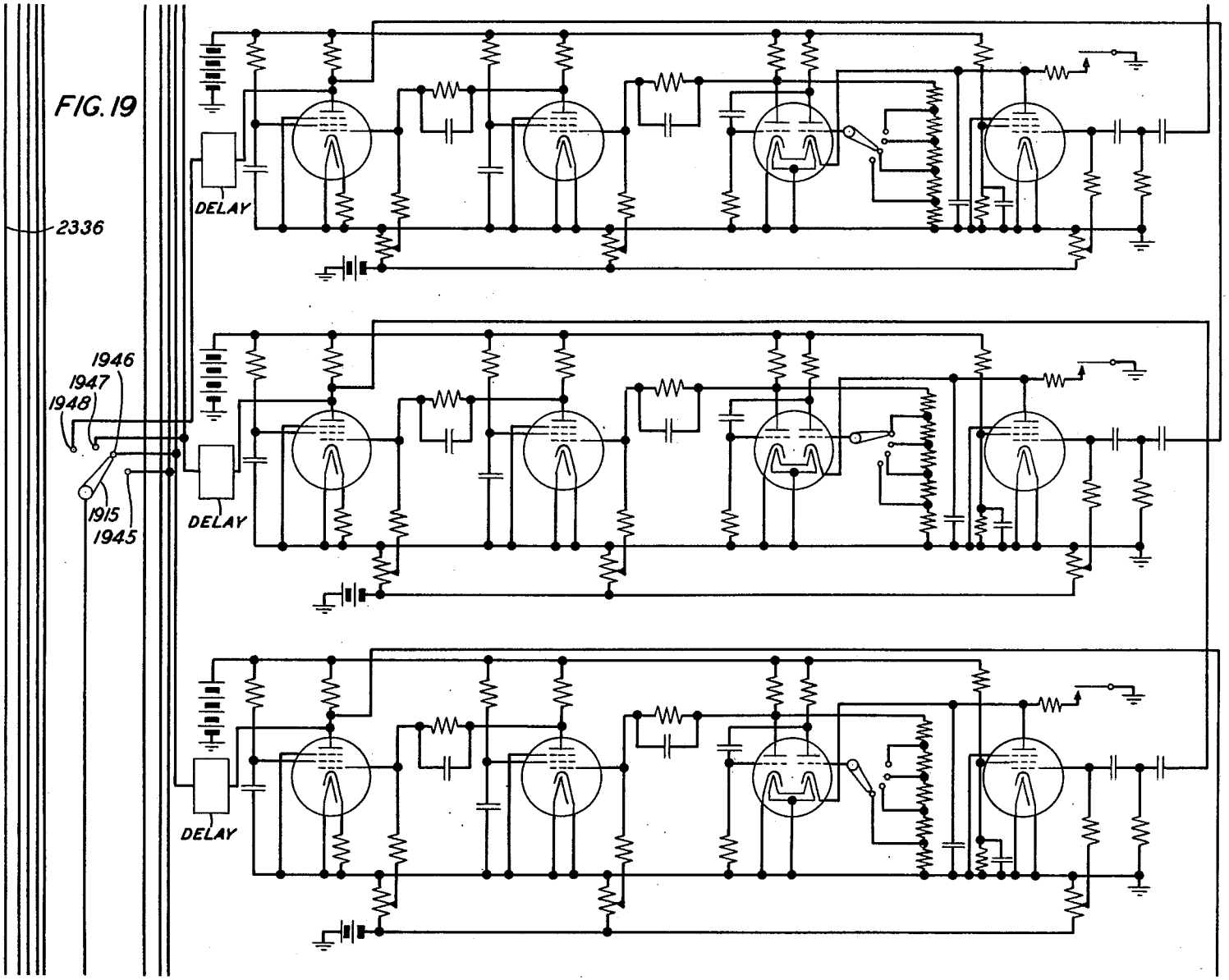

One pulse counting circuit as shown in FIG. 17 comprises four tubes, namely, counting 1711, 1712 and 1713. The second pulse counting circuit comprises tubes 1720, 1721, 1722 and 1723. The third pulse counting circuit of FIG. 17 comprises tubes 1730, 1731, 1732, and 1733. Likewise three similar pulse countin circuits are shown in FIG. 19, two in FIGS. 21, 22 and 24. Each one of these circuits is provided with a twin tube having both sections interconnected so that either section may conduct current at a given instant of time but not both. These tubes are designated 1710, 1720 and 1730 for the respective pulse counting circuits shown in FIG. 17. The grid of the right-hand section of tube 1710 is biased more positively than the grid of the left-hand section of this tube, consequently when the power is first applied to the system or the circuits of FIG. 17 the right-hand section of tube 1719 will start to conduct current first and thus apply a negative voltage through the coupling condenser 1718 to the control grid of the left-hand section of tube 1710 thus preventing this section from conducting current.

The current which the right-hand section of tube 1710 passes at this time is employed to charge the upper terminal of condenser 1714 to a positive voltage. When the positive voltage of the upper terminal of condenser 1714 approaches or exceeds the bias voltage of the control element of the right-hand section of tube 1710 current flowing through this tube decreases with the result that the voltage of the anode of this section starts to rise and thereupon applies a more positive voltage to the control grid of the left-hand section of tube 1710 through the coupling condenser 1718. When the voltage applied to the control grid of left-hand section of the tube 1710 rises sufficiently current will start to flow in the cathode-anode circuit of this tube and lowers the anode voltage. As a result the voltage of the control grid of the right-hand section of tube 1710 is reduced so that this voltage will be lower than the voltage of the upper terminal 1714 connected to the cathode of the right-hand section of tube 1710. Consequently an effective negative bias is applied to this section of tube 1710 which is sufficient to interrupt the current flowing through this section of tube 1710. Thereafter the sections and circuits of tube 1710 remain in the above-described conditions of change and conduction until changed as will be described hereinafter.

The corresponding tubes 1720 and 1730 cause the upper terminals of the respective condensers 1724 and 1734 to be charged to a similar high positive voltage after which time current ceases to flow through the right-hand sections of these tubes and flows instead through the left-hand sections. The circuits of the corresponding tubes in the other counting circuits referred to above operating in substantially the same manner.

Each of the positive pulses arriving over lead 1701 is transmitted through a coupling network comprising condensers 1716 and resistors 1717. The product of the capacity and resistance of the respective resistors and condensers is made small so that a pulse of very short duration is transmitted through these condensers in response to the application to a positive pulse to lead 1701. By employing two condenser and resistance networks in tandem as shown in the drawing the duration of the pulse may be made very short and substantially independent of the duration of the pulses applied to the lead 1701.

Each of the pulses of short duration output from the network comprising condensers 1716 and resistors 1717 is applied to the control element of tube 1711. Tube 1711 as shown in the drawing, is a multielement tube in which the magnitude of the current transmitted through the tube is substantially independent of the voltage of its anode. Furthermore, the tube 1711 is arranged so that substantially no current normally flows in its anode-cathode circuit. However, upon the application of each of the positive pulses to a control element of this tube a predetermined and small quantity of charge is removed from the upper terminal of condenser 1714 thus reducing the voltage of the upper terminal of this condenser by a small increment.

After a sufficient number of small increments of charge have been removed from the upper terminal of condenser 1714 in response to a corresponding number of pulses of short duration applied to the control grid of tube 1711 the voltage on the upper terminal of condenser 1714 will fall to a sufficiently low value to cause current to again flow through the right-hand section of tube 1710 which current reduces the voltage of the anode of this section and in turn interrupts the current flowing through the left-hand section of tube 1710. Current flowing through the right-hand section of tube 1710 at this time again charges the upper terminal of tube 1714 to a relatively high positive voltage whereupon the above-described operation of discharging the upper terminal of this condenser is repeated by removing a plurality of small increments of charge each increment being removed in response to each of the plurality of positive pulses received over conductor 1701.

By controlling the potentials applied to the various control elements of tube 1711 such as the potential applied to the screen grid thereof and the suppressor grid, as well as the magnitude of the pulses applied to the control grid it is possible to control and determine the amount of charge removed from condenser 1714 in response to each of the received pulses. If this quantity is made large only a few pulses will be required to discharge the condenser sufficiently to actuate the circuits of tube 1710 as described above and cause this condenser to be recharged. If, on the other hand, the increment of charge removed in response to each pulse is made small a large number of pulses will be required to sufficiently discharge condenser 1714 to set the circuits of tube 1710 into operation in the manner described above. It is obvious that the number of pulses required to sufficiently discharge the corresponding condensers in each of the pulse counting circuits may be arranged to be the same or different as may be desired. However, it should be noted that the corresponding pulse counting circuits at each end of the system, i.e., at the transmitting station and the receiving station, should both be arranged to count exactly the same number of pulses to set the circuits of the tubes corresponding to tube 1710 into operation.

In order to insure that the counters all start at the proper time and pulse to count a contact has been provided for discharging the storage condenser of each of the counters. These contacts are represented in FIG. 17 by contacts 1719, 1729 and 1739. These contacts and the corresponding contacts of the other counters may be momentarily operated by a single or a plurality of manual keys or they may be momentarily operated by one or more relays which relays in turn may be operated by one or more manual keys or by other circuit means. The operation of these contacts, say 1719, for example, discharges condenser 1714 and causes current to flow through the right-hand section of tube 1710 and interrupt the current flowing through the left-hand section of this tube. Upon the release of the contacts 1719 the upper terminal of condenser 1714 is charged to the positive voltage determined by the grid voltage of the left-hand section of tube 1710 as described above. In this manner the counters may be all set in a predetermined condition prior to the application of pulses to them to count. Thus when it is desired to set the system into operation as described hereinafter these contacts will be momentarily closed at both the transmitting and receiving stations.

Figure 21:
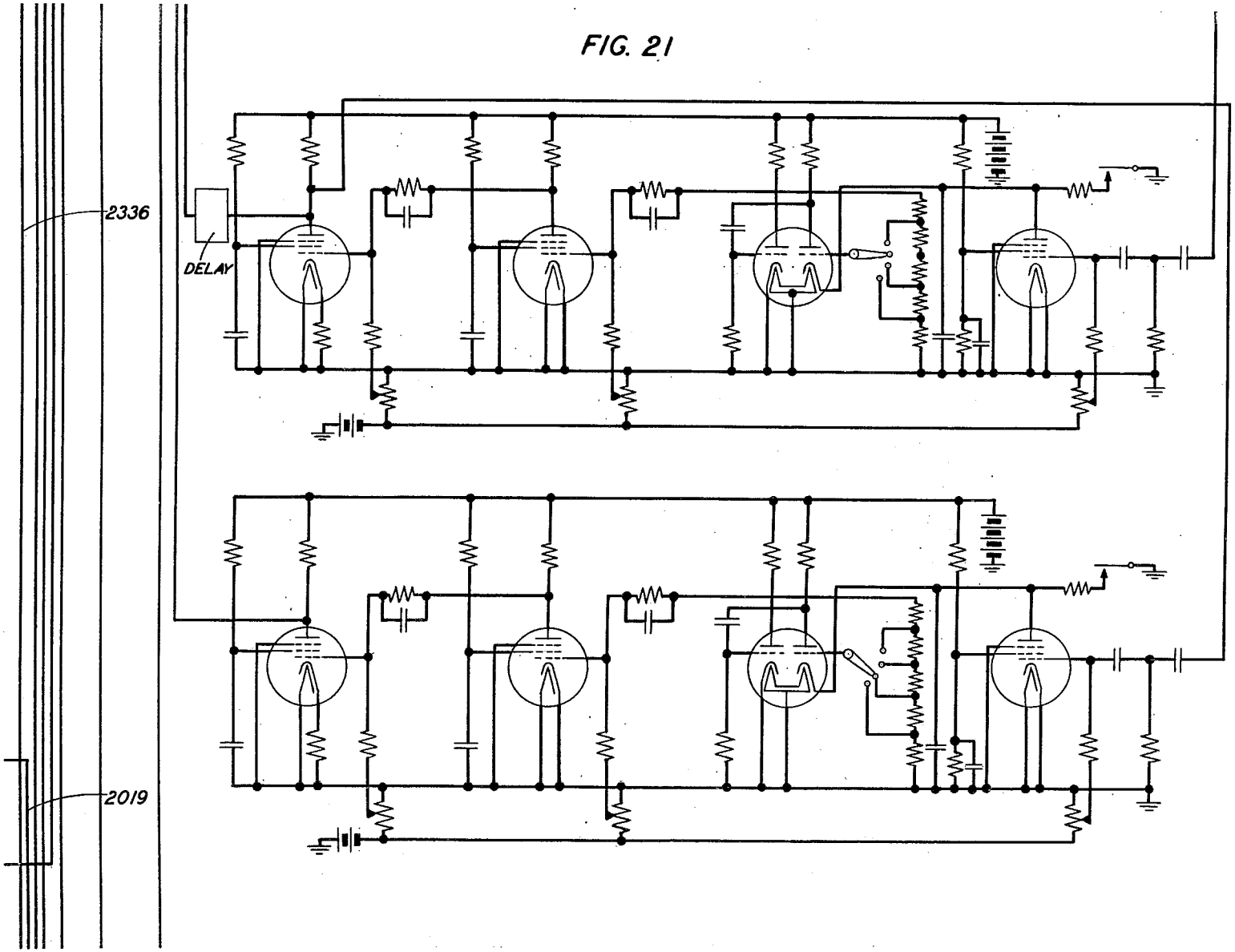

Each time the current flowing through the right-hand section of tube 1710 is initiated in the manner described above, the voltage of its anode falls to a relatively low positive voltage and applies a less positive voltage to the control grid of the left-hand section of tube 1710 connected thereto. As a result the flow of current through the left-hand section of tube 1710 is interrupted so the volage of its anode increases to a relatively high positive value. Consequently the voltage of the grid of tube 1712 coupled thereto is also made more positive and as a result the voltage in the anode of tube 1712 decreases to a relatively low value. The voltage of the grid of tube 1713 is correspondingly reduced so the output voltage for this tube becomes more positive. When the discharge through the left-hand section of tube 1710 is again initiated the volages of the various anodes are restored to their normal condition. The positive pulse output from the anode of tube 1713 is applied to the control element of tube 1721 through the coupling network comprising condensers 1726 and resistors 1727. These pulses are then counted by the counter comprising the second row of tubes in FIG. 17. The output of the tube 1723 is connected to the input of counter shown in the third row of FIG. 17. The output of this counter is similarly connected to the input of first counter shown in FIG. 19. The remaining counters in FIGS. 19 and 21 are similarly connected in tandem as shown in the drawing.

If it is assumed by way of example that the first counter in FIG. 17 comprising tubes 1710, 1711, 1712 and 1713 is arranged so that tube 1710 has the current conditions therethrough reversed in response to reception of ten pulses applied over lead 1701 and the second counter is arranged so that the current conditions through the two sections of tube 1720 are reversed in response to ten pulses applied to the control grid of tube 1721 and that the third counter is arranged so that the current conditions through the two sections of tube 1730 are reversed in response to ten pulses applied to the control grid of tube 1731, then an output pulse is repeated in the output circuit of tube 1733 in response to the application of ten times ten times ten or one thousand pulses applied to lead 1701. If the counters are arranged as shown in the drawing the number of pulses applied to lead 1701 required to produce a pulse in the output circuit of any of the respective counters will be the number of pulses required to produce a pulse in the output circuit in the counter in question times the number of pulses required to produce a pulse in each of the previous counters in the chain.

The tubes 1712 and 1713 are employed as amplifying, clipping, limiting and otherwise shaping and control the wave form and magnitude of the pulse output from the counter shown in the first row in FIG. 17. Similar pulse shaping, amplifying, and controlling tubes are provided for each of the other counting circuits.

Figure 22:
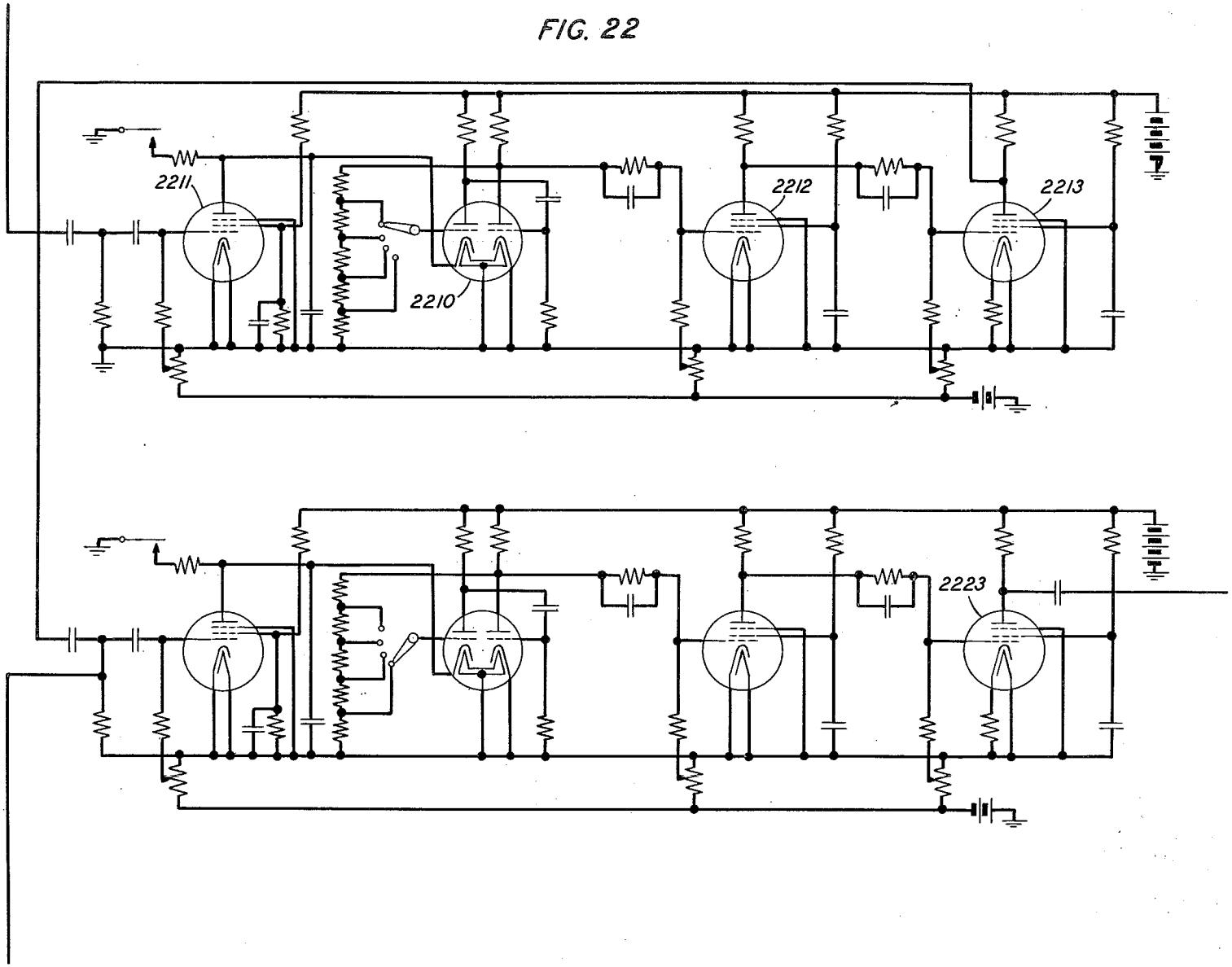

The output of tube 1713 is also connected to the input circuit of the counter comprising tubes 2210, 2211, 2212 and 2213. The output of this counter is connected to the input of the other counters shown in FIG. 22 and to both the counter circuits shown in FIG. 24. The pulse output from tube 2223 of the second counter in FIG. 22 is applied to the control element of tube 2311 which causes the upper terminal of condenser 2301 to be charged to relatively high positive voltage. The control element of 2312 is connected to the upper terminal of condenser 2301 and the application of positive voltage to the control element of 2312 in response to a positive voltage applied to the upper terminal of condenser 2301 causes the anode potential of tube 2312 to fall to a relatively low value. This voltage is repeated by tubes 2313 and 2314 but the voltage applied at this time to the magnet 1612 of the stepping switch shown in FIG. 16 is insufficient to operate this magnet.

In a similar manner the upper terminals of condensers 2501 and 2502 are charged to positive voltage. The charge on the upper terminal of condenser 2501 is employed to control certain switch operations which will be described hereinafter. The charge on the upper terminal of condenser 2502 causes the voltage applied to the stepping magnet 1612 of the tape controlling mechanism shown in FIG. 16 to be released.

The outputs of the last four stages of the counters shown in FIGS. 19 and 21 are connected to switch contacts with which the switch arm 1715 cooperates. The outputs of the fourth through seventh stage of the counters shown in FIGS. 19 and 21 are connected to switch contacts with which the switch arm 1915 cooperates. It is obvious that the output of any of the counter stages shown as well as the outputs of any additional stages when such stages are desired or necessary may be similarly connected to switch contcts of the respective switches when it is desired to give a greater number of choices of times for operating the stepping switch magnet 1612 or the tape control magnet 1613.

As shown in the drawing the output from the fourth to the seventh counter must pass through a delay network connected between the pulse counter and switch contacts. The delay networks provide progressively shorter delays between the counters and the switch contacts as the number of the counters increases. These delay networks are provided to compensate for the time required for the pulse to be transmitted through the additional stages of the counters so that pulses arive at the switch contact at the same instant within the multiplex cycle or frame from all the counters. In other words the pulse from each stage of the counter while arriving in different multiplex frames or multiplex cycles, will arrive at the switch contacts at substantially the same instant of time within the multiplex cycles of frames. This arrangement is desirable to permit accurate timing of the various pulses and insure proper operation of the system.

Switch arm 1715 is connected to the input circuit of tube 2310 through a delay network 2309. Likewise, switch arm 1915 is connected to the input circuits of tubes 2510 and 2520 through a corresponding delay network.

Figure 23:
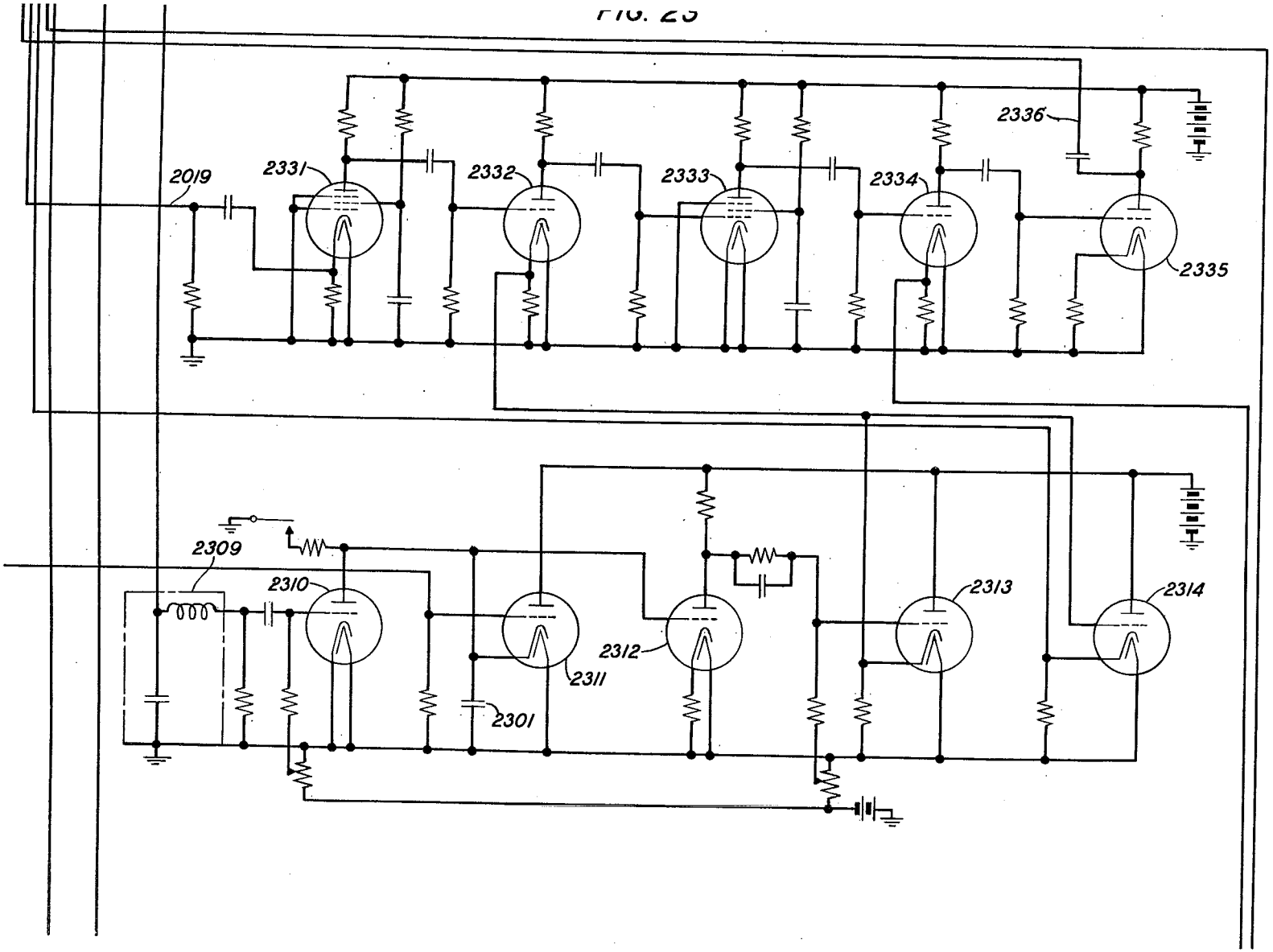

Delay network 2309 is provided to properly time the operation of the circuits shown in FIG. 23 so that the pulses are supplied to the control element of tube 2310 after the pulse applied to the control element or grid of tube 2313 has terminated. Likewise, the delay network connected to the switch arm 1915 insures that pulses are not applied to the control elements of tubes 2510 and 2511 until after the pulse applied to the control elements of tubes corresponding to 2311 has terminated.

It is evident that if desired, the delay networks connected in series with switch arm 1715 and 1915 may be omitted by providing slightly longer delays in the delay devices between the fourth through seventh counters and by adding a corresponding delay from the eighth counter to the switch contact. Either of the above-described arrangements or the arrangement shown in the drawings operate equally satisfactory.

Switch 1715 controls the frequency of application of the positive pulses applied to the control element of tube 2310 as determined by the output pulses from the various stages in the counter. The application of each positive pulse to the control element of tube 2310 causes current to flow through this tube which discharges the upper terminal of condenser 2301 and reduces the voltage thereof to relatively low value. As a result the current flowing through tube 2312 is interrupted. Consequently the voltage from the anode of tube 2312 and also the control grid of 2313 rises to a more positive value. This positive value is repeated by tube 2314 which in turn applies a sufficiently high voltage to the winding of the stepping mechanism 1612 to operate this magnet.

By arranging the number of pulses counted by the first stage of counting circuits of FIG. 17 and both stages shown in FIG. 22 so that the output of tube 2223 is a integral submultiple of the number of pulses received from lead 1701 to produce an output pulse in each of the five final counter stages a pulse will be applied to the control grid of tube 2311 at a predetermined interval of time after a pulse is applied to the control grid of tube 2310. This interval of time is made sufficiently long to provide ample time for the operation of the stepping magnet 1612 of the stepping switch shown in FIG. 16. When a pulse applied to the control element of tube 2310 in the upper terminal of condenser 2301 is charged to positive voltage which in turn reduces the voltage applied to the stepping magnet 1612 so that this magnet releases.

Figure 24:
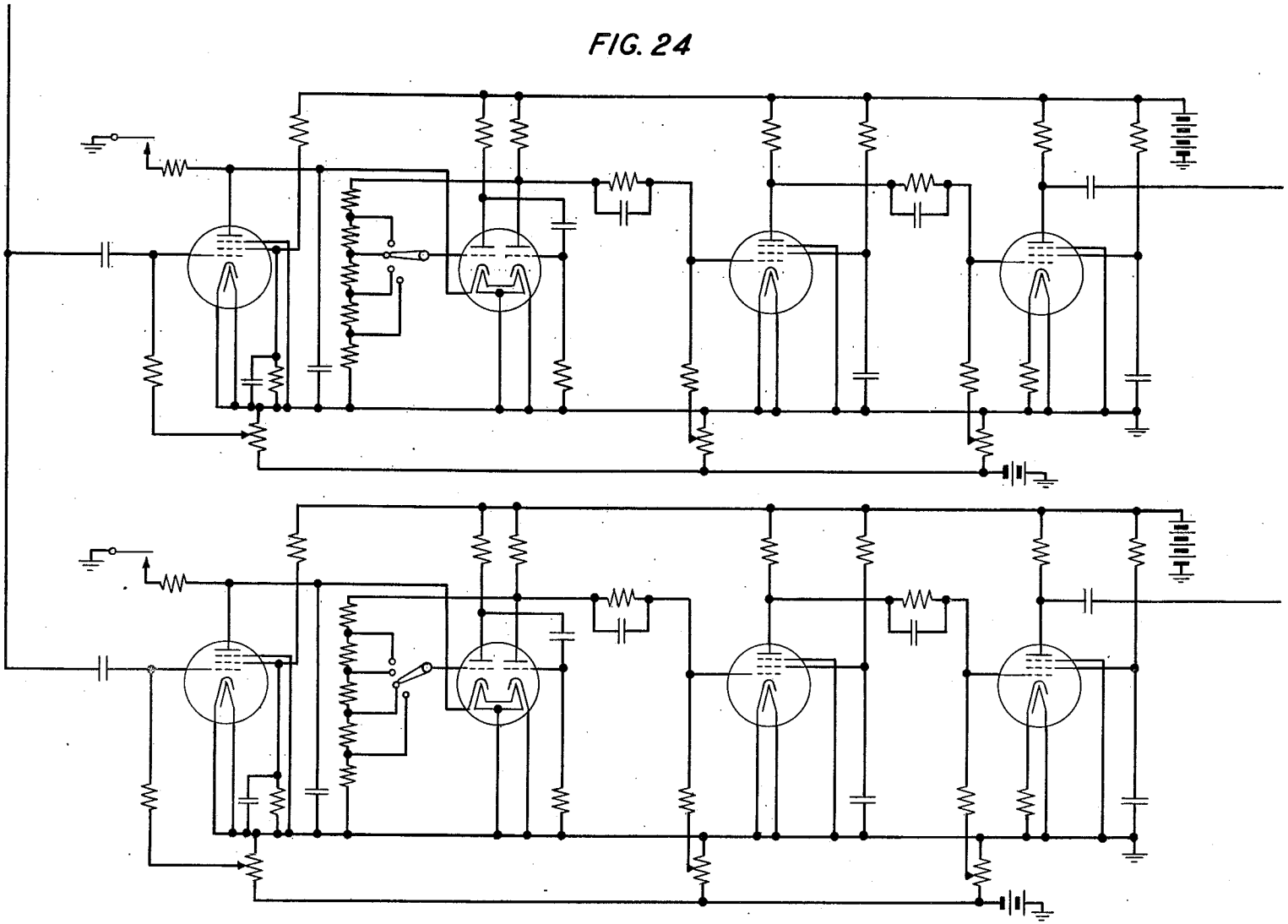
Figure 25:
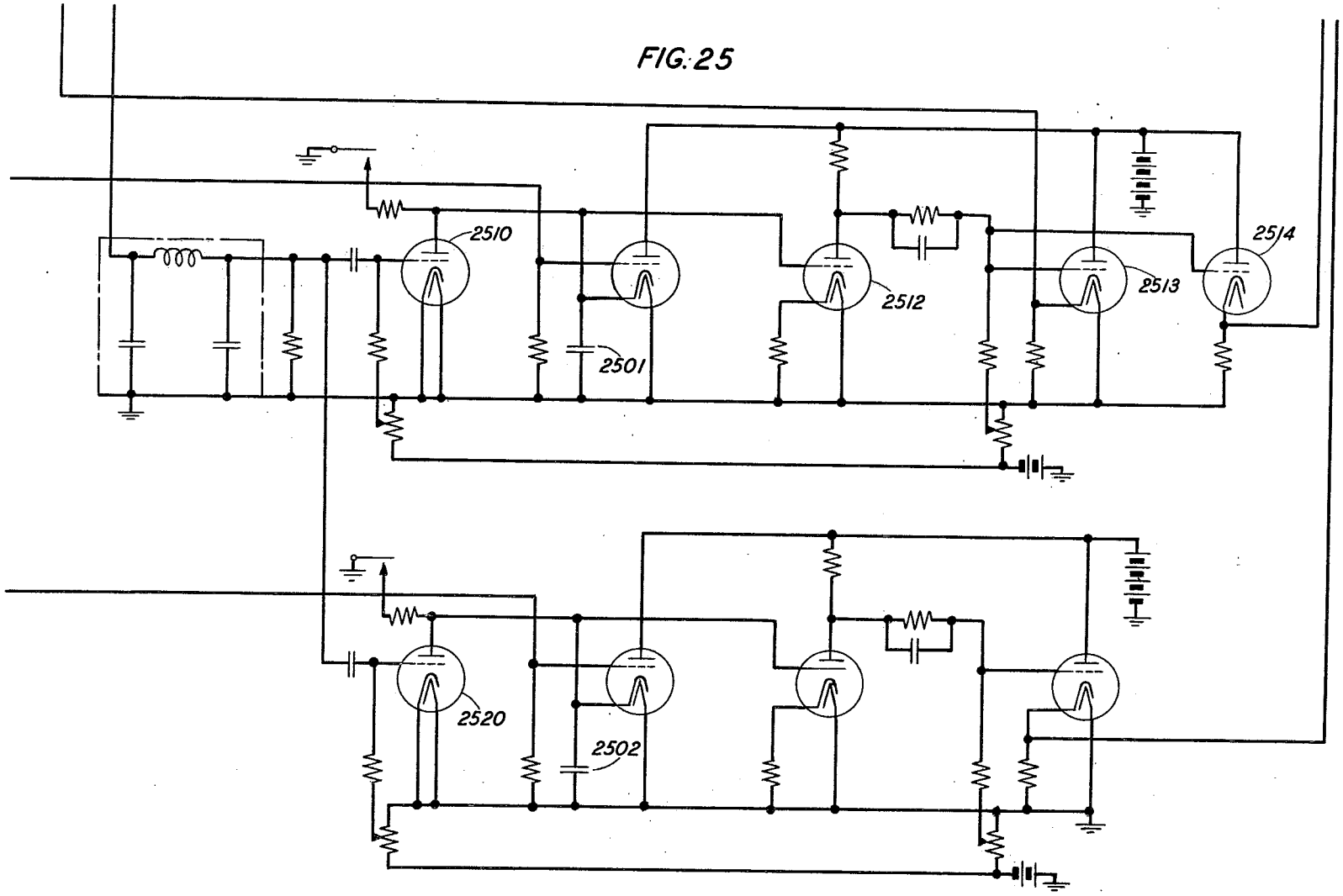

Switch 1915 and th circuit shown in the lower portion of FIG. 25, as well as the counter shown in the lower portion of FIG. 24, is employed to similarly control the stepping magnet 1613 of the tape controlled mechanism shown in FIG. 16.

As shown in FIGS. 2 and 3, the key signals after being formed in the last mark space reverser are transmitted first through a switching transient silencer and then through a transmitting key lock before they are transmitted to the keying apparatus associated with the timing division transmitting equipment.

At the receiving station, the signals are transmitted through a similar switching transient silencer and receiving key lock before they are connected to the keying equipment associated with the receiving apparatus 315.

The transmitting switching transient silencer is shown in detail in the upper portion of FIG. 23. The output key signals from the mark space reverser 2015 are transmitted over conductor 2019 to the control element of tube 2331 through suitable coupling networks. Tube 2331 represents any suitable number of repeating and amplifying tubes which may also be employed to suitably shape the pulses when desired. As shown in the drawing, tube 2331 operates as a grounded grid amplifier tube. The output of tube 2331 is coupled to the input circuit or control grid of tube 2332. Tube 2332 also normally operates as a repeating tube and repeats the signals to tube 2333. However, when the upper terminal condenser 2301 is discharged as described above, to cause the operation of the stepping switch magnet 1612, the anode of tube 2312 becomes positive and applies a positive potential to the control element of tube 2313. Tube 2313 repeats this positive potential in its cathode circuit. The positive voltage is then applied to the control element of tube 2333 as described above, and also to the cathode of tube 2332.

When this more positive potential is applied to the cathode of tube 2332, the voltage of the cathode rises with respect to the control grid of tube 2332 so that tube 2332 is cut off and no longer operates as an amplifier tube. As pointed out above, the upper terminal 2301 is discharged in response to some one of the pulses from the pulse counting circuits. The discharge of this condenser then applies the operating voltage to the stepping magnet 1612 but first interrupts the transmission of keying signals to the keyer circuit so that the keyer signals are not being transmitted during the time the stepping magnet is being operated and thus being mutilated by changes in connections between the different positions of the stepping switch. After the stepping magnet is fully operated, condenser 2301 is again charged and the positive potential removed from the cathode of tube 2332, and from the operating magnet 1612 to the stepping switch.

It is thus apparent that the key signals are interrupted and restored at a predetermined point in each complete multiplex frame or cycle, which point is preferably between the complete code combinations, frames or cycles of the multiplex system. By properly adjusting the various time delay devices, the time at which the key signals are interrupted may be accurately fixed or adjusted.

The output signals from tube 2332 are repeated by tube 2333 and applied to the control grid of tube 2334 which tube normally repeats the signals and applies them to tube 2335, which tube operates as a cathode follower and transmits the signals over conductor 2336 to the transmitting key lock circuit shown in FIG. 15.

When it is desired to operate the magnet 1613 of the tape control device, the upper terminals of condensers 2501 and 2502 are discharged as described above. When the upper terminal condenser 2502 is discharged operating potential is applied to the winding of magnet 1613 as described above. When the upper terminal of condenser 2501 is discharged, the potential applied to the control grid of tube 2512 is reduced and as a result the current through the tube decreases and the voltage of its anode rises and applies a more positive voltage to the control grid of tubes 2513 and 2514, tube 2514 repeats this positive voltage and applies it to the cathode of tube 2334. The application of this more positive voltage to the cathode of tube 2334 changes the relative voltage of the control grid and cathode of this tube by making the cathode more positive or making the grid more negative with respect to the cathode, thus cutting off the tube and preventing this tube from amplifying or repeating the key signals. As described above, with reference to the tape control device shown in FIGS. 16 and 34, the tape control contacts are restored to normal soon after the operating magnet is energized and are not restored to their next position until just before the operating magnet has released. Consequently, it is desirable to maintain the key signals interrupted during both the operating and release time of this magnet. For this reason, two counting circuits shown in FIG. 24 and the two condensers 2501 and 2502 are provided. The counter circuit shown in the lower portion of FIG. 24 is arranged to restore the charge on condenser 2502 after sufficient time has been allowed to operate the control magnet 1613. However, the charge is not restored to condenser 2501 until after a still later interval of time which is sufficient to permit the control magnet 1613 to fully relese and allow the contacts of the tape control device to be accurately positioned in accordance with the perforations or punches in the tape beneath the associated sensing pins. In the case of the operation of the controlling magnet 1613 as in the case of the operation of the stepping magnet 1612 and the stepping switch, the time of interrupting of the keyer signals and the time of which they are again transmitted is accurately controlled by the timing delay of the various time delay devices and by the synchronizing pulses from the snychronizing pulse genertor. As a result, the signals are interrupted and transmission of them resumed at a predetermined part of multiplex interval or cycle, usually near the beginning of one cycle or the end of the previous cycle.

The operation of the switching transient silencer is illustrated by graphs 5318 and 5319 in FIG. 53, and 5418 and 5419 in FIG. 54. At the transmitting station graph 5318 represents the pulses from the snychronous pulse generator applied to the first counter of FIG. 17. Graph 5319 represents the potential applied both to the stepping switch magnet 1612 and to the transient switching silencer shown in the upper part of FIG. 23. As shown, after a sufficient number of the pulses from the synchronous pulse generator have been counted, the potential applied to the stepping magnet and to the switching transient silencer is increased due to the discharge of condenser 2301 as described above. Graph 5320 in FIG. 43 illustrates the key pulses which are transmitted through the switching transient silencer and as shown in graph 5320 in comparison with the key pulses generated as shown in graph 5317, the pulses from the key generator after the switching transient silencer is operated are suppressed.

Likewise, after a suitable interval of time which is ample to permit the magnet 1612 to operate, condenser 2301 is again charged so that the output of the circuit shown in the lower part of FIG. 23 again falls to a low value thus releasing the stepping magnet 1612 and unblocking the switching transient silencer so that thereafter as shown in graph 5320 the key signals will be transmitted through the switching transient silencer. The graphs 5418 and 5419 show the corresponding pulses and outputs at the receiving terminal of the system. Both sets of graphs in FIGS. 53 and 54 are broken so that the left-hand section will show the operation at the beginning of the switching period, while the right-hand portion shows the graphs of current voltges at the end of the switching operation. As shown in both figures, the switching transient silencer operates between the times assigned to pulses from the key generator. Thus it does not in any way interfere with or mutilate any of the pulses from the key generator. Likewise, the operation occurs at the beginning of individual multiplex cycles so that it will not in any way interfere with transmission of the fifth pulse which is employed to regenerate the proper key pulses or signals at the receiving station.

From the switching transient silencer the key signals are transmitted over conductor 2336 to the transmitting key lock circuit, where they are applied to a control electrode or grid of tube 1513. Normally the bias voltages of tube 1513 and 1514 are such that these tubes repeat the signals to tubes 1511 and 1512. Tube 1512 repeats the signals over conductor 1531 to the transmitting holding circuit shown in the lower portion of FIG. 6. As long as the key signals are applied to the cathode of tube 662, this tube will operate as a grounded grid amplifier and repeat the signals to the rectifier or diode 661. The rectifier 661 will charge the condenser 667 to a positive voltage in response to these signals and cause tube 660 to pass sufficient current to operate relay 663. Relay 663 in operating, completes the transmission path from the input repeat coil 664 to the output repeat coil 665. However, when the key signals are interrupted by switching transient silencer as described above, during the time either magnet 1612 is operated or during the time magnet 1613 is advancing the tape or when the key lock is in the starting position as will be described hereinafter, the key signals are interrupted. Consequently, condenser 667 is discharged by current flowing through resistor 668, so that the voltage applied to the control element of tube 660 falls and interrupts the current flowing through this tube and the winding of relay 663. As a result relay 663 releases and interrupts the incoming transmission path. Consequently, neither signaling pulses nor key signal pulses are applied to the coding and keying equipment. As a result neither series of pulses is transmitted over the radio system to the receiving station at this time.

When it is desired to use the key pulses to encipher coded signals switch 1201 will be operated to the position where it engages contact 1203. Under these circumstances the negative pulse output fom the distributor tubes 811 and 1112 through 1115 are amplified and shaped and repeated by tube 1211 as positive pulses which pulses are in turn applied to the control grid of tube 1213. Tube 1213 in turn repeats the pulses in its output circuit as positive pulses. In other words, the negative pulses from the distributor tubes appear as negative pulses in the output circuit of tube 1212 and as positive pulses in the output circuit of tube 1213. As described above the tubes 811 and 1112 through 1115 remain conducting for substantially an entire pulse interval which, under the assumed conditions, will be approximately 20 microseconds. Tubes 1211 and 1213 are so biased that in the absence of the negative pulse from the distributor tubes 811 and 1112 through 1115 these tubes conducted current while tube 1212 does not conduct current. It is to be noted that the output potentials in the output circuits of tubes 1212 and 1213 are reversed. In other words, when the output of tube 1212 becomes more positive and visa versa. The output of tube 1212 is coupled to one of the control elements of tube 1214 while the output of tube 1213 is similarly coupled to a corresponding control element of tube 1215.

The key pulses as received from the key lock circuit shown in FIG. 15 are applied to a control element of tube 911 and repeated by this tube as negative pulses and applied to a control element of tube 912. Tube 912 is provided with two output circuits, one connected to its anode and the other connected to the cathode. Tube 912 repeats the negative pulses applied to its control element as negative pulses in the output circuit connected to is cathode and applies them to a control element of tube 914. Tube 914 repeats these negative pulses as positive pulses and applies them to a control element of tube 1215.

Tube 912 repeats the negative pulses applied to its control element as positive pulses in the output circuit connected to its anode. These positive pulses are applied to a control element of tube 913. Tube 913 has its output circuit connected in parallel with the output circuit of tube 903, and the common anode resistor 907. Tube 903 normally maintains the anodes of both tubes 907 and 913 at a relatively low positive voltage. Tube 903 has a negative voltage applied to its grid about the same time that the positive voltage in response to a key pulse is applied to the control grid of tube 913. Consequently, these two pulses substantially neutralize each other at this time and do not apply a more positive potential to the control grid of tube 1214 at this time.

Under the assumed condition with a negative code pulse received from the distributor tubes and a positive key pulse received from the key generator circuit the two control elements of tube 1214, which are the control grid and screen grid in the exemplary embodiment shown in the drawing, are both negative. The corresponding control elements of tube 1215, however, are both positive at this time, consequently, current flows in the anode-cathode circuit of tube 1215 through the common anode resistor 1218 and causes a negative pulse to be applied to the control element of tube 1216. Tube 1216 repeats this pulse as a positive pulse in its output circuit and applies a positive potential in response thereto to the control elements of tube 1217. Tube 1217 operates as a cathode follower tube and repeats a corresponding positive pulse to radio transmitter 1204 which pulse is then transmitted from the antenna 1205 to the distant receiving station.

If, on the other hand, a negative code pulse had not been received from he distributor tubes 811 and 1112 through 1115 at the time a positive pulse is received from the key generator circuit then the potentials of the screen grids of tube 1214 and 1215 will be reversd so that the screen of tube 1214 will be more positive and the screen grid of the tube 1215 more negative.

Tubes 1214 and 1215 have their various elements connected to sources of biasing and other operating voltages of such magnitude that current does not flow in either of their output circuits unless a positive signaling voltage is applied to both their control grid and screen grid, in the exemplary embodiment set forth herein. Consequently, when a positive pulse is received from the key generator and no negative pulse from the coding tubes, the control grid of the tube 1214 is negative, or not positive, while the screen grid of this tube has a positive signaling voltage applied to it. Under these circumstances no current flows in the output circuit of tube 1214. At this time the screen grid of tube 1215 is negative while the control grid of this tube is positive, consequently, no pulse flows in the output circuit of this tube at this time with the result that the voltage of plates of both of tubes 1214 and 1215 is of a relatively high value and cause curent to flow in the output circuit of tube 1216 ths current reduces the anode potential of this tube to a relatively low value so that a "no" current pulse is transmitted through the cathode follower tube 1217 to the radio transmitting equipment.

If, on the other hand, a negative code pulse is received from the distributor tubes 811 and 1112 through 1115 but a positive pulse is not received from the key generators, then the screen grid of tube 1214 is negative while the screen grid of tube 1215 has a positive signaling voltage applied to it. Bias voltages applied to tube 1214 are such that in the absence of a negative voltage applied to the control grid of this tube, in response to the positive pulse received from the key generator equipment, current does not flow in the output circuit of tube 1214. Consequently, tube 1214 does not conduct current at this time so no pulse of current is transmitted over the radio system. Instead as a spacing pulse, i.e., a pulse of "no" current is transmitted over the radio system.

When no positive pulses are received from the key generator the control element of tube 913 is negative so that tube 913 does not conduct current at this time. Consequently, when a negative pulse is applied to a control grid of tube 903 the potential of the anode tube 903 rises to a more positive value and applies positive signaling voltage to the control grid of tube 1214. However, the screen grid of this tube is negative at this time, consequently tube 1214 does not conduct current. If a positive pulse is not received from the key generator, the control grid of tube 914 remains at a more positive voltage while its anode remains at a more negative value. As a result, the control grid of tube 1215 remains more negative so this tube does not conduct current at this time. Thus with both the key generator pulse and the code pulse of a negative polarity no signaling pulse is transmitted to the radio transmitter 1204. In other words, the signal condition transmitted at this time is of negative polarity of character.

If, on the other hand, a code signaling pulse is not received from the distributor tubes 811 and 1112 through 1115 at this time when the screen grid of tube 1214 will be positive and the screen grid of tube 1215 negative so no current pulse will flow in the output circuit of tube 1215. However, upon the application of a positive pulse of the control grid of tube 1214 in response to the negative pulse applied to the control grid of tube 903 current will flow through the common anode resistor 1218 and through tube 1214. This current causes a pulse of positive current to be transmitted to the radio transmitting equipment 1204 and 1205.

It is thus evident that when the key generator pulse and the code signaling pulse are of the same character or polarity, a spacing pulse or a pulse of no current or negative polarity is transmitted to the radio transmitting equipment. If, on the other hand, the key pulse and the code pulse are of opposite character or polarity, then a marking pulse or pulse of current of positive polarity is transmitted to the radio transmitting equipment. Inasmuch as the key pulses from the key generator are of an arbitrary character unrelated to the coded pulses and are as nearly random as possible the enciphered pulses will be unintelligible and provide a high degree of secrecy and security for the transmitted message currents.

When the coded signaling pulses are enciphered at the transmitting station it is, of course, necessary to decipher them at the receiving station. In order to decipher the received signals, switch 2910 must be moved into engagement with contact 2911 and switch 2923 must be moved into engagement with contact 2924. In addition, it is necessary to combine a series of key signals, identical with key signals employed at the transmitting station for enciphering the message, with the enciphered signals at receiving station. Substantially identical circuits are employed at the receiving station for combining the received enciphered signals with the receiving key signals. As pointed out hereinbefore the key signal generating equipment provided at the receiving station is substantialy identical as that provided at the transmitting station and is adjusted the same as the equipment at the receiving station. As a result the receiving key generator generates a series of key signals identical with the key signals generated by the key generating equipment at the transmitting station and employed to encipher the code signals. The key signals are combined with the received enciphered signals by mark-space reverser circuits which are sometimes called reentrant circuits. This combining equipment comprises tubes 2711, 2712, 2713, 2714 and 2703 as well as tubes 2914, 2915, 2916 and 2917 and related circuits and equipment. Briefly, the key signals are received over conductor 3130 and applied to control element of tube 2711. The marking or "on" signals comprise pulses of positive current. The spacing or off signals comprise the absence of current sometimes referred to as pulses of no current. These signals are of the same character as generated by the key generating equipment at the transmitting station. Tube 2711 repeats the signals to tube 2712 which tube in turn repeats the signals to tubes 2713 and 2714. These two tubes together with tube 2703 cause a pulse of negative potential to be applied to a control element of tube 2914 and a pulse of positive potential to be applied to a control element tube 2915 in response to a pulse of positive voltage received from the key generator. At substantially the same time a positive pulse is received over conductors 1530 from the key generator at the transmitting station which pulse causes a negative signaling voltage to be applied to the control element of tube 1214 and the positive signaling voltage to the control element of tube 1215 of the transmitting station as described hereinbefore. Assuming for purposes of illustration that one of the distributor tubes 811 or 1112 thrugh 1115 is conducting current at this time. As a result the negative potential of voltage is applied to the control element of tube 1211. As a result the screen of tube 1214 has a negative signaling voltage applied to it while the screen of tube 1215 has a positive signaling voltage applied to it. Under these conditions as described above, current flows through tube 1215 and the common anode resistor 1218 causing a negative pulse to be applied to the control element of tube 1216. This pulse is repeated as a positive pulse to the radio system comprising radio transmitter 1204 and antenna 1205. At the receiving station the radio receiving equipment including antenna 2901, radio set 2902 and adjustable delay device 2903 causes a positive voltage or pulse to be applied to the cathode of tube 2905 and a control grid of tube 2904. If no current had been flowing through one of the distributor tubes 811 and 1112 through 1115 inclusive, at this time, no positive pulse would be transmitted to the radio system so that the output of the adjustable delay device 2903 would have been more negative. Assume for the purpose of illustration that it is positive in response to the above assumed conditions wherein a pulse of positive voltage is applied to the radio system. The application of a positive pulse or voltage, in response to the positive pulse applied to the radio system at the transmitting station to the cathode of tube 2905, causes a positive pulse to be repeated in this output circuit to the screen of tube 2915. In the application of a positive pulse or voltage to the control grid of tube 2904 causes a negative pulse to be applied through switch 2910, when moved to engage contact 2911, to the screen of tube 2914. As a result tube 2915 conducts current at this time and applies a negative voltage to the cathodes of tubes 2811, 2812, 3013, 3014 and 3015 causing a current to flow through one of these tubes which is properly conditioned by the synchronizing multiplex equipment herein described above.

The three other possible combinations of signaling pulses and key pulses may be similarly traced through the marked space reversers or reentrance circuits in the manner described above with reference to the enciphering equipment at the transmitting station. In each case when current flows through one of the distributor tubes 811, 1112 through 1115 at transmitting station, current will also flow through the corresponding receiving distributor tubes 2811, 2812, 3013, 3014 and 3015. Likewise, when current fails to flow through one of the distributor tubes at the transmitting station when it is conditioned to pass current, the corresponding distributor tube at the receiving station does not pass current. In other words, the original coded signal conditions or pulses are recovered and applied to the decoding equipment which equipment responds as described above in the absence of the use of the enciphering and deciphering equipment.

The above-described operations of combining the key signals at both the transmitting and receiving station with the coded and received signals are illustrated by graphs 5320, 5321 and 5322 which show the operation of the system at the transmitting station, and by graphs 5420, 5421 and 5422 which show the corresponding operation at the receiving station.

Graph 5320 shows the key signals as applied to the combining or reentry circuit and graph 5321 shows the pulses received from the distributor tubes 811 and 1112 through 1115 inclusive. As illustrated when a negative pulse is received from the distributor simultaneously with a positive pulse from the key generator, marking pulse is applied to the radio system as shown in graph 5322. Similarly when neither a positive pulse from the key generator nor a negative pulse from the distributor tubes is received during a pulsing interval, a marking pulse is applied to the radio system. However, if either a positive pulse from the key generator or a negative pulse from the distributor tubes without a pulse from other of these devices is applied to the combining circuit, a spacing pulse is applied to the radio system.

At the receiving station series of key signals illustrated by graph 5420, identical with the key signals employed at the transmitting station and shown in graph 5320, is applied to the combining circuit together with the received pulses which are represented by graph 5421. The received marking pulses are assumed to be of positive polarity as described herein. Consequently, in order to decipher the enciphered signals and recover the original code pulses or signals, the combining circuit has been arranged so a negative pulse is produced in the output circuit of tube 2917 when a positive pulse is received from the radio system at the same time a positive key pulse is received, and also when no positive pulse is received from either of these devices during a code element of pulse interval. However, in case pulses are received from one of the devices but not both of them, no such pulse is produced in the output circuit. It is evident by comparing the graphs 5321 and 5422 that the identical series of code pulses are recovered at the receiving station. It is also evident from the graphs that the fifth pulse is properly transmitted over this system so that the proper key signals may be generated at the receiving station. Once the coded signals are recovered they may be decoded as described herein and the complex signaling wave may be reconstructed.

SYNCHRONIZING THE KEY GENERATORS AND CIRCUITS

As pointed out hereinbefore when it is desired to use the ciphering equipment, it is necessary to properly start the receiving equipment in synchronism with the transmitting equipment and maintain it in exact synchronism with the transmitting equipment at all times so that identical series of key pulses will be generated both at the transmitting and receiving stations for enciphering and deciphering the signals. In order to properly start the circuits in synchronism, a number of switches have been provided which must be manually operated by an attendant. If the systems have been properly synchronized, it will remain in synchronism for indefinite periods of time. Each time the system is shut down due to trouble conditions or for any other reason or receiving equipment due to trouble conditions falls out of synchronism with the transmitting equipment which makes it necessary to stop the operation of the system, it is necessary to restart the equipment at both ends in synchronism. One suitable way of properly starting both ends of the system in synchronism will now be described.

The multiplex equipment is set into operation and synchronized at each end of the system so that it is possible to operate the system in the manner described above without the use of the key generator equipment. When it is desired to use the key generating equipment, switch 1201 is moved to engage contact terminal 1203; switch 2923 is moved into contact with terminal 2924; and switch 2910 is moved to engage terminal 2911. Switch 1250 is moved to engage contact terminal 1251 and switch 2950 is moved to engage terminal 2951. Switch 603 is moved so that it will engage contact 607, switch 648 will be moved to engage contact 650, and switch 630 will be moved to engage contact 632. In addition, the contacts corresponding to 1719, 1724, 1739, etc. will be momentarily operated so the associated condensers such as 1714, 1724 and 1734 and all the corresponding condensers in all of the pulse counting circuits at the transmitting station, and also at the receiving station, charge to maximum positive voltage. Condensers 2301, 2501 and 2502 and the corresponding condensers in FIGS. 40 and 42 will be discharged by the operation of the contacts associated with them. As a result of the magnet 1612 of the stepping switch is energized and the magnet 1613 of the tape control mechanism is also energized. Each of the corresponding cams of the stepping switch at the transmitting station and the receiving station are identical and positioned on the shaft at identical angular positions. Furthermore, the shaft of the stepping switch at both ends of the system are moved to the same condition. Likewise, the same position of the two identical cipher tapes at the transmitting and receiving stations are positioned under the tape control contact. Furthermore, switch 1715 and corresponding switch 3315 are positioned in identical positions as are switches 1915 and 3515. In addition, the switches 1425 and 3025 are likewise positioned in identical positions.

In addition, switch 1110 when moved to engage contact 1117 and switch 3035 is moved to engage contact 3056. Power is applied to the entire system including the noise generating equipment in FIGS. 13 and 14 which causes pulses to be applied to the delay equipment 1610 and corresponding pulses regenerated by the circuit shown in FIG. 32 and applied to the delay equipment 3410. At this time no positive pulses from the key generating equipment are applied to the conductors 1530 and 3130. As a result the control grids of tubes 1215 and 2915 are maintained at a more negative voltage. Consequently, each time the screen grid of tube 1214 becomes more positive in response to an off pulse that is a signaling condition wherein no current passes through any one of the distributor tubes 811 or 1112 through 1115, a pulse is transmitted over the radio system. The corresponding pulse at the receiving station is transmitted to the cathode of tube 2905 and to control grid of tube 2904 causing a positive signaling voltage to be applied to the screen of tube 2915 and a correspondingly negative voltage applied to the screen of tube 2914. As a result, current does not flow through either tubes 2914 or 2915 at this time so that current does not flow through the corresponding distributor comprising tubes 2811, 2812, 3013, 3014 and 3015.

Likewise, every time current does flow through one of these tubes at transmitting station, the signaling conditions are reversed both at the transmitting and receiving station so that current will flow through corresponding distributor tubes at the receiving station. In this manner the pulses from the noise generator shown in FIG. 14 are transmitted over the system and applied to the pulse regenerating equipment shown in FIG. 32 so that proper pulses are applied to the delay line 3410. Inasmuch as no key pulses are transmitted at this time, relay 663 will be released and short circuit the incoming signals so that they will not be transmitted over the system. Switch 648 in position as shown in drawing is in contact with terminal 650. After the circuits have been conditioned as described above and multiplex equipment is operated for a sufficient length of time so that the delay lines 1610 and 3410 will have had time to become completely filled with similar pulses, said timing including certain of the time to be described hereinafter the square wave generator 1427 is set into operation.

This generator generates a series of square wave signals having fundamental frequency which is within the usual frequency range of the voice or other signals to be transmitted over the system. Assume, for example, that the fundamental frequency is in the order of 500 cycles. These square waves are then applied to the counting circuits 1428 at the transmitting station. The counting circuits 1428 are similar to the counting circuits shown in FIGS. 17, 19 and 21. These counting circuits may comprise a greater or lesser number of stages and may be arranged to count a greater or lesser amount of square waves or pulses. As shown in the drawing, there are at least five stages to which the output switch 1425 may be moved in contact. The condensers of each of the counting stages are charged as described above with reference to the counter stages shown in FIG. 17.

The output from square wave generator 1427 also extends through switch 1426 and over conductor 1429 through FIGS. 14, 13, 10 and 7 to switch 648 in FIG. 6. The switch 648 as pointed out above is positioned so that it is in engagement with contact 650. The square waves are thus transmitted through switch 648, hybrid coil 647, switch 630, which is positioned to engage contact 632 at this time, and then through the sampling circuit shown in FIG. 6, coding tube 610 and the other coding circuits described above and applied to the radio path extending to the receiving station. At the receiving station the code pulses are received and decoded in the manner described above and square wave reconstructed at the output of the low-pass filter 2650 in the same manner as other signaling currents such as voice frequency currents, telegraph signals, or picture signaling currents are reconstructed. At this time switch 2651 is positioned so that it engages contacts 2623 and transmits the reconstructed square wave over conductor 2656 which conductor extends through FIGS. 26, 27, 28, 30 and 32 to the pulse counters 3028. As pointed out above, the pulse counters 3028 are similar to the pulse counters shown in FIGS. 17, 19, 21, 22, 24, 33, 35, 37, 40 and 42, and in addition, are substantially identical with the pulse counters 1428. Furthermore, the switches 1425 and 3025 at the transmitting and receiving stations are both set in similar positions so that at the end of the same number of square wave cycles of pulses from the square wave generator 1427 a positive pulse is applied to the control grid of tube 1520 at the transmitting station and 3120 at the receiving station.

The switch 1521 at the transmitting station and switch 3121 at the receiving station are closed as shown in the drawing. However, the tubes 1520 and 1530 are non-conducting at this time. If these tubes had been previously conducting, the associated swiches 1521 and 3121 are opened to extinguish the discharge through these tubes and then reclosed. The tubes 1520 and 3120 as shown in the drawing are gaseous conducting tubes in which the control element prevents a discharge through the tubes so long as it is maintained at a proper negative voltage. The application of a positive signaling voltage to this element initiates a discharge through the tubes which discharge then conducts substantially independently of the potential applied to the control element thereafter. However, as soon as a discharge through the tube is interrupted the grid or control member gains control and again prevents current from flowing through the tube until another positive signaling voltage is applied to the control elements.

With the discharge through tube 1520 interrupted, its anode is at a relatively high positive voltage and this voltage as applied to the control element of tube 1519 through coupling network causes current to flow in the output circuit of tube 1519 and through the anode resistor 1522. This current produces a large voltage drop across resistor 1522 and thus applies a relatively low voltage to the control element of tube 1515. Tube 1515 operates in part as a cathode follower tube. Due to the low voltage of the control element the cathode of this tube is likewise at a relatively low voltage. The voltage of the cathode of tube 1515 is applied to the control grids of tubes 1516 and 1514. These tubes are biased by the voltage drop through the cathode resistors common to these tubes and associated tubes 1517 and 1513 so that tubes 1516 and 1514 are cut off and pass substantially no current at this time. Consequently, tubes 1516 and 1514 are unable to repeat signaling currents or pulses so long as tube 1520 remains non-conductive. Thus tubes 1517 and 1516 do not repeat the pulses from the synchronous pulse generator shown in FIG. 5 to the pulse counting circuits shown in FIG. 17 as long as tube 1517 is non-conductive. Likewise, tubes 1513 and 1514 do not repeat key signals from conductor 2336 to conductor 1530 as long as tube 1520 remains non-conductive.

Figure 31:
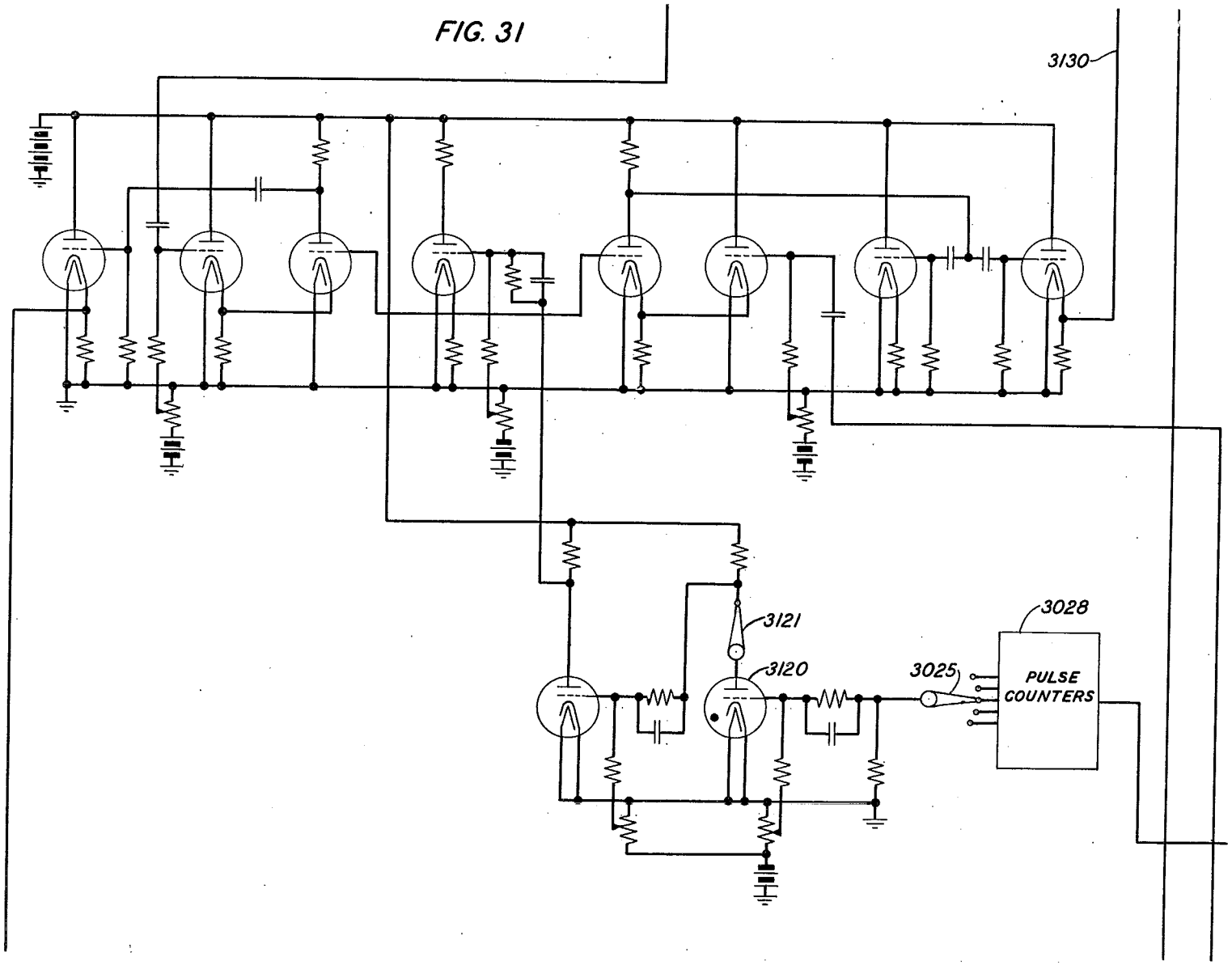

The various circuits and tubes at the receiving station shown in FIG. 31 operate in a corresponding manner and prevent the transmission of pulses through the repeating circuits of FIG. 31 in the same manner so long as tube 3120 remains non-conductive.

However, upon the application of a positive voltage to the control element of tube 1520 in response to the pulse counting circuits 1428 counting a predetermined number of square waves, a discharge is initiated through tube 1520.

At substantially the same time discharge is also initiated through tube 3120 due to application of a positive voltage to the control element of tube 3120 in response to the pulse counter 3028 counting the same number of square waves after having been transmitted to it over the radio transmission systems.

The initiation of a discharge through tube 1520 causes the voltage of the anode of this tube to fall to relatively low voltage which voltage causes the current flowing through tube 1519 to decrease or to be interrupted with the result that the voltage of the anode of tube 1519 rises to a more positive value. This voltage is repeated by tube 1515 so that the cathode of tube 1515 also becomes more positive and applies the proper biasing voltages to the grids of tubes 1516 and 1514 so that these tubes in combination with the respective associated tubes 1517 and 1513 operate to repeat the pulses applied to the control grids of the respective tubes 1517 and 1513.

At this time pulses will therefore be repeated from the synchronous pulse generating equipment shown in FIG. 5 to pulse counters shown in FIG. 17. However, due to the fact that pulses from the key generator are still not transmitted through the switching transient silencer shown in the upper portion of FIG. 23, no key generator pulses are transmitted from the key generator equipment to the enciphering or deciphering equipment at either the transmitting station or the receiving station.

It is to be understood, however, that pulses from the noise or random signal generator shown in FIG. 13 are transmitted to the delay lines 1610 and 3110 during this time so that identical series of pulses are being transmitted down both delay lines so that when it is desired to employ these pulses for generating the key signals they will be available at both the transmitting and receiving stations.

The pulse counting circuits of FIGS. 17, 19, 21 and 23 and corresponding circuits at the receiving station operate in the manner described above. In addition, the pulse counting circuits shown in FIGS. 22 and 24 at the transmitting station and the corresponding circuits shown in FIGS. 40 and 42 at the receiving station likewise operate and count pulses in the manner described above. Due to the times involved as pointed out hereinabove, the pulse counting circuits shown in FIG. 22 is arranged to apply positive pulse to the control element of tube 2311 before a pulse is applied to output circuit of any of the other pulse counting circuits. As a result the upper terminal of conductor 2301 is charged positively which in turn causes the operating potential to be removed from the magnet 1612 of the step switch as described hereinbefore. In addition, the positive potential applied to the cathode of tube 2332 is also reduced so that thereafter tube 2332 will operate as a repeating tube to repeat key signals to its control element to tube 2333. The key signals are still not transmitted through the switch transient silencer shown in FIG. 23 because the tape control circuits have not been properly conditioned.

In the exemplary embodiment set forth herein at a slightly later time a positive potential will be applied to the output of the counter circuit shown in the lower portion of FIG. 24. It is not essential that a positive pulse be applied to the output of the counter in the upper portion of FIG. 24 when such a pulse is applied to the output of the counter shown in the lower portion of FIG. 22. The pulses may be applied in either order depending upon the operating characteristics of the tape stepping magnet 1613 and the magnet 1612 of the stepping switch or for any other reason the order may be changed.

The application of a positive pulse to the output of the counter shown in the lower portion of FIG. 24 causes condenser 2502 to be charged positively which in turn removes the operating potential from the stepping magnet 1613 of the tape control mechanism.

The magnet 1613 will therefore release and cause the tape controlled contacts to be positioned in accordance with the perforations in the tape under the corresponding sensing pins.

The equipment at the receiving station operates in a similar manner and likewise causes the operating magnet of the tape control mechanism to release and position the tape control contacts in accordance with the perforations under the sensing pins at the receiving station. As pointed out hereinbefore, it is essential that the two tapes be perforated with identical perforations so that the corresponding contacts controlled by the tape at both the transmitting and receiving stations will be positioned in the same positions. Thereafter, the pulses from the delay lines are transmitted through the marked space reverser circuits in the manner described above with the result that the key signals are generated and applied to conductor 2019 at the transmitting station. Identical key signals are generated when applied to conductor 3819 at the receiving stations. These signals are not applied to the enciphering and deciphering equipment at this time.

Sufficient pulses will be counted by the pulse counting circuits of FIGS. 17, 22 and 24 to provide ample time to permit the stepping magnet 1613 of tape control mechanism at the transmitting station to fully release and the tape controlled contacts to be positioned so the marked space reverser circuits will properly respond to the pulses or signaling conditions applied to them. At the end of this time a positive voltage is applied to the upper terminal of condenser 2501 which voltage is repeated by tubes 2512, 2513 and 2514 which in turn causes the blocking potential previously applied to the cathode of tube 2334 to be removed so that thereafter the pulses from the key generator will be transmitted to the enciphering equipment at the transmitting station. The equipment at the receiving station operates in the same manner so that the first pulse transmitted to the decoding circuit from the key generating equipment will be a pulse corresponding to the first pulse transmitted from the key generating equipment at the transmitting station to the enciphering apparatus. As a result the transmitting signaling pulses will be enciphered and the receiving pulses properly deciphered to recover the coded pulses. Thereafter the circuits operate in substantially the same manner as described above.

The application of key pulses to the enciphering equipment at the transmitting station causes relay 663 to operate as described above and conditions the transmission circuit for transmitting.

Thereafter switch 648 will be operated to engage contact 649 at the transmitting station and switch 2651 operated at the receiving station to engage contact 2652. The transmission circuit is then completed from the source of signal 601 to the receiving device 2655. The code signals as transmitted over the radio path from antenna 1205 to antenna 2901 are enciphered so that a high degree of secrecy and security of the message currents is obtained.

Thereafter each time a pulse from the pulse counters is applied to the input circuit of tube 2310, the output of the key generator is interrupted and transmission path interrupted and stepping switch advanced both at the transmitting and receiving stations. At the end of a time interval sufficient to insure that the stepping switches at both stations have advanced, the key signals are again applied to the enciphering and deciphering equipment and the transmission path reestablished.

Each time the pulse counters count sufficient pulses to apply a positive pulse to the input circuits of tubes 2510 and 2520, the application of key signals to the enciphering and deciphering equipment at both the transmitting and receiving stations is interrupted and the transmission path is interrupted at the transmitting station. In addition, the control magnet 1613 at the transmitting station and the corresponding magnet at the receiving station are operated and released to advance the control tapes at both stations. Thereupon the key signals are again applied to the enciphering and deciphering equipment and the transmission path between the source 601 and the receiver 2655 reestablished. The circuits and apparatus then continue to function in the above-described manner.

It will be evident that each time the stepping switches function and each time the tape control mechanism is advanced, the connections within the key generator are changed so that different key signals are generating. It is also evident that the changes made in the key generator circuits do not in any way interfere with the transmission of the pulses from the transmitting station to the receiving station in the fifth position of each multiplex cycle or frame so that identical series of pulses are being transmitted down the delay lines or delay devices at both stations at all times independently of whether or not the key signals are being transmitted to the enciphering and deciphering equipment. It is also evident that it is desirable to allow sufficient time after each of the random signal pulses is transmitted over the system to insure that the pulse is properly received and decoded at the receiving station before the key signals are changed by the stepping switch or tape controlled contacts.

When desired or necessary, automatically operating means may be employed at both ends of the system to insure that the receiving circuits are properly conditioned and reconditioned as often as may be desired during the switching intervals of the key generator equipment. In order to insure that the flip-flop circuits shown in FIGS. 28 to 30, which are employed to change the code groups of signals representing changes in amplitudes of the signaling wave between the sampling times into code groups which represent actual amplitudes as described above, are properly positioned relative to the circuits at the transmitting station the circuits at both ends of the system may be reset during each operation of the switching transient silencer or at any other convenient intervals of time. In order to employ this automatic setting and resetting apparatus, switch 657 is moved to engage contact terminal 658 and switch 4126 is operated to engage contact terminal 4127.

As shown in the drawing the circuits are arranged to permit such realignment of the circuits each time the tape controlled switch magnet 1613 operates. It could, however, be each time the stepping magnet 1612 operates or each time either of these magnets operate. As described above, each time it is desired to operate the tape switch magnet 1613, a pulse is applied to the input circuit of tube 2510 to discharge the upper terminal of condenser 2501. Upon the discharge of condenser 2501, the cathode circuits of both tubes 2513 and 2514 become more positive. The cathode of tube 2513 is connected to the switch contact 659. Consequently, if switch 657 is moved in contact with terminal 659, the grid of right-hand section of tube 651 becomes sufficiently positive to saturate this section and block the left-hand section which prevents any current flowing between its anode and cathode. As a result, pulses from the synchronous pulse generator will not be repeated through this tube. Consequently, condenser 654 remains discharged and maintains the beam in tube 610 at its lowermost position.

Figure 41:
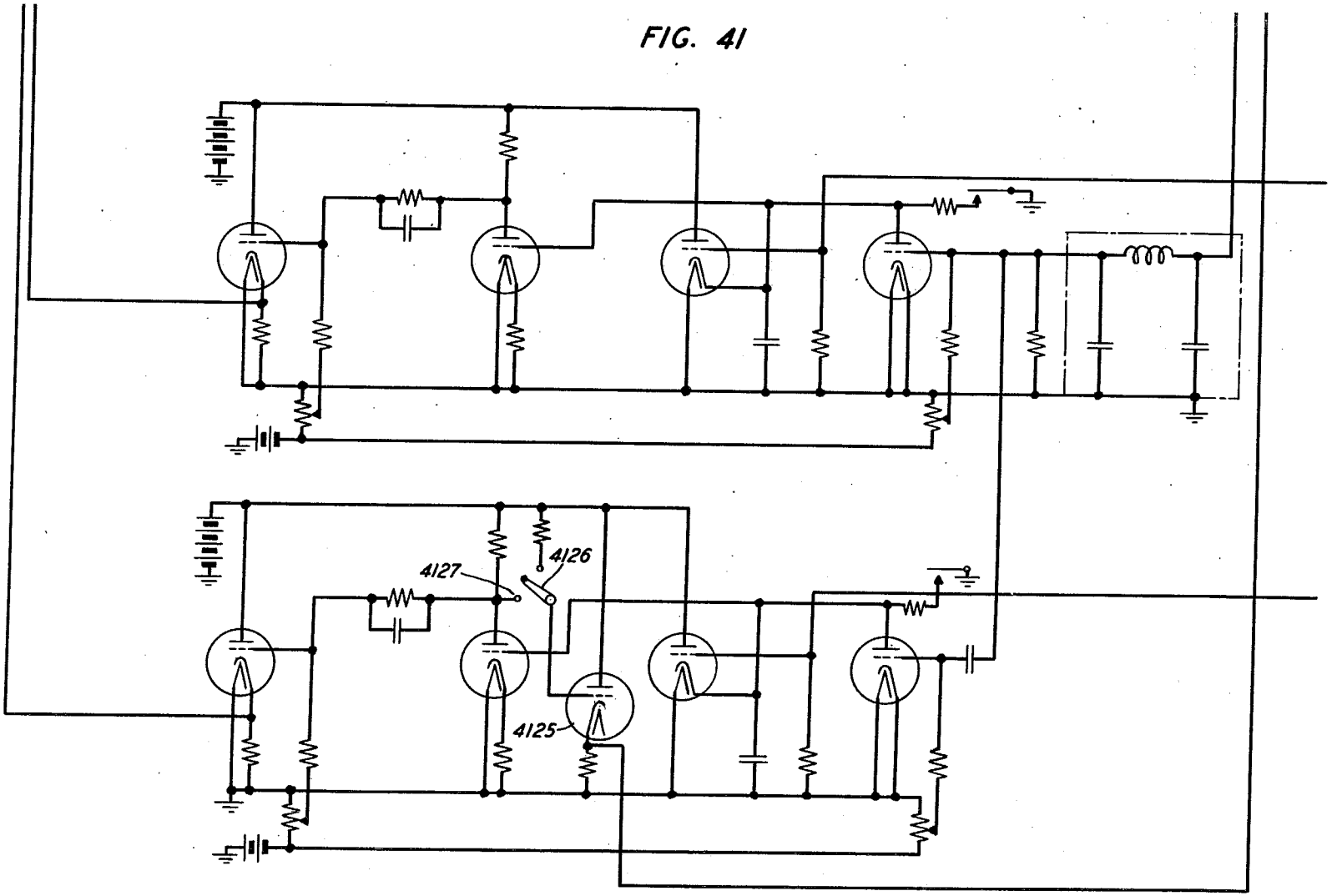
Figure 42:
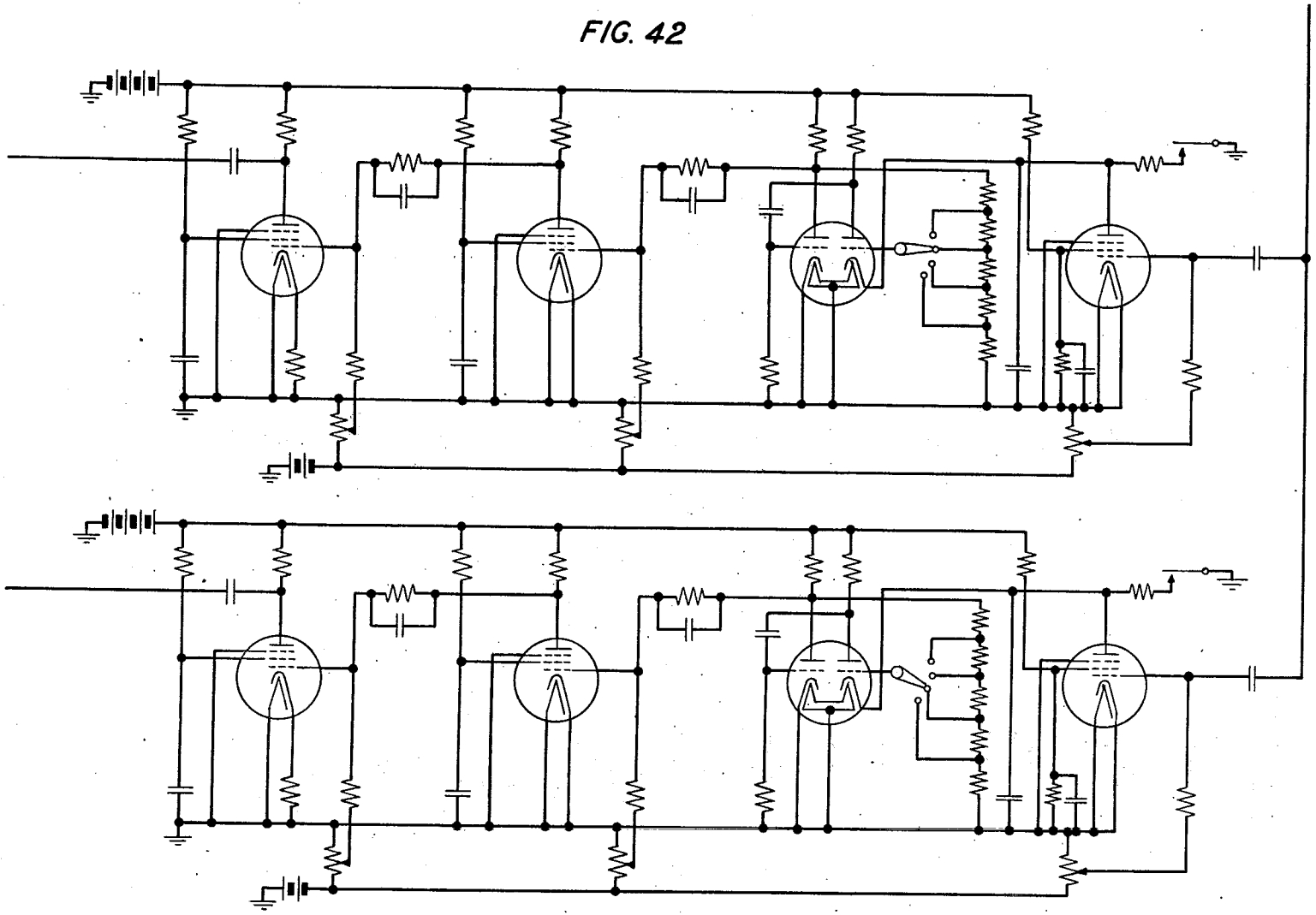

Each time the tape stepping magnet 1613 is operated at the transmitting station, the corresponding tape stepping magnet 3413 is likewise operated due to the operation of the corresponding circuits of FIGS. 41 and 42. When switch 4126 is operated to engage contact 4127, a positive voltage is applied to the control element of tube 4125 at this time, which repeats positive voltage in its output circuit and applies positive voltage to the screen grid or other control elements of each of the control grids of tubes 2816, 2818, 3012, 3022 and 3032 through the respective isolating diodes or crystal rectifiers 2886, 2887, 3088, 3089 and 3090. This positive voltage causes the above-enumerated tubes to become conducting which is the condition they should assume as described above when the electron beam of tube 610 is operated and remains in its lowermost position. At the end of the interval of time when the switching transient silencer again operates to permit resumption of transmission over the system, the above-described positive voltages are removed so that tube 651 operates in the normal manner to repeat the synchronizing pulses so that condenser 654 will be charged to a voltage determined by the amplitude of the applied signal wave. Likewise, the flip-flop circuits at the receiving station will operate in their usual manner as described above to regenerate the voltage condition appearing on the output electrodes of tube 610.

It is sometimes desirable to interrupt the supply of key signals to the combining equipment at both the transmitting and receiving stations. In order that this may be accomplished without interrupting transmission between the stations, key 1250 is provided at the transmitting station and key 2950 at the receiving station. When it is desired to merely prevent the use of the key signals at both stations without further affecting the transmission, switch 1250 is operated to engage contact 1252 instead of 1251 as shown in the drawing and switch 2050 is operated to engage contact 2952 instead of contact 2951 as shown in the drawing. At these times the system will operate as described above during the switching transient silencer intervals. Of course, the operator or attendant may operate other switches to apply the signals to the system independent of the blocking circuits as described above in FIG. 6, so that the system may operate satisfactorily in case the security of the enciphering message is not necessary or in case of trouble conditions in the ciphering and deciphering equipment.

In order to provide still greater security for the signals and the cipher key, a random noise generator 645 is provided which may be of any suitable type and may be similar to the noise generator shown in FIG. 13 or it may employ a gas conduction path or be of any other suitable type which generates noise currents having frequency components extending over a wide frequency range. The output of the noise generator 645 is transmitted through a high-pass filter 646 which has a cut-off just above the highest signaling frequency desired to be transmitted over the system. As a result, noise currents having frequency components higher than this are passed through the high-pass filter 646. If, for example, it is desired to transmit voice frequency currents over the system up to and including 3,000 cycles then the high-pass filter will have a cut-off somewhat about 3,000 cycles so that noise components having frequency above 3,500 cycles for example will be applied to the hybrid coil 647 and transmitted over the system. Under the assumed conditions with the repetition rate of approximately 10,000 cycles or times per second the upper limit of transmission of the system will be slightly less then 5,000 cycles, consequently, noise currents from 3,500 to approximately 5,000 cycles will be added to the signal currents transmitted over the system. If it is desired to transmit a wider frequency range of noise currents, the upper limit of the system may be extended by increasing the repetition rate.

These high frequency noise currents are added to the signals and in general will change the codes employed to repeat the signals and in particular, the digits or pulses of the code representing the smaller increments of the amplitude of the complex wave transmitted and thus effectively mask both the code and cipher and key pulses employed.

It is apparent, of course, that the total amplitude range which must be transmitted over the system is the sum of the amplitude range of the signals from source 601 and from the noise generating equipment 645.

At the receiving station the currents due to noise currents are regenerated by the receiving and decoding equipment. These currents, however, are suppressed by the low-pass filter 2650 so that they are not added to the received currents transmitted through the terminal equipment 2654 to the receiving device 2655. In this manner the noise currents may be employed to mask the various signals and increase the security of transmission without being added to the actual signal currents received and thus without degrading the excellency of the transmission path provided between the transmitting source 601 and the receiving device 2655.

What is claimed is:

1. In a pulse code modulation system, a source of key signals comprising a source of random pulses, multisection delay device, means for applying said pulses to said multisection delay device, apparatus for combining the outputs of predetermined sections of said delay device and apparatus for enciphering pulse code modulation signals by combining said signals with said combined output from said sections of said multisection delay device.

2. Apparatus for generating key pulses for enciphering pulse code modulation signals comprising a source of random signals, a multielement delay device for securing different delay times, means for transmitting said random signals through said multielement delay device, combining circuits for combining said random pulses after delays of different amounts to secure key pulses for ciphering pulse code modulation signals and apparatus for automatically changing the delay intervals of said random pulses for combination.

3. Apparatus for gnerating key pulses for enciphering pulse code modulation signals comprising a source of random signals, a multielement delay device for securing different delay times, means for transmitting said random signals to said multielement delay device, combining circuits for combining said random pulses after delays of different amounts to secure key pulses for ciphering pulse code modulation signals, and a stepping switch interconnected between the elements of said delay device and said combining circuit for interchanging the connections whereby the random pulses are combined after different delay intervals.

4. Apparatus for generating key pulses for enciphering pulse code modulation signals comprising a source of random signals, a multielement delay device for securing different delay times, eans for transmitting said random signals through said multielement delay device, combining circuits for combining said random pulses after delays of different amounts to secure key pulses for ciphering pulse code modulation signals, a plurality of contacts controllable in accordance with perforations in the flexible medium, connections between said contacts and said combining apparatus for changing the interconnections under control of perforations in the said tape.

5. In a secret communication system, means for representing a signal wave by code groups of signals, each signal of which may comprise any one of a plurality of different characteristics, a signal transmission medium, means for transmitting pulse signals over a transmission medium, receiving apparatus connected to said medium comprising means for decoding pulse code groups of signals each signal of which may comprise any one of a plurality of different characteristics, cipher key generating equipment located at each end of said transmission medium comprising a multisection delay device, apparatus for generating random pulses and applying them to said delay device at the first end of said medium, apparatus for transmitting the characteristics of said pulses over said medium, other eqipment for regenerating pulse similar to the pulses applied to said delay devices at said first end and applying the regenerated pulses to corresponding delay devices at the receiving end of said medium, apparatus at each end of said medium for combining said random pulses in identical manner after predetermined different delays which delays are identical at both ends of said medium, and means for enciphering said code modulation signals at the first end of said medium under control of said combined signals, and means for deciphering said enciphered signals at the receiving end of said medium under control of identical pulses as combined by said combining apparatus at the first end of said medium.

6. In a secret communication system, means for representing a signal wave by code groups of signals, each of which may have any one of a plurality of different characteristics, a signal transmission medium, means for transmitting pulse signals over a transmission medium, receiving apparatus connected to said medium comprising means for decoding pulse code groups of signals each of which may comprise any one of a plurality of different characteristics, cipher key generating equipment located at each end of said transmission medium comprising a multisection delay device, apparatus for generating random pulses and applying them to said delay device at the first end of said medium, apparatus for transmitting the characteristics of said pulses over said medium, other equipment for regenerating the pulses similar to the pulses applied to said delay devices at the first end of said transmission medium and applying the regenerated pulses to corresponding delay devices at the receiving end of said medium, apparatus at each end of said medium for combining said random pulses in identical manner after predetermined different delays which delays are identical at both ends of said medium, and means for enciphering said code modulation signals at the first end of said medium under control of said combined signals, means for deciphering said enciphered signals at the receiving end of said medium under control of identical pulses as combined by said combining apparatus at the first end of said medium, apparatus located at both ends of said medium for automatically changing the delay intervals of the pulses which are combined, means for causing said changes to be made substantially simultaneously at both ends of said medium.

7. In a secret communication system, means for representing a signal wave by code groups of signals, each of which may have any one of a plurality of different characteristics, a signal transmission path, means for transmitting pulse signals over a transmission path, receiving apparatus connected to said path comprising means for decoding pulse code groups of signals each of which may comprise any one of a plurality of different characteristics, cipher key generating equipment located at each end of said transmission path comprising a multisection delay device, apparatus for generating random pulses and applying them to said delay device at the first end of said path, apparatus for transmitting the characteristics of said pulses over said path, other equipment for regenerating pulses similar to the pulses applied to said delay devices at the first end of said path and applying the regnerated pules to corresponding delay devices at the receiving end of said path, apparatus at each end of said medium for combining said random pulses in identical manner after predetermined different delays which delays are identical at both ends of said path, and means for enciphering said code modulation signals at the first end of said path under control of said combined signals, means for deciphering said enciphered signals at the receiving end of said path under control of identical pulses as combined by said combining apparatus at the first end of said path, a plurality of contacts at each end of said path, means for controlling said contacts in accordance with physical conditions recorded in a storage medium, interconnections between said contacts and said delay devices and between said contacts and said combining apparatus for interchanging the connections between said combining apparatus and said delay devices under control of the physical conditions stored in said medium, and appatus for advancing said medium substantially simultaneously at both ends of said transmission path.

8. In a secret communication system, means for representing a signal wave by code groups of signals, each of which may have any one of a plurality of different characteristics, a signal transmission path, means for transmitting pulse signals over said transmission path, receiving apparatus connected to said path comprising means for decoding pulse code groups of signals each of which may comprise any one of a plurality of different characteristics, cipher key generating equipment located at each end of said transmission path comprising a multisection delay device, apparatus for generating random pulses and applying them to said delay device at the first end of said path, apparatus for transmitting characteristics of said pulses over said path, other equipment at the receiving end of path for regenerating pulses similar to the pulses applied to said delay devices at the first end of said path and applying them to corresponding delay devices at the receiving end of said path, apparatus at each end of said path for combining said random pulses in identical manner after predetermined different delays which delays are identical at both ends of said path, and means for enciphering said code modulation signals at the first end of said path under control of said combined signals, means for deciphering said enciphered signals at the receiving end of said path under control of identical pulses as combined by said combining apparatus at the receiving end of said path, a plurality of contacts at each end of said path, a storage medium means for controlling said contacts in accordance with physical conditions recorded in a storage medium, interconnections between said contacts and said delay devices and between said contacts and said combining apparatus for interchanging the connections between said combining apparatus and said delay devices under control of the physical characteristics stored in said medium, apparatus for advancing said medium substantially simultaneously at both ends of said transmission path, apparatus for preventing transmission of signal pulses under control of said coding apparatus over said transmission path during the advance of said storage medium.

9. In a secret communication system, means for representing a signal wave by code groups of signals, each of which may have any one of a plurality of different characteristics, a signal transmission path, means for transmitting pulse signals over said transmission path, receiving apparatus connected to said path comprising means for decoding pulse code groups of signals each of which may comprise any one of a plurality of different characteristics, cipher key generating equipment located at each end of said transmission path comprising a multisection delay device, apparatus for generating random pulses and applying them to said delay device at the first end of said path, apparatus for transmitting the characteristics of said pulses over said path, other equipment for regenerating the pulses similar to the pulses applied to said delay devices at said first end of said path and applying the regenerated pulses to corresponding delay devices at the receiving end of said path, apparatus at each end of said path for combining said random pulses in identical manner after predetermined different delays which delays are identical at both ends of said path, and means for enciphering said code groups signals at the first end of said path under control of said combined signals, means for deciphering said enciphered signals at the receiving end of said medium under control of identical pulses as combined by said combining apparatus at the first end of said path, a plurality of contacts at each end of said path, a storage medium means for controlling said contacts in accordance with physical conditions recorded in a storage medium, interconnections between said contacts and said delay devices and between said contacts and said combining apparatus for interchanging the connections between said combining apparatus and said delay devices under control of the physical characteristics stored in said medium, apparatus for advancing said medium substantially simultaneously at both ends of said transmission path, apparatus for preventing the transmission of signaling pulses over said transmission path under control of said combined and variously delayed random pulses during the changing of said connections under control of said flexible storage medium.

10. In a communication system, apparatus for generating code groups of pulses representing information to be transmitted, enciphering apparatus comprising means for generating ciphered key signals for enciphering and deciphering said code signals, connections within said means to control the key signals generated thereby, apparatus for automatically varying said interconnections within the said key generating equipment for changing the key pulses generated thereby, and apparatus to suppress the transmission of pulses under control of either of said code groups of pulses or said key generating pulses during the time said interconnections are being changed.

11. A pulse code modulation system comprising a source of voice frequency currents, apparatus for representing said voice frequency currents by means of code groups of signals occurring in rapid succession, a source of key signals, means for enciphering said code signals by means of said key signals, storage means having cipher changing information stored therein, apparatus for controlling generation of said key signals in accordance with information stored in said storage means.

12. A pulse code modulation system comprising a source of voice frequency currents, apparatus for representing said voice frequency currents by means of code groups of signals occurring in rapid succession, a source of key signals, means for enciphering said code signals by means of said key signals, an enciphering storage medium having cipher control information stored therein, apparatus for controlling generation of said key signals in accordance with information stored in said storage means, and apparatus for advancing said storage medium at a slower rate than said code groups of signals.

13. In a pulse code modulation system enciphering means comprising enciphering control tape, a source of key signals, means for controlling the generation of said key signals by said control tape and enciphering apparatus for enciphering pulse code modulating signals under the control of said key signals.

14. In a pulse code modulation system comprising apparatus responsive to enciphered pulse code modulation signals, deciphering apparatus comprising a ciphering storage tape having cipher control information stored therein, a source of key signals controlled by said storage tape and means for deciphering said enciphered signals under control of said key signals.

15. In a pulse code modulation system a source of enciphering signals comprising a source of random signals, a stepping device and apparatus for changing the connections to said source by means of said stepping device and means for combining said random signals with said pulse code modulation signals.

16. In a pulse code modulation system a source of enciphering key signals comprising a source of random signals, a stepping device and apparatus for changing the connections to said source by means of said stepping device and means for combining said random signals with said pulse code modulation signals, deciphering apparatus comprising means for generating a second series of key signals identical with first series of key signals including a stepping device, means for advancing said second stepping device incident to the advance of said first stepping device.

17. In a pulse code modulation system a source of enciphering key signals comprising a source of random signals, a stepping device and apparatus for changing the connections to said source by means of said stepping device and means for combining said random signals with said pulse code modulation signals, deciphering apparatus comprising means for generating a second series of key signals including a second stepping device, and means for advancing said two stepping devices substantially simultaneously.

18. In a high speed secrecy system, apparatus for generting key signals comprising a source of noise currents, deriving pulses having random characteristics and durations therefrom, apparatus operating at high speed for combining said pulses to form enciphering key pulses, and other apparatus operating at a slower rate for changing the manner in which said pulses are combined.

19. In a high speed secrecy system apparatus for generating key signals comprising a source of noise currents, means for deriving pulses having random characteristics and durations therefrom, apparatus operating at high speed for combining said pulses to form enciphering key pulses other apparatus operating at a slower rate for changing the manner in which said pulses are combined, comprising a storage medium having cipher changing information stored therein and apparatus controlled by said storage medium for controlling the manner in which said random pulses are combined in a secrecy system.

20. Apparatus for generating enciphering key pulses comprising a source of noise currents, a tapped delay line supplied with currents controlled by said noise currents and apparatus for combining the outputs from a plurality of said taps to form enciphering key signals.

21. In a high speed secrecy system apparatus for generating key signals comprising a source of noise currents, means for deriving pulses having random characteristics and durations therefrom, apparatus operating at high speed for combining said pulses to form enciphering key pulses other apparatus operating at a slower rate for changing the manner in which said pulses are combined, comprising a stepping device and apparatus controlled by said stepping device for controlling the manner in which said random pulses are combined in a secrecy system.

22. Apparatus for generating enciphering key pulses comprising a source of noise currents, a tapped delay line supplied with currents controlled by said noise currents and apparatus for combining the outputs from a plurality of said taps to form enciphering key signals, a stepping device for selecting the taps from which the output is to be combined.

23. In a secret communication system a transmitting station, a receiving station, a communication path interconnecting said stations, a source of noise currents at said transmitting station, apparatus for deriving random pulses from said noise currents, means for transmitting the significant characteristics of said pulses over said transmission path, apparatus responsive to transmission of said significant characteristics over said transmission path for regenerating an identical series of random pulses at said receiving station, enciphering and deciphering pulse generating equipment at said transmitting and receiving stations comprising a tapped delay line, means for supplying said random pulses to said delay line at said stations and apparatus for forming ciphering key signals by combining the output of selected taps which are identical at both of said stations.

24. In a secret communication system a transmitting station, a receiving station, a communication path interconnecting said stations, a source of noise currents at said transmitting station, apparatus for deriving random pulses from said noise currents, means for transmitting the significant characteristics of said pulses over said transmission path, apparatus responsive to transmission of said significant characteristics over said transmission path for regenerating an identical series of random pulses at said receiving station, enciphering and deciphering pulse generating equipment at said transmitting and receiving stations comprising a tapped delay line, means for supplying said random pulses to said delay line at said stations, apparatus for forming cyphering key signals by combining the output of selected taps which are identical at both of said stations, a stepping device located at each of said stations for selecting the taps the output of whch is combined, and means for advancing said stepping device substantially simultaneously at both of said stations.

25. In a secret communication system a transmitting station, a receiving station, a communication path interconnecting said stations, a source of noise currents at said transmitting station, apparatus for deriving random pulses from said noise currents, means for transmitting the significant charcteristics of said pulses over said transmission path, apparatus responsive to transmission of said significant characteristics over said transmission path for regenerating an identical series of random pulses at said receiving station, enciphering and deciphering pulse generating equipment at said transmitting and receiving stations comprising a tapped delay line, means for supplying said random pulses to said delay line at said stations and apparatus for forming ciphering key signals by combining the output of selected tape which are identical at both of said stations, a stepping device located at each of said stations for selecting the taps the outpt of which is combined and means for advancing said stepping device substantially simultaneously at both of said stations, apparatus for preventing the transmisson of significant signals over said transmission path during the time said characters are being changed.

26. In a communication system means for masking the communication currents comprising a source of noise currents having frequency components outside the frequency range of said communication currents, apparatus for eliminating from said noise currents all component currents having a frequency range within the frequency range of said communication currents and apparatus for combining the remaning noise currents with said communication currents.

27. In a communication system means for masking the communication currents comprising a source of noise currents having frequency components outside the frequency range of said communication currents, apparatus for eliminating from said noise currents all component currents having a frequency range within the frequency range of said communication currents and apparatus for combining the remaining noise currents with said communication currents, receiving equipment responsive to said communication currents and apparatus for suppressing currents having frequencies of said noise frequency currents.

28. In a pulse code modulation signaling system a source of signaling currents, a source of cipher key signals, a source of noise currents having frequencies outside said signaling frequency range means for suppressing all frequency components of said noise currents within said signaling frequency range, apparatus for employing said signaling currents and said noise currents for controlling the generation of pulse code modulation signals, means for combining said pulse code modulation signals with said key cipher signals, deciphering and decoding apparatus for recovering said noise and signaling currents and filter means for separating said noise currents from said signaling currents.

29. In a pulse code modulation system a plurality of double stability circuits, apparatus for supplying received pulses to said circuits in rotation, means for causing said circuits to change their condition of stability in response to the application of pulses having predetermined characteristics to said double stability circuits, apparatus for interrupting transmission of said pulse code modulation system at intervals and means for restoring all of said double stability circuits to a predetermined condition of stability during said interruptions.

30. In a secrecy system a transmitting station, a receiving station, a communication path extending between said stations which path is susceptible to unauthorized monitoring, a source of key signals at each of said stations comprising apparatus for generating identical series of random pulses at each of said stations and a stepping device for controlling the random signal pulses generated at each of said stations, apparatus for enciphering signals under control of said key pulses at said transmitting station, other apparatus for deciphering said signals under control of said key pulses at said receiving station, apparatus for advancing said stepping devices step by step substantially simultaneously at both of said stations, apparatus for interrupting transmission of communication currents during the advancing of said stepping device.

31. In a secrecy system a transmitting station, a receiving station, a communication path extending between said stations which path is susceptible to unauthorized monitoring, a source of key signals at each of said stations comprising apparatus for generating identical series of random pulses at each of said stations and a stepping device for controlling the random signal pulses generated at each of said stations, apparatus for recovering signals under control of said key pulses at said transmitting station, other apparatus for deciphering said signals under control of said key pulses at said receiving station, apparatus for stepping said stepping device substantially simultaneously at both of said stations, apparatus for interrupting transmission of communication currents during the stepping of said stepping device, apparatus for restoring receiving circuits at said receiving station of a predetermined condition during the operation of said stepping device.

32. In a communication system for the transmission of complex signaling waves, apparatus for representing changes in amplitude of the signaling wave between predetermined instants of time by means of code groups of pulses, a source of cipher key signals and apparatus for combining said ciphered key signals with said pulses and means for recovering said differences in amplitude and reconstructing a complex wave form therefrom.

33. In a pulse code modulation system, a source of pulse code modulation signals, comprising code groups of pulses representing the amplitude of the complex wave form at discreet instants of time, translating apparatus for translating said code groups of pulses into other pulses representing a change in amplitude of said complex wave between said discreet instants of time, a first source of cipher key signals, means for enciphering said signals representing differences in amplitude under control of said cipher key signals, a second source of signals for generating cipher key signals identical with said first group of cipher key signals and means for deciphering said enciphered signals under control of signals from said second source of cipher key signals, and means for recovering said complex wave form from said deciphered signals.

34. In a communication system, apparatus responsive to a complex signaling wave form for generating code groups of signals representing the difference in amplitude of said complex wave form at discrete instants of time, a communication path, means for transmitting said signals over a communication path, apparatus for recovering said complex wave form from said signals and apparatus for periodically restoring the output of said apparatus for recovering the complex wave form to a predetermined level.

35. In a pulse code modulation system, modulating equipment for representing differences in amplitude of an applied signaling wave by means of code groups of signaling conditions, demodulating equipment responsive to code groups of signaling conditions for recovering said differences in amplitude, means for reconstructing the signaling wave from said differences in amplitude, apparatus for periodically simultaneously resetting said modulation and demodulation equipment to predetermined reference conditions.

36. In a communication system apparatus for representing changes in an applied signaling wave by means of signaling pulses, apparatus for recovering said changes in amplitude from said signaling pulses, means for reconstructing the signaling wave from said recovered changes, apparatus for periodically interrupting the operation of said system and applying a predetermined reference input level, other apparatus for restoring said reconstructing apparatus to a corresponding reference level.

37. In a pulse communication system, apparatus for representing changes in amplitude of a signaling wave between discrete instants of timwe by means of pulses, means for periodically interrupting said apparatus for predetermined intervals of time, and means for restoring said apparatus to a pedetermined condition during said interruption intervals.

38. In a pulse communication system, apparatus responsive to groups of pulses representing differences in signal amplitude of an applied signal wave, means for recovering the differences represented by said pulses, and other apparatus for reconstructing the signal wave from said differences, apparatus for periodically restoring said reconstructing apparatus to a predetermined reference condition.

* * * * *